US012324977B2

(12) United States Patent
Pikulski

(10) Patent No.: US 12,324,977 B2
(45) Date of Patent: Jun. 10, 2025

(54) MOBILIZED PLATFORMS

(71) Applicant: Joseph L. Pikulski, Westlake Village, CA (US)

(72) Inventor: Joseph L. Pikulski, Westlake Village, CA (US)

(73) Assignee: Joseph L. Pikulski, Westlake Village, CA (US)

( * ) Notice: Subject to any disclaimer, the term of this patent is extended or adjusted under 35 U.S.C. 154(b) by 0 days.

(21) Appl. No.: 18/170,503

(22) Filed: Feb. 16, 2023

(65) Prior Publication Data

US 2023/0302346 A1 Sep. 28, 2023

Related U.S. Application Data

(63) Continuation of application No. 17/020,675, filed on Sep. 14, 2020, now Pat. No. 11,583,754, which is a continuation of application No. 16/128,413, filed on Sep. 11, 2018, now Pat. No. 10,814,211, which is a continuation of application No. 15/247,820, filed on Aug. 25, 2016, now Pat. No. 10,071,303.

(60) Provisional application No. 62/210,351, filed on Aug. 26, 2015.

(51) Int. Cl.

| | |
|---|---|
| ***A63C 17/12*** | (2006.01) |
| ***A63C 17/01*** | (2006.01) |
| ***A63C 17/26*** | (2006.01) |

(52) U.S. Cl.

CPC ..... *A63C 17/12* (2013.01); *A63C 17/016* (2013.01); *A63C 17/262* (2013.01); *A63C 2203/12* (2013.01)

(58) Field of Classification Search

CPC ..... A63C 17/10; A63C 17/12; A63C 17/015; A63C 17/016; B62B 5/0036; B62B 5/004; B62B 5/0043; B62B 5/0046; B62B 5/005

See application file for complete search history.

(56) References Cited

U.S. PATENT DOCUMENTS

| | | | | | |
|---|---|---|---|---|---|
| 2,260,027 | A | * | 10/1941 | Hotson | A63C 5/035 280/844 |
| 3,876,032 | A | * | 4/1975 | Ferino | A63C 17/12 180/9.1 |
| 4,337,961 | A | * | 7/1982 | Covert | A63C 17/012 280/844 |
| 5,022,668 | A | * | 6/1991 | Kenny | A63C 5/03 280/844 |
| 5,305,846 | A | * | 4/1994 | Martin | A63C 17/12 280/14.28 |

(Continued)

*Primary Examiner* — Jeffrey J Restifo

(74) *Attorney, Agent, or Firm* — Ferguson Case Orr Paterson

(57) ABSTRACT

Mobilized platforms are disclosed herein. The mobilized platforms can include one or more fork hangers attached to a platform with a cog-hub assembly attached thereto. The fork hangers can be attached to the cog-hub assemblies such that each fork hanger is attached to a cob-hub assembly at both a first cog-hub assembly end and a second cog-hub assembly end opposite said first cog-hub assembly end. The mobilized platforms can include additional features such as baseplates or transom plates. The cog-hub assemblies can also comprise wheel assemblies or connected cog-hub sub-assemblies. The mobilized platforms can also include a treading connected to the cog-hub assemblies.

17 Claims, 161 Drawing Sheets

(56) References Cited

U.S. PATENT DOCUMENTS 5,330,026 A * 7/1994 Hsu ..... A63C 17/12 180/181
5,382,052 A * 1/1995 Tarng ..... A63C 17/01 280/844
5,390,958 A * 2/1995 Soo ..... A63C 17/10 280/844
5,413,380 A * 5/1995 Fernandez ..... A63C 17/10 280/844
5,580,096 A * 12/1996 Freilich ..... A63C 17/10 280/844
5,730,241 A * 3/1998 Shyr ..... A63C 17/10 180/181
5,826,674 A * 10/1998 Taylor ..... A63C 17/12 180/181
5,934,706 A * 8/1999 Yiu ..... A63C 17/10 280/11.26
6,288,505 B1 * 9/2001 Heinzmann ..... A63C 17/12 180/181
7,091,724 B2 * 8/2006 Heinzmann ..... G01R 31/343 324/546
7,275,607 B2 * 10/2007 Kamen ..... B60L 15/20 701/1
7,293,622 B1 * 11/2007 Spital ..... A63C 17/12 180/181
7,383,908 B2 * 6/2008 Tuli ..... A43B 3/34 180/181
7,458,435 B2 * 12/2008 Negoro ..... A63C 17/12 180/181
7,798,886 B1 * 9/2010 Williamson ..... B62D 55/24 446/73
7,962,256 B2 * 6/2011 Stevens ..... G05D 1/0891 180/65.245
8,170,780 B2 * 5/2012 Field ..... B60N 2/06 180/21
8,210,304 B2 * 7/2012 Baldwin ..... A63C 17/10 180/9.1
8,430,192 B2 * 4/2013 Gillett ..... B60N 2/14 180/2.2
D691,686 S * 10/2013 Yu ..... D21/765
8,672,074 B2 * 3/2014 Ganeous ..... A43B 5/1641 280/11.115
8,991,541 B1 * 3/2015 Maier ..... A63C 5/085 180/181
9,027,690 B2 * 5/2015 Chavand ..... A63C 17/12 280/11.115
9,452,345 B2 * 9/2016 Doerksen ..... A63C 17/01
9,598,141 B1 * 3/2017 Doerksen ..... H02K 5/02
9,616,318 B2 * 4/2017 Rogers ..... B60K 7/0007
9,908,032 B2 * 3/2018 Garcia Elena ..... A63C 17/015
9,919,200 B2 * 3/2018 Mo ..... H02K 7/08
9,925,453 B1 * 3/2018 Tuli ..... A43C 19/00
9,950,243 B2 * 4/2018 Evans ..... B62D 65/02
10,099,084 B2 * 10/2018 Polinsky ..... G09B 19/0038
10,099,086 B2 * 10/2018 Polinsky ..... A63B 22/18
10,112,680 B2 * 10/2018 Doerksen ..... H02K 1/20
10,486,052 B2 * 11/2019 Choi ..... A63C 17/12
D899,542 S * 10/2020 Schapiro ..... D21/765
11,291,909 B2 * 4/2022 Gorden ..... A63C 17/26
2002/0074176 A1 * 6/2002 Justus ..... B62D 55/07 180/181
2006/0170174 A1 * 8/2006 Hiramatsu ..... A63C 17/01 280/87.041
2006/0213711 A1 * 9/2006 Hara ..... A63C 17/016 180/181
2010/0090423 A1 * 4/2010 Farrelly ..... A63C 17/01 280/841
2011/0175304 A1 * 7/2011 Arbogast ..... B62D 55/04 305/129
2013/0056942 A1 * 3/2013 Maratta ..... A63C 17/01 280/28.5
2013/0282216 A1 * 10/2013 Edney ..... A63C 17/04 701/22
2016/0129963 A1 * 5/2016 Ying ..... B62K 11/007 180/6.5
2017/0056756 A1 * 3/2017 Pikulski ..... A63C 17/016
2017/0341690 A1 * 11/2017 Pikulski ..... B62K 23/08
2018/0111039 A1 * 4/2018 Wood ..... A63C 17/12
2019/0256163 A1 * 8/2019 Chen ..... B62K 11/007
2019/0351315 A1 * 11/2019 Li ..... B62K 13/00
2020/0261786 A1 * 8/2020 Chen ..... A63C 17/26
2021/0015200 A1 * 1/2021 Tuli ..... A63C 17/12
2021/0331768 A1 * 10/2021 Rudofsky ..... B62M 27/02
2023/0302346 A1 * 9/2023 Pikulski ..... A63C 17/262

* cited by examiner

MOBILIZED PLATFORMS

CROSS-REFERENCE TO RELATED APPLICATION

This application is a continuation application of, and claims the benefit of, U.S. non-provisional application Ser. No. 17/020,675 to Joseph L. Pikulski, filed on Sep. 14, 2020, entitled MOTORIZED PLATFORMS, which in turn is a continuation of, and claims the benefit of, U.S. non-provisional application Ser. No. 16/128,413 to Joseph L. Pikulski, filed on Sep. 11, 2018, entitled MOTORIZED PLATFORMS, which in turn is a continuation of, and claims the benefit of, U.S. application Ser. No. 15/247,820, to Joseph L. Pikulski, filed on Aug. 25, 2016, entitled MOBILIZED COOLER DEVICE WITH FORK HANGER ASSEMBLY, which in turn claims the benefit of U.S. provisional application number 62,210,351, filed on Aug. 26, 2015, entitled MOTORIZED SKATEBOARD. Each of these applications is hereby incorporated by reference herein in its entirety.

BACKGROUND

(1) Field

This invention relates to motorized and non-motorized platforms, such as skateboards, treaded skateboards, and in particular, to motorized and non-motorized skateboards, treaded skateboards, and treaded skateboards that use single wheels mounted on fork arm trucks. Furthermore, this invention relates to fork arm systems that use motorized wheels, both externally mounted to the skateboards, and more specifically, relates to internally mounted motors within the wheels. This invention also relates to new wheel designs for single wheel skateboard applications, and a new complementary riding system that incorporates magnetic coupling to skateboards and to skateboard shoes.

(2) Description of Related Art

Conventional skateboards have provided excitement over the years and are deemed a right of for young people. Along with bicycles and scooters, skateboards are playing a large role in increasing youth mobility. A new paradigm of travel is evolving as skateboards become motorized.

The problem with the current skateboard four-wheel system is that it is comprised of four-wheels. Two wheels on each axis separated by 7 to 10 inches in a common skateboard hanger system. Riding a skateboard that has four wheels, even though they are on independent trucks, subjects the rider to a bumpy ride.

Skateboard parks are not always available to all skateboard enthusiasts. Often, skateboarders are performing tricks and enhancing their skills in places where they may not be welcomed. Performing tricks with skateboards that involve public structures, such as stairs, planters, railings, and curbs, can be destructive to the community property, as well as, being dangerous to the skateboarder and others in the area. This damage is caused by the action of grinding. These tricks often use the aluminum or steel skateboard hanger undersides to skid on the surfaces previously mentioned. To mitigate the effects of this grinding, Teflon® and other resilient materials have been added to the undercarriage of the skateboard to minimize the effects of grinding away the skateboard components and damaging public property. It is the intent of this disclosure to solve the problem for the community property damage and enhance the performance and safety of the skateboarder by introducing new skateboard wheel geometries for the single wheel truck skateboard.

Skateboard parks and half pipe gatherings are events where the skateboarders exhibit their coordination and mastery of riding skateboards. Some of the maneuvers performed by the skateboarders, such as 360°, 720° and 1080° turns, are qtlite dangerous. Injuries occur when the skateboard riders' feet separate from the skateboard. Often these injuries occur when in the crouched position, holding the skateboard deck to the skateboard riders' feet. These maneuvers place skateboarders in precarious positions that can result in injury. It is the intent of this novel invention to introduce the use of the magnetic shoe and skateboard deck skin coupling system to help improve skateboarders' performance and safety.

With new manufacturing processes and composite materials, skateboard production has been revolutionized. Along with the introduction of highly efficient electric motors, and substantially improved lithium-ion and lithium phosphate batteries, the popularity of using skateboards for transportation is expanding.

As a result of these advancements, certain skateboard motor assemblies have the components exposed to the elements and can interfere with the skateboarders' ability to maneuver. Additionally, it is difficult to streamline the four-wheeled skateboard when adding heavy drive train accessories such as belts, pulleys and chains. It is the intent of this invention to eliminate the concerns by integrating the motors inside the wheels.

The current skateboard is a four-wheel system with two wheels on each axis separated by 7 to 10 inches in a common skateboard hanger system conFIGuration. Although each set of wheels is on an independent truck, the ride is bumpy, Four-wheel skateboards are limited to smooth compact surfaces for riding. The proposed invention will increase the rider's access to grass, sand, snow, ice, and mud with the treaded skateboard and/or the large wheel skateboard.

Another application of this invention is the treaded cooler, which provides ease of use and comfort in any environment and can easily be managed by one person, consider any situation that would involve the use of large two or four-wheel coolers, from emergency response events to pleasure/sport activities. The large two wheeled coolers are difficult to lift, pull or place without involving vehicle logistics and additional manpower. Such efforts can result in physical injuries to those using this type of cooler.

The cooler wheels do not traverse on uneven or soft surfaces, which require the cooler to be picked up and carried across these surfaces, The coolers are heavy and bulky in size, which can be challenging to carry over or pull on rough or soft surfaces.

Conventional coolers are not constructed to provide stable seating for small children or to caravan multiple coolers. Consequently, transporting coolers, children and other accessories to the designated location may involve multiple trips.

It is the intent of this invention to demonstrate another application of the fork truck and wheel combinations that can be applied to a recreational cooler, which will provide ease of use, manageability by one person, provide transport for small children and caravan multiple coolers to the point of destination.

SUMMARY

The single-wheel fork system design versus the conventional two-wheel skateboard truck system provides the rider with smooth nondestructive wheels, stability control on slanted surfaces, and increased speed by eliminating the grinding of the aluminum or metal structure of the skateboard trucks on the concrete or brick planter edges. The novel invention addresses the stability and smoothness of the skateboard ride by creating a single-wheel fork truck system, which consists of one single-wheel fork truck system in the front and another in the rear.

This novel invention also incorporates the motor drive system into the wheel or wheel hub. This invention can convert a conventional skateboard into a motorized version by installing motors into any one of the four wheels. However, the preferred embodiment of this novel invention is to use two wheels, which is the single-wheel fork truck system.

To produce the two-wheel motorized and non-motorized skateboard, this invention introduces the skateboard transom fork banger. This novel skateboard transom fork hanger assembly holds the wheel on the inside of the skateboard hanger. Conventional skateboard hangers put the skateboard wheels on the outside of the hanger. The uniqueness of the invention is to use the skateboard transom fork hanger assembly to hold a motorized wheel assembly by the inside of the forks. This system design increases maneuverability, stability, and smoothness of tile ride.

Another advantage of the novel invention is the flexibility for designing small non-motorized single-wheel fork truck skateboards. Descriptions of different skateboard wheels in this invention, and as part of the invention, reveals how important the skateboard transom fork hanger assembly is in developing new skateboard media. This invention also describes how to motorize even the small wheel skateboard by coupling an externally mounted motor to the underside of the skateboard single-wheel transom fork hanger assembly.

Normally, a skateboard has two wheels in the front and two wheels in the back of a skateboard deck. They establish a wide riding plane. This plane alternates between infinite numbers of planes as the skateboard trucks wobble when in motion. Even on smooth sidewalks on a diagonal angle, the rider will feel the crack in the sidewalk four times as skateboard rides across. A rider on a two-wheel skateboard will only experience two cracks. As elementary as this point is, it can introduce discomfort to the rider with a four-wheel skateboard. The current invention aspires to solve that problem by using two wheels.

By using two wheels, one in the front and one in the back, the skateboard is riding on a wide line, as opposed to the wide plane, that continually oscillates due to the oscillation amplification of the four skateboard wheels as they encounter road imperfections and debris. The speed performance of the skateboarder is enhanced with the reduced friction on the road with the two skateboard wheels. This increases performance, comfort and safety. This novel invention will disclose the design feature of a large single wheel skateboard that can be used on grass, gravel, sand, mud, or other soft surfaces.

The current invention, the motorized version of skateboards, provides a direct drive that eliminates cumbersome chains, belts and the associated gearing and harnessing that are required to implement the drivetrain on conventional skateboards. This invention introduces a novel skateboard fork transom system, which includes novel wheel designs for non-motorized skateboard systems that will enhance safety of the skateboard rider when performing tricks on public property or in skateboard parks.

These designs will eliminate the need for the destructive action of grinding on park or public structures. Other surfaces become accessible to the skateboarder with the introduction of the skateboard transom system. The multiple novel wheel profiles allows for less destructive activities, and more challenging skateboard maneuvers and positive control over those maneuvers. For example, skateboarders like to use planter beds, curbs and other concrete structures that have obstruction free edges to perform "grinding" maneuvers. With these novel wheels, skateboarders will be able to ride on obstacles as though they were grinding, but with less destnlctive results. Grinding or riding on edges of obstacles can not be performed with wheels. Riding the rails (hand rails) or exposed pipes can be performed with specially configured wheels.

Typically riding these rails involves using the center metallic portion of the skateboard truck. This is actually the bottom part of the skateboard truck, which holds the wheels. This maneuver defaces the object and degrades the skateboard truck. The present invention creates a single wheel that has a circular or straight v-groove in the center of the wheel for riding on objects.

The present invention shows that the large single wheel motorized and non-motorized skateboard has a larger surface area to travel on grass, sand, and muddy surfaces. Another novelty of the invention is that a tread may be added to the wheel hubs that extend the capabilities of the skateboarding on different surfaces that aren't accessible to four-wheel skateboards. New skateboard learners will benefit significantly from the treaded skateboard. The treaded wheels can be used on grass and sand, which are safer than hard surfaces. Even the experienced skateboarder will welcome a grassy skateboard park with a downhill run.

Another novel aspect of this invention is the introduction of the magnetic shoe sole and skateboard deck skin system to improve skateboarder's performance and safety. This can be employed to expand proficiency, finesse and the degree of difficulty currently attained by professionals and amateurs. The 360° maneuvers are performed more safely with the magnetic shoe and skateboard deck skin system.

Such a configuration allows for positive contact of the skateboard shoe sole with the skateboard deck during the skateboard time of flight, or during execution of the trick, or performance, The skateboard trick performer does not need to crouch to the lower positions in order to grab the board and hold it to the soles of shoes as part of the trick with the positive control of the skateboard being effected by magnetic shoes, tricks can be performed with enhanced safety and the ability to concentrate on higher degrees of rotation or other aspects of the performance.

With the motorized and non-motorized versions of the skateboard transom system, the ride is greatly enhanced by the use of suspension springs that are incorporated between the transom plate and the skateboard base plate. The present: invention also provides a new spring system, which can he replaced in the conventional skateboard, which are resilient leaf-like springs.

The tires used for the different skateboard applications generally resemble, in the majority of cases, barrel wheel geometry with a flat section. When a rider is on the skateboard, the tire flattens to a small fiat portion. This flatness, from the front wheel to the rear wheel, is significantly smaller than the area defined by the conventional four-wheel skateboard. The ride, even with the hard tire on the skateboard fork transom assembly and a single tire, is much smoother than a conventional skateboard ride. This means that it will not only he a smoother ride but a faster ride too.

The skateboard transom fork hanger assembly, with whatever wheel configuration is chosen, is much easier to streamline.

It is also the intent of the present invention and its components to expand the single wheel skateboard transom fork assembly to include motorcycles with two and three wheels; automobiles with two, three or four wheels; scooters in either stand-up and sit-down versions; and to include automobile applications with the main drive source (the motor) incorporated into the wheel or wheels, Also, the motors that are part of the drive mechanism of the previous skateboards, whether internal or external, may also include small gas driven reciprocating engines, turbine, compressed air driven and rotary engines. Incorporating the engines or motors into the wheel, creates more space for batteries or the fuel supply. The lighter weight is due to the reduction on the material needed for the mounting and coupling of the engine to the drivetrain.

Yet another novel aspect of this invention is a configuration wherein the basic aspect is modified into a treaded cooler, which provides the opportunity for all of the weight to rest on the treads and the user pulls the treaded vehicle to the reqtlired location. The treads can be changed to address the ground conditions such as snow, water, ice, sand, gravel, and other uneven surfaces.

For example, the treaded cooler can become a floating pontoon system allowing the cooler to float in water. For boaters and campers, this flexibility is easily understood.

Based on the design of the optional treads, lnovement with the treaded cooler encounters minimal ground resistance. Changing the treads is easy and doesn't require high level of mechanical ability. The treaded cooler can be motorized; in effect, becoming a vehicle. Other additional foatu.res include attaching a seat to the cooler top for transport of a child as well as a device, which allows for attaching several coolers together to provide a caravan to carry other accessories. Side panels can be added to the cooler sides to place service items allow the top remain free to be opened as needed.

The treaded cooler moves goods with minimal effort and increases its functionality in multiple situations. No excessive lifting or pulling required with a treaded cooler, which minimizes physical injuries.

BRIEF DESCRIPTION OF THE DRAWINGS

The objects, features and advantages of the present invention will be apparent from the following detailed descriptions of the various aspects of the invention in conjunction with reference to the following drawings, where:

FIG. 18B shows the isometric view of the fully assembled dual shock-absorbing dual-fork tine from FIG. 18A;

Figure 18A:
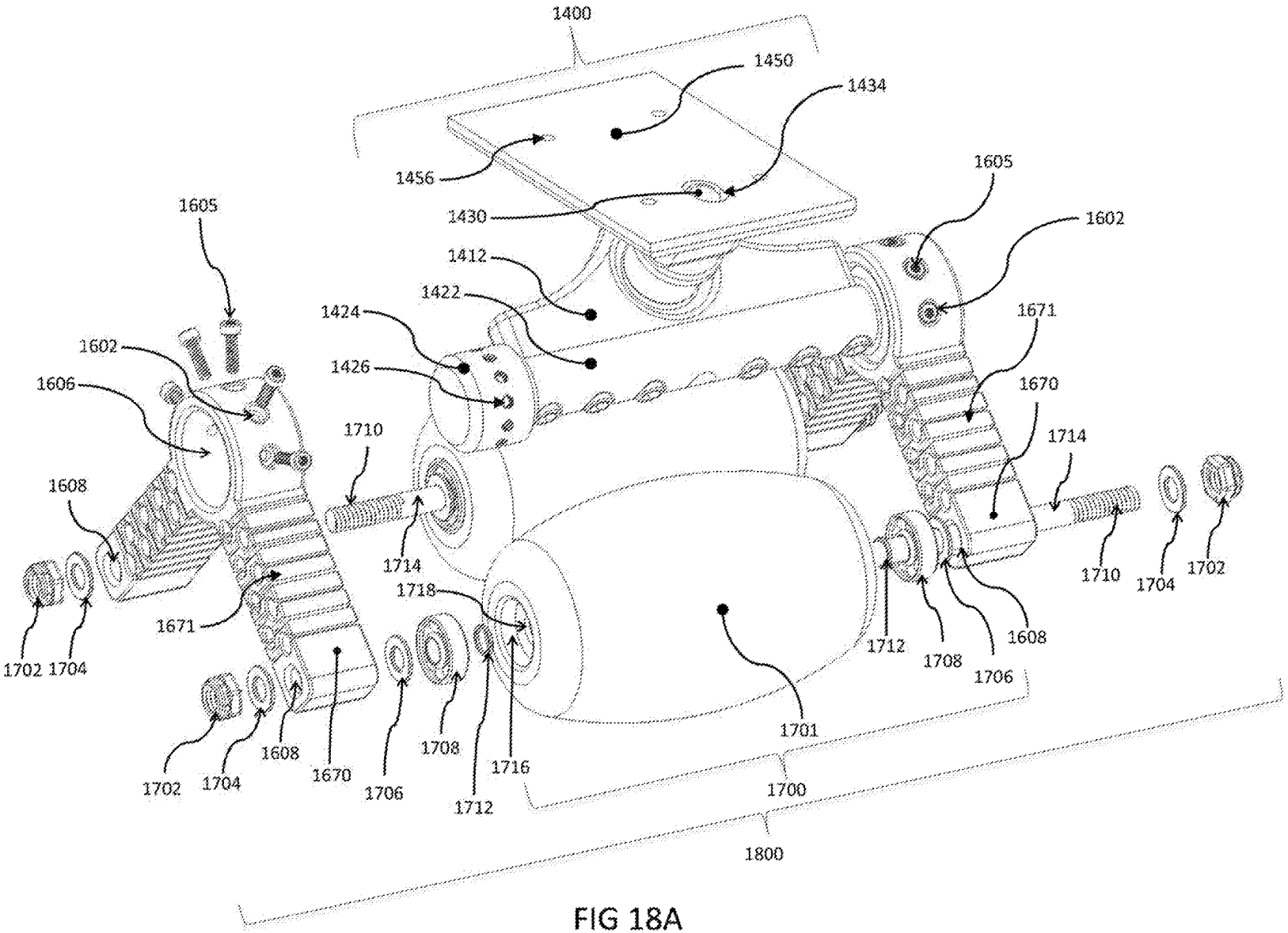
FIG. 18A shows the partially expanded off-axis elevated view of the dual shock-absorbing dual-fork tine and the monolithic axel-hub fork-truck assembly with dual single wheel axel assemblies and the wheels.
Figure 18B:
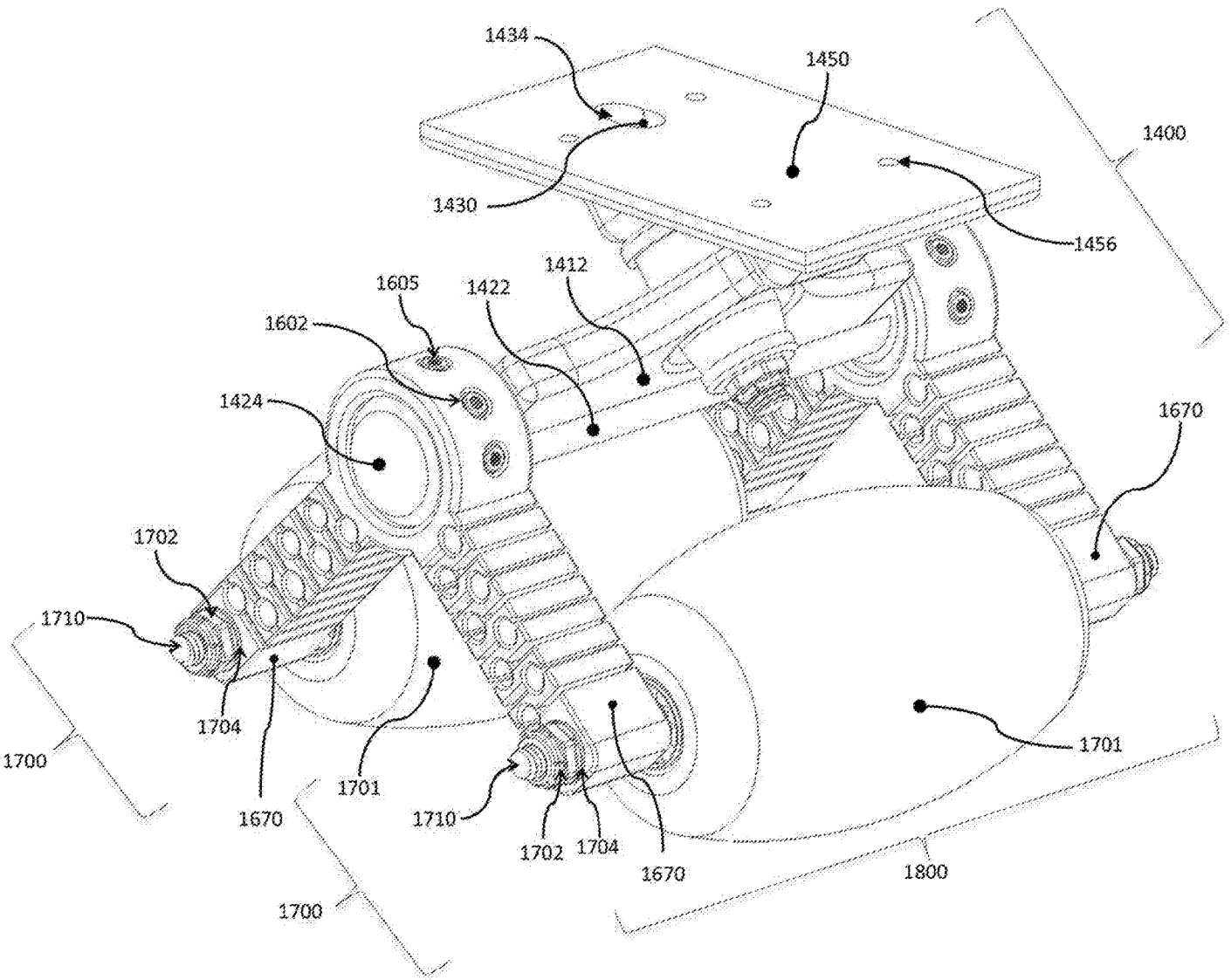
Figure 18C:
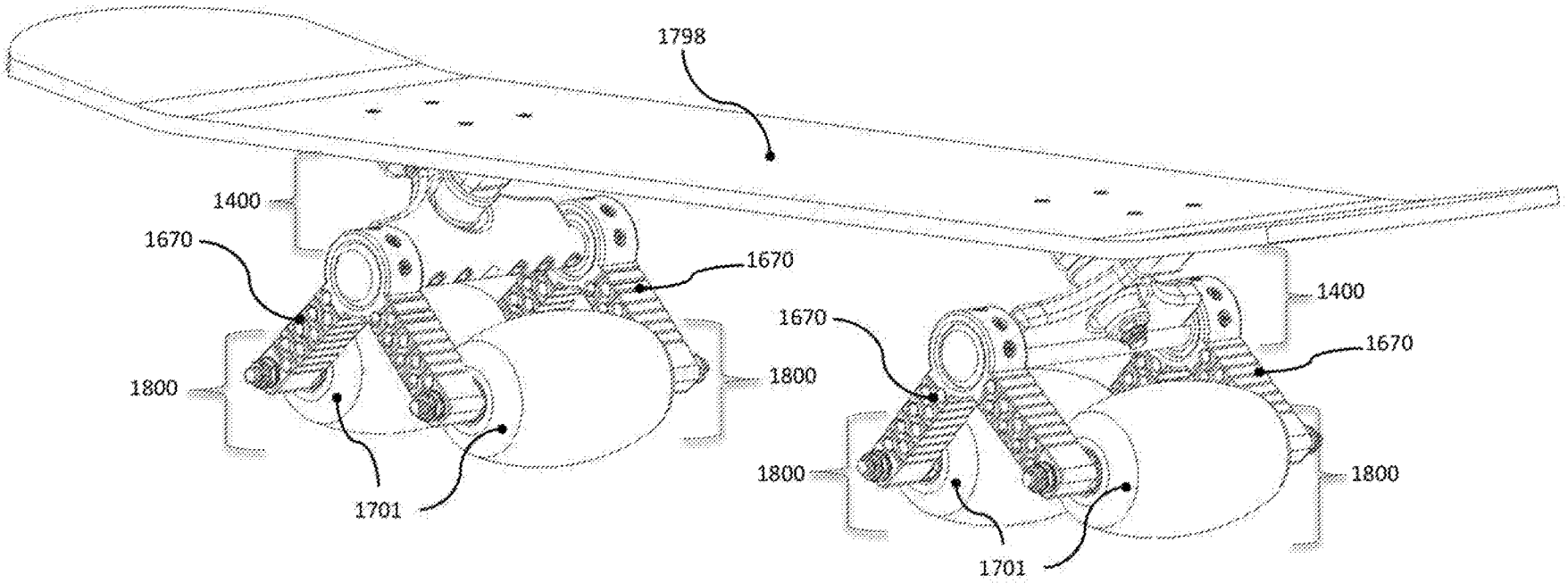
Figure 19A:
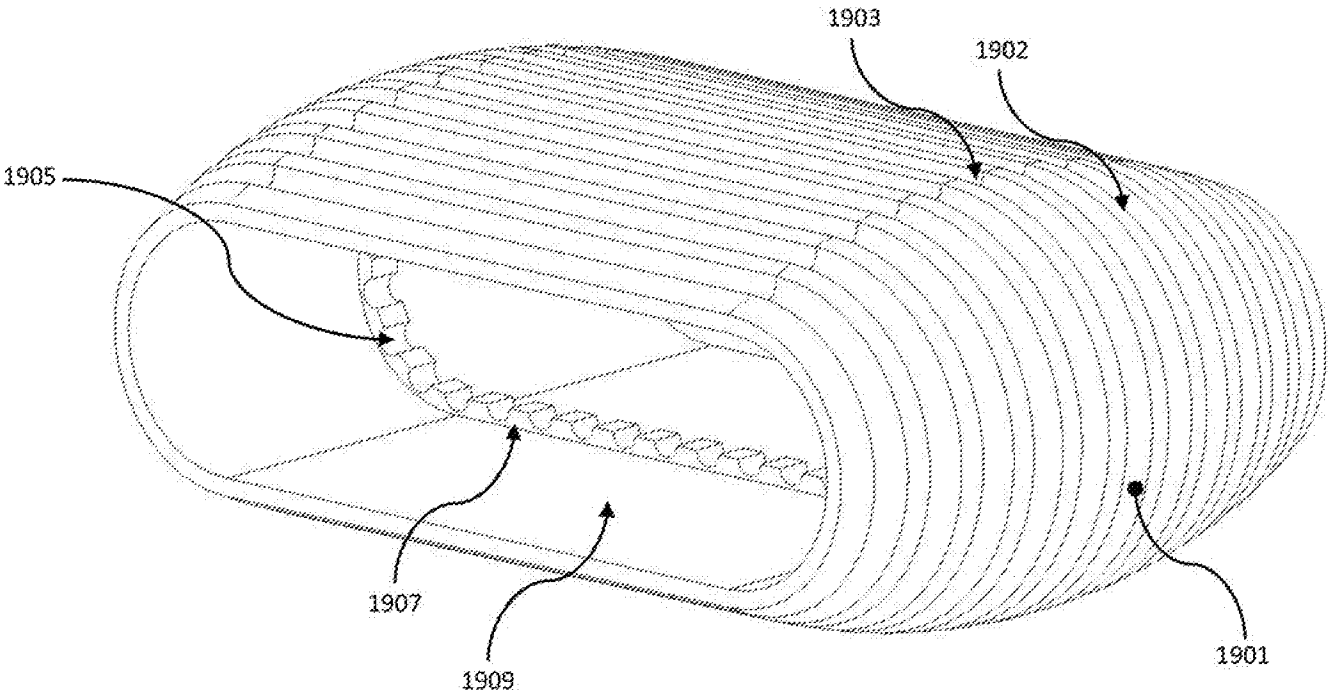
Figure 19B:
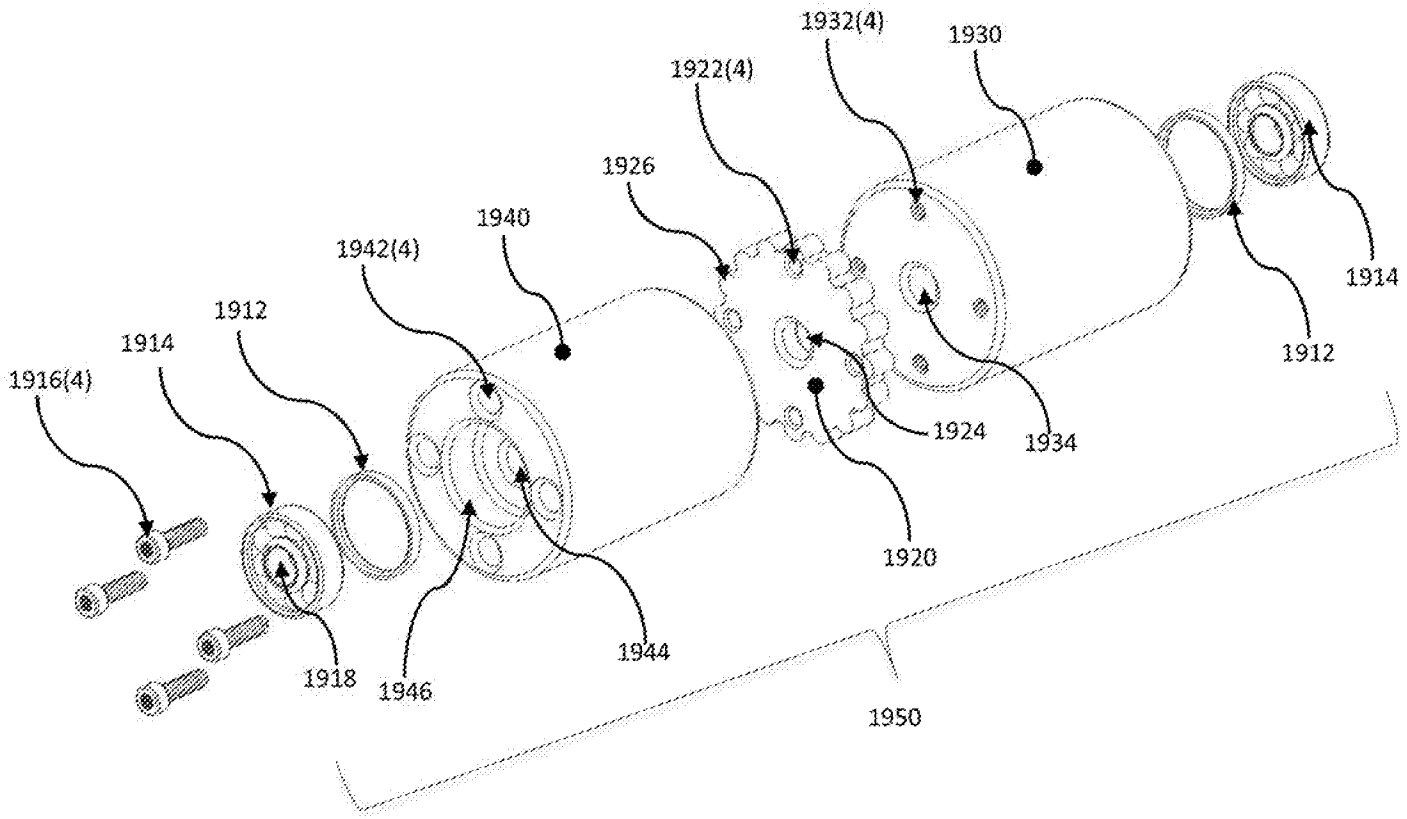
Figure 19C:
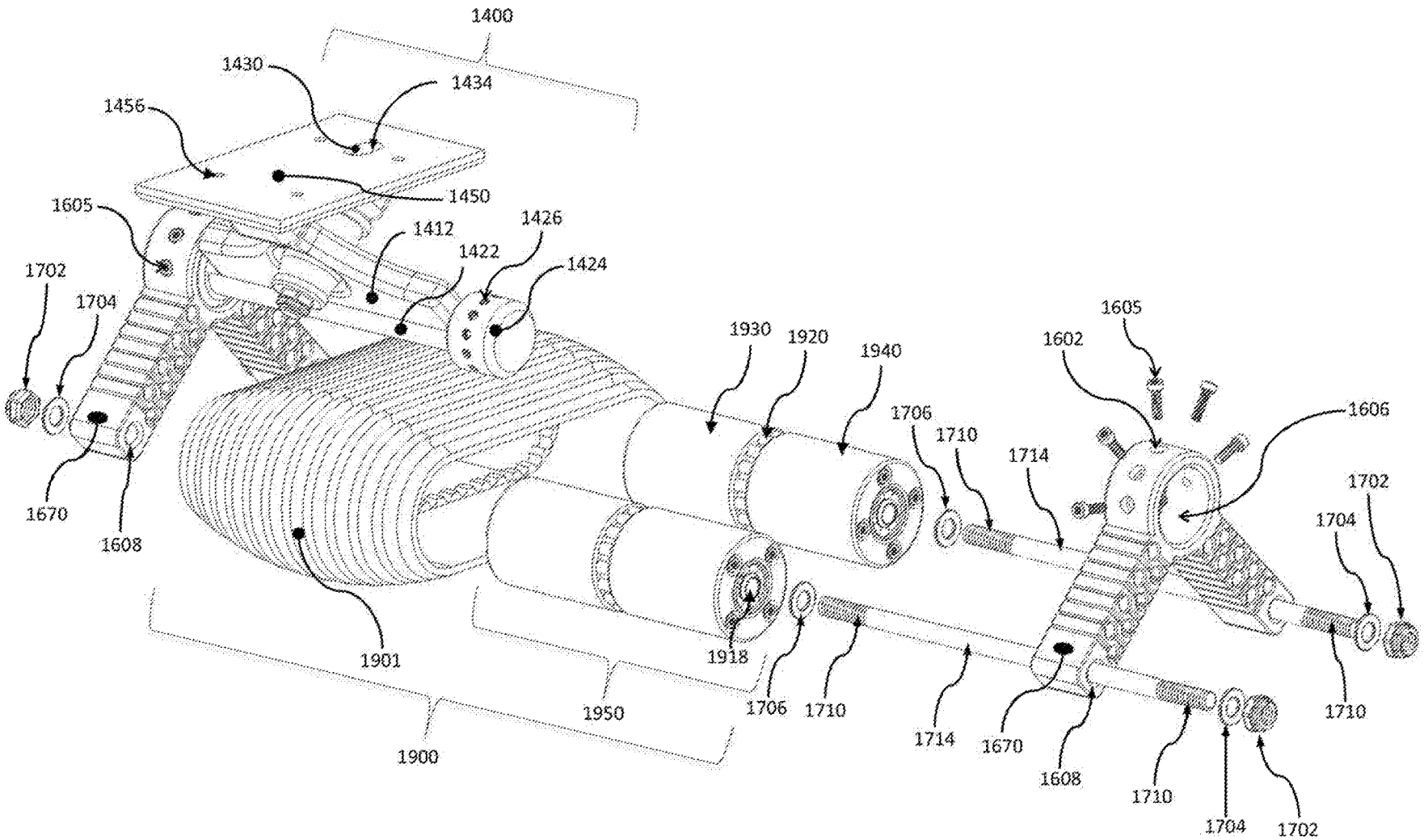
Figure 19D:
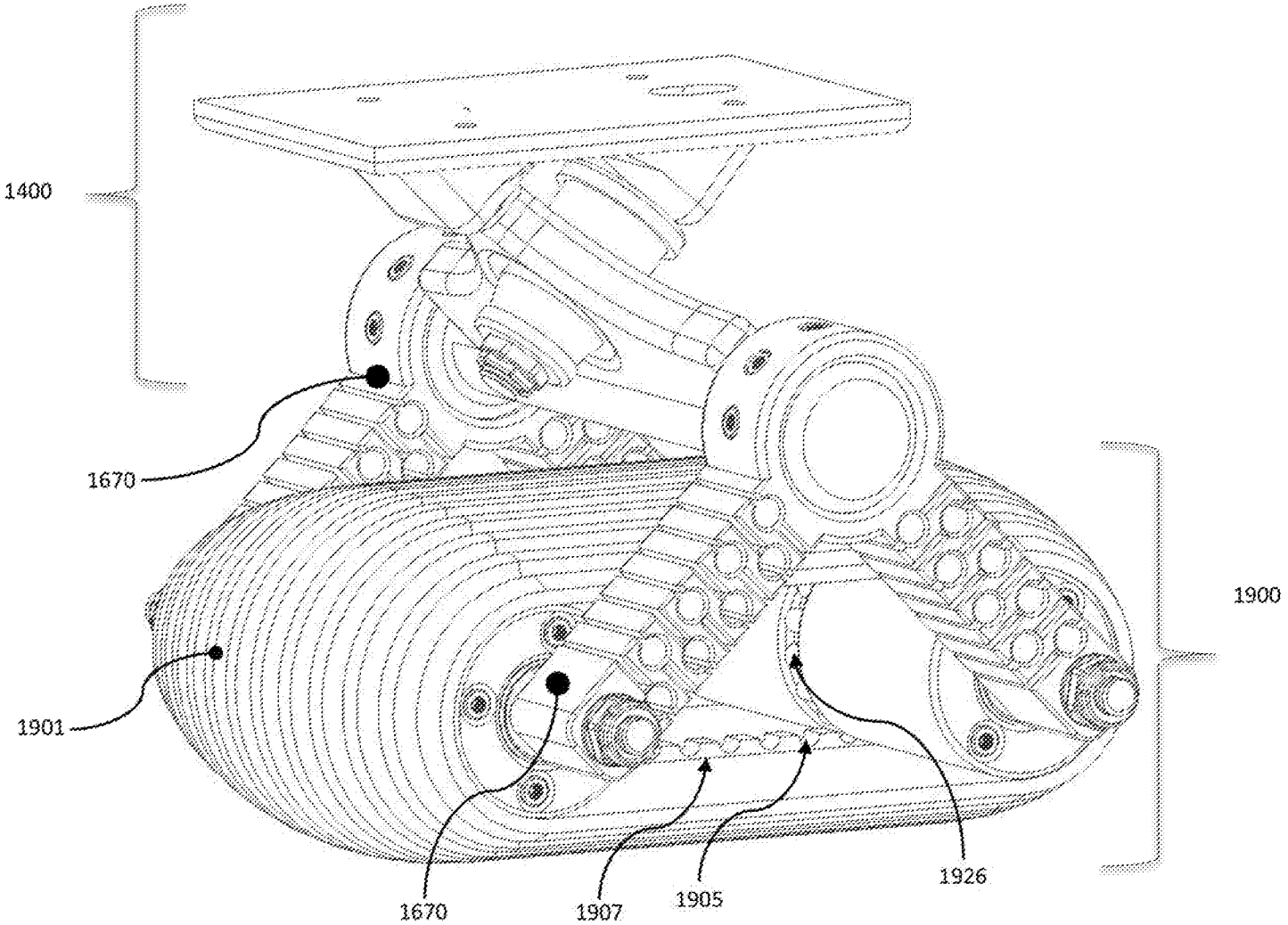
Figure 19E:
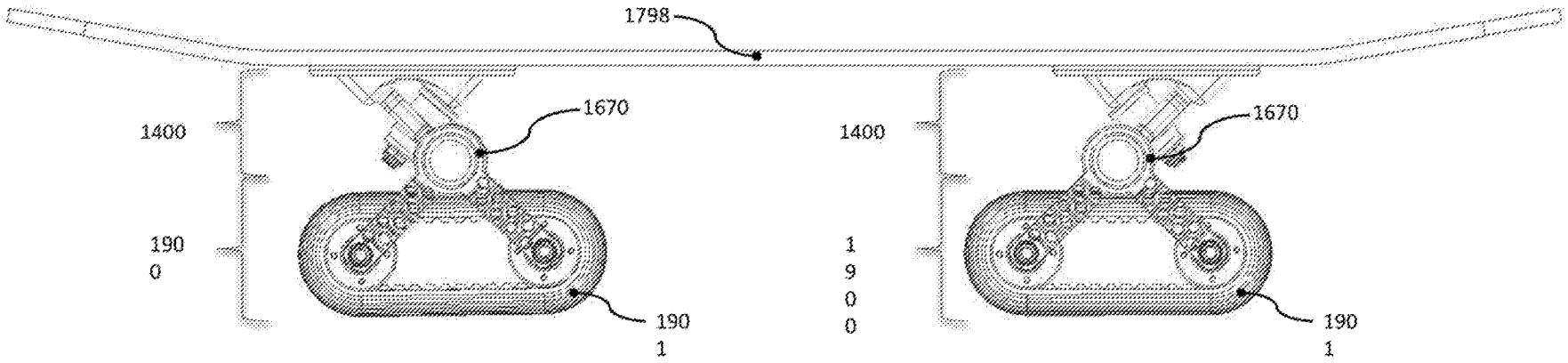
Figure 19F:
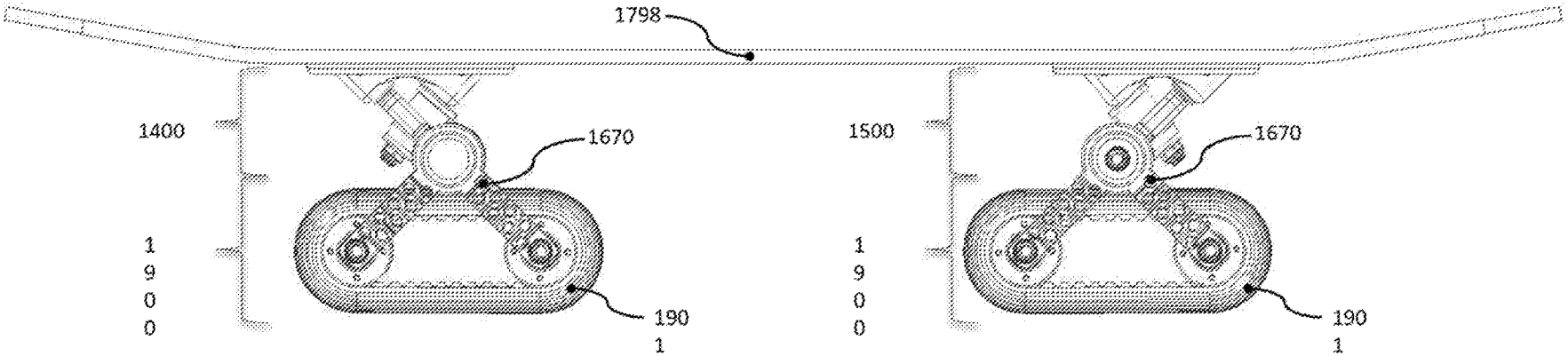
Figure 19G:
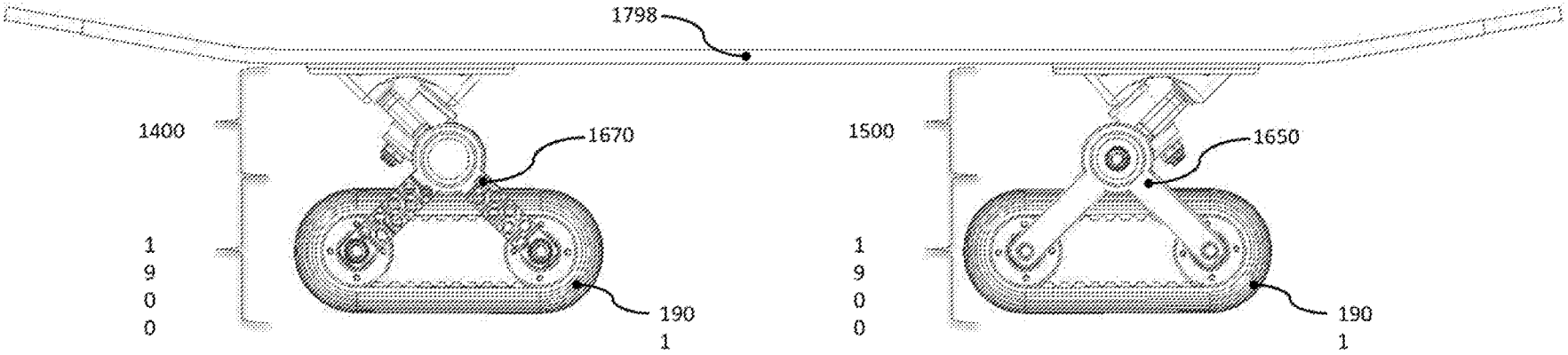
Figure 19H:
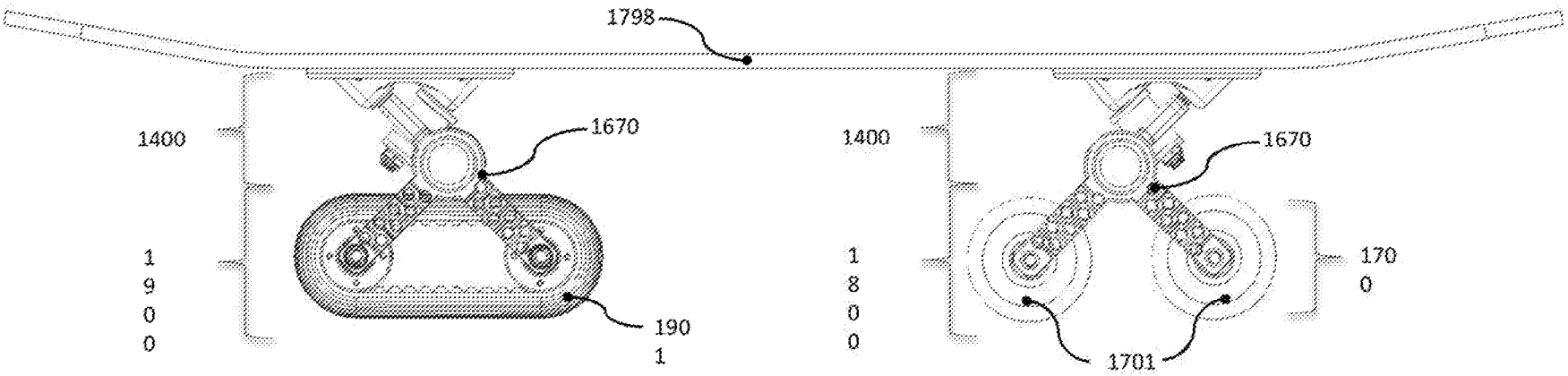
Figure 20A:
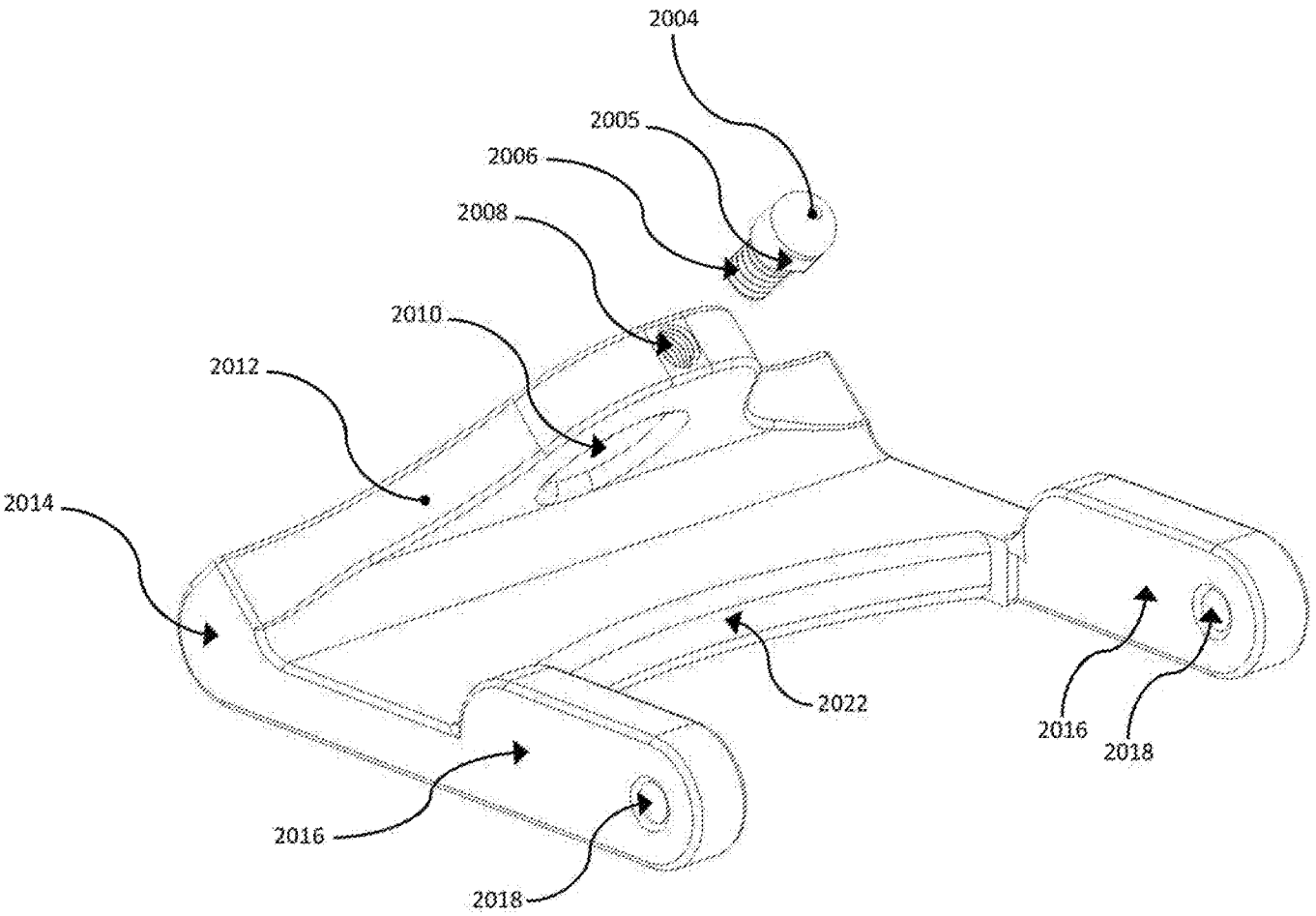
Figure 20B:
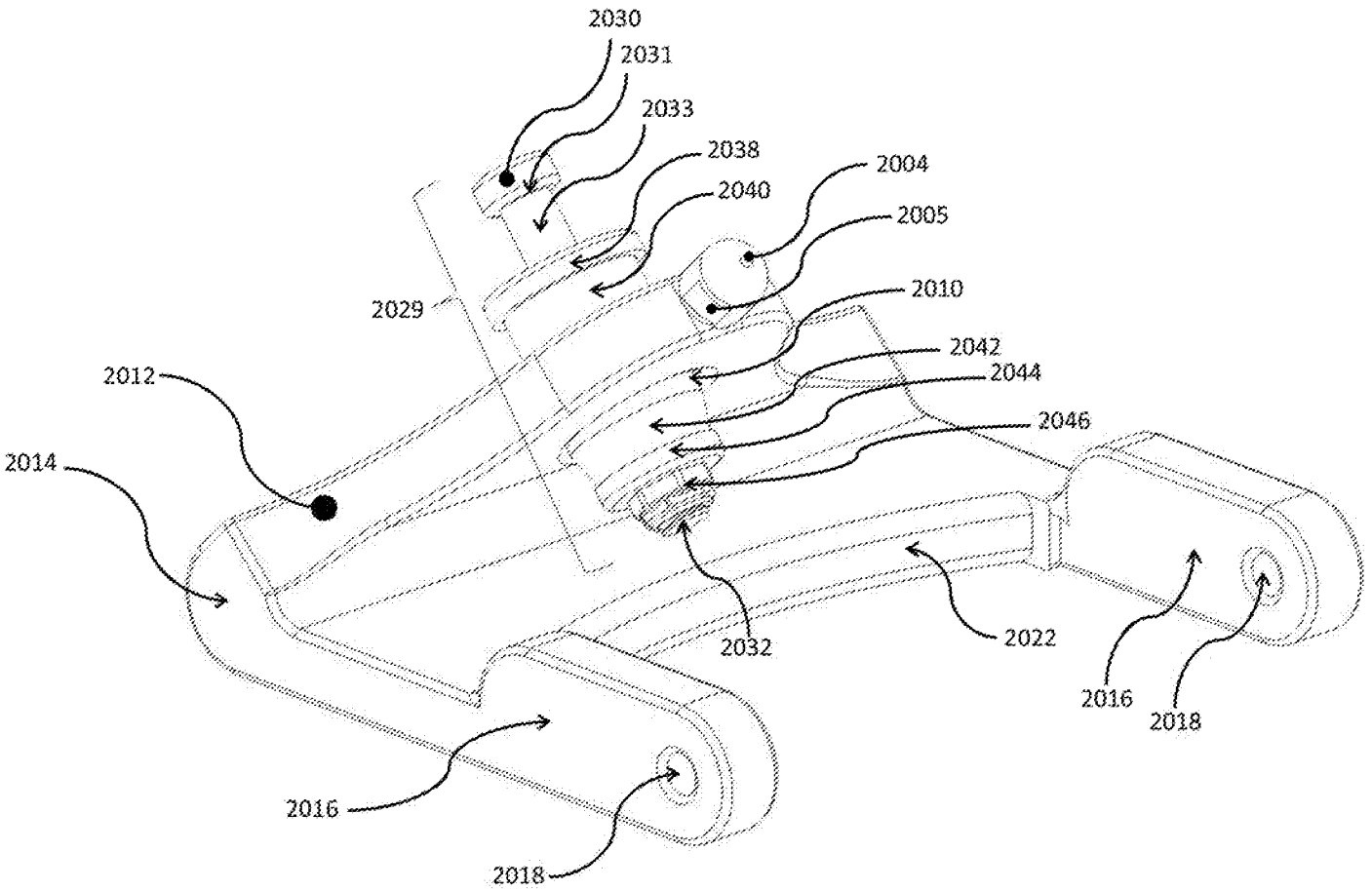
Figure 20C:
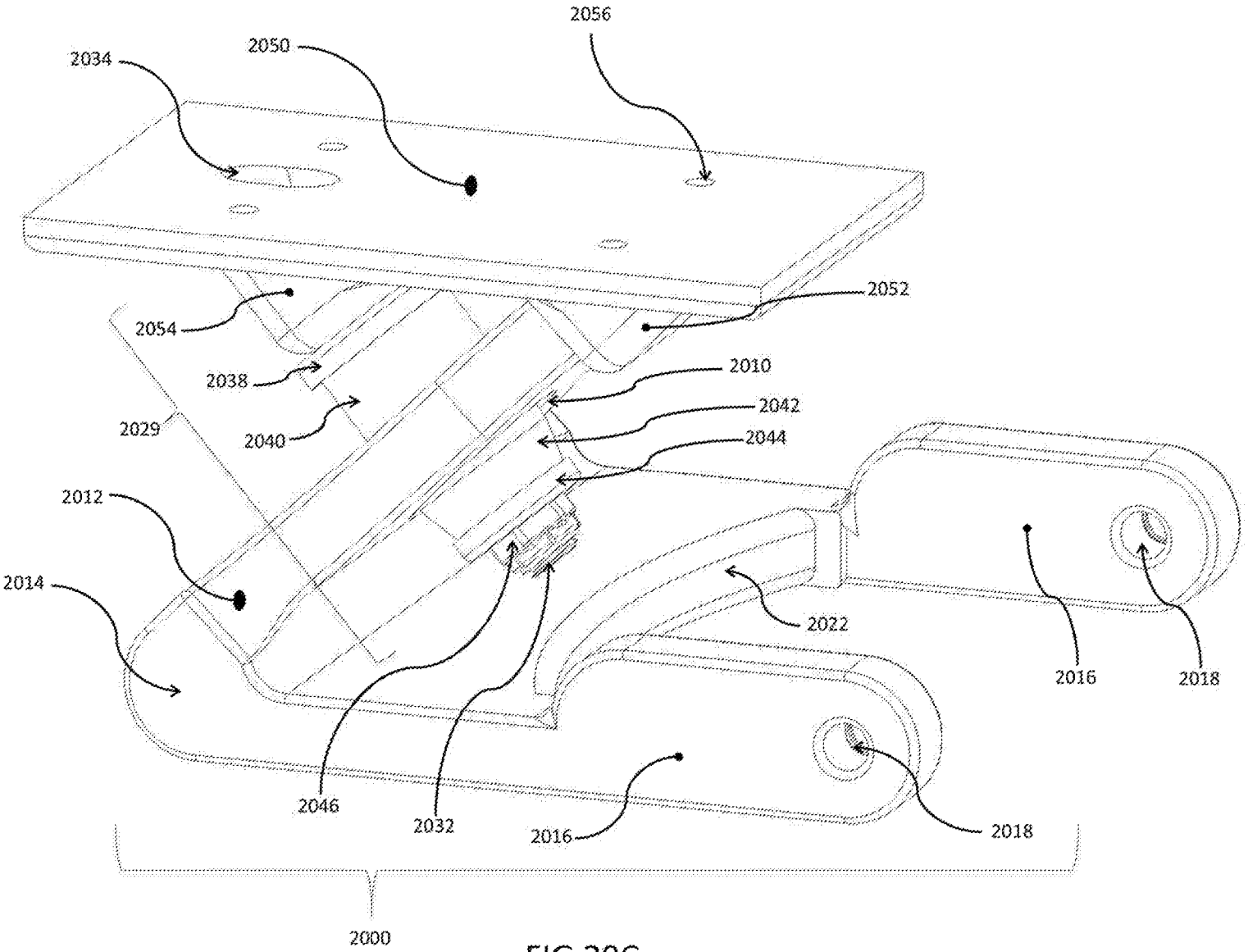
Figure 20D:
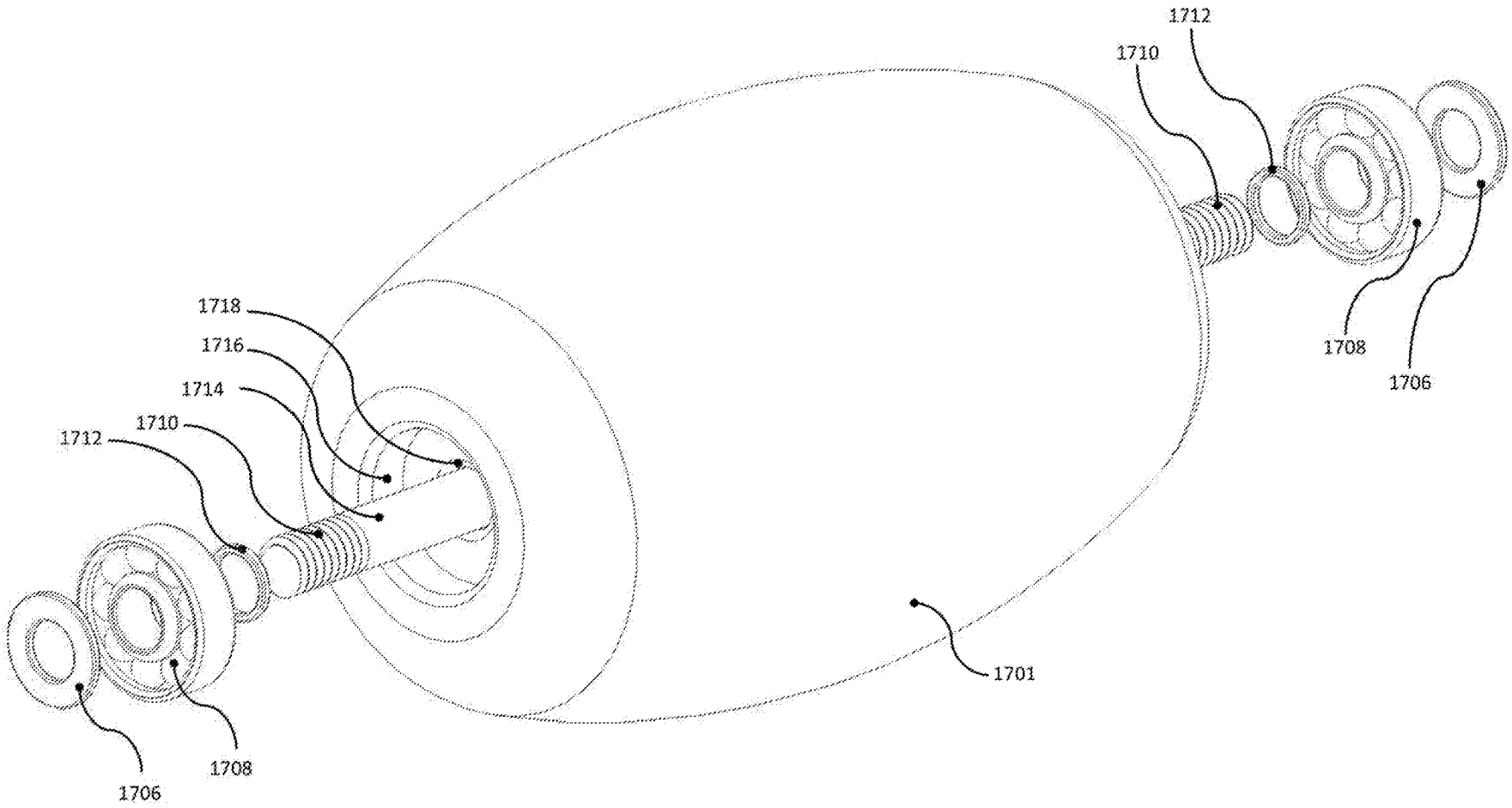
Figure 20E:
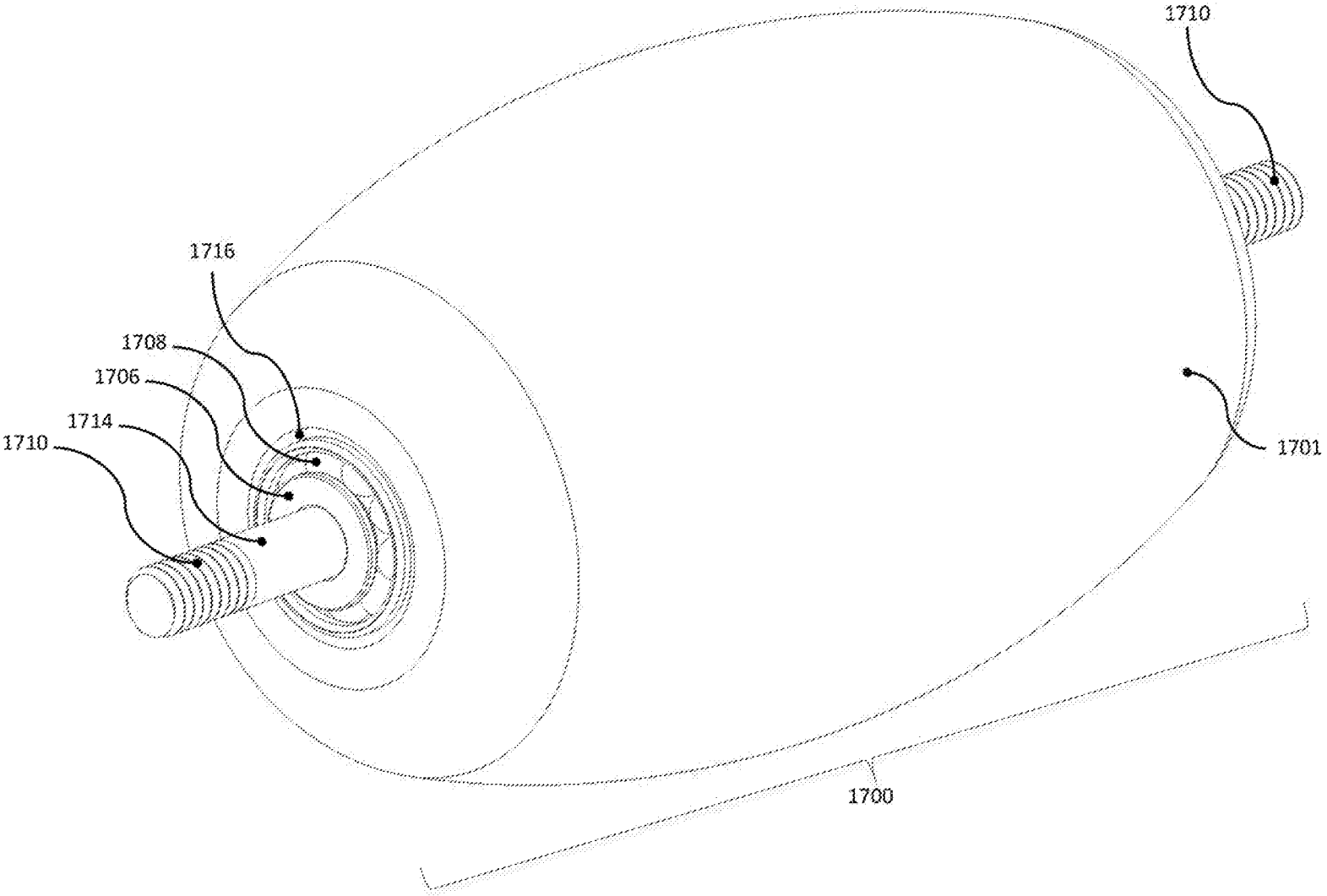
Figure 20F:
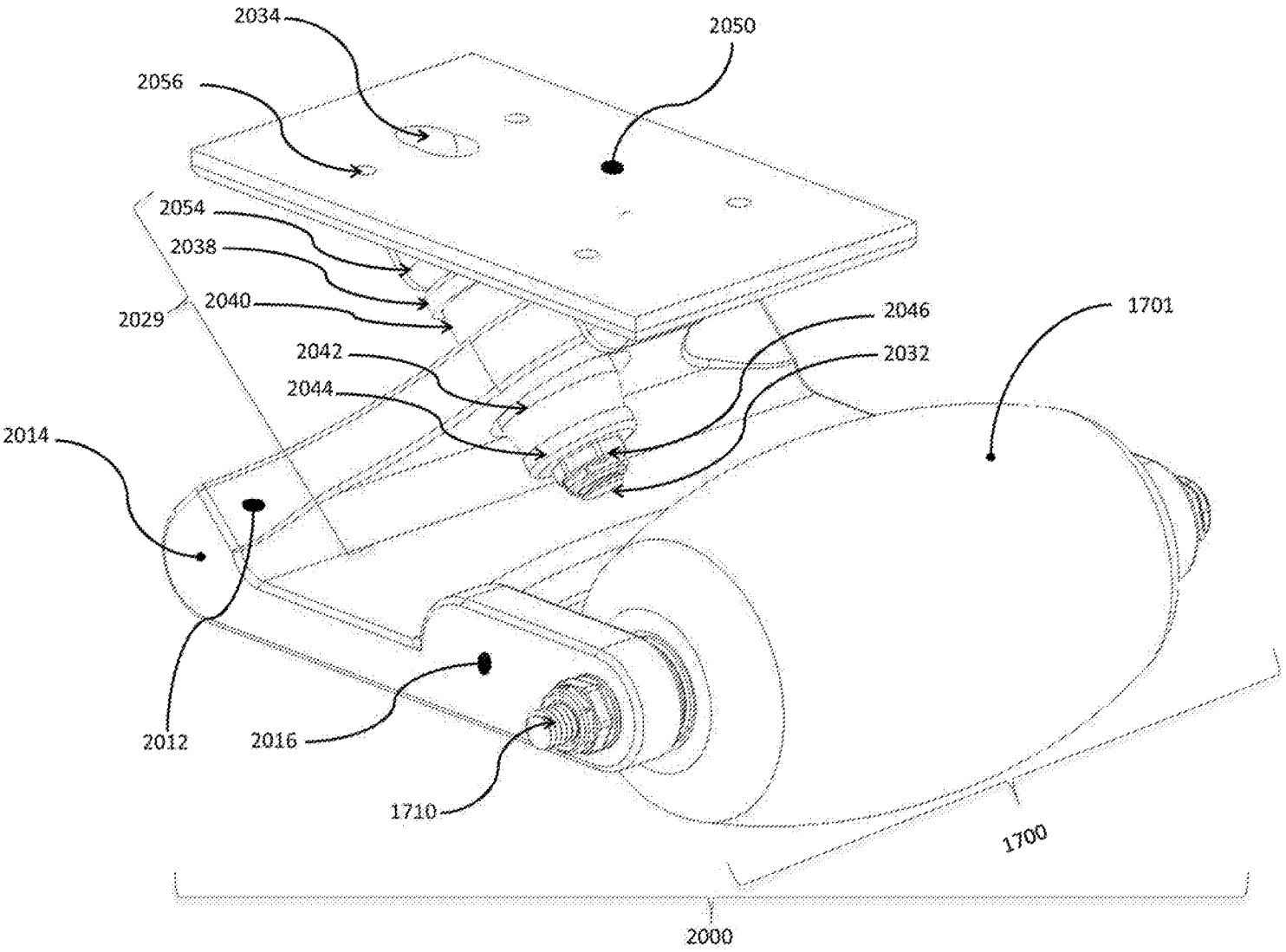
Figure 21A:
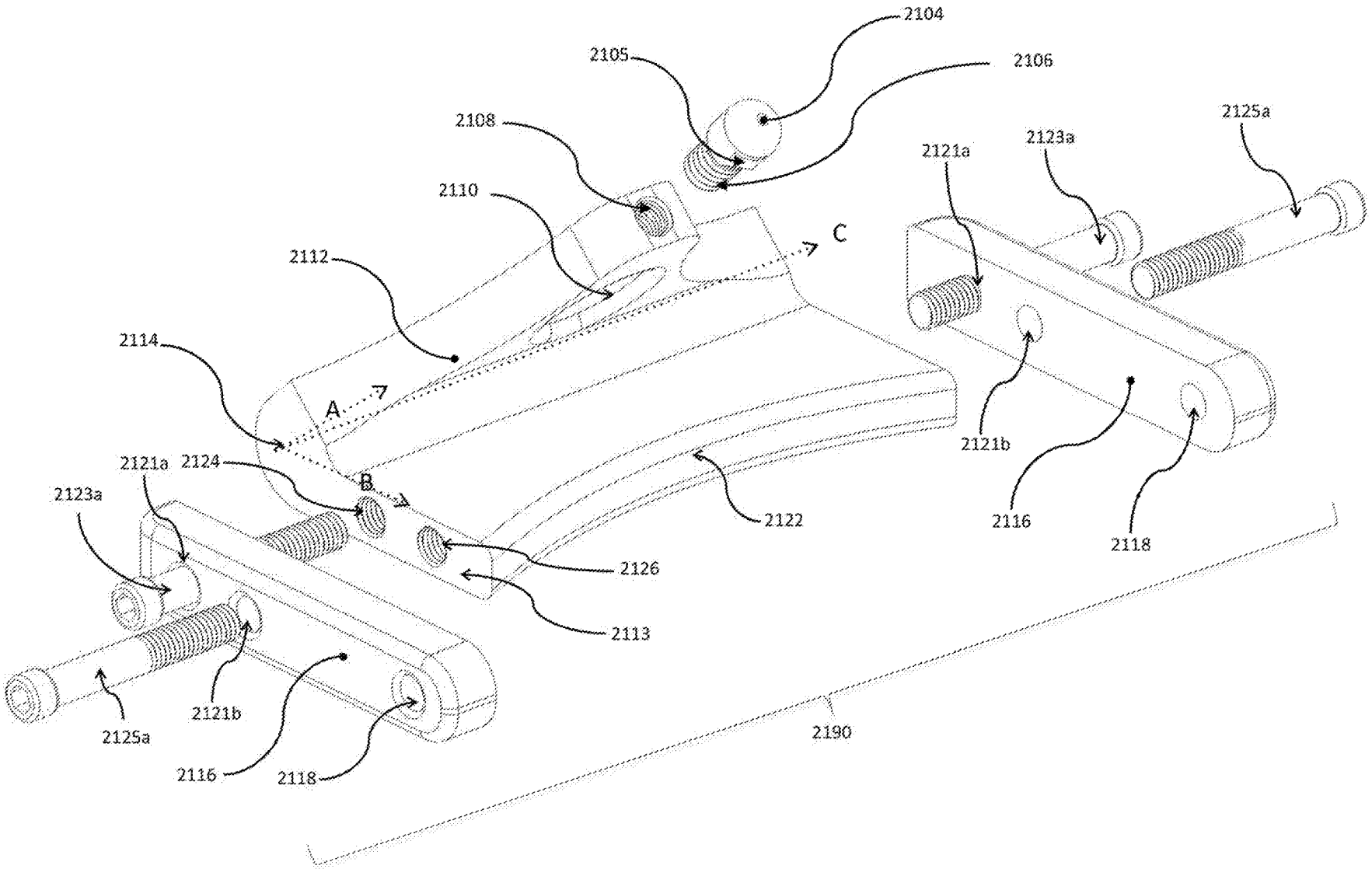
Figure 21B:
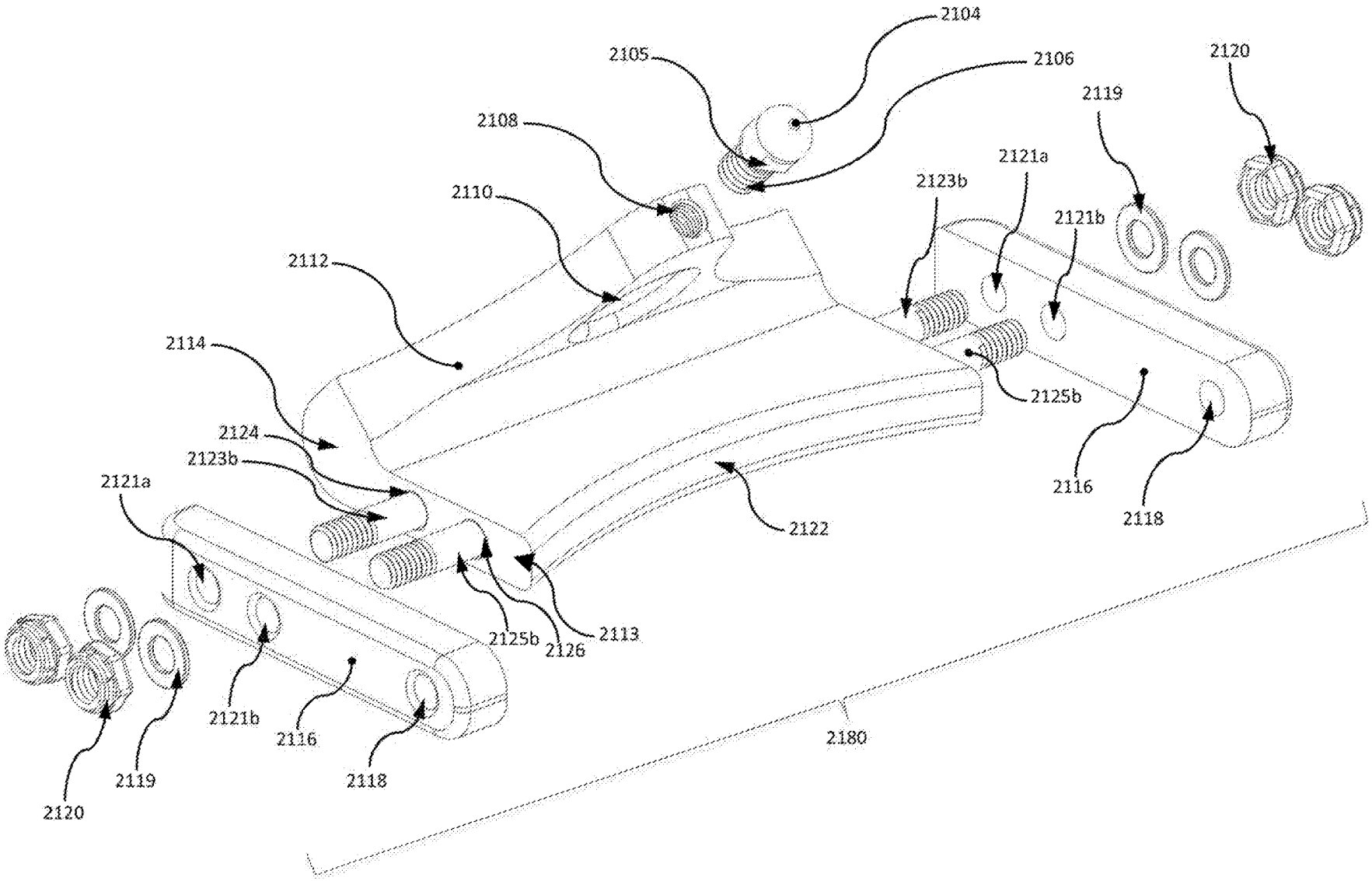
Figure 21C:
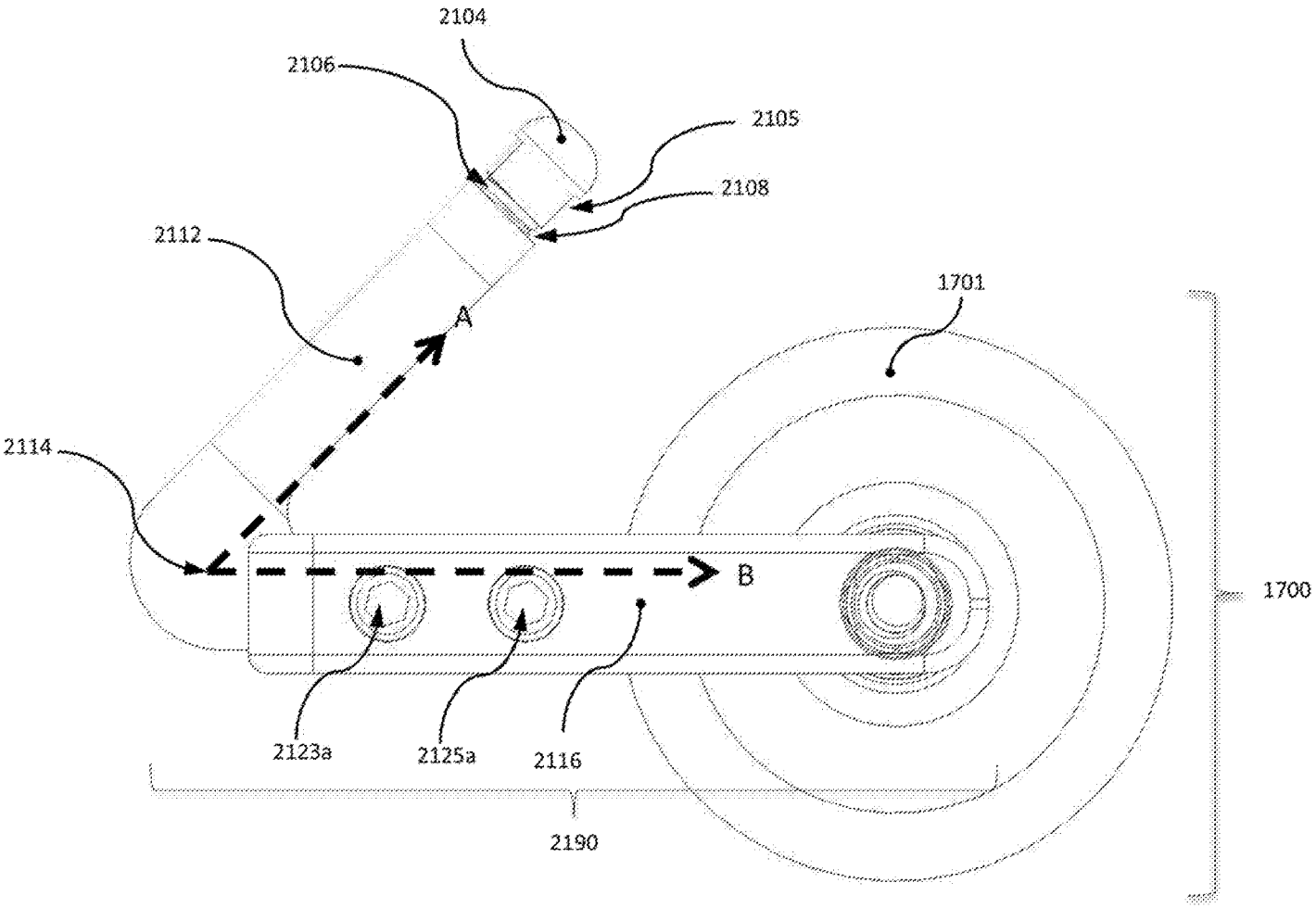
Figure 21D:
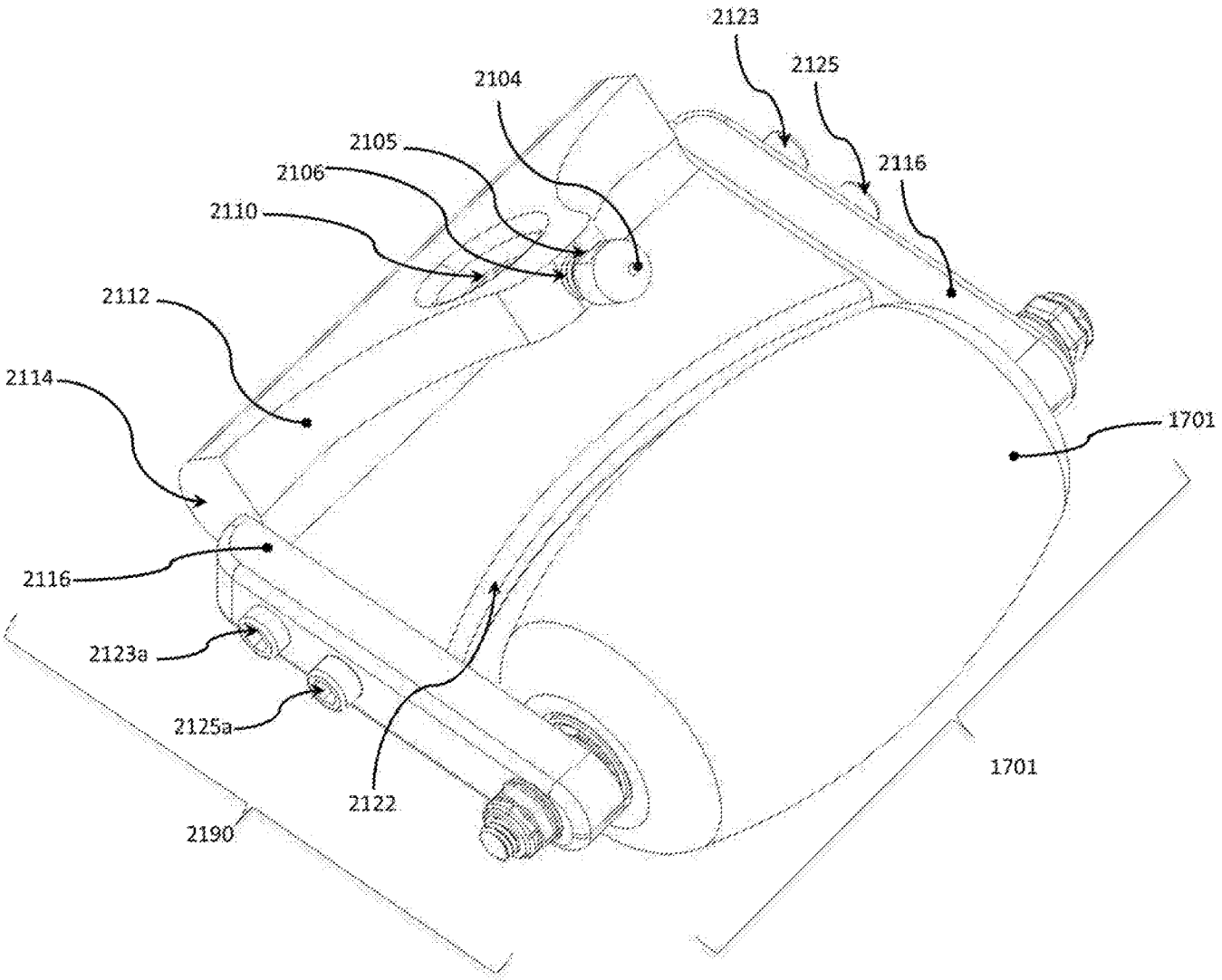
Figure 21E:
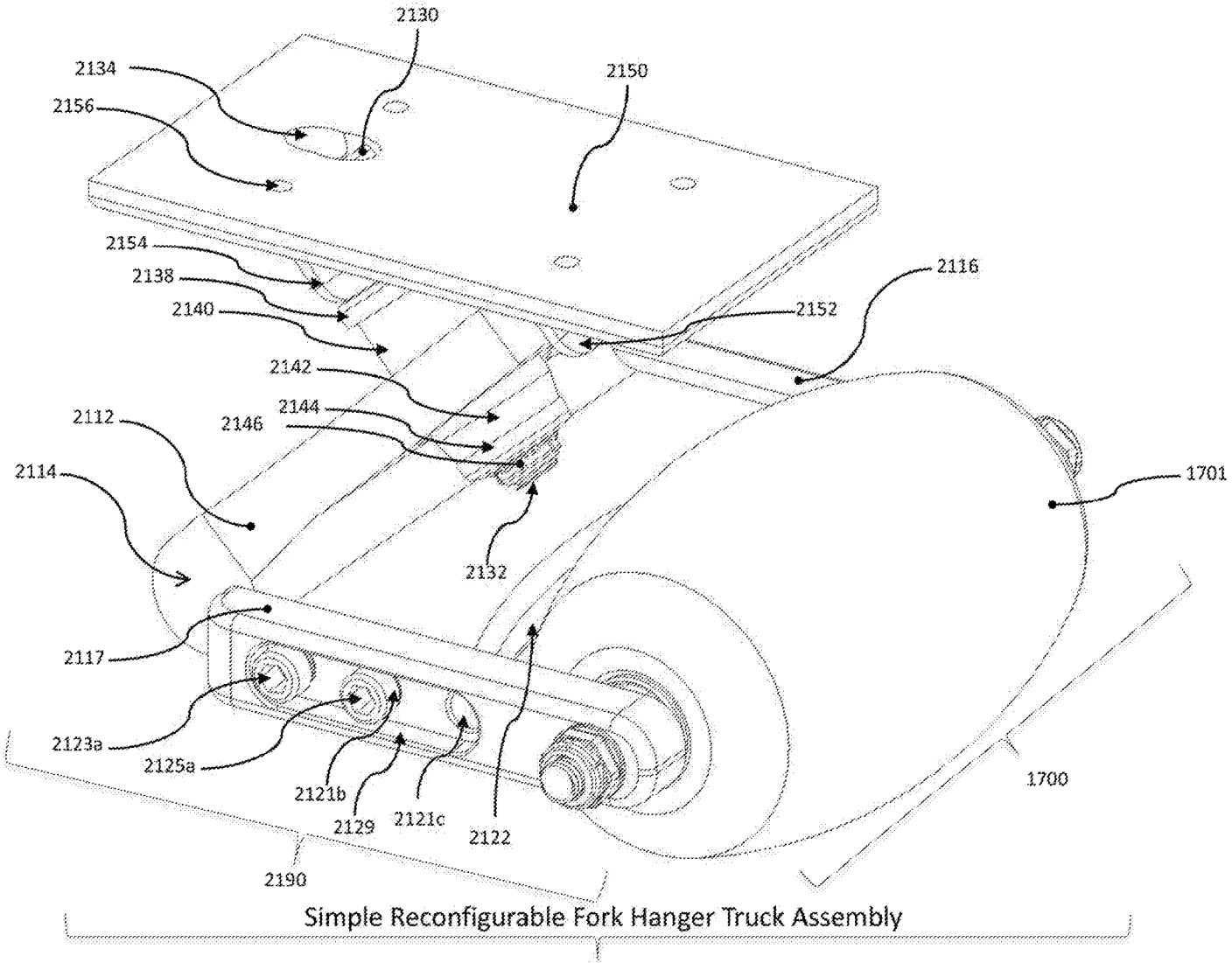
Figure 22A:
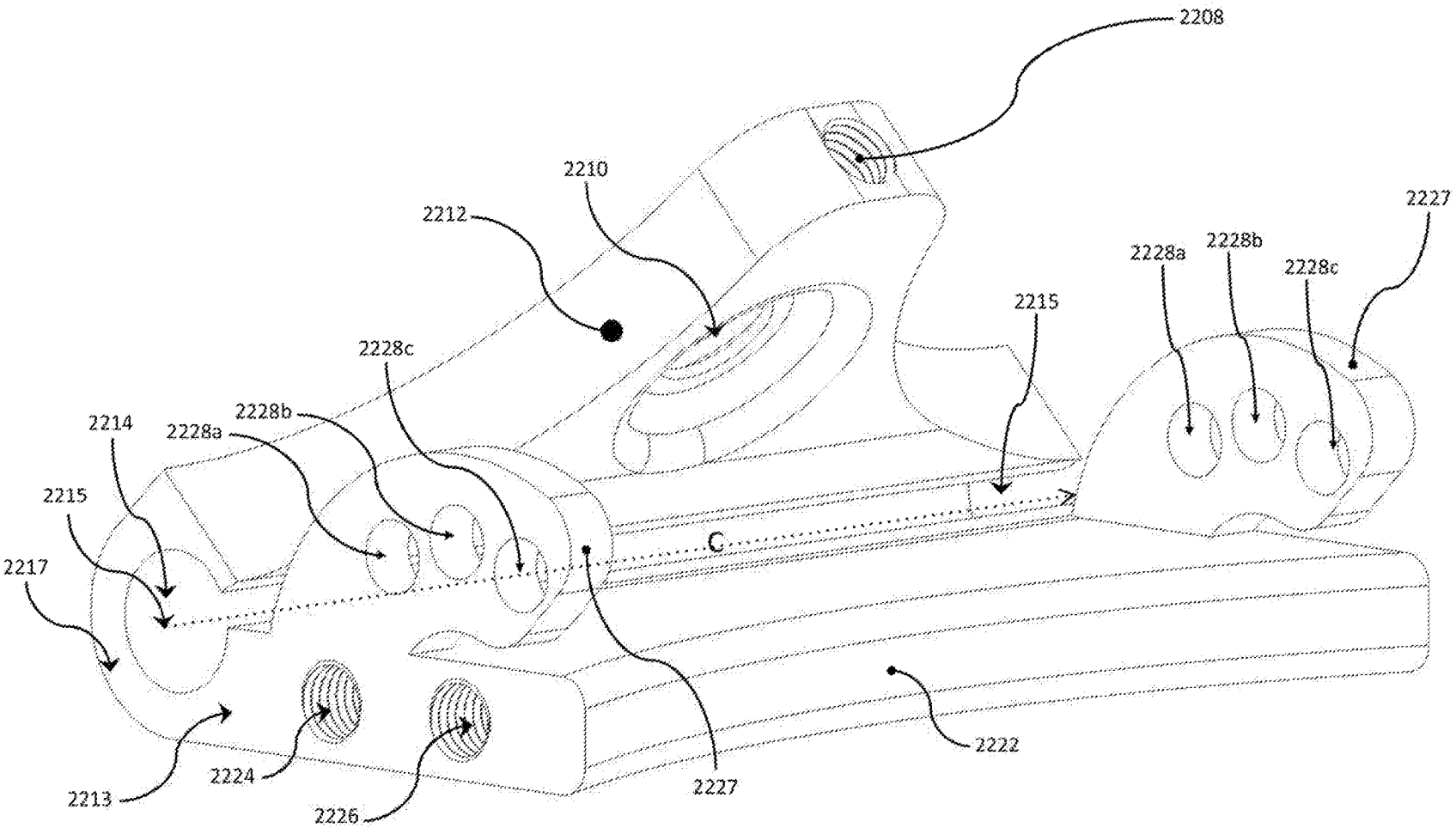
Figure 22B:
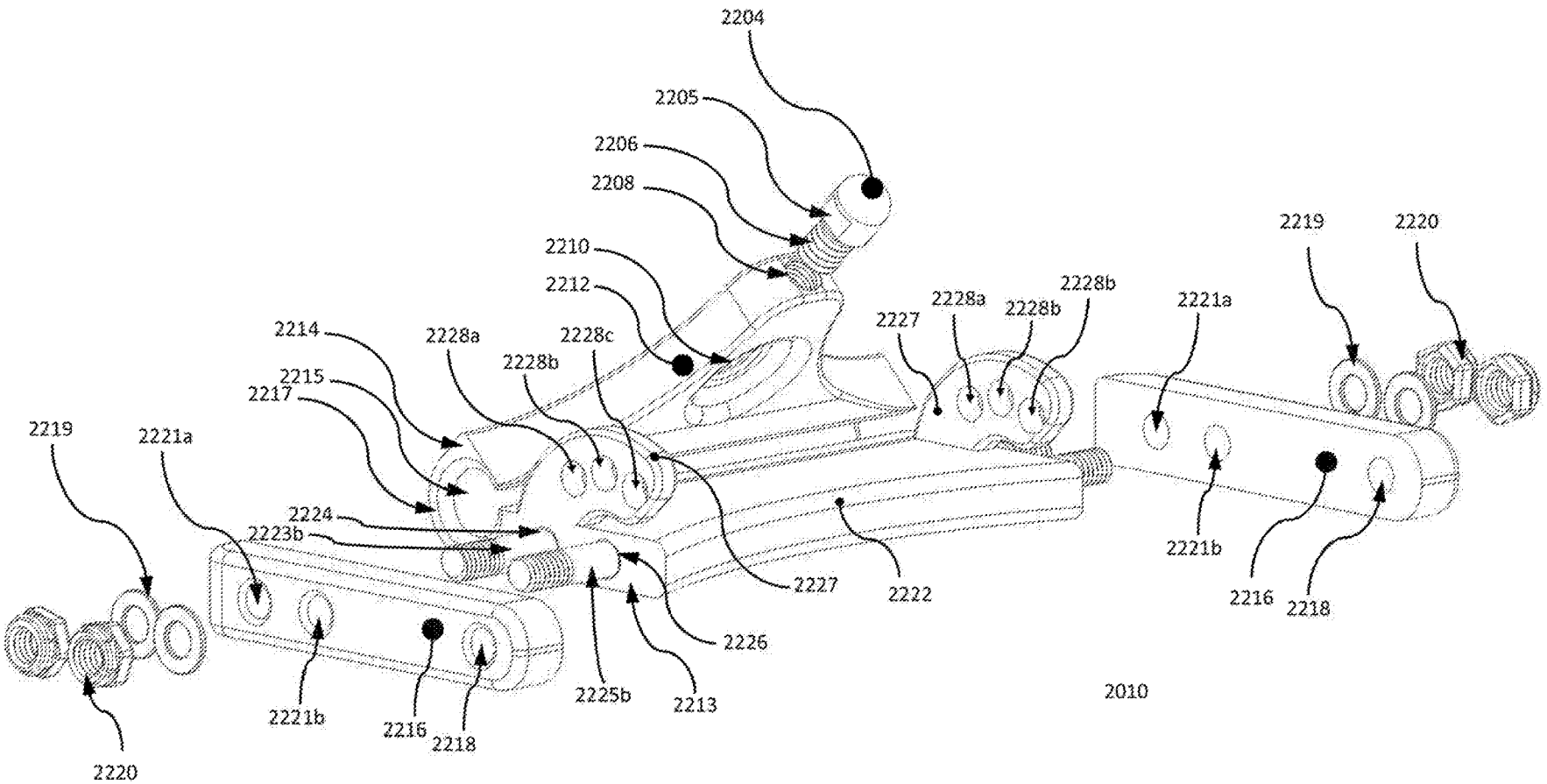
Figure 22C:
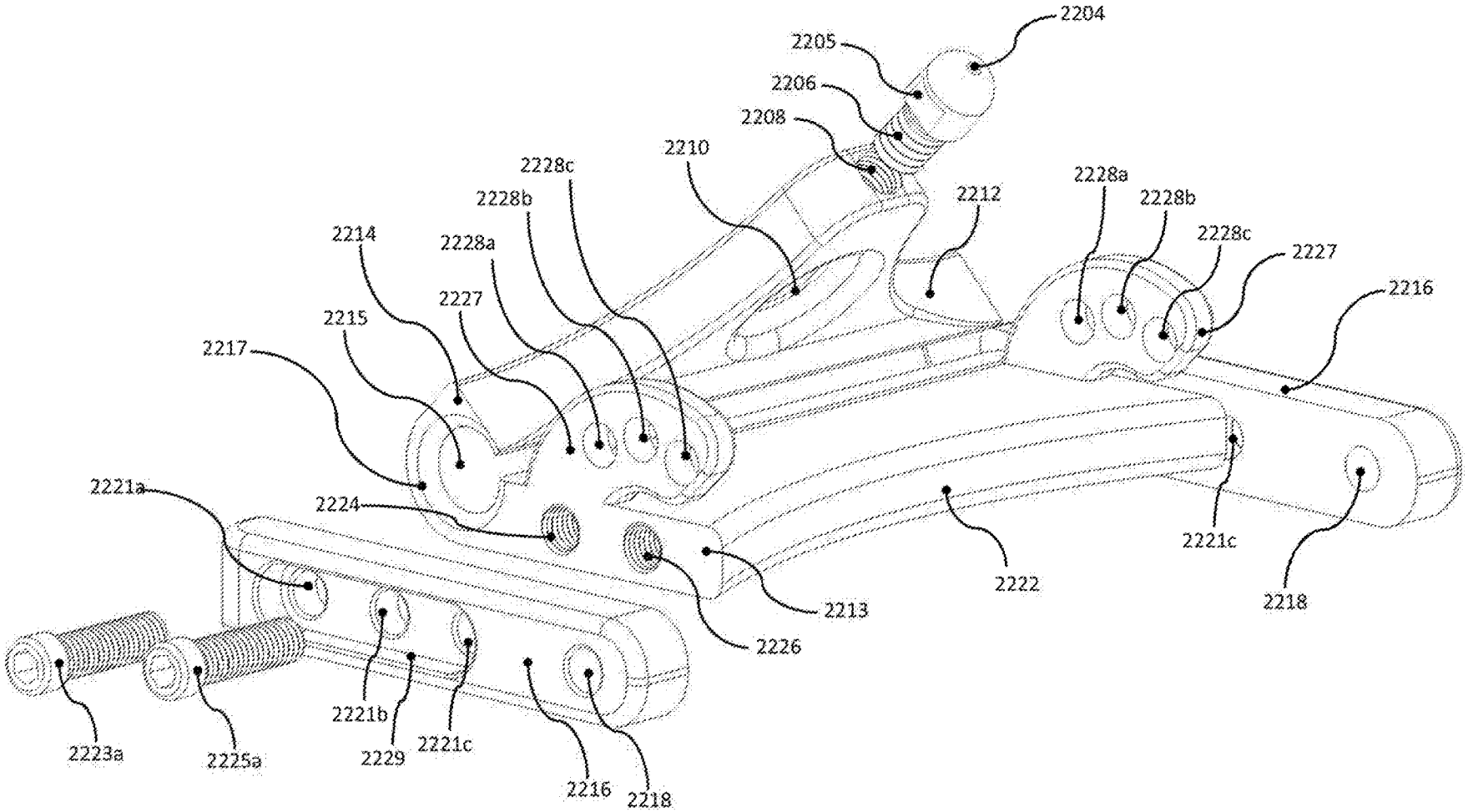
Figure 22D:
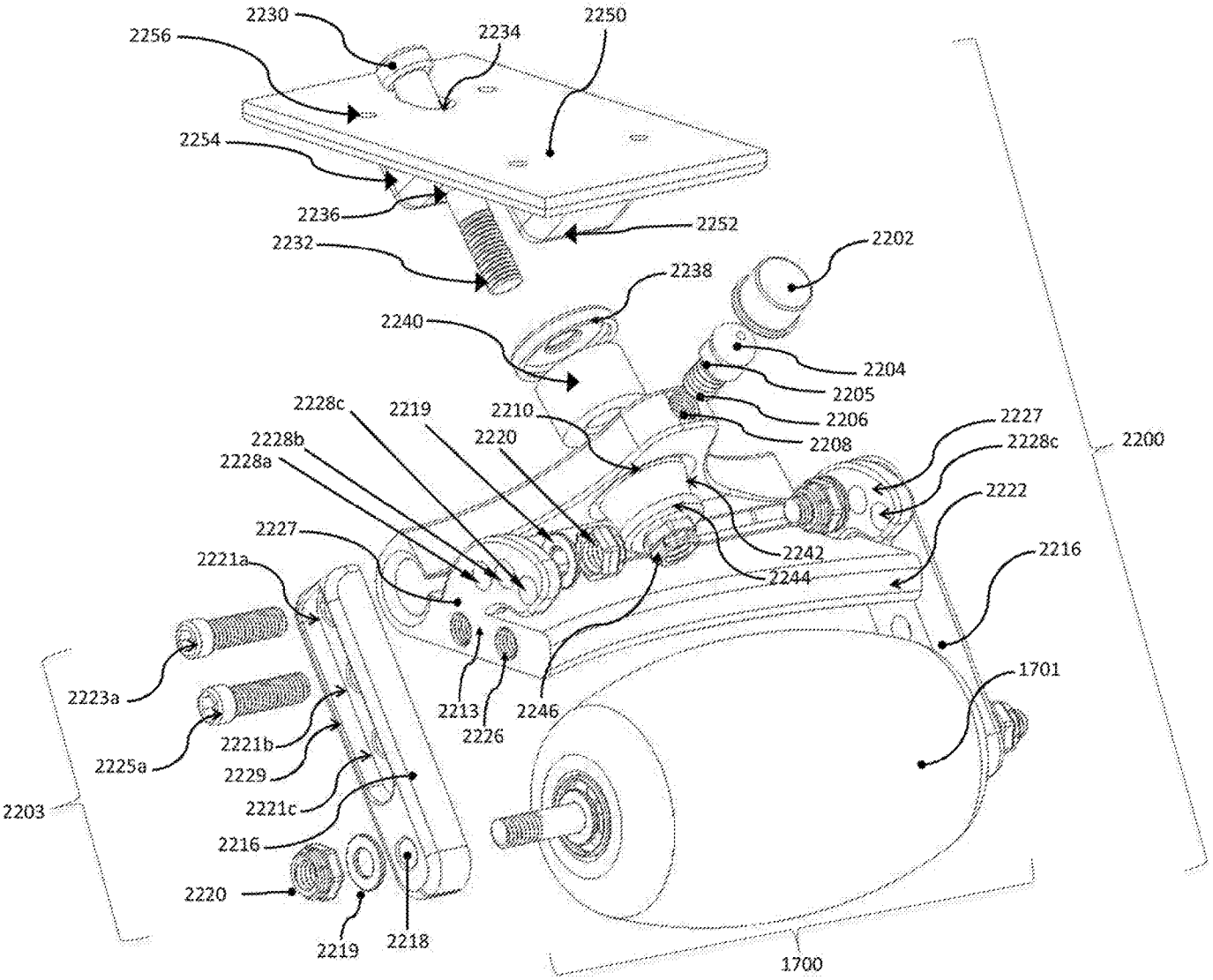
Figure 22E:
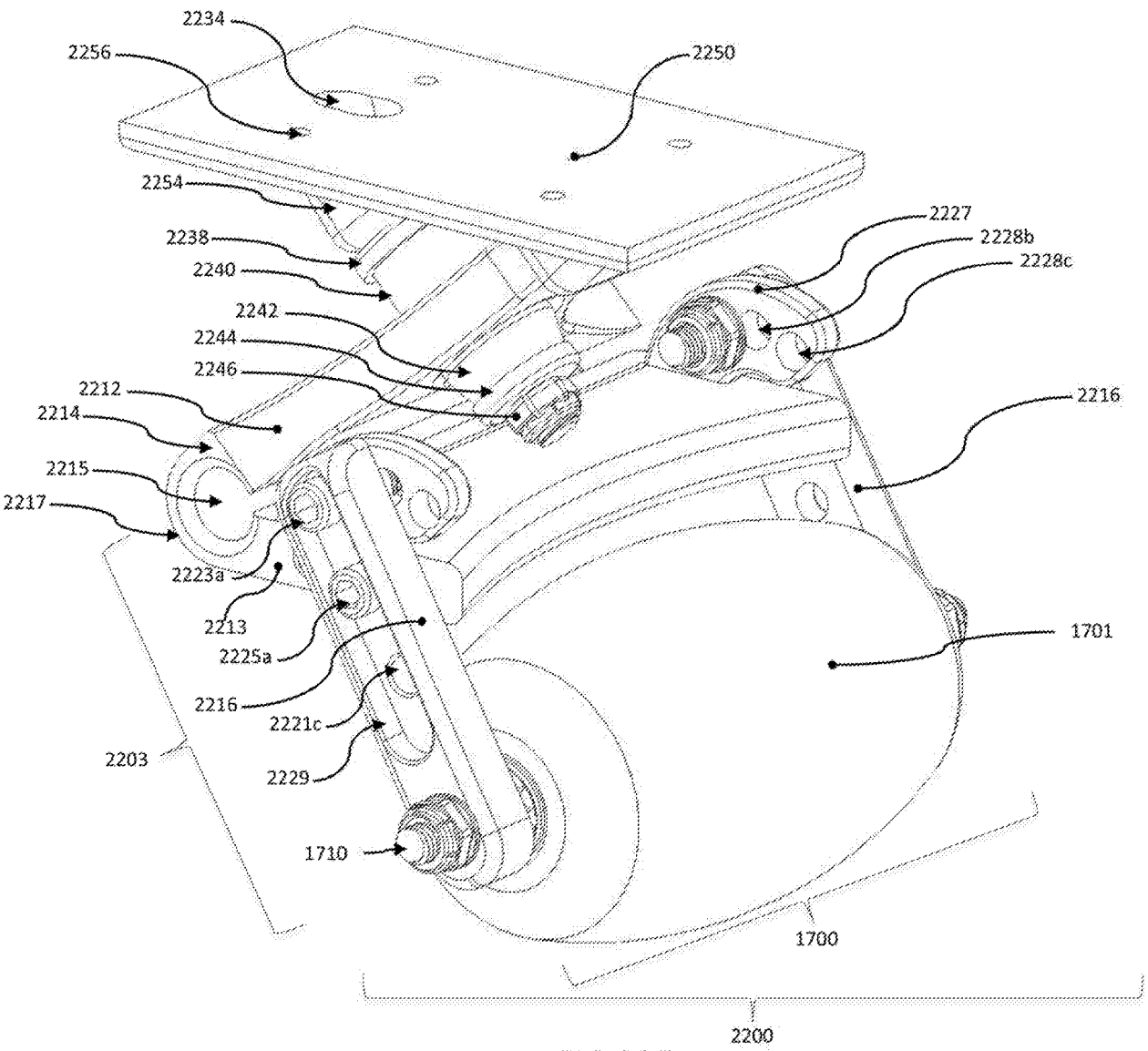
Figure 22F:
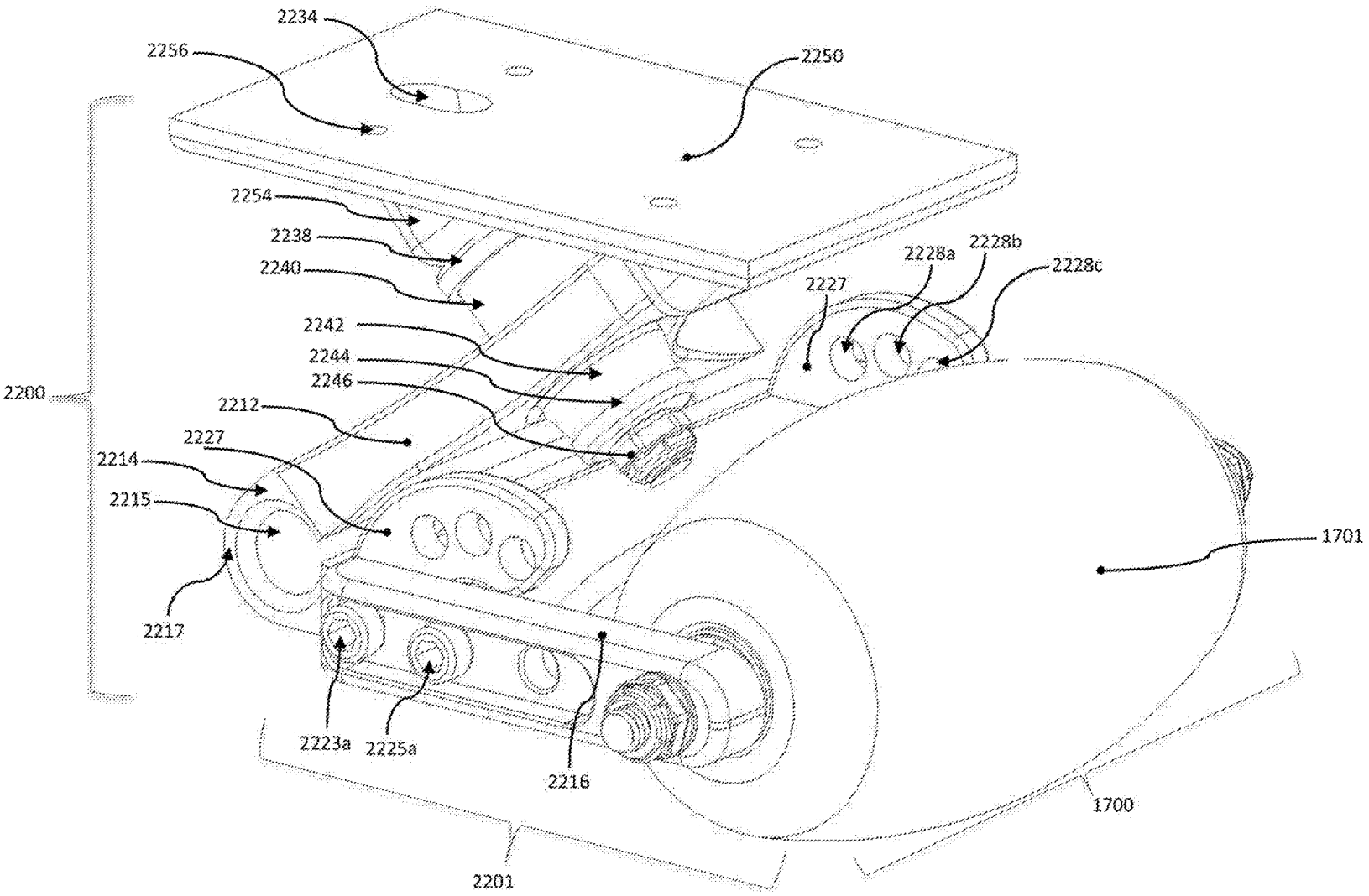
Figure 23A:
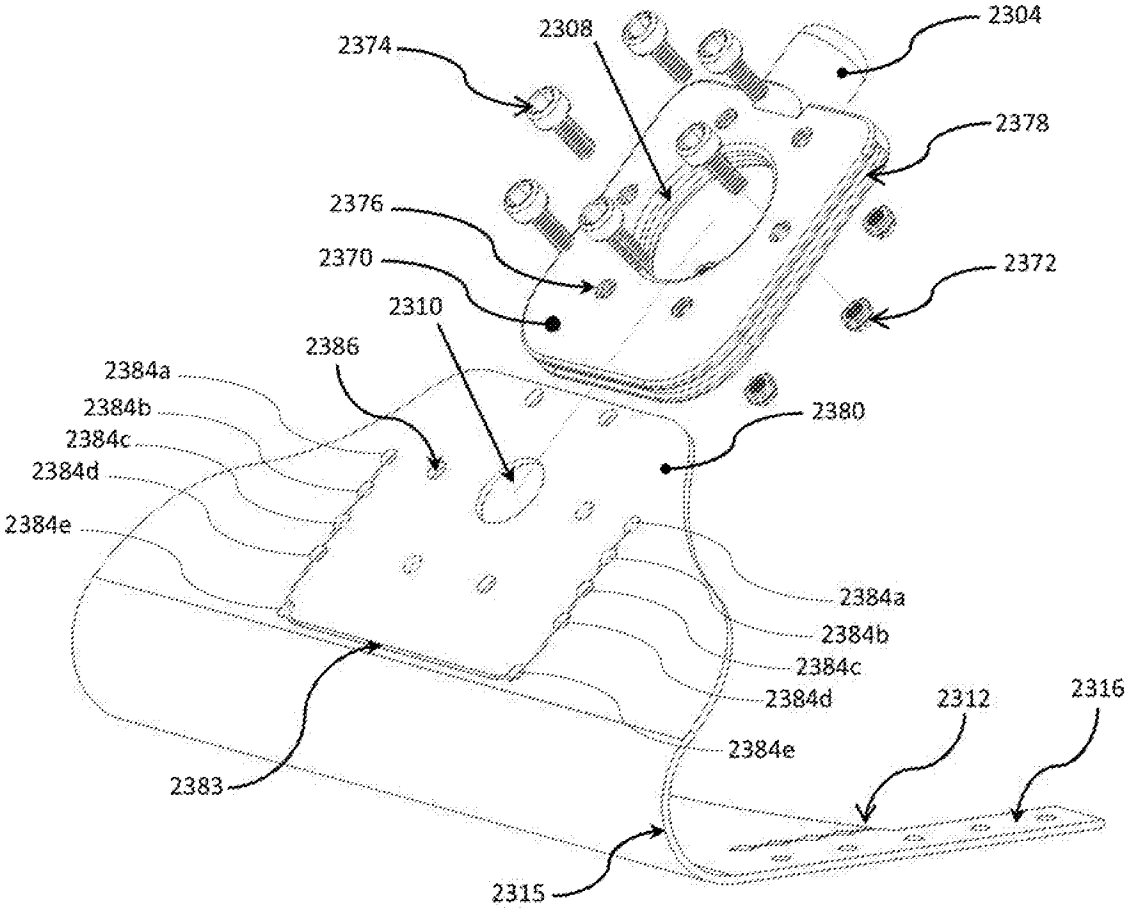
Figure 23B:
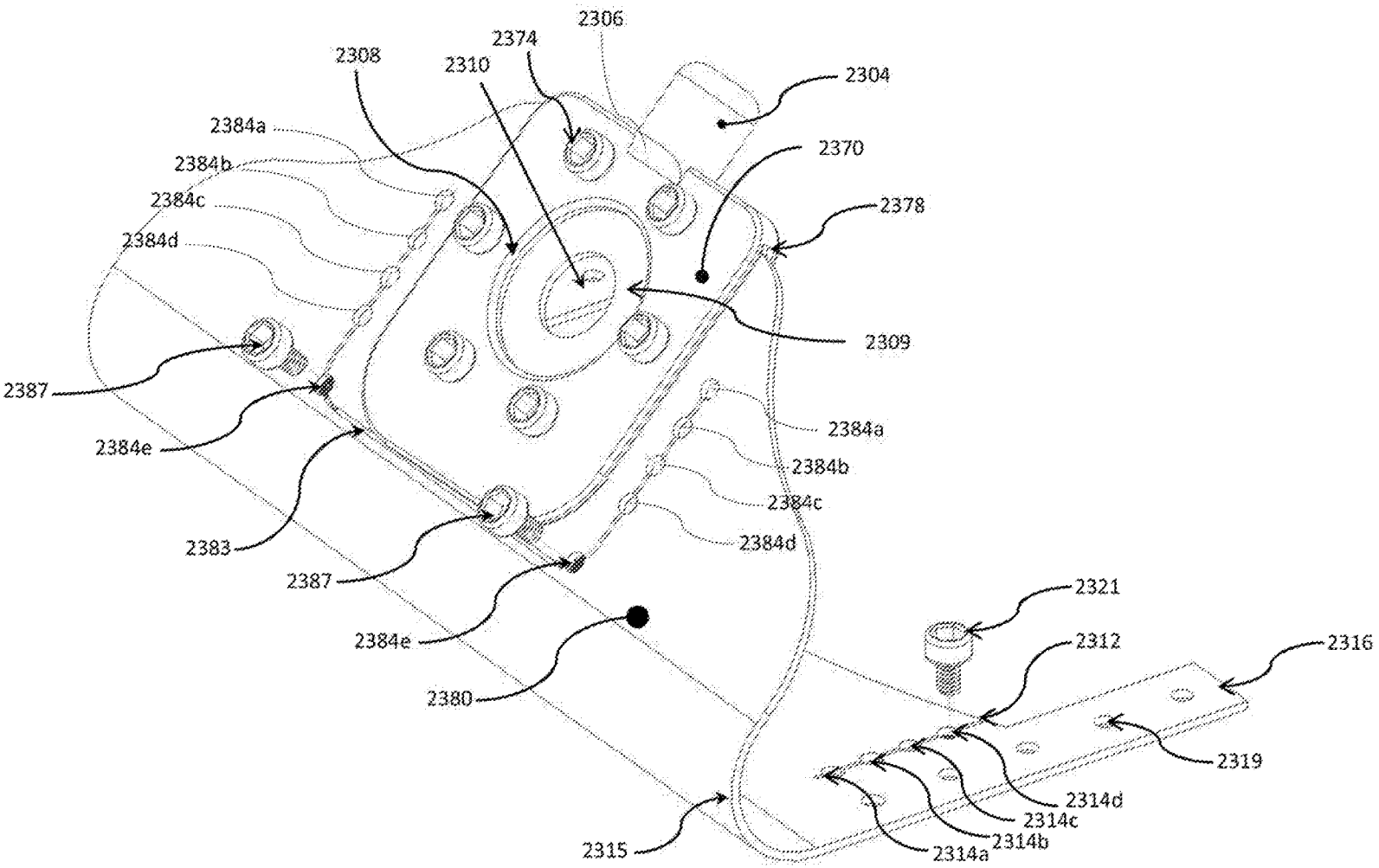
Figure 23C:
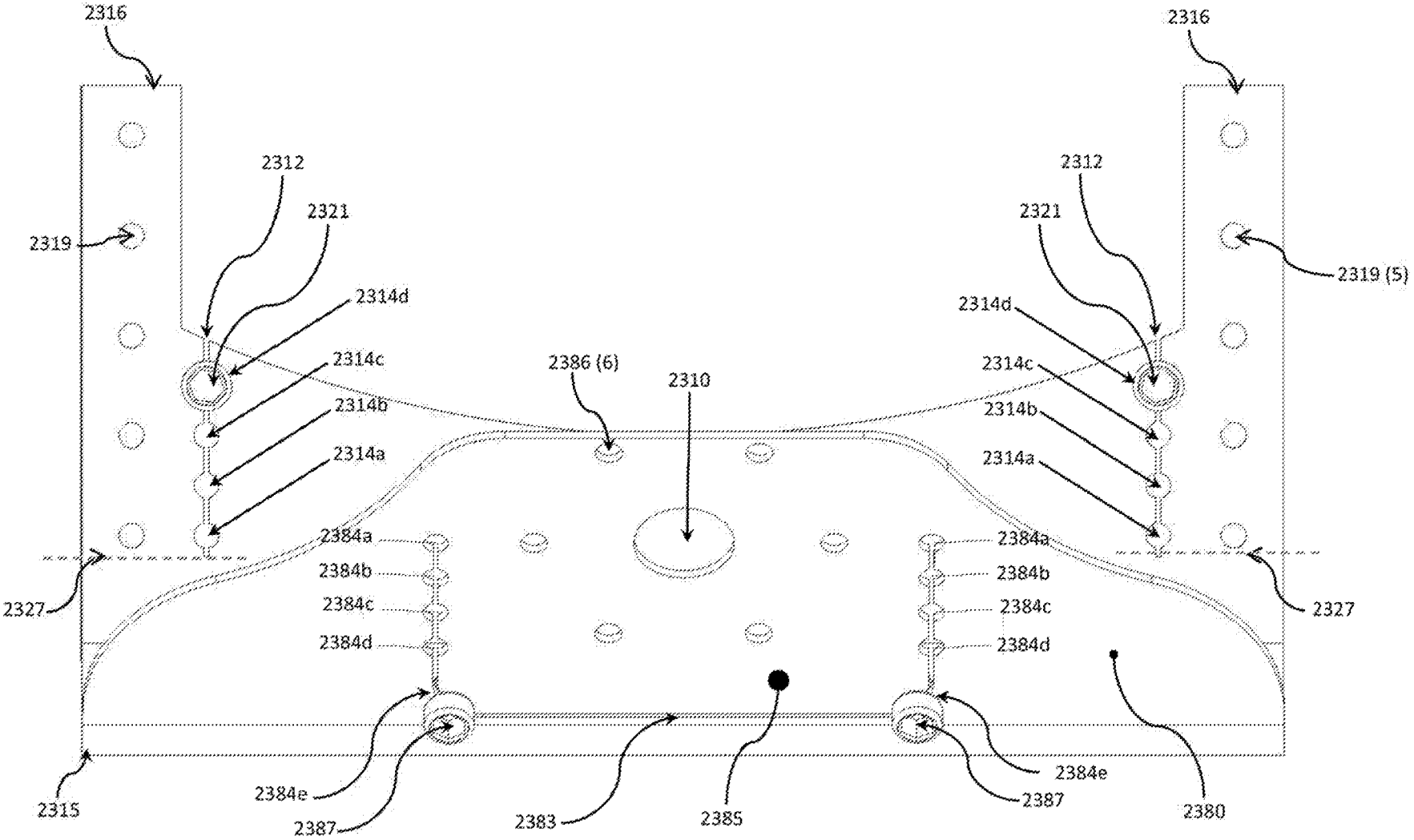
Figure 23D:
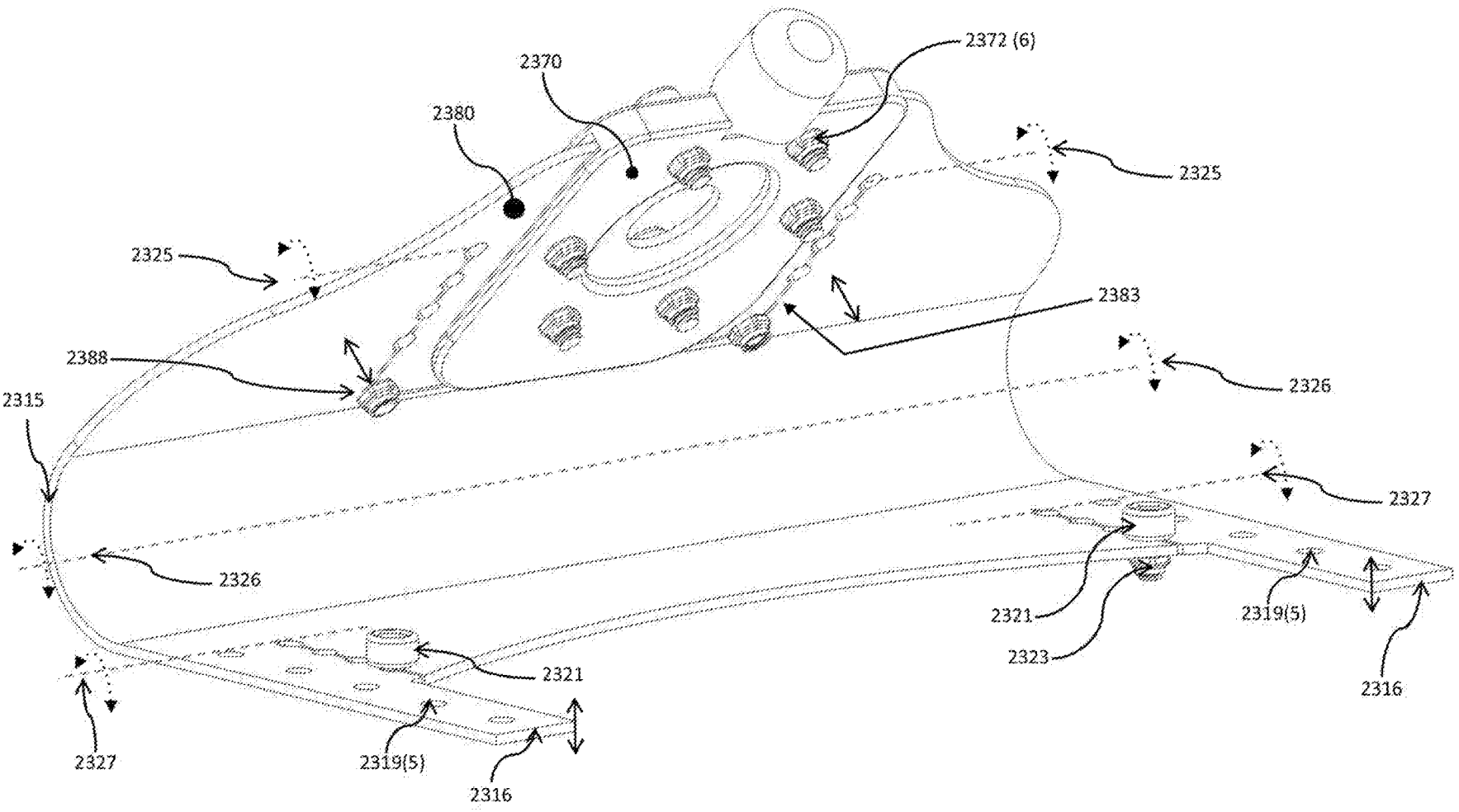
Figure 23E:
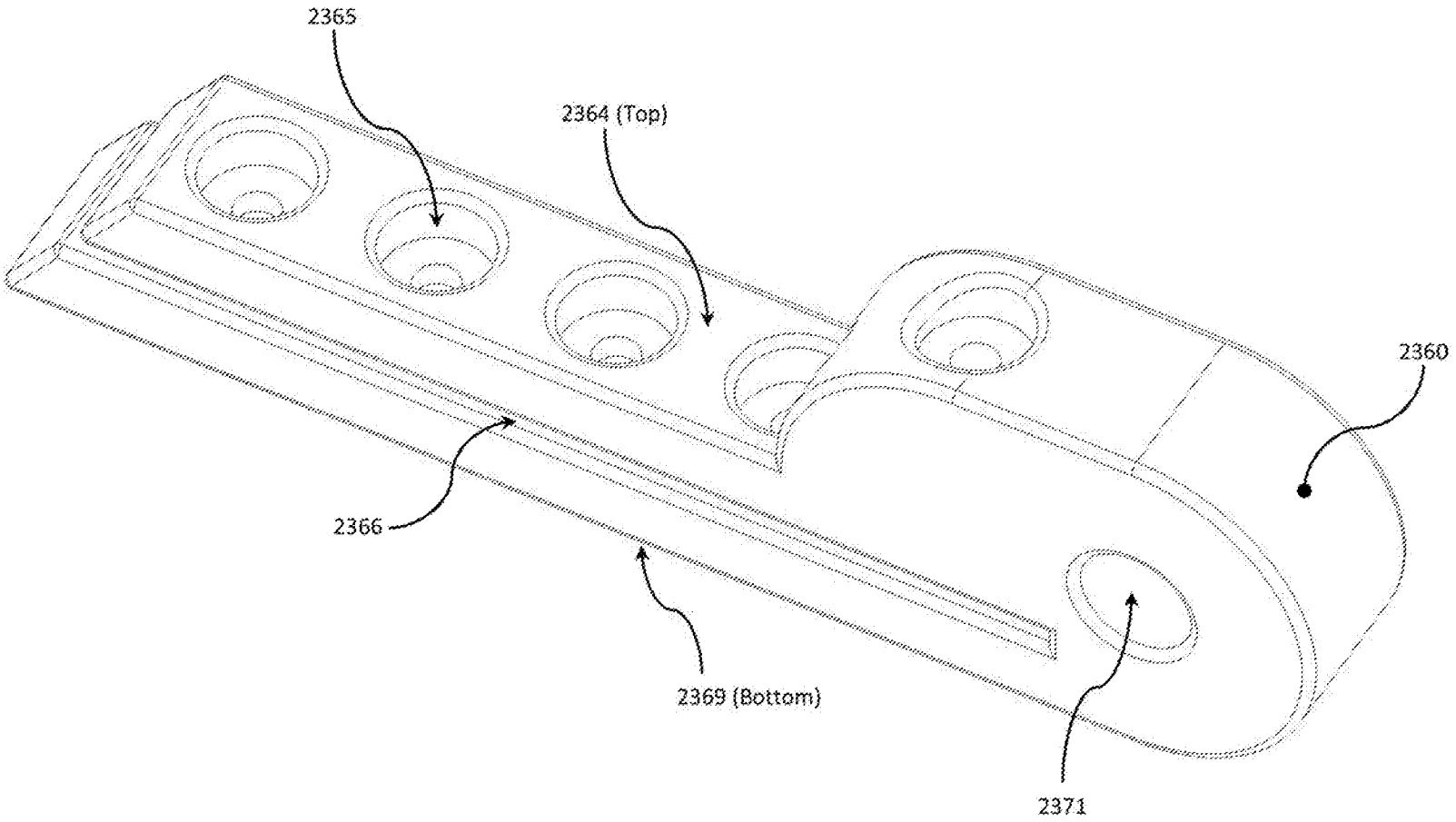
Figure 23F:
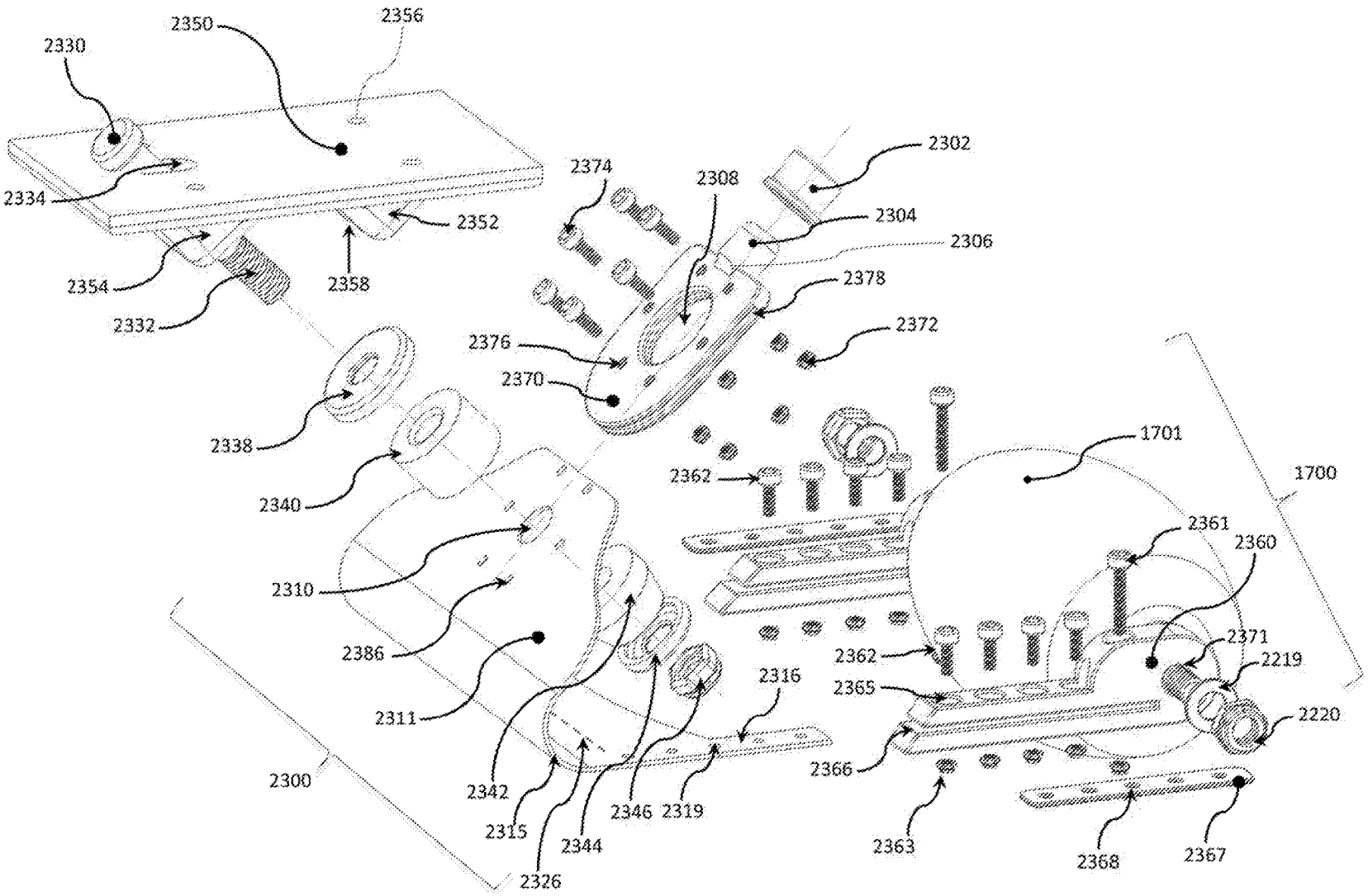
Figure 23G:
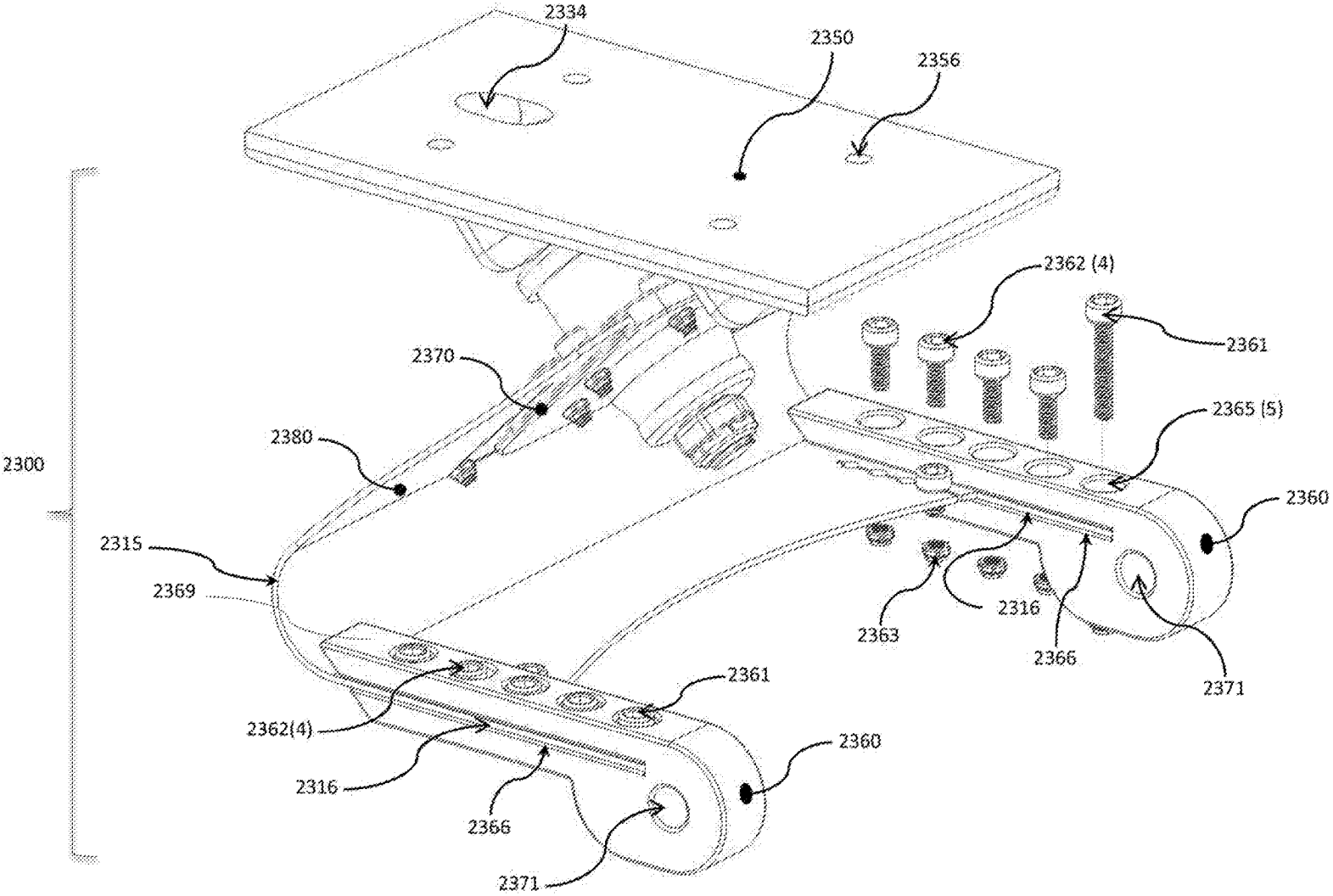
Figure 23H:
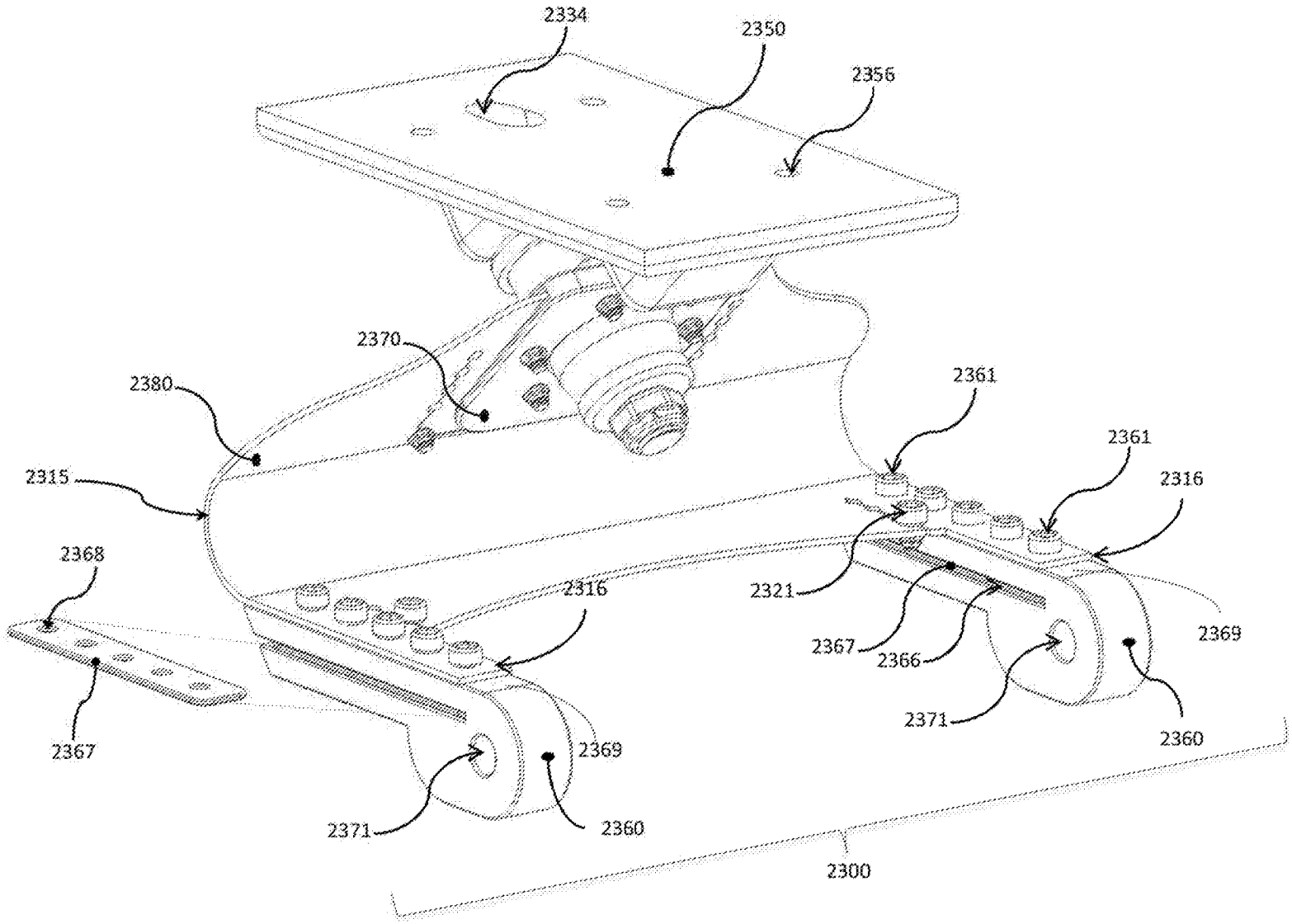
Figure 23I:
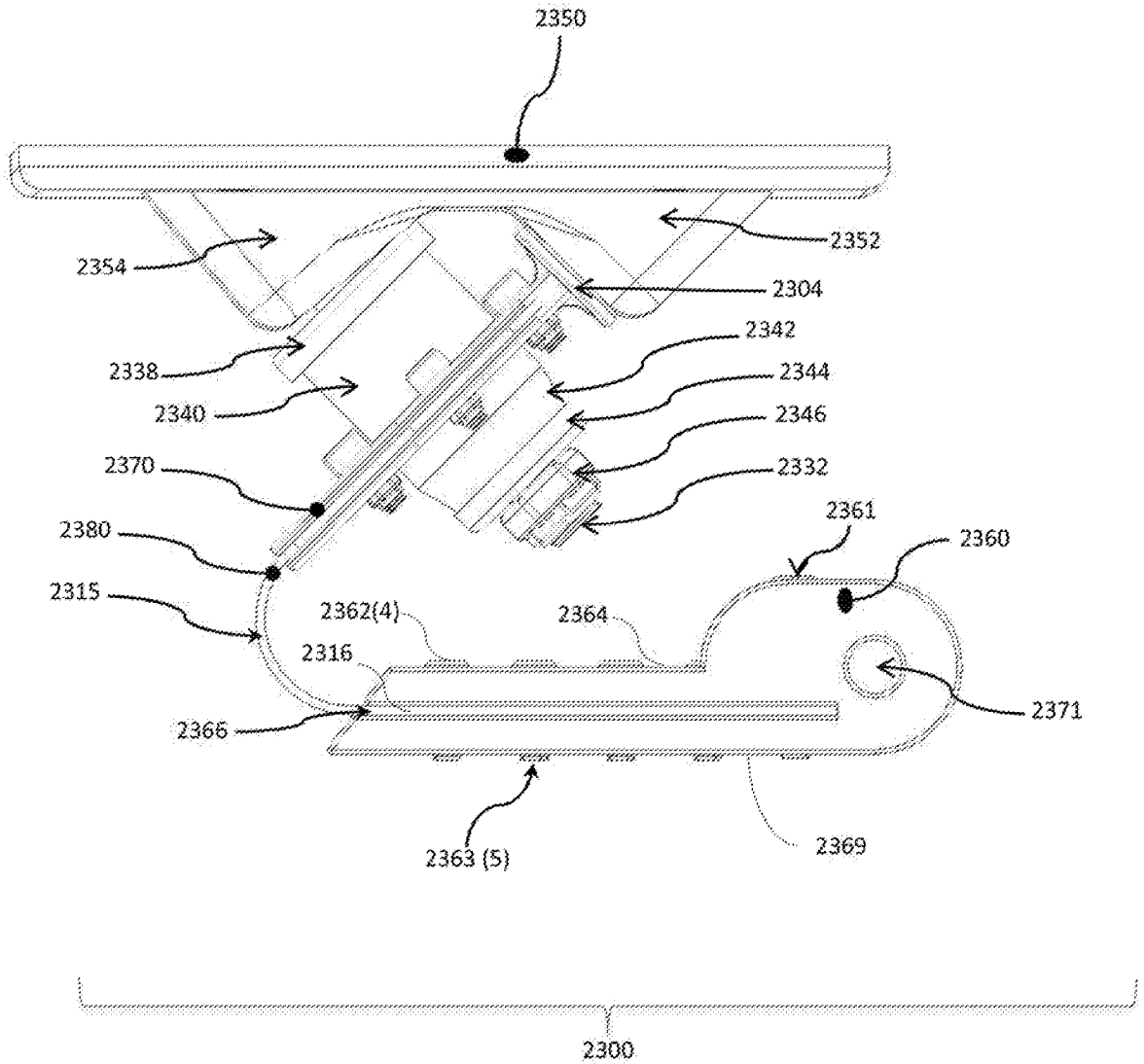
Figure 23J:
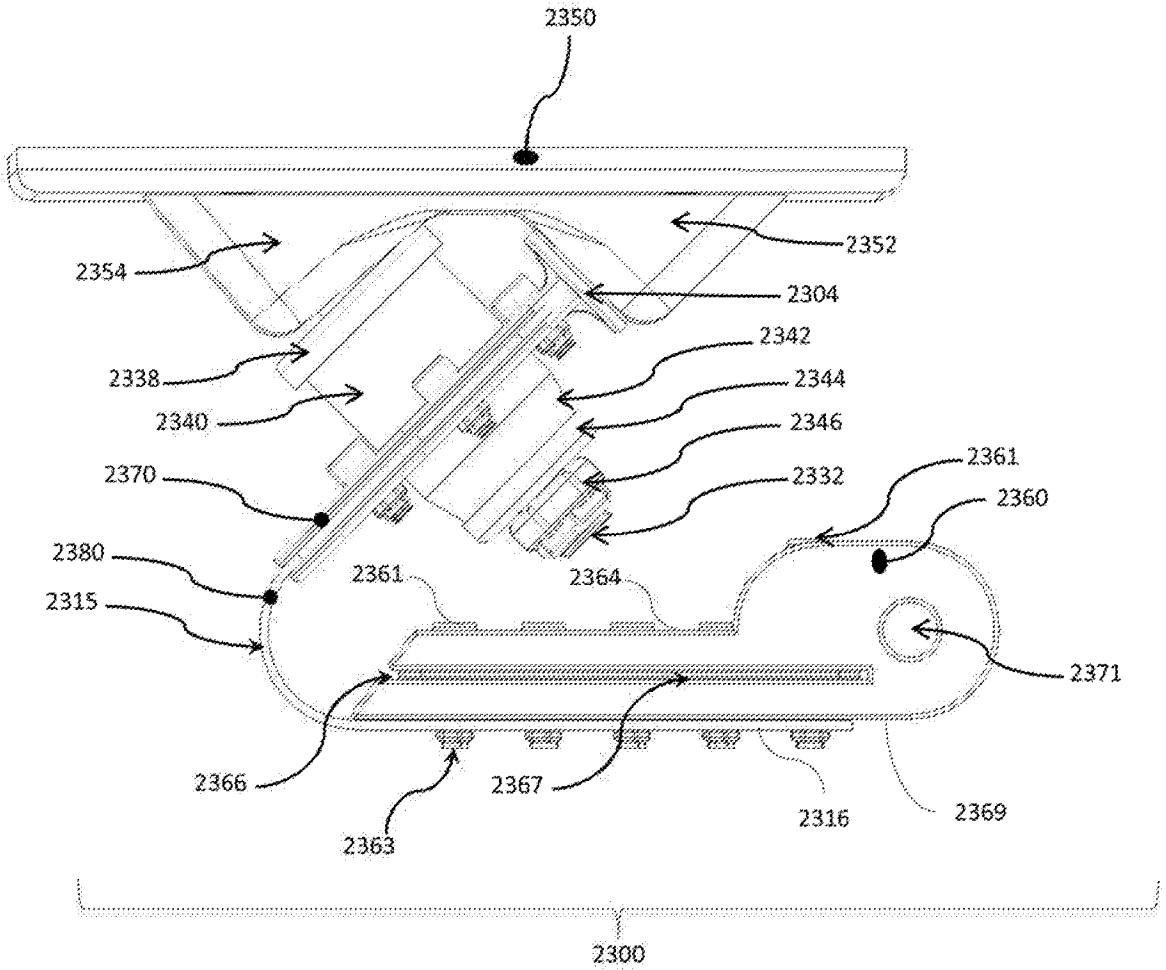
Figure 23K:
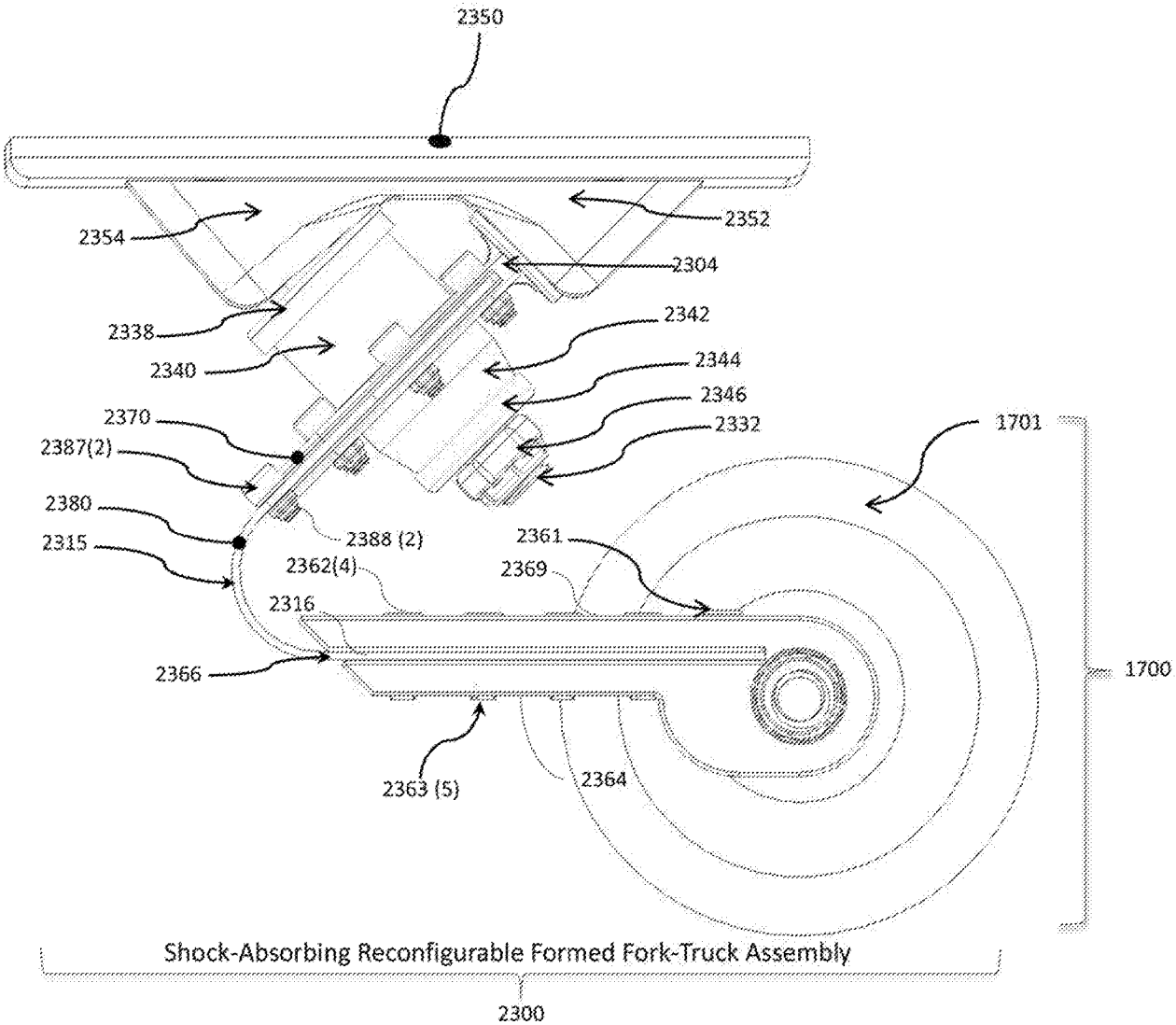
Figure 24A:
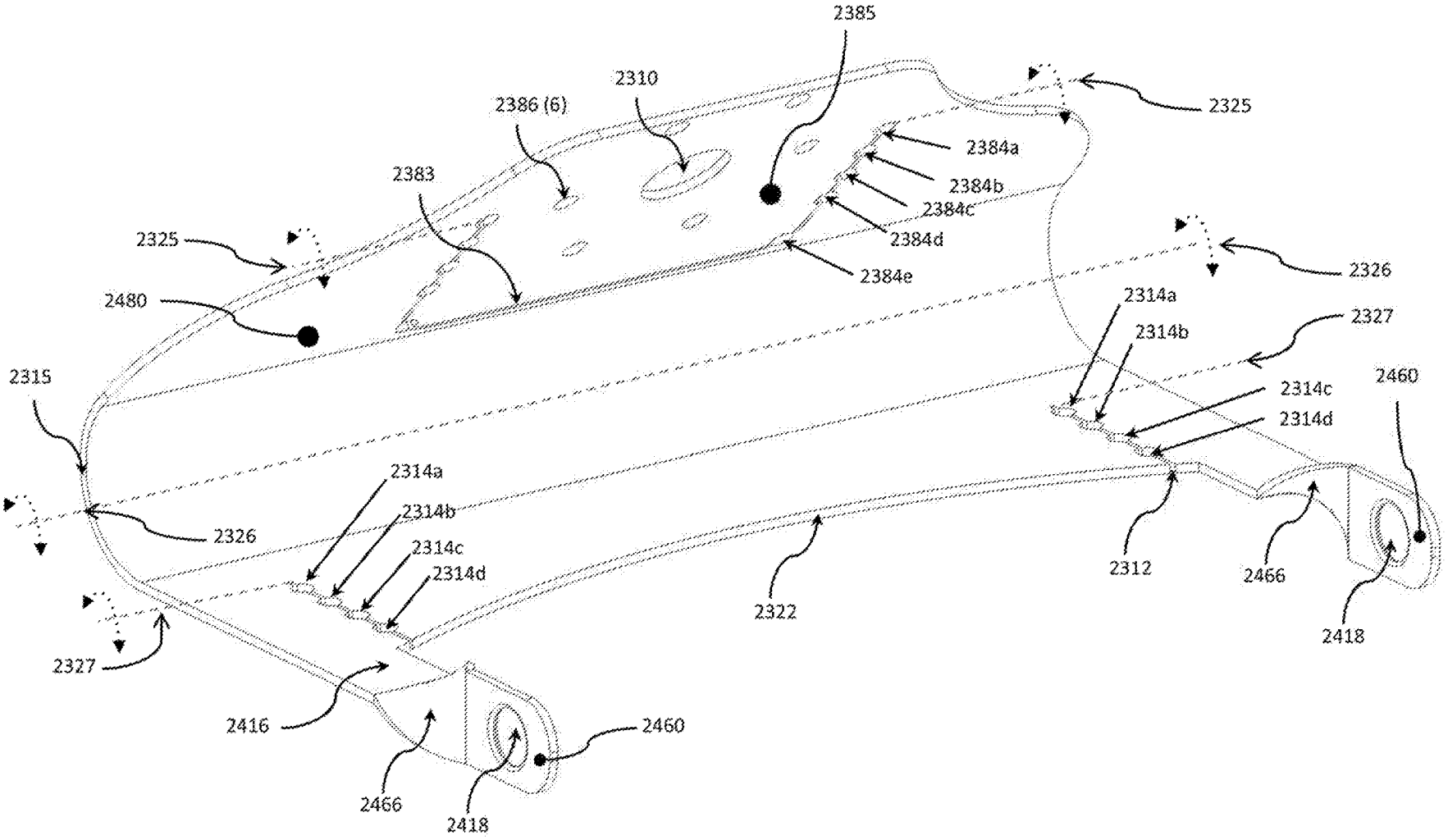
Figure 24B:
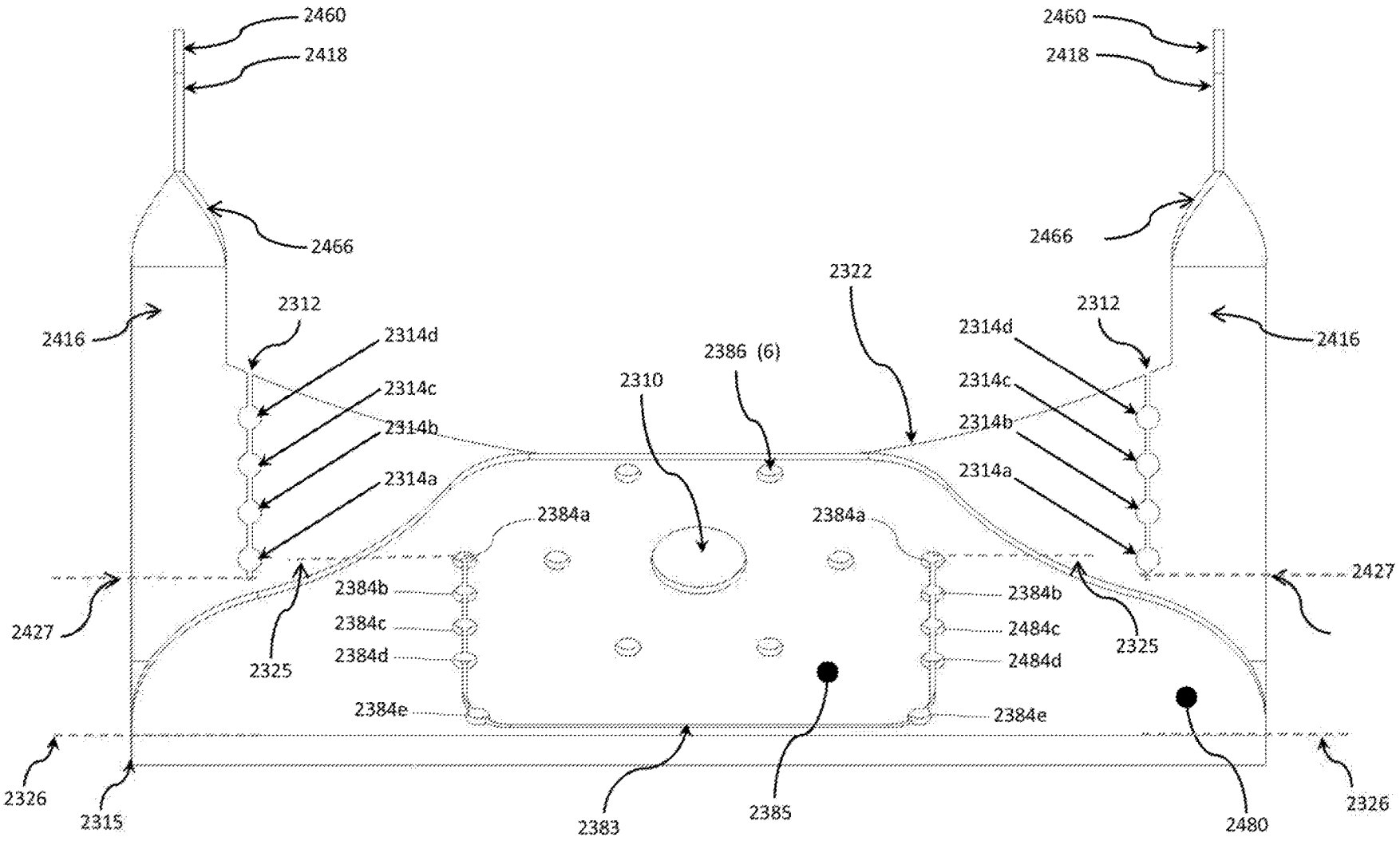
Figure 24C:
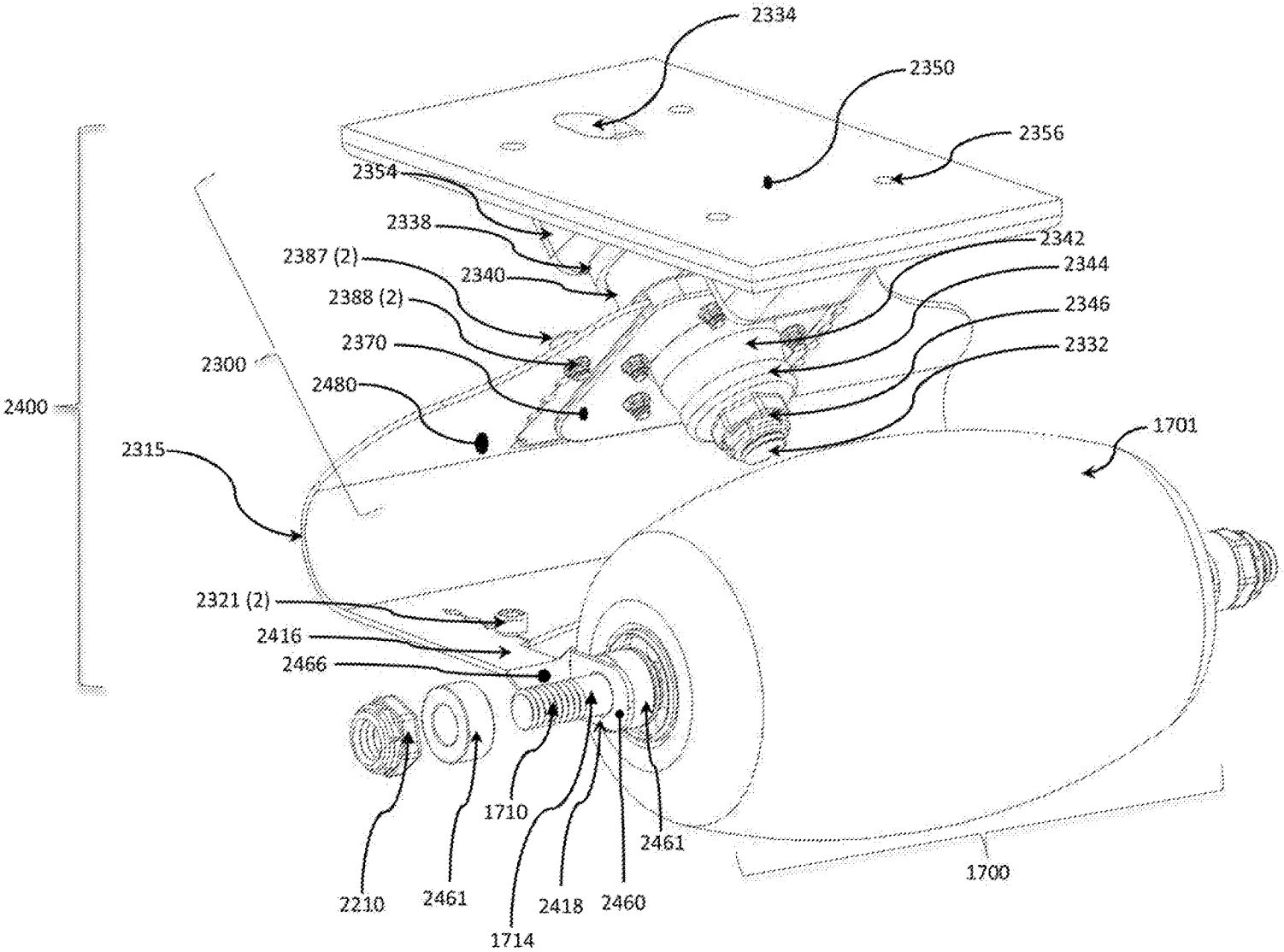
Figure 24D:
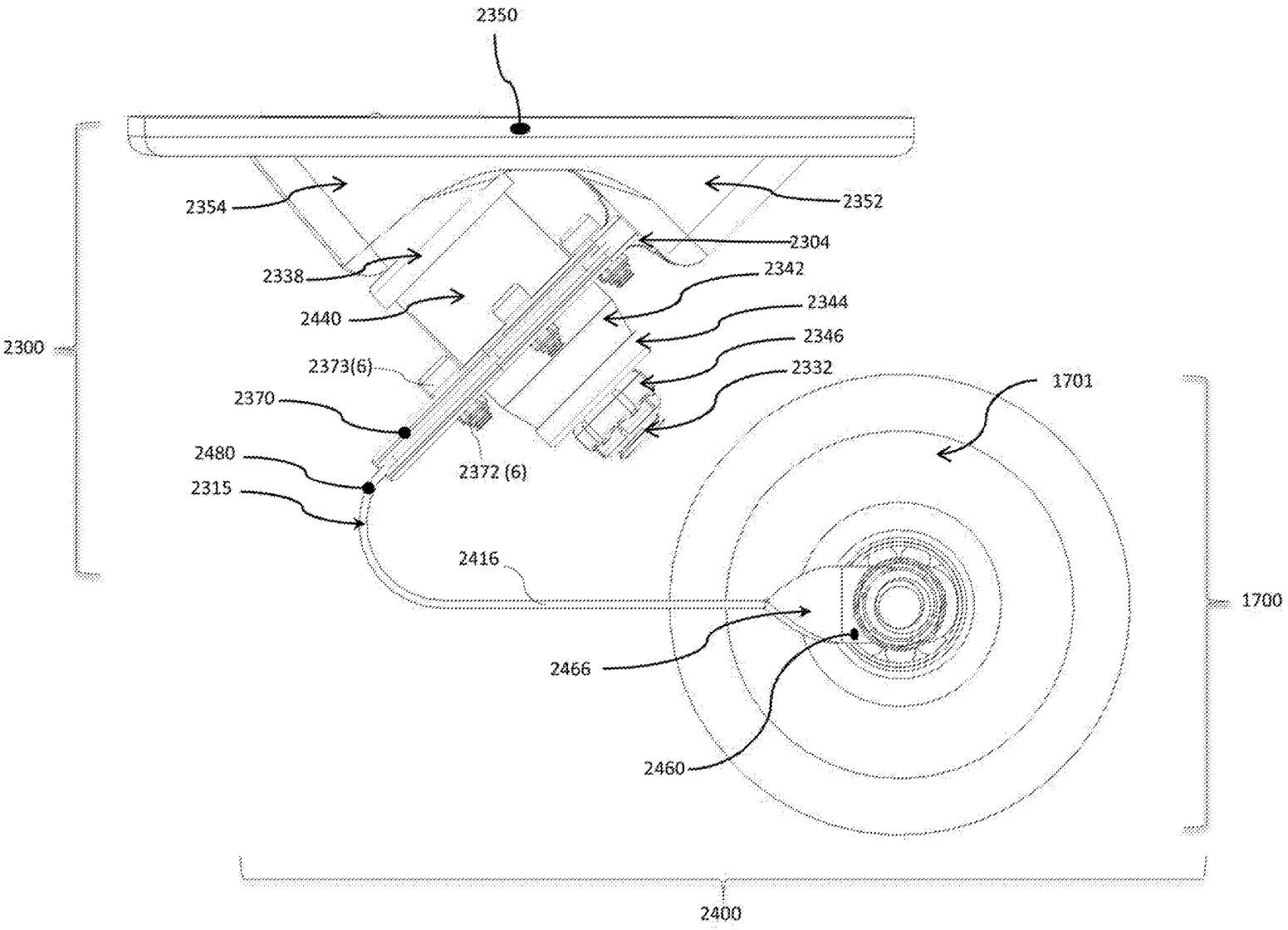

FIG. 18C showing an isometric view of the fully assembled dual shock-absorbing dual axle truck assembly mounted onto the skateboard deck;

FIG. 19A is a view of a skateboard tread;

FIG. 19B is an expanded isometric view of the components of the tread drive hub assembly:

FIG. 19C is a partially expanded isometric view of the tread-drive dual-fork truck assembly;

FIG. 19D is an elevated side view of the tread-drive dual-fork truck assembly:

FIG. 19E this side view of a skateboard truck with attached monolithic axel-hub fork-truck assembly front and rear and both supporting the dual shock-absorbing dual-fork tines and the tread-drive dual-fork truck assembly and tread;

FIG. 19F this side view showing a skateboard with the rear monolithic axel-hub fork-truck assembly and the front with the fork hub-adapter truck assembly with both having the dual shock-absorbing dual-fork tines and the tread-drive dual-fork truck assembly and tread;

FIG. 19G this side view showing a skateboard with the rear monolithic axel-hub fork-truck assembly with the dual shock-absorbing dual-fork tines and the front with the fork hub-adapter truck assembly and the solid dual fork tine with both having the tread-drive dual-fork truck assembly and tread:

FIG. 19H this side view of a skateboard with a hybrid configuration showing the tread-drive dual-fork truck assembly with tread in the rear and the dual shock-absorbing dual-fork assembly with wheels in the front;

FIG. 20A, the forward isometric view, showing a solid monolithic hanger with a threaded-hole that functions as a seat for the adjustable threaded pivot pin;

FIG. 20B shows an isometric view of the solid monolithic hanger and the kingpin suspension system;

FIG. 20C shows the base plate attached to the components in FIG. 20B;

FIG. 20D is a review of the wheel axel assembly and wheel;

FIG. 20E is an isometric view of the assembled wheel assembly;

FIG. 20F is an isometric view of the complete truck assembly;

FIG. 21A is an isometric view of a simple reconfigurable hanger system with bolts;

FIG. 21B is an isometric view of a simple reconfigurable hanger system with double ended lag bolts;

FIG. 21C is a side view of the simple reconfigurable hanger system;

FIG. 21D is an upper view of the simple reconfigurable hanger system;

FIG. 21E is an isometric over view of a completed reconfigurable skateboard fork hanger truck assembly;

FIG. 22A is view of a monolithic reconfigurable fork hanger;

FIG. 22B is an expanded isometric view of the monolithic reconfigurable fork hanger and full complement of parts;

FIG. 22C is an expanded isometric view of the monolithic reconfigurable fork hanger with the hanger arms;

FIG. 22D is a partially expanded view of components that will form a complete reconfigurable skateboard fork hanger truck assembly;

FIG. 22E is an assembled isometric view of the reconfigurable skateboard fork truck assembly;

FIG. 22F is an assembled isometric view of the reconfigurable skateboard fork truck assembly, in the normal riding configuration;

FIG. 23A is an isometric view of a formed fork banger with integrated leaf spring shock absorbing action;

FIG. 23B is an isometric view of the assembled formed fork hanger and hanger yoke;

FIG. 23C is a top view of the formed fork hanger showing the U-channel leaf spring formed by the U-channel cutout;

FIG. 23D is a forward off-axis view of the formed fork hanger and hanger yoke, showing the pivot points of the leaf springs;

FIG. 23E is a fork arm with all axel through-hole;

FIG. 23F shows a rear off-axis expanded view of all components used to make up the reconfigurable shock-absorbing fork-truck assembly;

FIG. 23G is an isometric view of a fork arm configuration that has the leaf spring fork arm slid into the fork arm slot;

FIG. 23H is an off-axis view of a specific fork arm configuration to illustrate tile use of the spacer;

FIG. 23I is a side view of another configuration that raises the wheel closer to the skateboard and creates a more stable ride;

FIG. 23J is the side view of a configuration showing the fork arm mounted on top of the leaf spring fork arm with the spacer inserted into the fork arm slot;

FIG. 23K is a side view of the assembled shock-absorbing reconfigurable fork-truck assembly with the wheel axel assembly and the wheel;

FIG. 24A is an elevated off-axis view of a formed fork hanger with an integrated axel through-hole;

FIG. 24B is a top view of the formed fork hanger with an integrated axel through-hole and multiple leaf springs with their respective pivot points;

FIG. 24C is an isometric view of an assembled shock absorbing formed truck assembly with a partially assembled wheel axel assembly and a wheel; and FIG. 24D is a side view of the colnpleted shock absorbing formed truck assembly.

DETAILED DESCRIPTION

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6, Please note, if used, the labels left, right, front, back, top, bottom, forward, reverse, clockwise and counter clockwise have been used for convenience purposes only and are not intended to imply any particular fixed direction.

Figure 1:
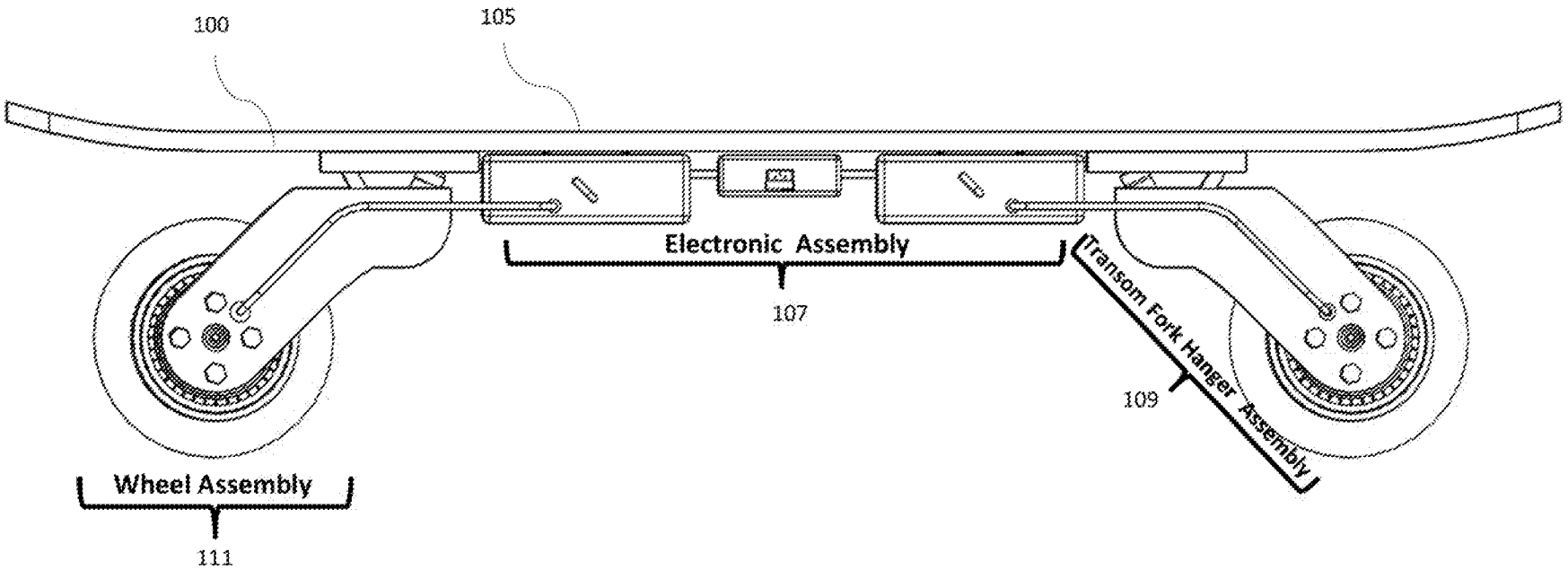
FIG. 1 is a side perspective view of the assembled skateboard with motorized and non-motorized wheel assemblies.

Instead, they are used to reflect relative locations and/or directions between various portions of an object The present invention is exemplified by three principle configurations. The first of these, shown in FIG. 1, is a side view showing the basic components of the motorized skateboard. This view shows a typical skateboard deck 100 and a skateboard deck skin 105 that provide a good foothold for the rid, r. Along with the skateboard deck 100, there are the electrical components that form the electronic assembly 107 attached to the underside of the skateboard deck 100. Illustrated in FIG. 1, are the transom fork hanger assembly 109 and its relation to the skateboard deck 100 and electronic assembly 107. Attached to the skateboard transom fork hanger assembly 109 is the notarized wheel or non-motorized wheel assembly 111. A general view of the skateboard is shown to give some perspective for the range of sizes that this invention will be addressing.

Figure 2:
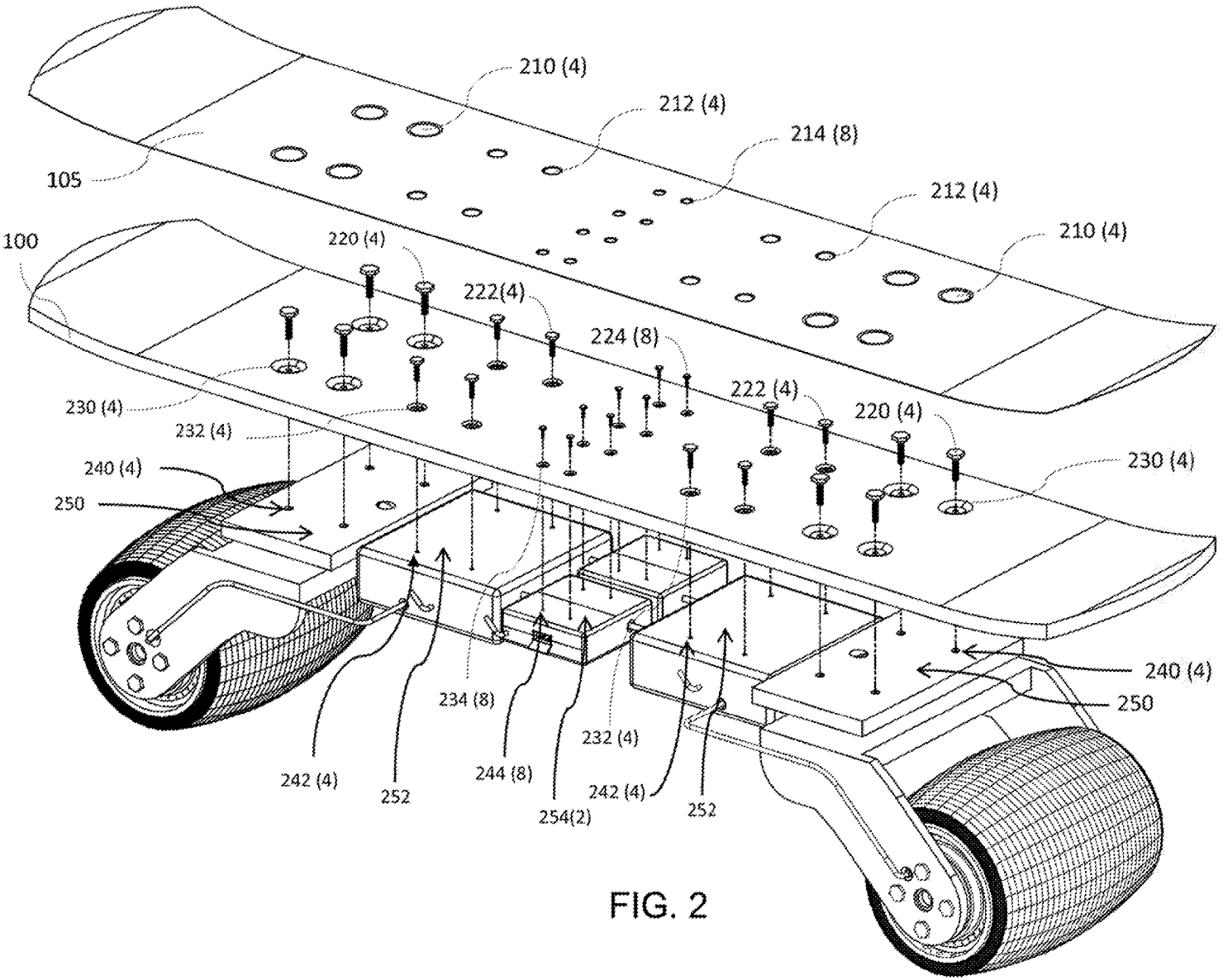
FIG. 2 is an expanded isometric view of FIG. 1 of the skateboard deck and the fastening components illustrating the method of attachment of the electronic assembly, transom-fork hanger assembly and the wheel assembly.

FIG. 2 is an expanded isometric view of the skateboard deck 100 components and illustrates the method of attachment The skateboard deck skin 105 is made from sandpaper-like material. There are through-holes cut into the skateboard deck skin 105. These through-holes are 210, 212, and 214. The chamfered through-holes 230, 232, and 234 in the skateboard deck 100 allow skateboard components to be fastened to it, the skateboard deck 100. The skateboard deck skin 105 with the through-holes 210, 212, and 214 allows access of the component fasteners 220, 222, and 224 without removal of the skateboard deck skin 105. The skateboard deck skin 105 is not required to have through-holes. However, assembling and reconfiguring components of the skateboard deck 100 is greatly facilitated by having the through-holes 210, 212, and 214. Component fasteners 220 pass through the chamfered through-holes 230 in the skateboard deck 100 and attach to baseplate 250 by engaging threaded-holes 240. The next set of component fasteners are 222, which pass through the chamfered through-holes 232 in the skateboard deck 100 and hold the batter compartments 252 by engaging threaded-holes 242. Component fasteners 224 pass through the chamfered through-holes 234 in the skateboard deck 100, and hold the electronic control boxes 254 by engaging threaded-holes 244. This forms a secure and effective placement of the electronic components required for the motorized skateboard operation.

Figure 3:
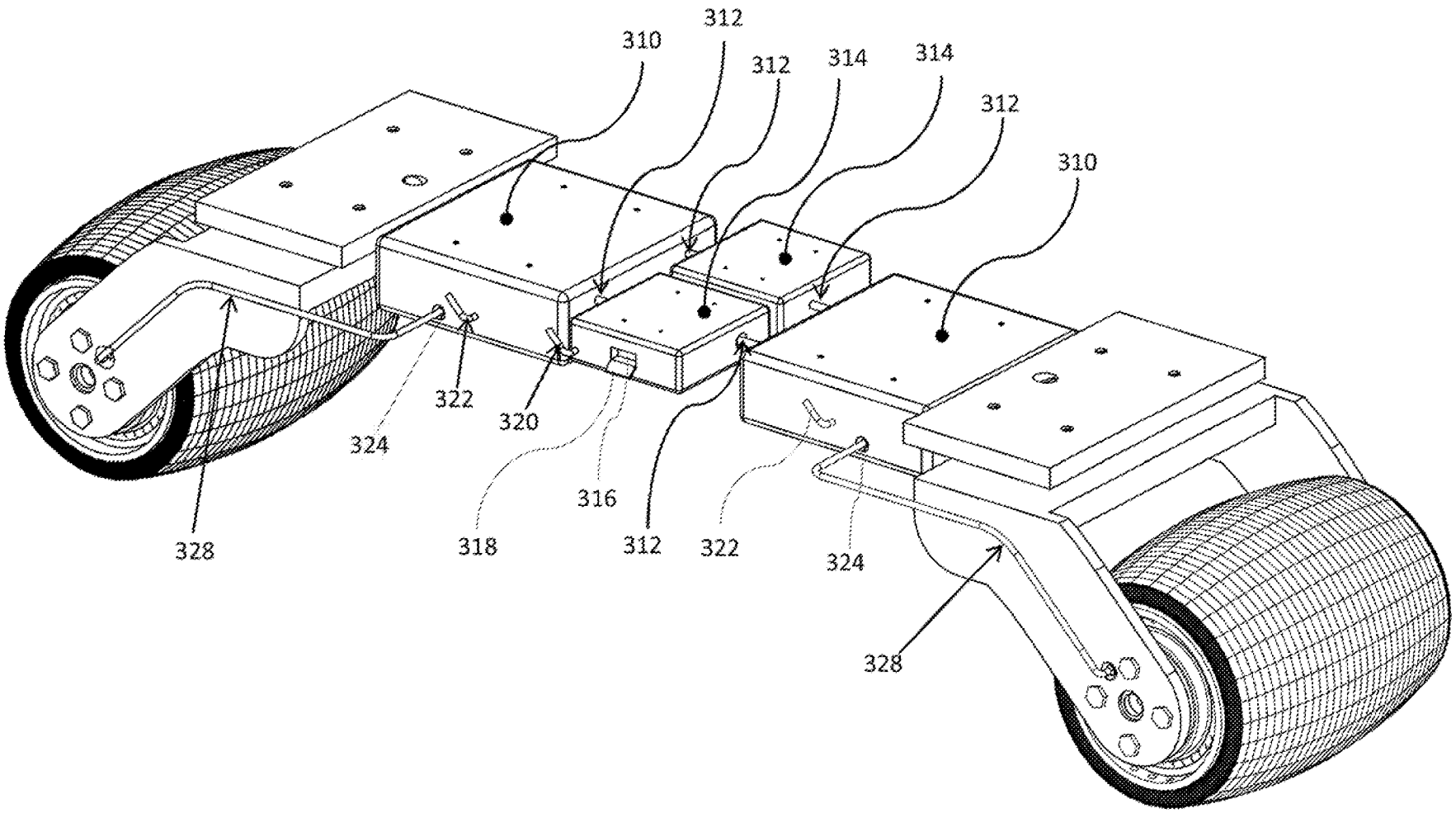
FIG. 3 shows the basic electrical configuration of the components of the electronic assembly attached to the skateboard.

FIG. 3 shows the basic electronic assembly 107 as it would be attached to the underside of the skateboard deck 100 as seen in FIG. 2. The battery compartment, formerly 252, is now referred to as battery compartment 310. The battery compartment 310 provides a secure holding compartment for the lithium ion and/or lithium phosphate batteries that are typically used to power various electrical motors. There may be several batteries that are stored in one of the two battery compartments 310. There is a battery engagement switch 322, which allows selection of a single battery or multiple batteries to be engaged. The power from the battery compartments 310 is fed through the electrical conduit through-hole 324. The electrical current is carried via wires that are conveniently stowed in the electrical conduit 328—The electrical control boxes 314, formerly known as electrical control boxes 254 in FIG. 2, contains the electrical charging circuitry, remote control for power application to the motors, and smart charging chips for properly monitoring battery discharge and charging. This is an essential part of any remote control power application to prevent the batteries from overheating and catching fire if they are charging or discharging too quickly. Various commercial charging circuits and remote control circuits will be housed in electrical control boxes 314, and their functions are controlled with the electronic function controller switch 320. There is a connection between the electronic control boxes 314 and the battery compartments 310 via an electrical conduit 312. This provides an adequate environment for keeping the electronics free of water and dust contamination, Electrical connector 316 is provided for both AC and DC charging. An environmental cover plate 318 also secures the power connection from exposures to the elements.

Figure 4A:
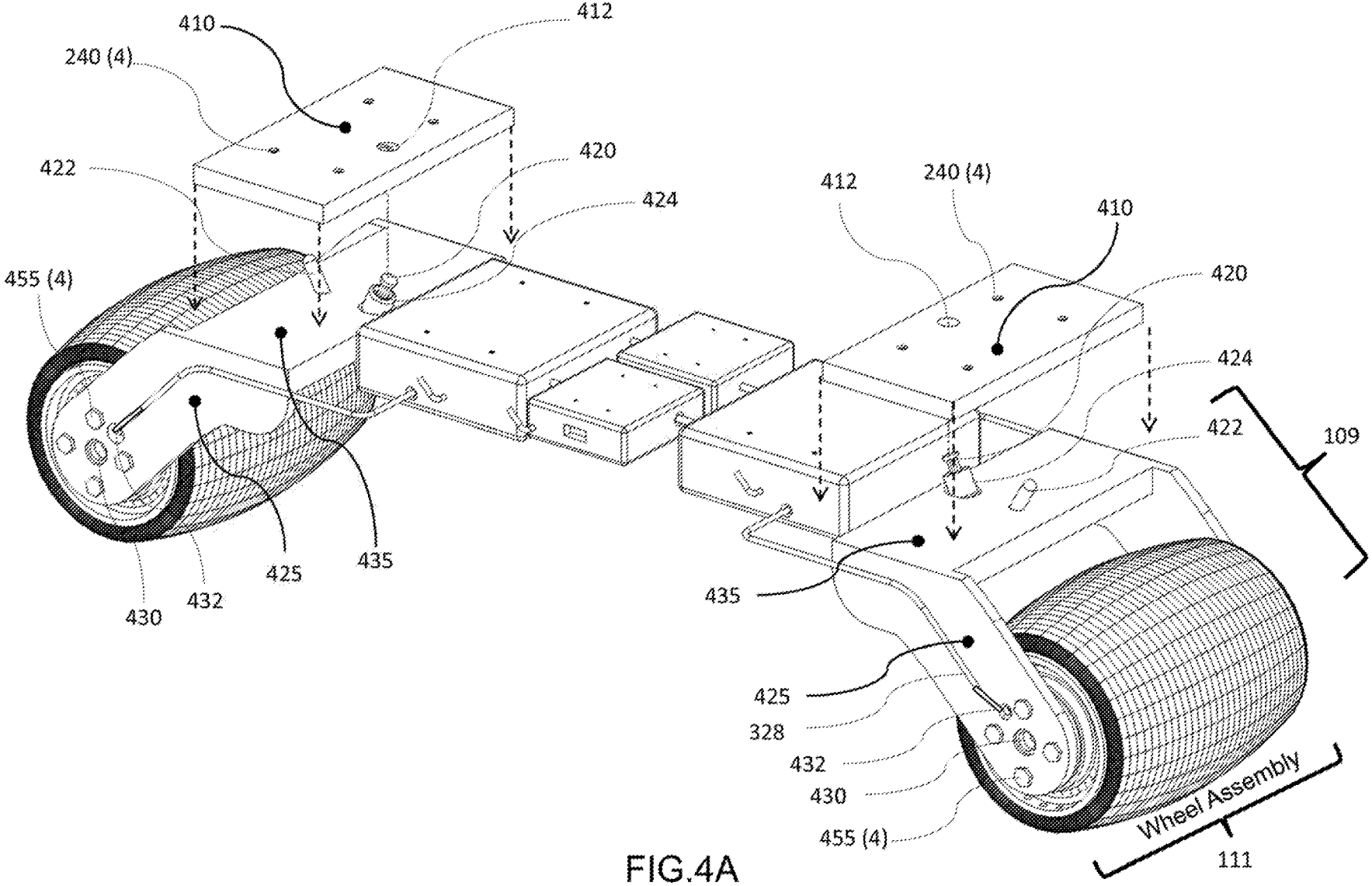
FIG. 4A is a view of the basic elements that are mechanically attached to the underside of a skateboard deck that form the transom-fork hanger assembly and the wheel assembly.

FIG. 4A shows the basic elements that are mechanically attached to the skateboard deck 100 as seen in FIG. 2, mainly the attachment of the baseplate 410, formally known as baseplate 250 in FIG. 2. The baseplate 410 is attached to the skateboard deck 100 (not shown; see FIG. 2) with a component fastener 220 that screws into threaded receptacle 240. This secures the baseplate 410 to the skateboard deck 100 (not shown, see FIG. 2). The transom plate 435 is attached to the fork hanger 425, In this case, the invention shows that the transom plate 435 is a unique method for attaching motorized and non-motorized skateboard single wheel assemblies 111. The fork hanger 425 also provides a means of transitioning the electrical wires through the electrical conduit 328 through electrical conduit through-hole 432. The wheel assembly 111 is attached to the fork hanger 425 via mounting bolts 455.

The transom plate 435 is similar to current skateboard assemblies and uses the same components such as the skateboard kingpin 420, the top bushing 424, and the pivot pin 422. The baseplate 410 provides the kingpin through-hole 412 for the kingpin 420 to fit through and to secure the baseplate 410 to the transom plate 435, The transom fork hanger assembly 109, for future reference, is going to include the transom plate 435 and the fork hanger 425.

FIG. 48 is a side cross-sectional view of the transom plate 435, the base plate 410, the kingpin 420, the pivot pin 422, top-busing/s 424, bottom-bushing 426, bottom-bushing washer 427, and the kingpin locking-nut 428. This view also shows the side view of the fork hanger 425.

In this cross-section view the location of the pivot pin 422 and the resilient pivot pin cup 404 are shown. These structures are made of metal or plastic or a combination. A metal injection, casting, and other molding processes typically make common skateboard hangers, Some newer skateboard hangers are made from composite material. It is assumed that the injection molding process or other metal or plastic forming processes make the skateboard transom fork hanger assembly 109 in one piece.

Figure 4B:
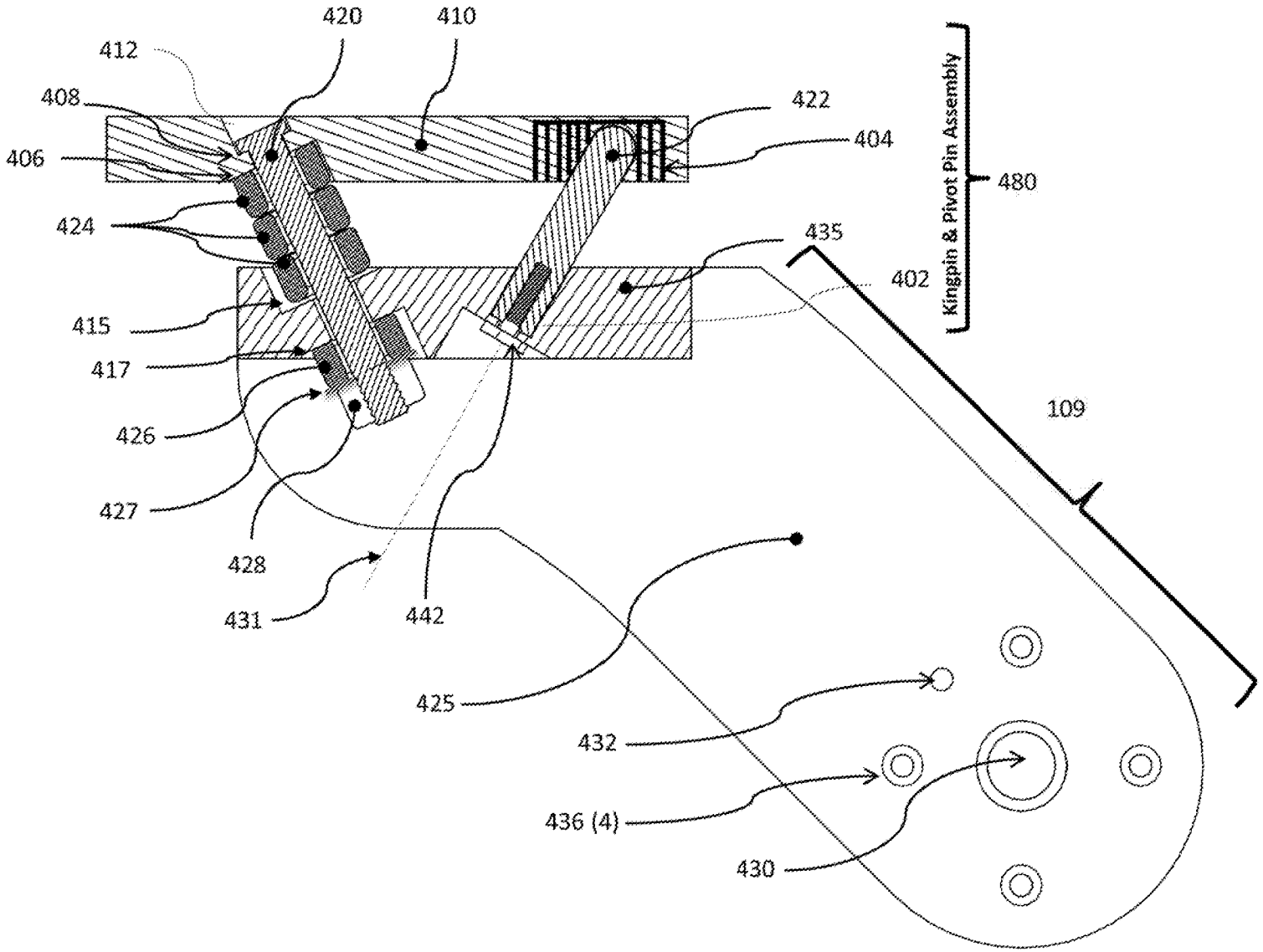
FIG. 4B is a side cross-sectional view of the base plate, transom plate, the kingpin, the pivot pin, top-busing.is, bottom-bushing, bottom-bushing washer and the locking nut all elements that form the transom-fork hanger assembly and the kingpin and pivot pin assembly.

This view FIG. 4B shows the baseplate 410 with the skateboard kingpin 420 inserted into the kingpin through-hole 412. The skateboard kingpin 420 is stopped and held in place at the kingpin counter-bore stop 408. On the underside of the baseplate 410 is the top-bushing interaction surface 406 that holds the top-bushing/s 424 firmly in place. Depending on the length of the pivot pin 422 and turning requirements, more top-bushings 424 are required. The resiliency of top-bushings 424 and bottom-bushing 426, and with the open flat space provided by the bushing interaction surfaces 415 and 417, allows the transom fork hanger assembly 109 to freely slide and rotate about the pivot pin axis 431. The degree of pivoting about the pivot pin axis 431 is determined by how tight the kingpin locking-nut 428 compresses the top-bushings 424 and the bottom-bushings 426. The bottom-bushing washer 427 is the metal washer that the kingpin locking-nut 428 pushes onto for compression. It produces uniform compression on the top-bushings 424 and bottom-bushing 426 without distorting or tearing during compression. Also, the ease of rotation about the pivot pin axis 431 is determined by how much compression is applied to the kingpin locking-nut 428 and how smooth are the top-bushing interaction surface 406 and the bushing interaction surfaces 415 and 417. The pivot pin 422 is held firmly to the transom plate 435 by the pivot pin bolt 442, Also shown, the through-holes 436, which secure the wheel assembly 111, shown in FIG. 4A, to the fork hanger 425. The electrical conduit through-hole 432 allows the electrical wires to pass through the fork hanger 425 and mates to the motors contained within the wheel assembly 111 (not shown), Accessory through-hole 430 is for attaching accessories to monitor motor or wheel performance such as tachometers.

Figure 4C:
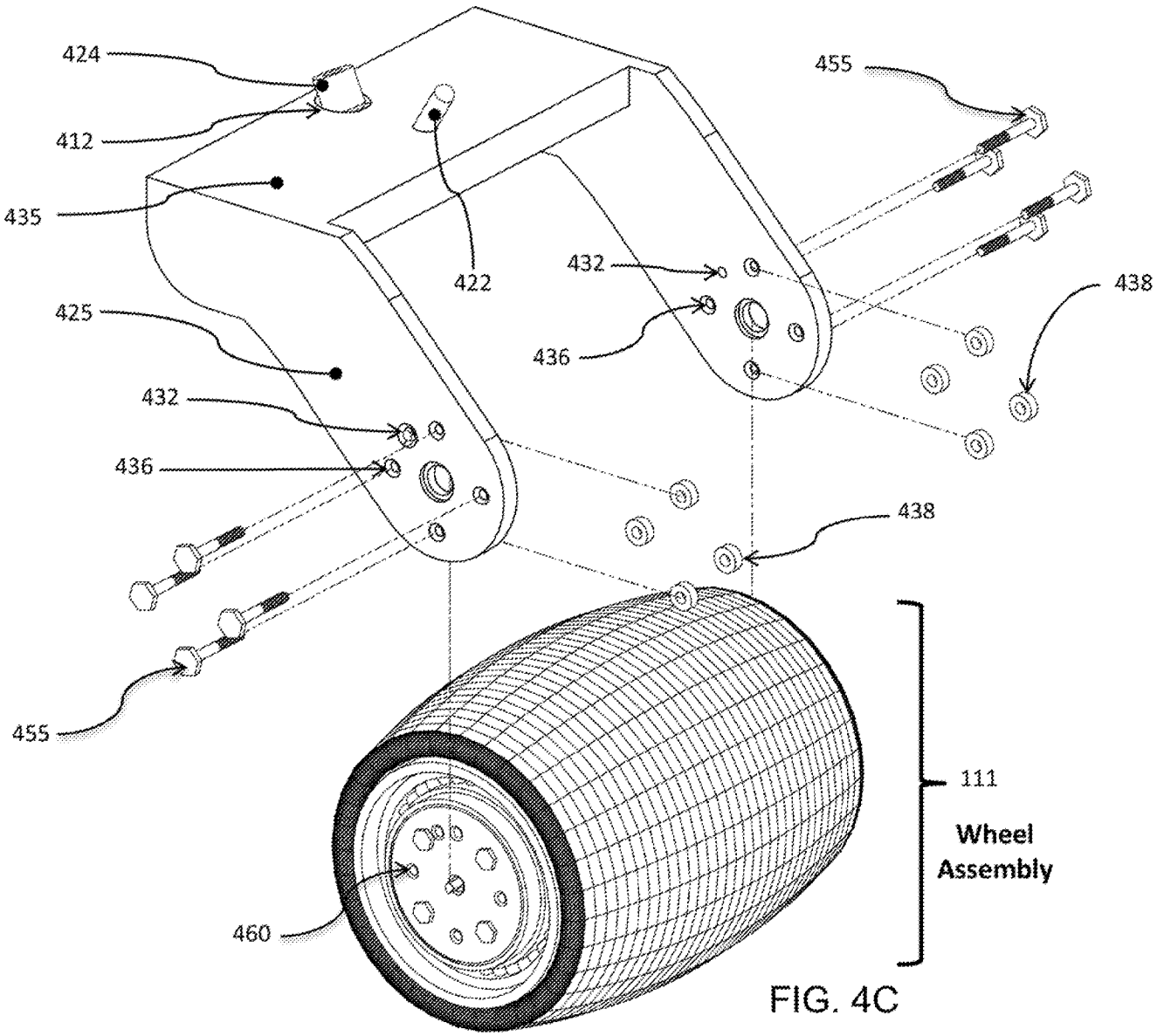
FIG. 4C shows an expanded isometric view of the fork hanger attached to the transom plate and the method of attachment of the wheel assembly.

FIG. 4C shows an expanded isometric view of the fork hanger 425 attached to the transom plate 435. Also shown is the method of attachment of the wheel assembly 111. The wheel assembly 111 is held in place by mounting bolts 455 that pass through through-holes 436, spacers 438, and secured to the threaded-holes 460. The spacers 438 provide proper spacing and alignment of the wheel assembly 111.

Figure 5A:
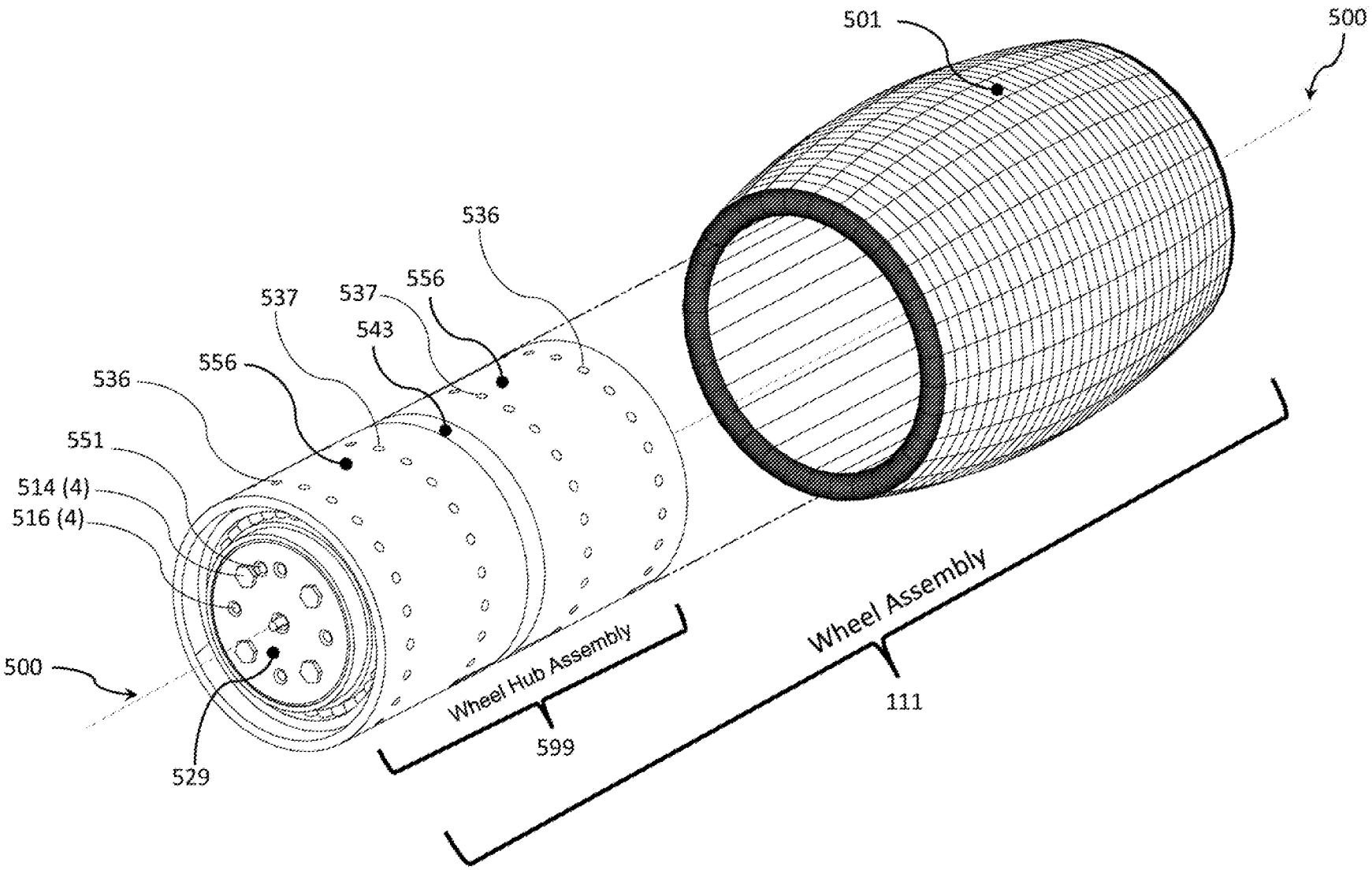
FIG. 5A is an expanded isometric view of the wheel assembly, which is comprised of the tire skin and two identical hubs, all of which comprise the wheel hub assembly.

FIG. 5A is an expanded isometric view of the wheel assembly 111. The wheel assembly 111 is made up of the tire skin 501 and two identical wheel hubs 556, which comprise the wheel hub assembly 599. All components rotate about the axis of rotation 500. The wheel hub assembly 599 is held in position to the fork hangers 425 and by mounting bolts 455, as shown in FIG. 4C. The mounting bolts 455 fit into the threaded-holes 516, which were threaded-holes 460 as shown in FIG. 4C. These threaded-holes 516 are actually on the motor hub face 529. The conduit through-hole 551 is for the electrical conduit 328 as shown in FIG. 4A, and is used to pass wires to the enclosed motors within the motor hub 510, Bolts 514 are used to secure the internal motors. On the periphery of the two wheel hubs 556 are rings of circles, outside bearing through-holes 536, and inside bearing through-holes 537, which are through-holes for epoxy or threaded through-holes for setscrews to attach internal components. Also shown in this view is a space 543 between the two wheel hubs 556.

FIG. 58 is an isometric cross sectional view of the wheel hub assembly 599. It is made up of two identical wheel hubs 556. These two wheel hubs 556 are bolted together with bolts 540, spacers 542, and the locking nuts 544 that are engaged via a through-hole 541.

Located on each internal surface of the wheel hub 5561*s* gear seat 546. This gear seat 546 allows engagement of motor drive gear 523. The motor drive gear 523 is mounted on the motor shaft 525.

Figure 5B:
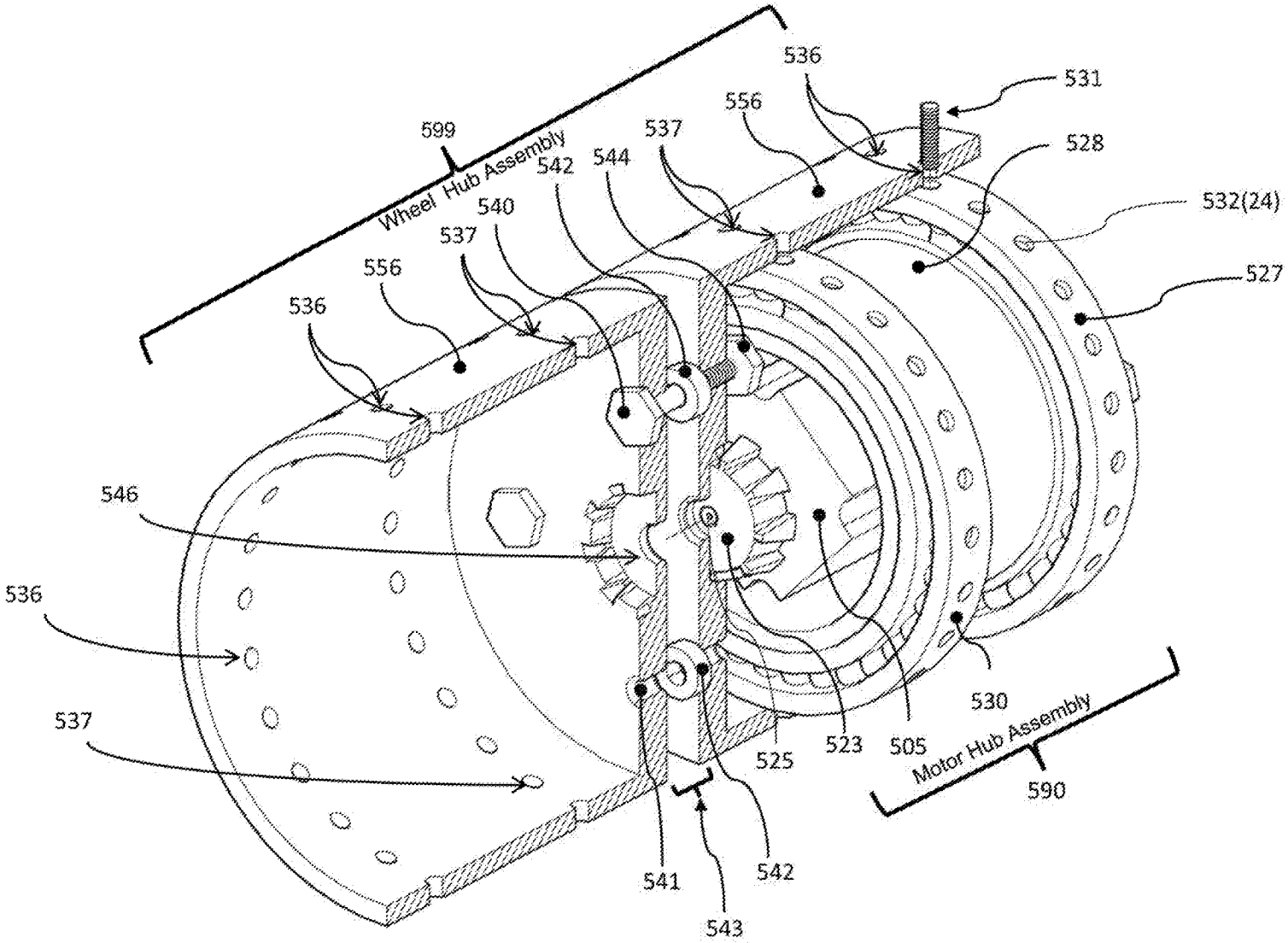
FIG. 5B is a partial isometric cross-sectional view of the wheel hub assembly, an isometric view of the motor-hub inserted into one of the hubs.
Figure 5C:
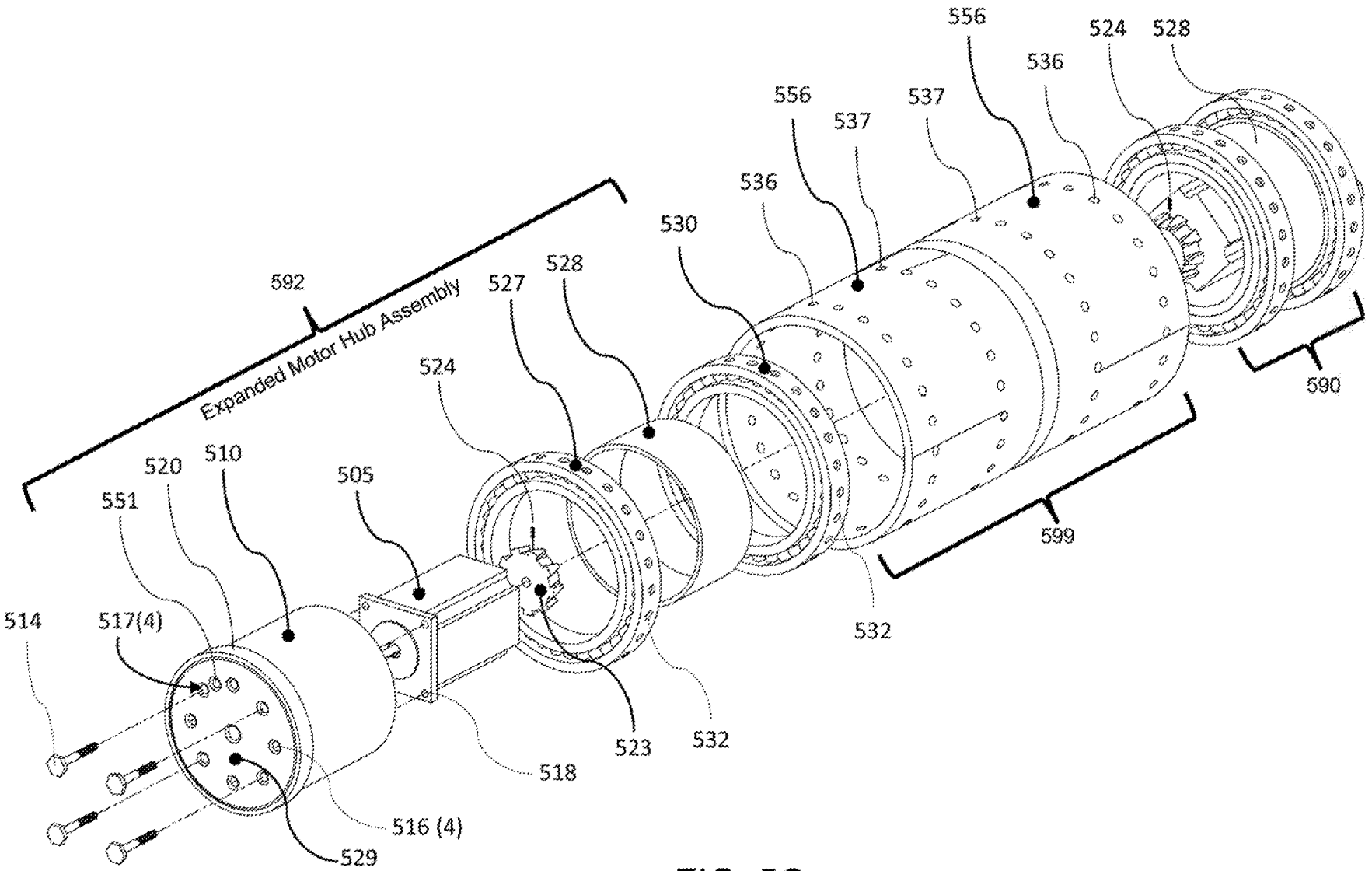
FIG. 5C is an expanded isometric view of the wheel hub assembly, the motor hub assembly and the isometric view expanded motor hub assembly.

In this view there are two rings of through-holes, outside bearing through-holes 536 and inside bearing through-holes 537. The outside bearing$_w$ through-holes 536 and inside bearing through-holes 537 can be threaded to accept setscrews 531 for securing outside bearings 527 and inside bearings 530. The outside bearing through-holes 536 and inside bearing through-holes 537, if not threaded, are used as through-holes to apply epoxy or other materials to secure the bearings in their respective positions. Outside bearing through-holes 536 are used to secure the outside bearing 527; whereas, inside bearing through-holes 537 are used to secure inside bearings 530, FIG. 5C is an expanded isometric view of the wheel hub assembly 599 and the expanded isometric view of the motor hub assembly 592. The wheel hub assembly 599 is made up of two wheel hubs 556 as described in FIG. 5B. These two wheel hubs 556 will contain one or two motors 505, One completed motor hub assembly 590 is shown ready to be inserted into the one wheel hub 556. The view of the expanded motor hub assembly 592 shows the respective parts and the way they are assembled. The motor drive gear 523 is attached to the motor shaft 525 as shown in FIG. 5B with setscrew 524. The motor 505 is mounted into the motor hub 510 by inserting bolts 514 through through-holes 517 and into threaded-holes 518 of the motor 505, 'hle outside bearing 527 slides onto the outside of the motor hub 510 and rests at the bearing reference stop 520. A hearing spacer 528 slides onto the outside surface of the motor hub 510. This hearing spacer 528 will separate inside bearing 530 from the outside bearing 527. This assembly is referred to as a motor hub assembly 590.

Figure 5D:
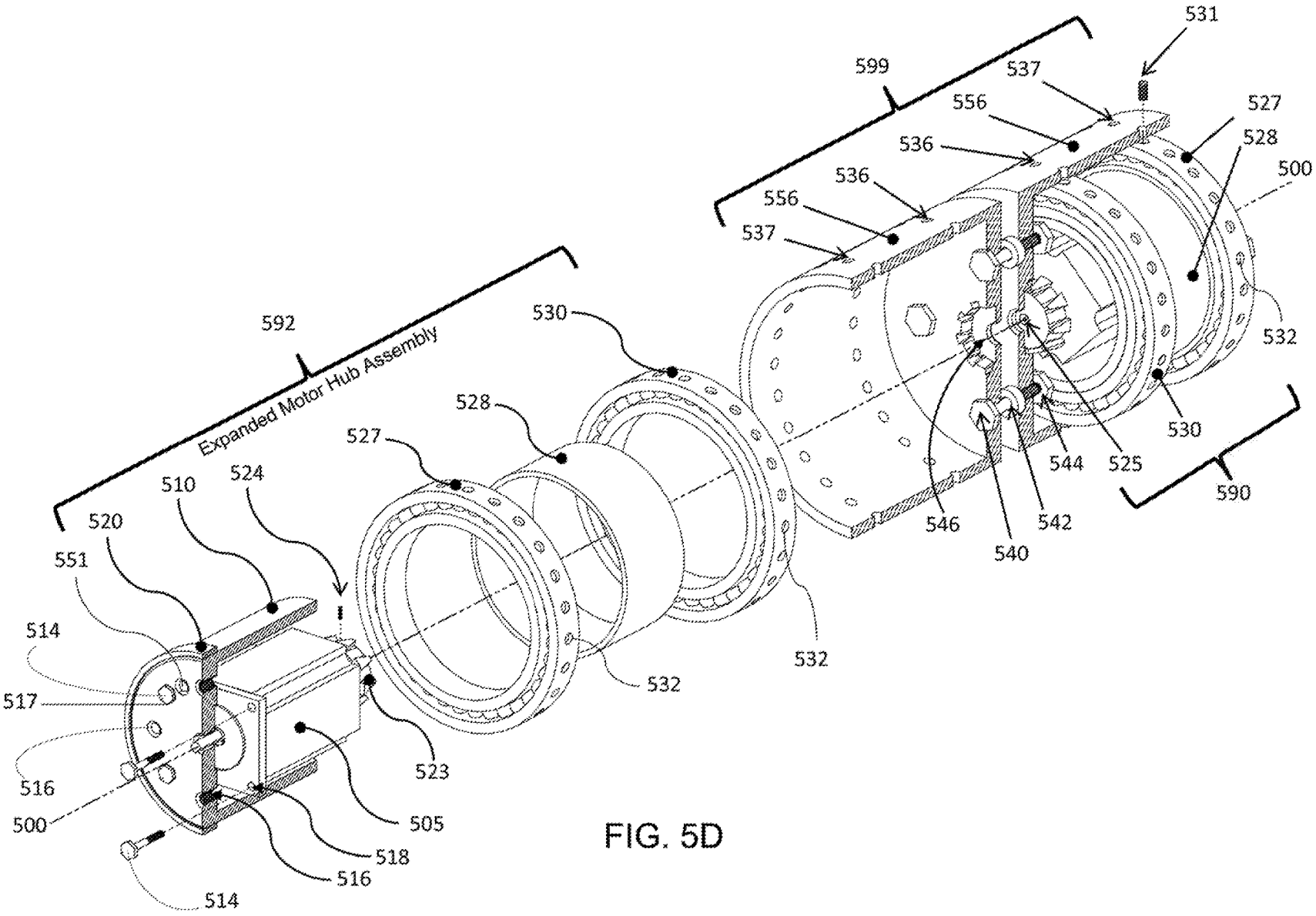
FIG. 5D is an isometric view of the cross-sectioned motor hub and a cross-sectioned wheel hub assembly with the inserted motor-hub assembly.

FIG. 5D is an expanded isometric view of the cross-sectioned motor hub 510, a cross-sectioned wheel hub assembly 599, and a motor hub assembly 590 shown inserted into hub 556 of the wheel hub assembly 599. All the components are aligned on the axis of rotation 500. In this view the motor 505 is seated in the motor hub 510, It is secured in place with bolts 514 that pass through the through-hole 517 that is shown in FIG. 5C, and engages the threaded-holes 518 of the motor 505 with the motor 505 secured, the outside bearing 527 slides onto the motor hub 510 followed by the hearing spacer 528. The inside bearing slides onto the motor hub 510. These three components, outside bearing 527, bearing spacer 528, and inside hearing 530 slides onto the motor hub 510 until seated against the bearing reference stop 520. The bearing reference stop 520 is a ring that is welded, machined, or formed onto the motor hub 510 outside surface as part of the motor hub 510, The motor drive gear 523 has been secured to the motor shaft 525 with setscrew 524.

The motor hub assembly 590 slides into the wheel hub 556 until the motor drive gear 523 engages the gear seat 546. At this point the bearing receiving-holes 532 can be aligned with inside bearing through-holes 537 and. outside bearing through-holes 536. These surfaces are then locked together with setscrews 531.

Figure 5E:
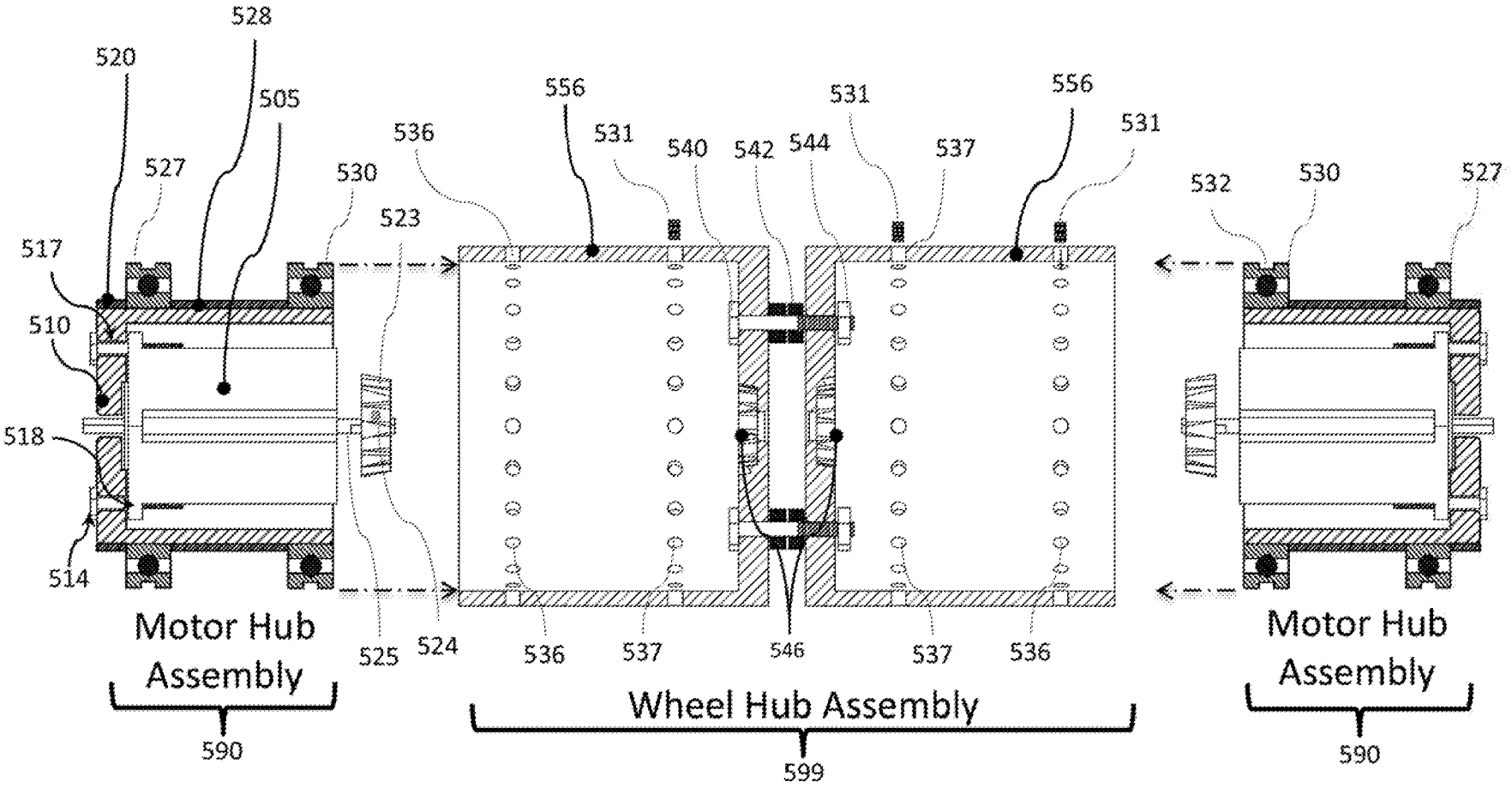
FIG. 5E is a front-end cross-sectional view of wheel-hub assembly and cross-sectioned motor-hub assemblies ready to be inserted into their respective hubs.

FIG. 5E is an expanded front-end cross-sectional view of the wheel hub assembly 599 and motor hub assembly 590, In this Figure the two wheel hubs 556 are shown joined with two spacers 542, the locking nuts 540, and bolts 544. The motor hub assembly 590 is shown with outside bearings 527, inside bearings 530, bearing spacer 528, and bearing referenced stop 520. All of these are placed on the outside diameter of the motor hub 510. Inside the motor hub 510, the motor 505 is joined to the motor hub face 529 with bolts 514 that passes through the through-holes 517 and mate to threaded-holes 518 in the n-motor 505. The motor drive gear 523 is attached to the motor shaft 525. The motor hub assembly 590 slides into the wheel hub 556.

When the novel skateboard is in motion, the following components are in rotation the wheel hub assembly 599, inside bearing 530, outside bearings 527, the motor shaft 525, the motor drive gear 523, and the tire skin 501.

Figure 5F:
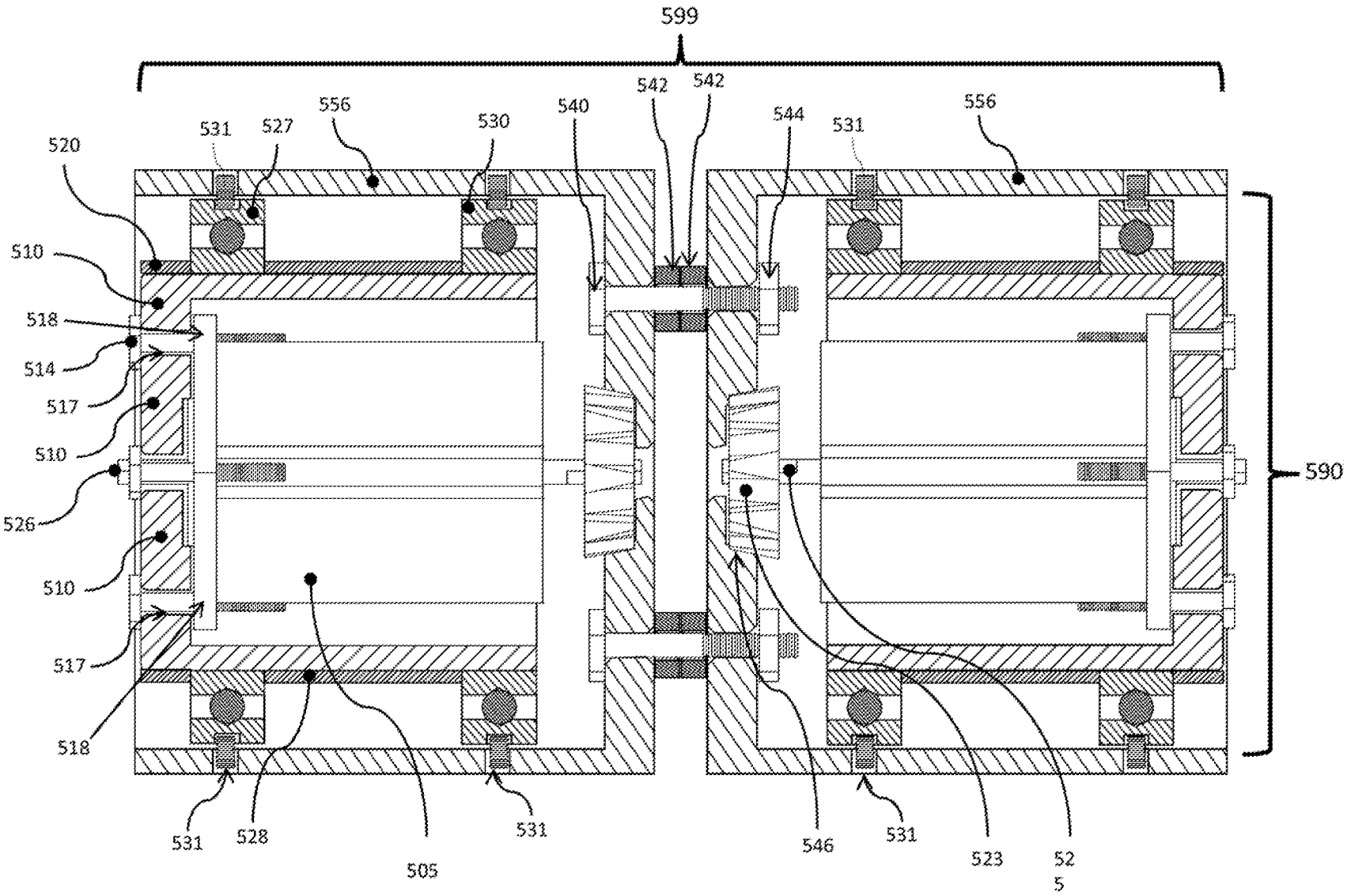
FIG. 5F shows the front-end cross-sectional view of the wheel hub assembly with the motor hub assemblies seated in their respective positions within the wheel hub assembly.

FIG. 5F shows the front-end cross-sectional view of the wheel hubs 556 attached to one another forming the wheel hub assembly 599. The motor hub assemblies 590 are shown inserted into their respective positions within the wheel hub assembly 599, The motor hub assemblies 590 are shown attached to the wheel hubs 556 with setscrews 531 that engage the inside bearings 530 and outside bearings 527. The motor drive gear 523 is shown properly seated into the gear seat 546.

Figure 5G:
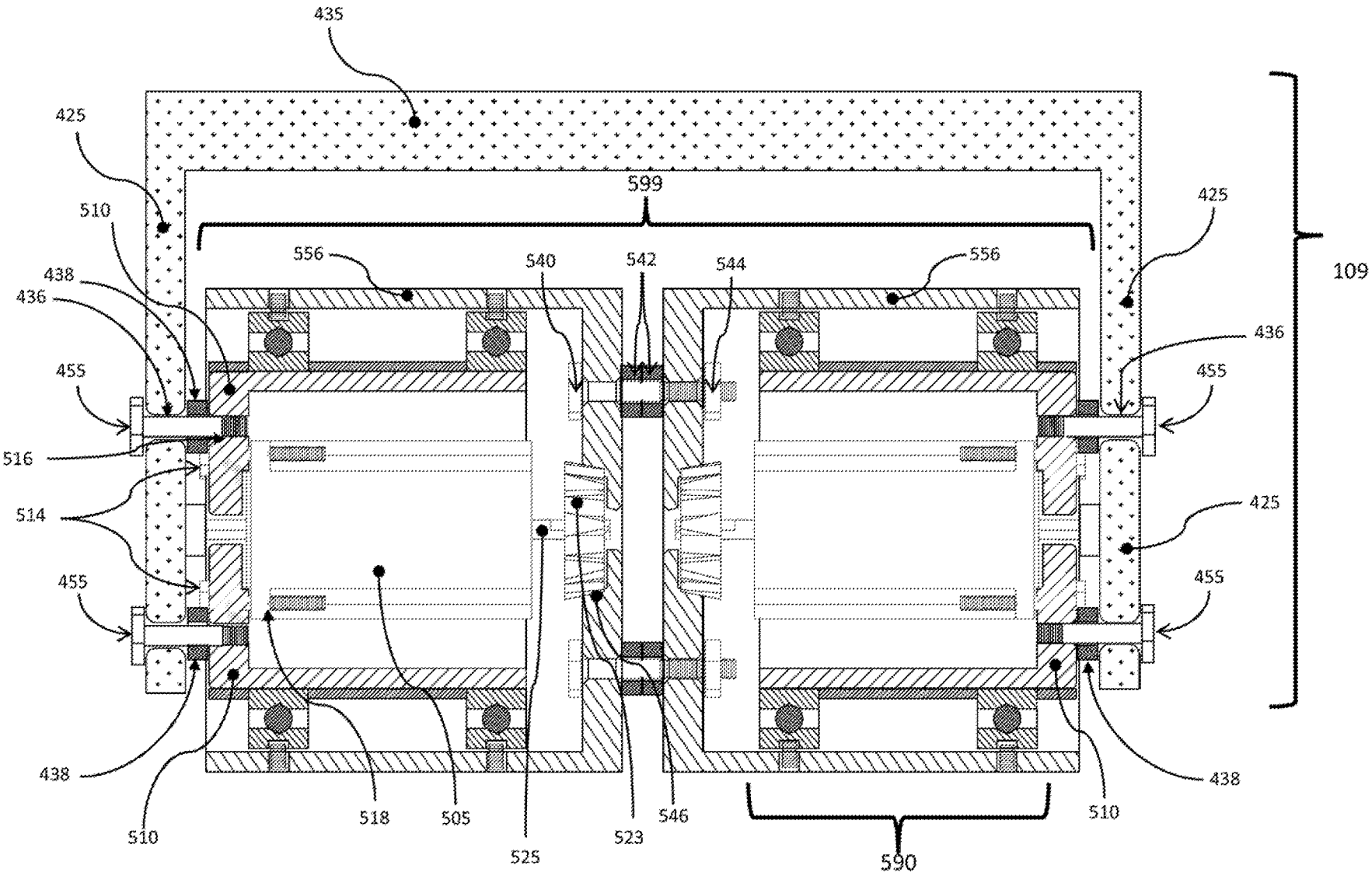
FIG. 5G shows the wheel hub assembly attached to the transom-fork hanger assembly, which is comprised of the fork hanger and the skateboard transom.

FIG. 5G shows the wheel hub assembly 599 attached to the transom fork hanger assembly 109, which is comprised of the fork hanger 425 and the transom 435. The attachment of the wheel hub assembly 599 is accomplished with mounting bolts 455 passing through the through-holes 436 and through the spacer 438 that engages the threaded-holes 516 on the motor bub face 529.

Figure 5H:
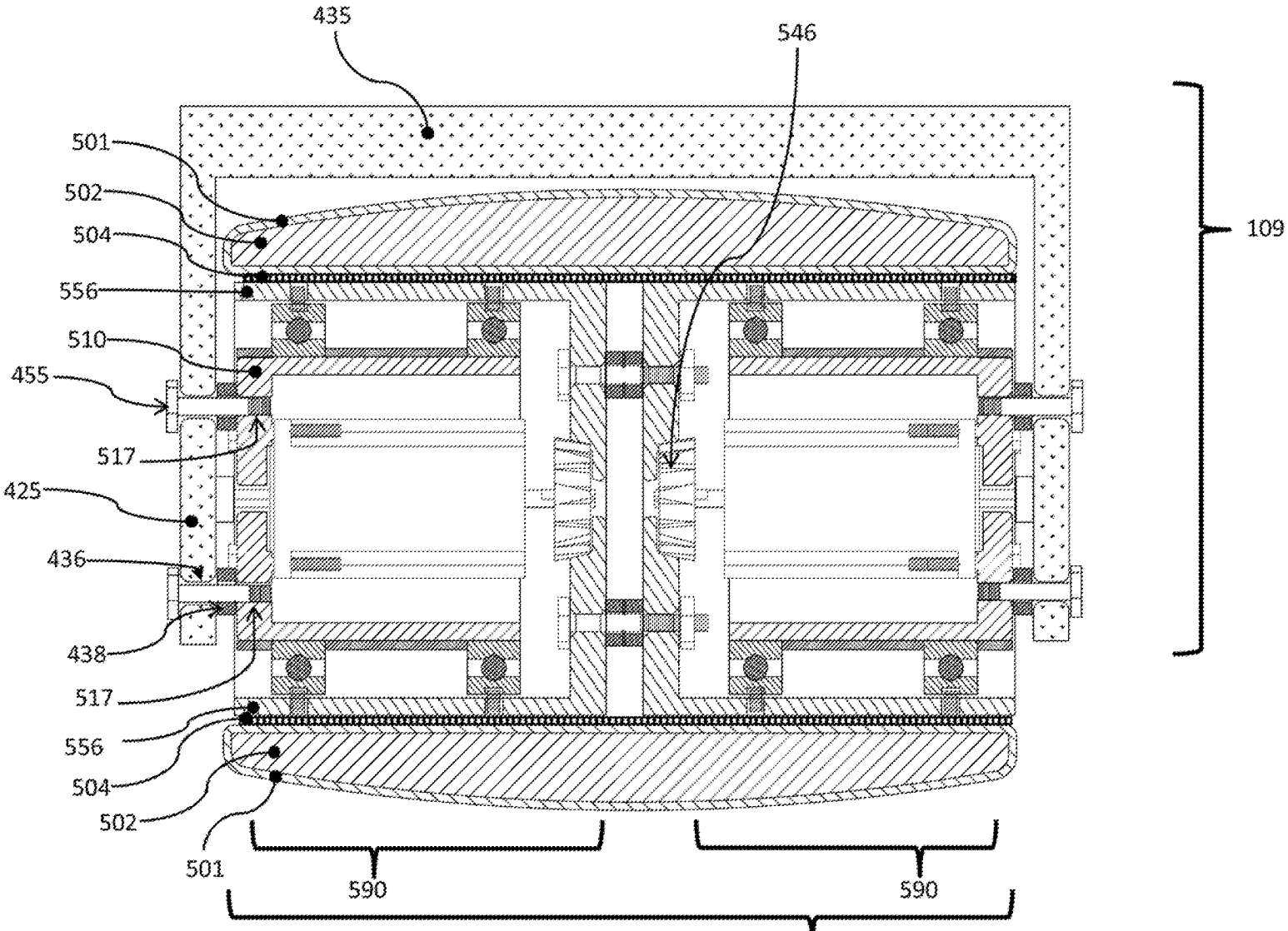
FIG. 5H shows a front cross-section view of the wheel, wheel assembly, motor hub assembly, wheel hub assembly and the hansom-fork hanger assembly.
Figure 5I:
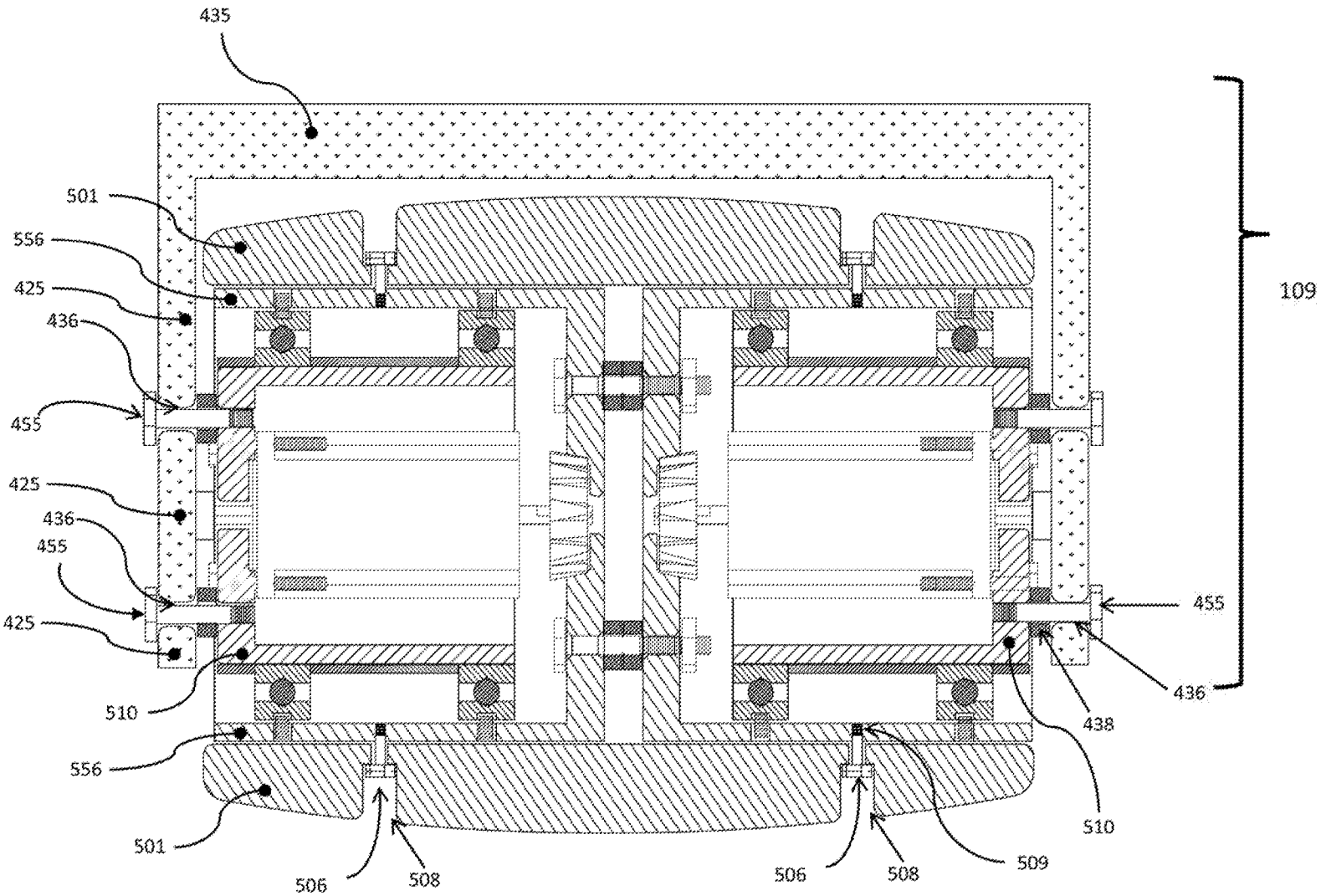
FIG. 5I shows a front cross-section view of the solid wheel and method of attachment to the wheel-hub assembly.

FIG. 5H shows a front cross-section orientation of the motor hub assembly 590 within the wheel hub assembly 599. It also shows the tire skin 501 attached to the wheel hub assembly 599 outer surface with an adhesive 504. Internal tire material 502 can consist of gases, foam, liquid material or gels. The motor hub 510 is attached to the banger fork 425 with the motor hub bolt 455 passing through the through-hole 436 and through the spacer 438, and into the threaded-hole of the motor hub 517. This secures the motor hub assembly 590 to the fork.

FIG. 51 shows a different method of attaching a solid tire to the wheel hub assembly 556. The tire skin 501 is attached to the wheel hub 556 with tire fasteners 506 that pass through a tire fastener recess 508. The tire f.ls 506 is fastened to a threaded-hole 509 that is machined or formed into the wheel hub 556. Locking glue or epoxy is used to assure that the tire fastener 506 remains fastened to the wheel hub 556.

Figure 6:
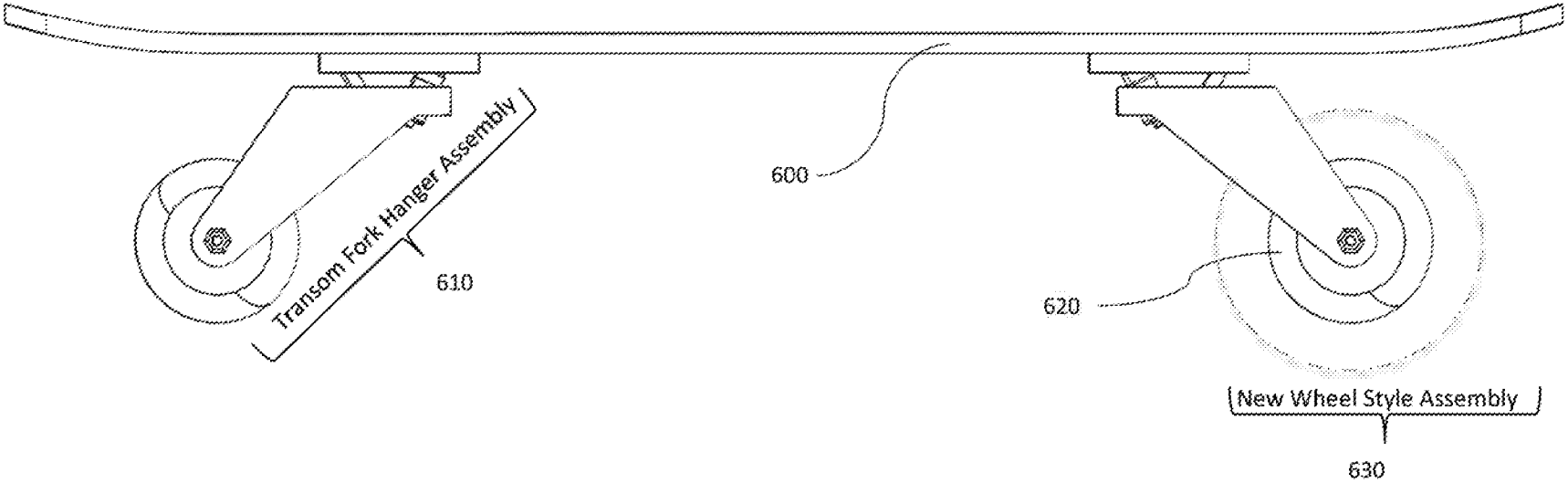
FIG. 6 shows a side view, as a dimension perspective, of a skateboard with the new wheel styles assembly attached to the transom-fork hanger assembly.

FIG. 6 shows a side view, as a dimension perspective, of a skateboard with a rang, of new wheel style assemblies 630. The average size of the skateboard deck 600 is roughly from 24 inches to, but not limited to, approximately 36 inches in length, and with the present invention the height ranges from generally 3 inches to 5 inches. The side view shows a typical skateboard deck 600, formerly known as skateboard deck 100 in FIG. 1 and FIG. 2. This drawing and subsequent figures will evolve from the simple non-motorized skateboards to the more complex motorized skateboards and different skateboard wheels with novel features which is referred to as new wheel style assemblies 630. The transom fork hanger assembly 610 will be used to mount the new wheel style assembly 630 as represented by the dotted line.

Figure 7A:
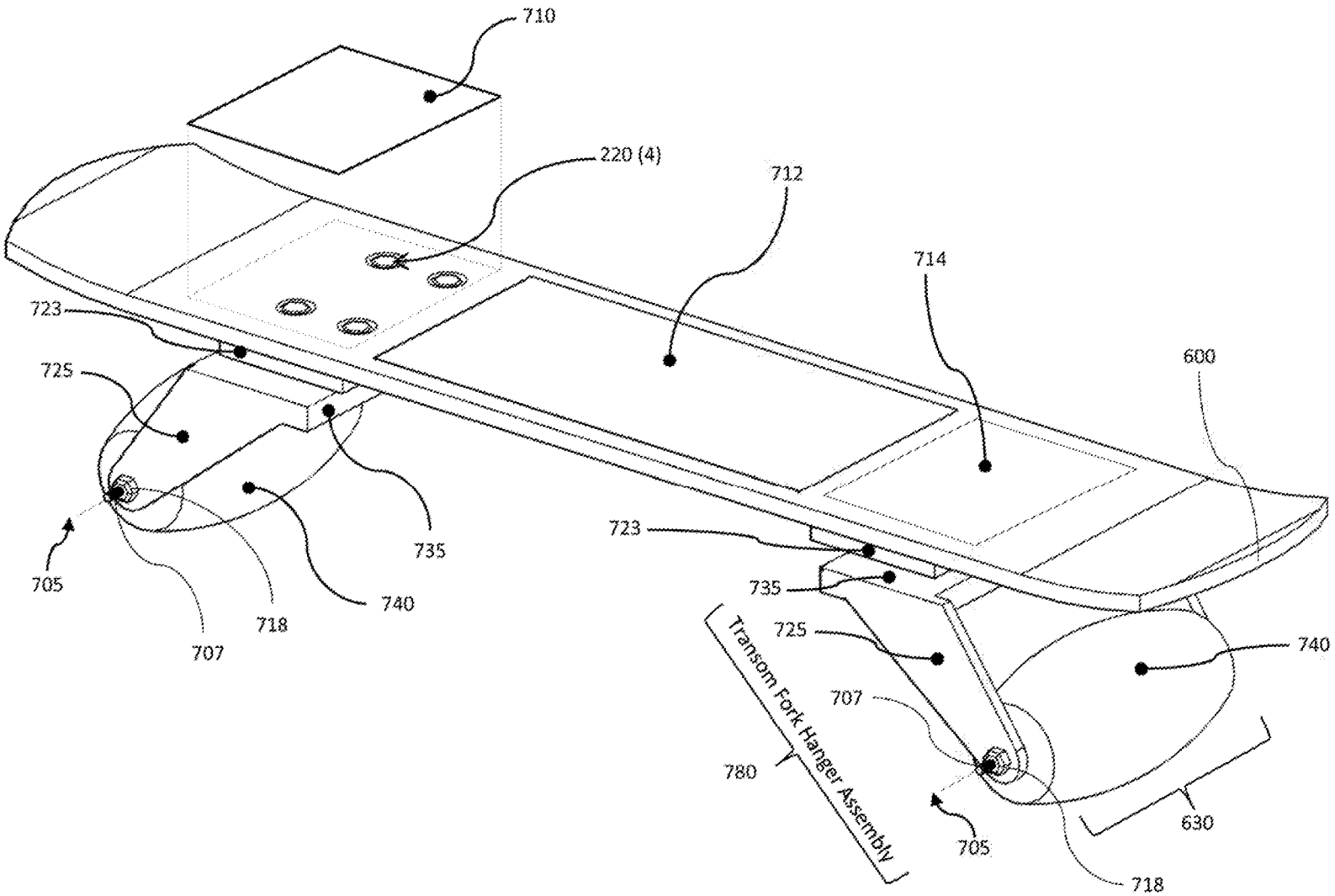
FIG. 7A is an isometric partially expanded view of deck skin that represents reduced size of a conventional skateboard deck skin.

FIG. 7A is an isometric view of the skateboard deck 600 with an expanded view of one of the deck skins 710 that represents reduced size of conventional skateboard deck skins. Deck skin 710, deck skin 712, and deck skin 714 protect the components and component fasteners. This view shows the component fasteners 220 that fasten the baseplate 723 to the skateboard deck 600. The skateboard deck 600, formally referred to as skateboard deck 100 as seen in FIG. 1, has the same component through-holes as skateboard deck 100, The main purpose of deck skins 710, deck skins 712, and deck skins 714 is to provide a gritty surface for the skateboard rider. Additionally, any one of the deck skins 710, deck skins 712, and deck skins 714 can be replaced quickly and inexpensively.

The fork hanger 725 and the transom plate 735 make up the transom fork hanger assembly 780, formerly referred to as transom fork hanger assembly 610 in FIG. 6. In his configuration, oval wheel 740, formerly referred to as new wheel style assembly 630 in FIG. 6, is mounted to the fork hanger 725 via threaded section 707 of axle rod 702 (not shown) and locking nut 718. The axis of rotation is 705.

Figure 7B:
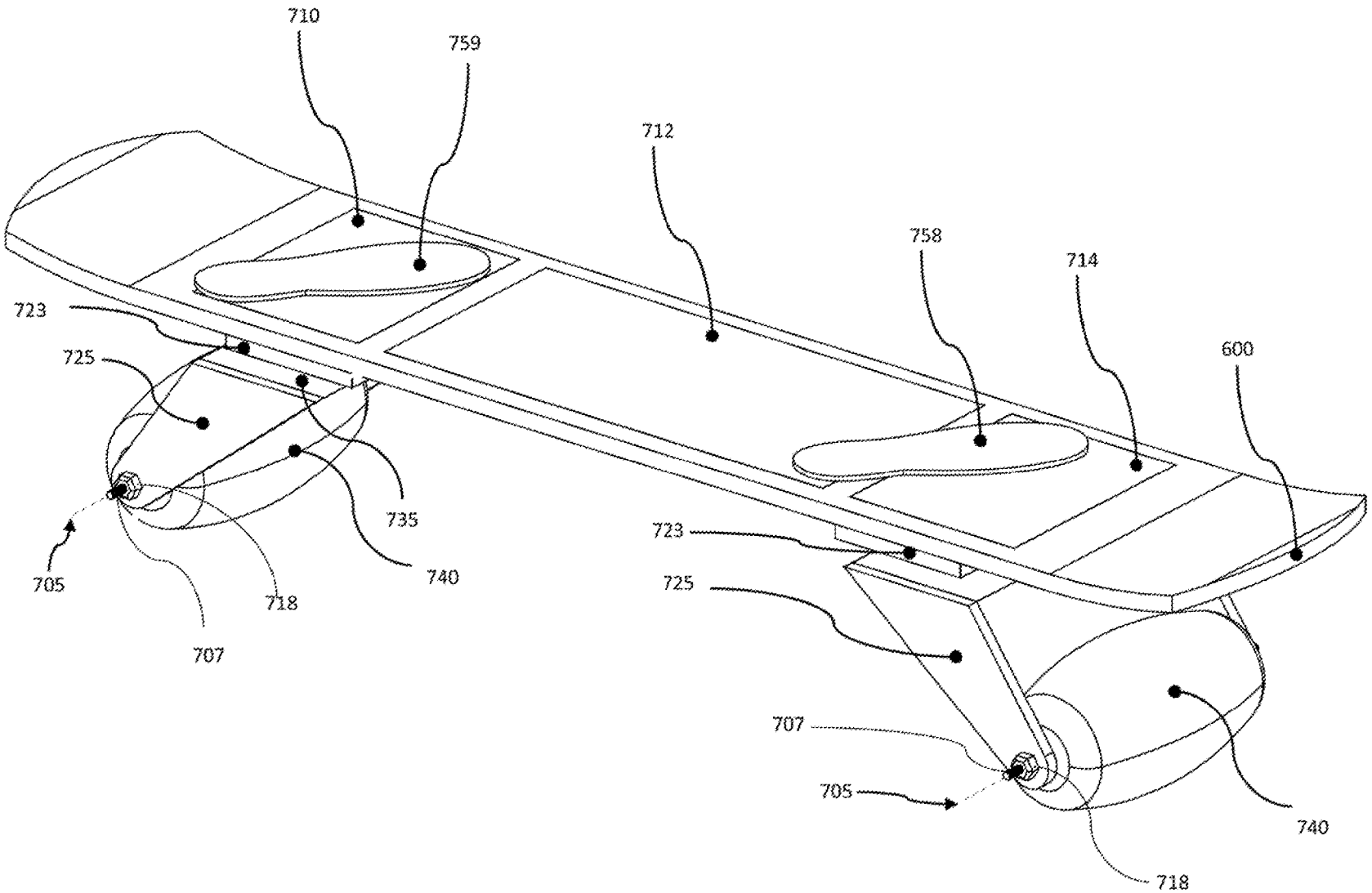
FIG. 7B shows the isometric view, of a skateboard deck with the respective deck skins in their normal positions and representative common skateboard foot placement patterns left foot and right foot.

FIG. 7B shows the isometric view of a non-motorized skateboard assembly with the respective deck skins 710, 712, and 714, which shows that the majority of the surface on the skateboard deck 600 is adequately covered. FIG. 7B also shows a common left foot placement pattern 759 and right foot placement pattern 758 to maintain normal control and stability when riding.

Figure 7C:
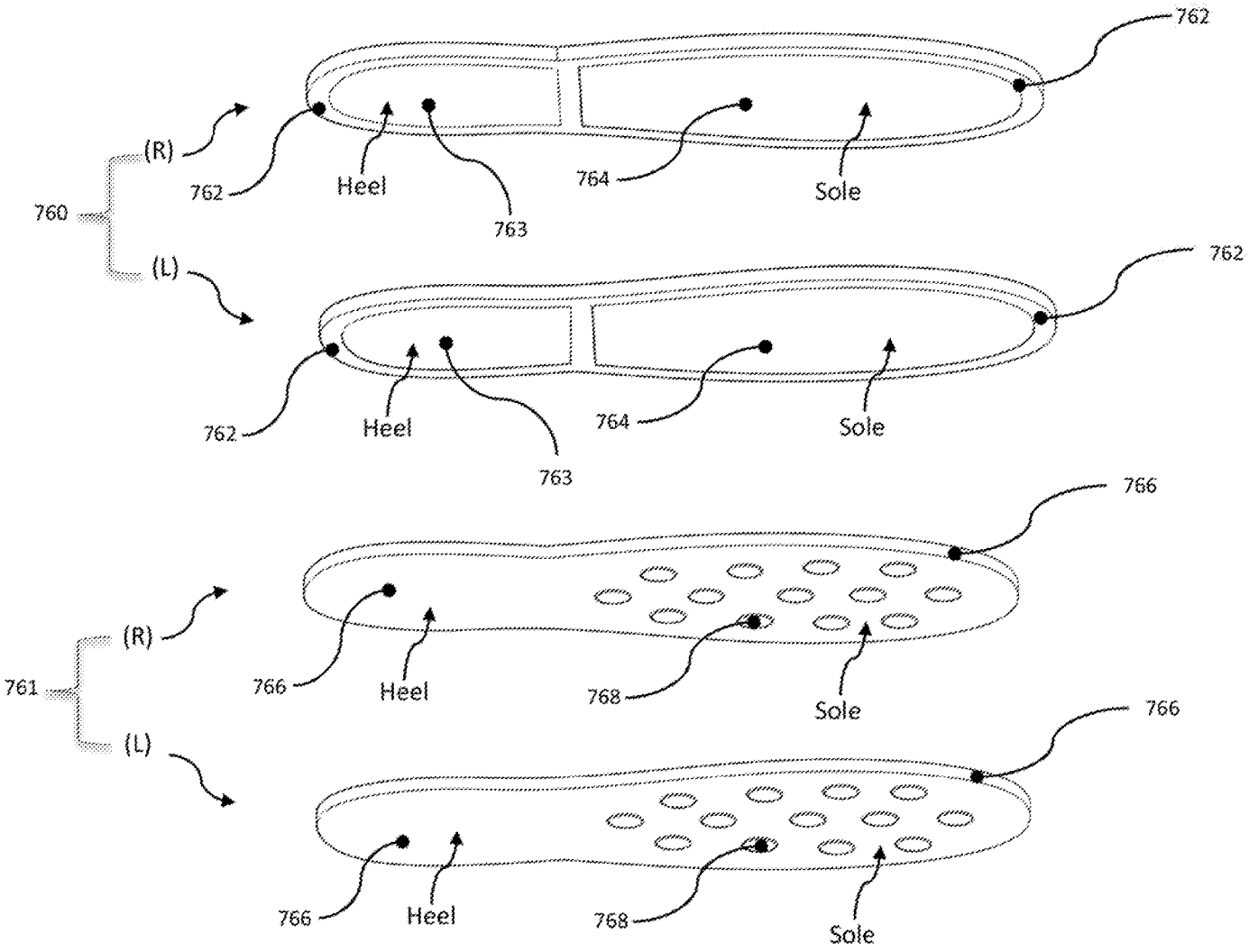
FIG. 7C shows the underside view of two skateboard shoe types.

FIG. 7C shows the underside view of two skateboard shoe types: shoe bottoms 760 (L) and 760 (R) and shoe bottoms 761 (L) and 761(R). Shoe bottoms 760 (L) and 760 (R) and shoe bottoms 761 (L) and 761(R), are representations of skateboard shoe soles that have unique features dependent on the complementary material used for the deck skin material as seen in FIG. 7B.

Shoe bottoms 760 (L) and 760 (R) consist of a retaining matrix material 762, the heel 763, and the sole 764. The retailing matrix material 762 can be molded with magnetic material in the heel 763 and with magnetic material .in the sole 764 to form a thick shoe bottom 760 (L) and 760 (R). There are many combinations of materials to form shoes bottoms 760 (L) and 760 (R).

Shoe bottoms 761 (L) and 761(R) shows magnets 768 as small permanent magnet plugs that are incorporated into the wells of the retaining matrix material that is typical of shoe sole material The magnets 768 can be embedded or molded into the entire retaining matrix material 766. Shoe bottoms 761 (L) and 761(R) configurations can also be made up of different combinations of materials such as composite sole skins that are taped, glued or fastened to the bottom soles of regular skateboard shoe.

Figure 7D:
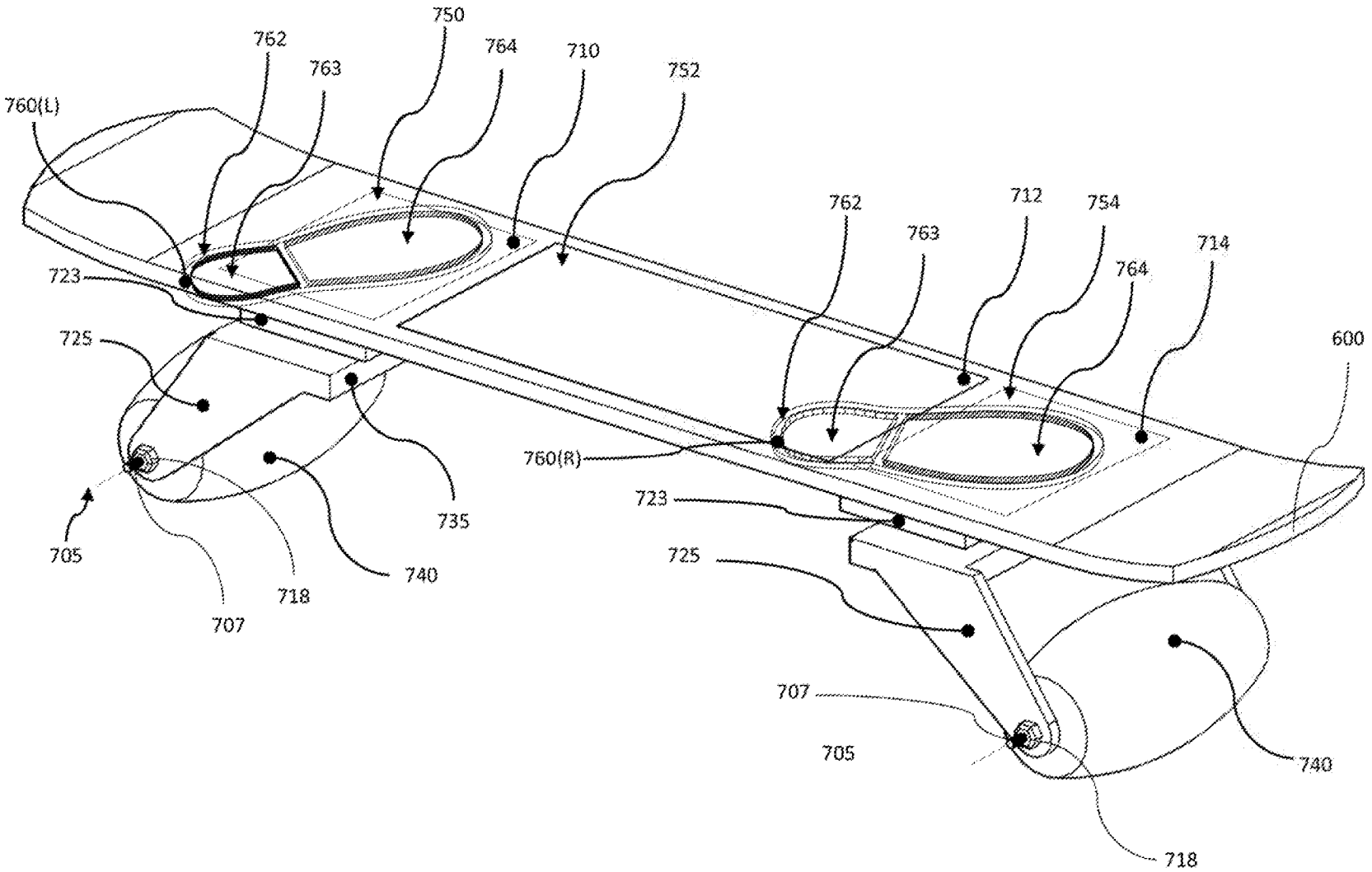
FIG. 7D shows the former left and right foot placement patterns now represent magnetic shoe bottoms of the left and right foot and are shown with magnetic material underlayment.

FIG. 7D shows the fomler right foot placement pattern 758 and left foot placement pattern 759 from FIG. 7B are now shoe bottoms 760 (L) and 760 (R). The shoe bottoms 760 (L) and 760 (R) are drawn transparent to show the interaction with materials beneath the shoe bottoms of the designated deck skin, 710. 712, and 714 shown in FIG. 7B.

The deck skins 710, 712, and 714 have an underlayment of magnetic material 750, 752, and 754, respectively, that interacts with the sole of the shoe bottoms 760 (L) and 760 (R) or shoe bottoms 761 (L) and 761(R). When the rider is performing airborne tricks the magnetic coupling generated between the shoe bottoms 760 (L) and 760 (R) or shoe bottoms 761 (L) and 761(R) and the magnetic material 750, 752, and 754, used as an underlayment, will create greater control for the skateboard rider. When the skateboard rider completes the airborne trick and lands on the terrain, the gritty deck skins 710, 712, and 714 provide positive control during the "touchdown" phase of the airborne trick and the subsequent ground ride. The interaction with the gritty material of the deck skins 710, 712, and 714 will allow positive control when momentum changes during skateboard maneuvers preventing the rider from sliding off. While performing aerial tricks positive contact and control of the skateboard will be maintained by the skateboard rider due to the magnetic interaction of the shoe bottoms 760 (L) and 760 (R) or shoe bottoms 761 (L) and 761(R) and the underlayment of magnetic material 750, 752, and 754. Such aerial tricks may include stands, spins, twirls or other skateboard motions. Typically airborne {Tricks require the skateboard rider to bend the knees to a high degree and physically grab the skateboard to avoid separation and loss of control. Maneuverability of the skateboard rider is not compromised by this invention but enhanced.

To separate from the magnetic surface the rider rotates a heel or toe edge out of the plane of the magnetic coupling surfaces. The simple action of pulling or flexing the heel up and applying downward pressure on the toes allows for controlled separation from the magnetic surface and alters the degree of coupling, It is easy to rotate the feet on the surface by minimizing the amount of weight on the shoe sole. This release is accomplished in the same skateboard maneuvers currently performed. The only difference is more positive control of the interaction between the sole of the skateboard shoe and the skateboard itself A higher degree of precision in performing skateboard tricks can be accomplished because of this optimized control.

Figure 7E:
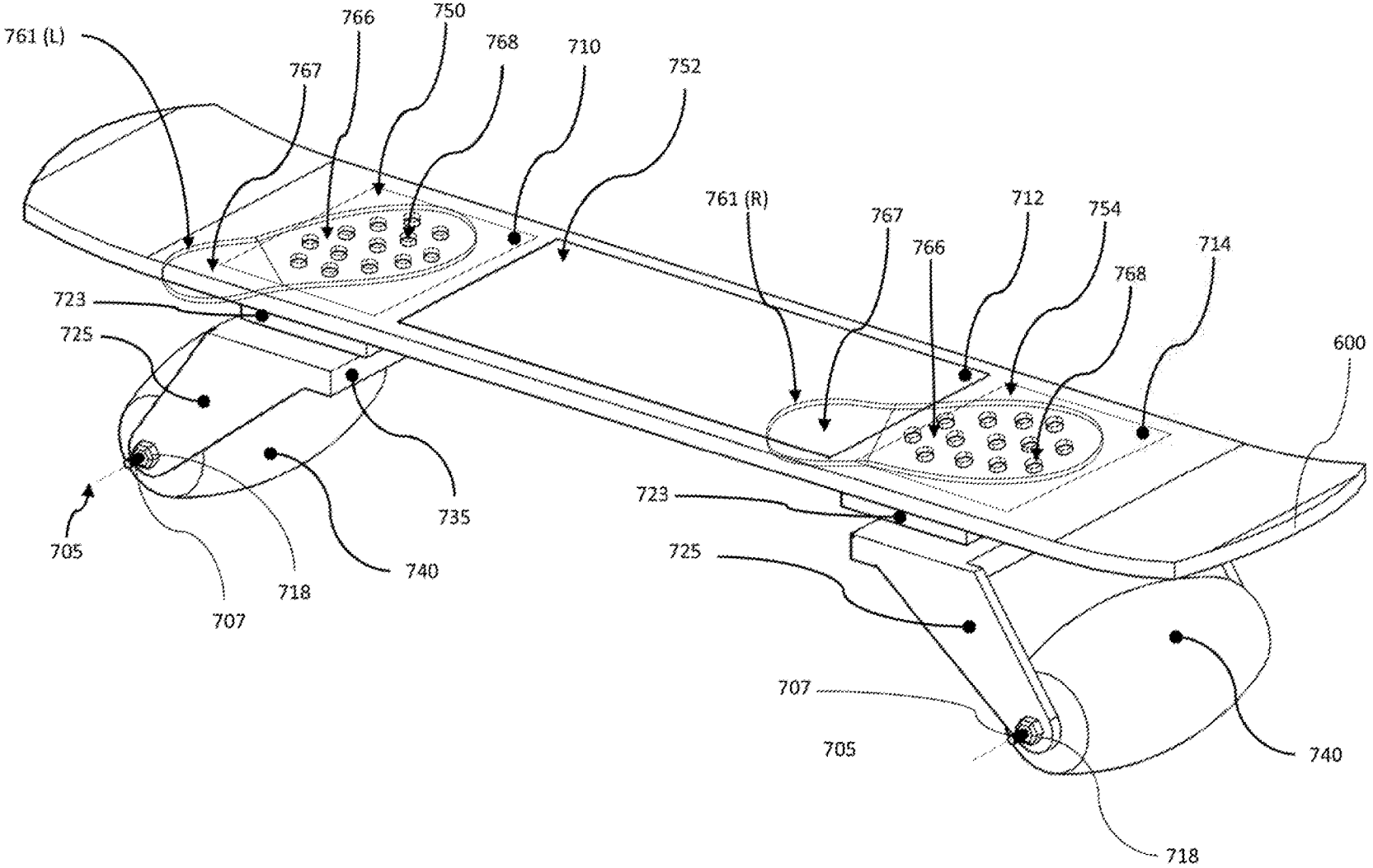
FIG. 7E deals with the isometric view visualization of the shoe bottoms (Left & Right), the deck skins are shown with magnetic material underlayment.

FIG. 7E deals with the isometric view visualization of the shoe bottoms 761 (L) and 761(R) and the deck skins 710, 712, and 714 as shown with magnetic material 750, 752, and 754 used as an underlayment. The deck skins 710, 712, and 714 are overlaid onto the magnetic material 750, 752, and 754, respectively. The magnetic interaction occurs between the shoe bottoms 761 (L) and 761(R) and the magnetic material 750, 752; and 754 used as an underlayment to the deck skins 710, 712, and 714 as shown in FIG. 7D with the shoe bottoms 760 (L) and 760 (R). There are no materials that can be magnetized and no magnets embedded in the matt-ix material heels 767.

Figure 7F:
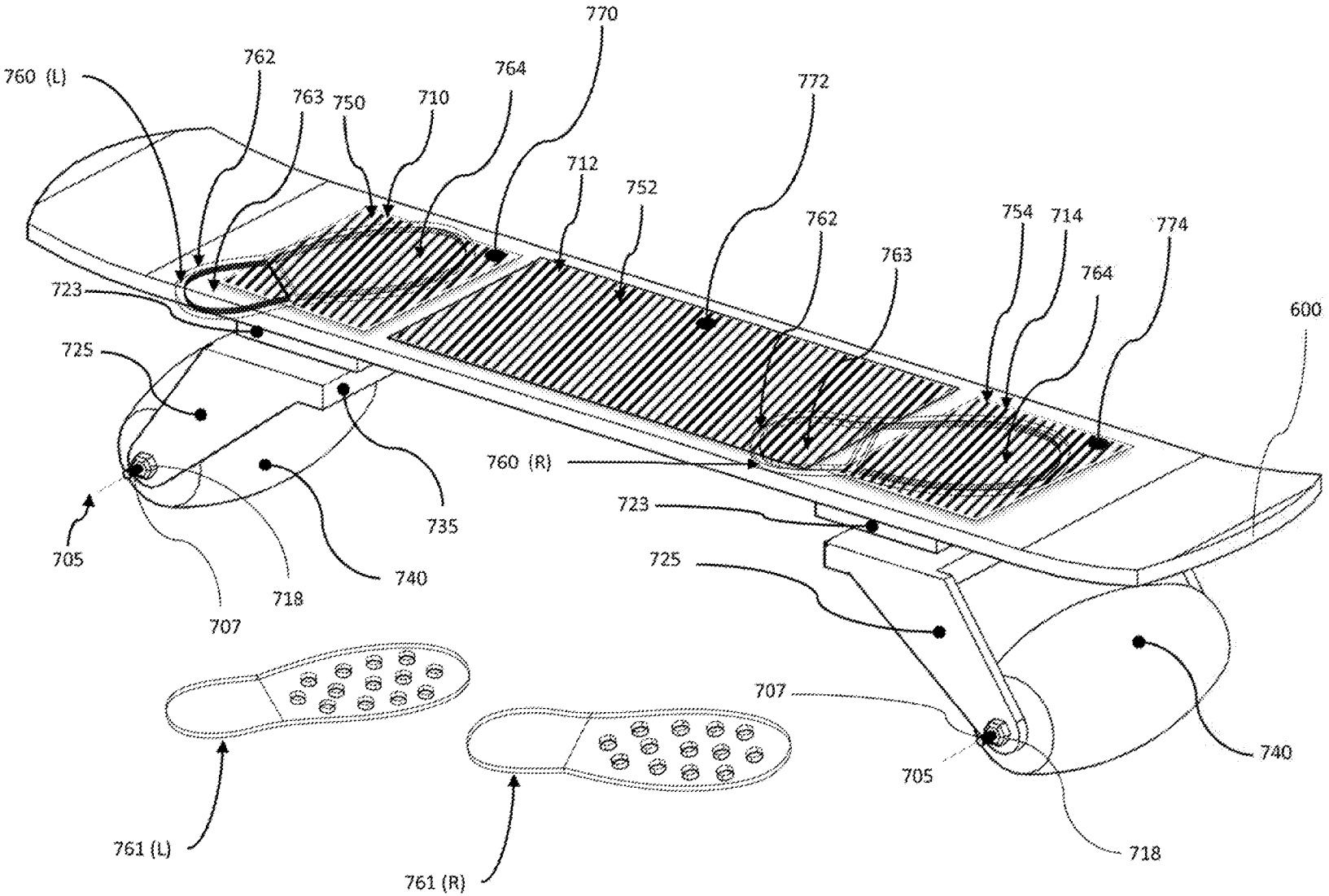
FIG. 7F is an isometric view of a hybridized deck skins, which are comprised of alternating strips of gritty material and magnetic material that lie on the same plane and shoe sole bottoms that are magnetic (transparent for clarity)

FIG. 7F is an isometric view of hybridized composite deck skins 770, 772, and 774, shoe bottoms 761 (L) and 761 (R) and shoe bottoms 760 (L) and 760 (R) (transparent for clarity). The hybridized deck skins 770, 772, and 774 refers to: alternating strips of abrasive deck skin 710 and magnetic material 750 forming hybridized composite deck skin 770;

alternating strips of abrasive deck skin 712 and magnetic material 752 forming hybridized composite deck skin 772; and alternating strips of abrasive deck skin 714 and magnetic material 754 forming hybridized composite deck skin 774. The hybridization formed on the same plane provides a single deck skin cover. This makes it easier for the rider to reconfigure or perform maintenance operations. This new configuration will provide the same interaction between the shoe bottoms 761 (L) and 761/R) and shoe bottoms 760(L) and 760 (R) as shown in FIG. 7D and FIG. 7E. This hybridized composite deck skins 770, 772, and 774 will allow the rider to perform tricks or simple maneuvers in regular skateboarding activities or when using the novel shoe soles to perform enhanced tricks and maneuvers.

Figure 7G:
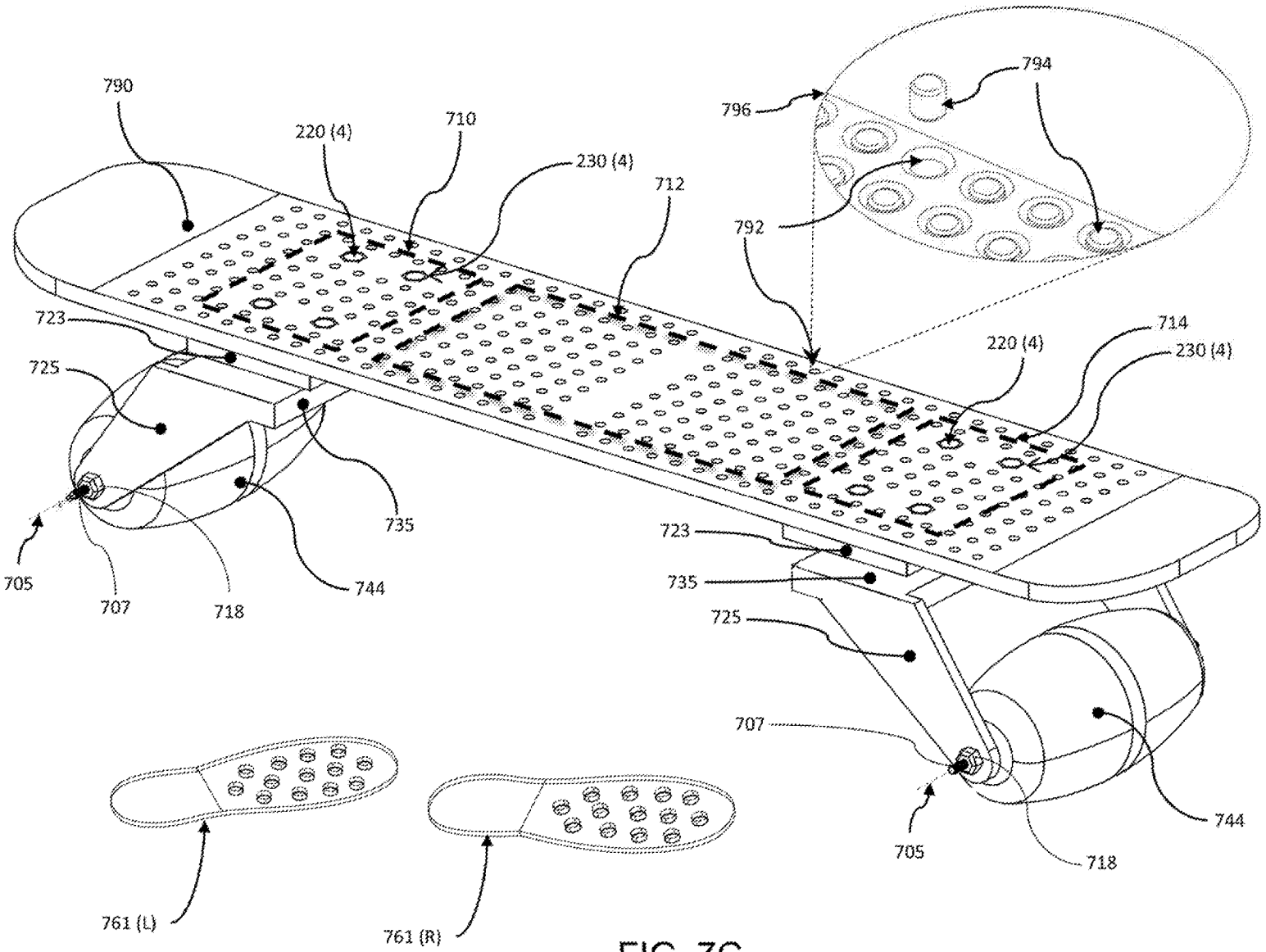
FIG. 7G shows an upper isometric view of a hybrid skateboard deck that has incorporated into the top surface an array of magnets.

FIG. 7G shows an upper isometric view skateboard deck 790 that has incorporated into the top surface an array of magnets 794, see inset 796. These magnets 794 are epoxied into the receptacles 792, also see inset 796. The magnets 794 are epoxied in place slightly below or flush with the surface of the skateboard deck 790. The surface of the skateboard deck 790 is covered with the abrasive deck skins 710, 712, and 714 that are represented as dashed line areas. The component mounting fasteners 220 are used to secure the skateboard deck 790 to the base plate 723 that pass through the through-holes 230. The magnets 794 lNill provide maximum coupling of the skateboard deck 790 to the shoe bottoms 761 (L) and 761 (R) with and shoe bottoms 760 (L) and 760 (R) (not shown).

Figure 7H:
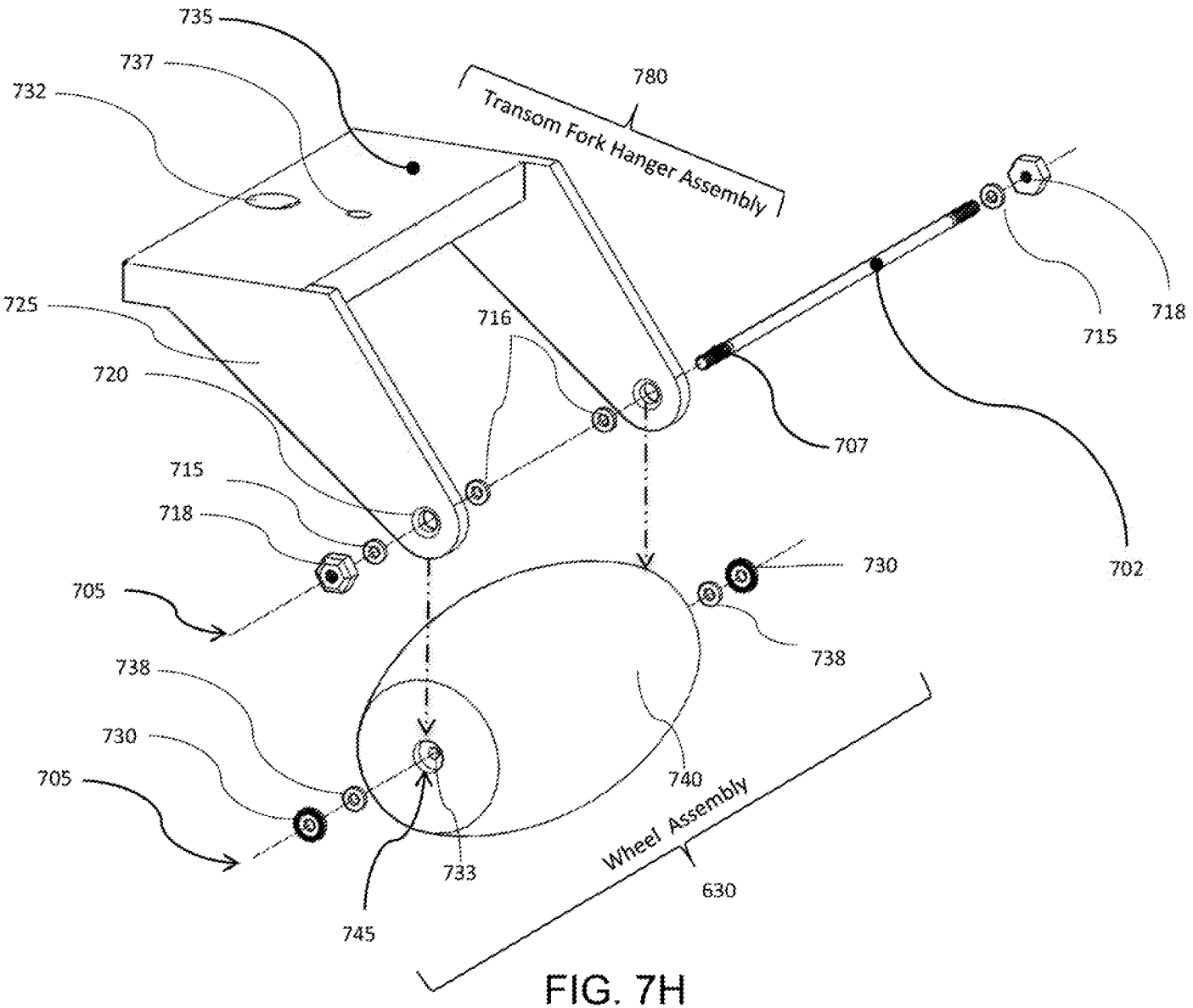
FIG. 7H is an isometric view of the transom fork hanger assembly and the expanded view of the new wheel style assembly FIG. 7I This end-on view shows the perspective view of the skateboard deck or the hybrid skateboard deck and the dashed line representation of new wheel styles assembly for a better perspective.

FIG. 7H is an isometric view of the transom fork hanger assembly 780 and the expanded view of the new wheel style assembly 630. Together, the transom plate 735 and the fork hanger 725, make up the transom fork hanger assembly 780. The transom fork hanger assembly 780 connects to the base plate 723, similarly a') the kingpin & pivot-pin assembly 480, as shown in FIG. 4R The transom plate 735 has the kingpin through-hole 732 as well as the pivot pin seat 737 shown for general reference. The new wheel style assembly 630 has an oval wheel 740 with an axel-rod through-hole 733, a bearing recess 745, a wheel to bearing spacer 738, and a bearing 730. For convenience the new wheel style assembly 630 will be called the wheel assembly 630 from this point on. The wheel assembly 630 is connected to the transom fork hanger assembly 780 by aligning the respective axis of rotation 705 to be collinear with axel-rod 702, The threaded end 707 of the axel-rod 702 passes through the through-hole 720 and through one of the spacers 716. The threaded end 707 of the axel-rod 702 is passed through the bearing 730, the bearing spacer 716, through the wheel axel-rod through-hole 733, the spacer 716, through the bearing 730, the spacer 716, and the second through-hole 720, The installed wheel assembly 630 is then seemed in place with the washer 715 and the locking nut 718 tightened on both ends of the threaded ends 707 of the axel-rod 702. The spacers 716 are used to keep proper spacing of the sides of the oval wheel 740 from rubbing on the inside of the fork arm 725.

Figure 7I:
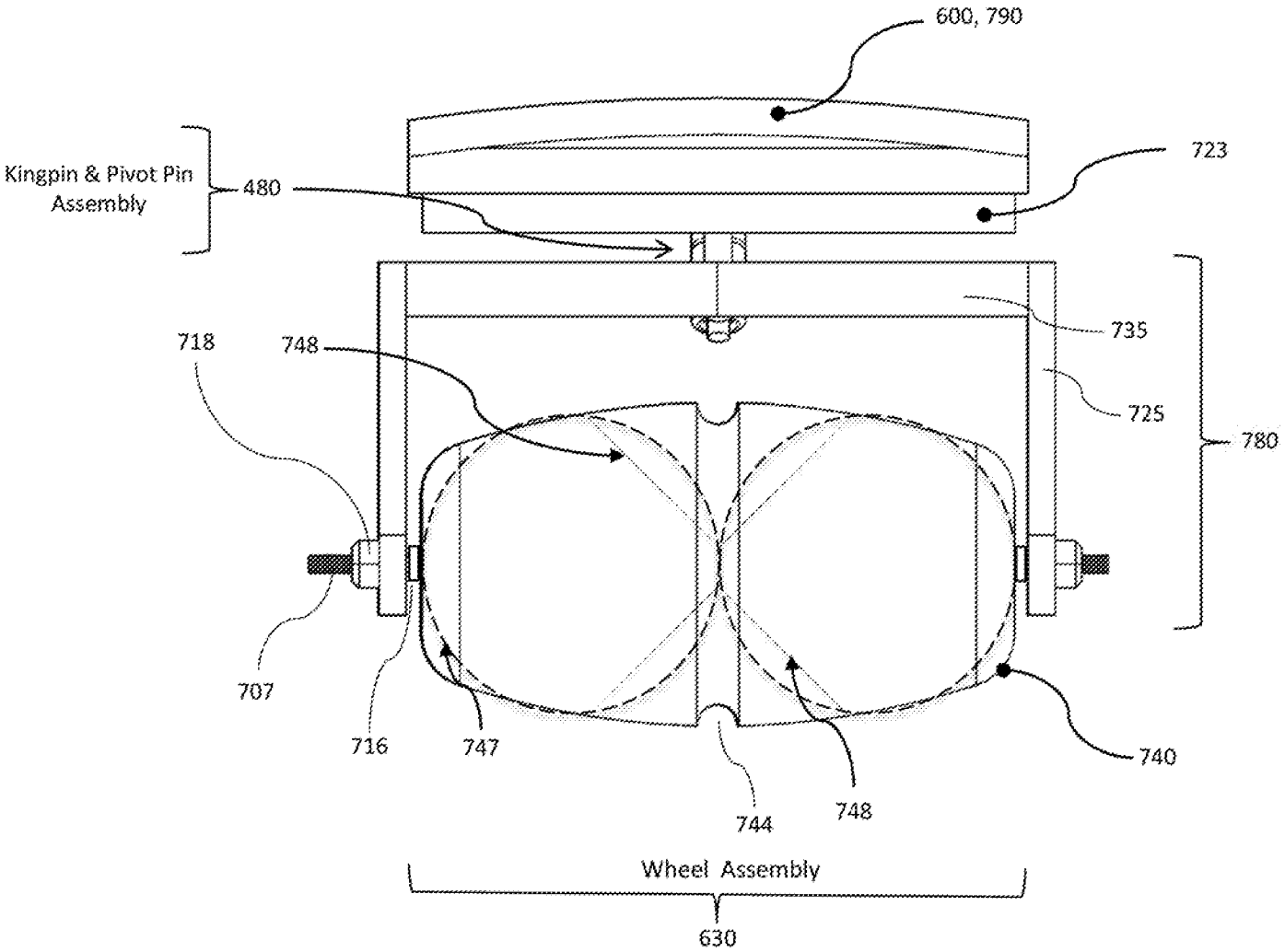
FIG. 7J is an isometric view and a front view of an oval wheel.
FIG. 7K is an isometric view and a front view of the oval V-grooved oval wheel.
FIG. 7L is an isometric view and front view of the double ball wheel.
FIG. 7M is an isometric and a front-end view of the deep V-grooved wheel.
FIG. 7N is an isometric and a front-end view of the studded wheel.

FIG. 7I is an end-on view of the non-motorized skateboard configuration. This end-on view shows the skateboard deck 600 or skateboard deck 790, base plate 723, and kingpin & pivot pin assembly 480 (see FIG. 4B) connecting to the transom fork hanger assembly 780, and a perspective front-end view of the various wheel assemblies 630. The kingpin & pivot pin assembly 480 joins the skateboard transom fork hanger assembly 780 to the base plate 723. To be described below are the geometry, size, and relative perspective end-on view showing multiple wheel profiles 740, 744, 747, and 748 that will provide efficient reconfigurable choices for performing tricks on skateboard-park surfaces and objects, The common element is the oval shape for deriving skateboard wheel geometries. The basic wheel is the oval wheel 740. The deep V-groove wheel 748 can be used for curbs and planters, while a U-groove wheel 744 can be used for riding the rails. For more aggressive turning on curves, a double-sphere wheel 747 is preferred. A full single sphere wheel 746 (not shown) can be used for high-speed downhill racing and better agility on curves. Longer spacers 716 may be required for centering of some wheel geometries.

Figure 7J:
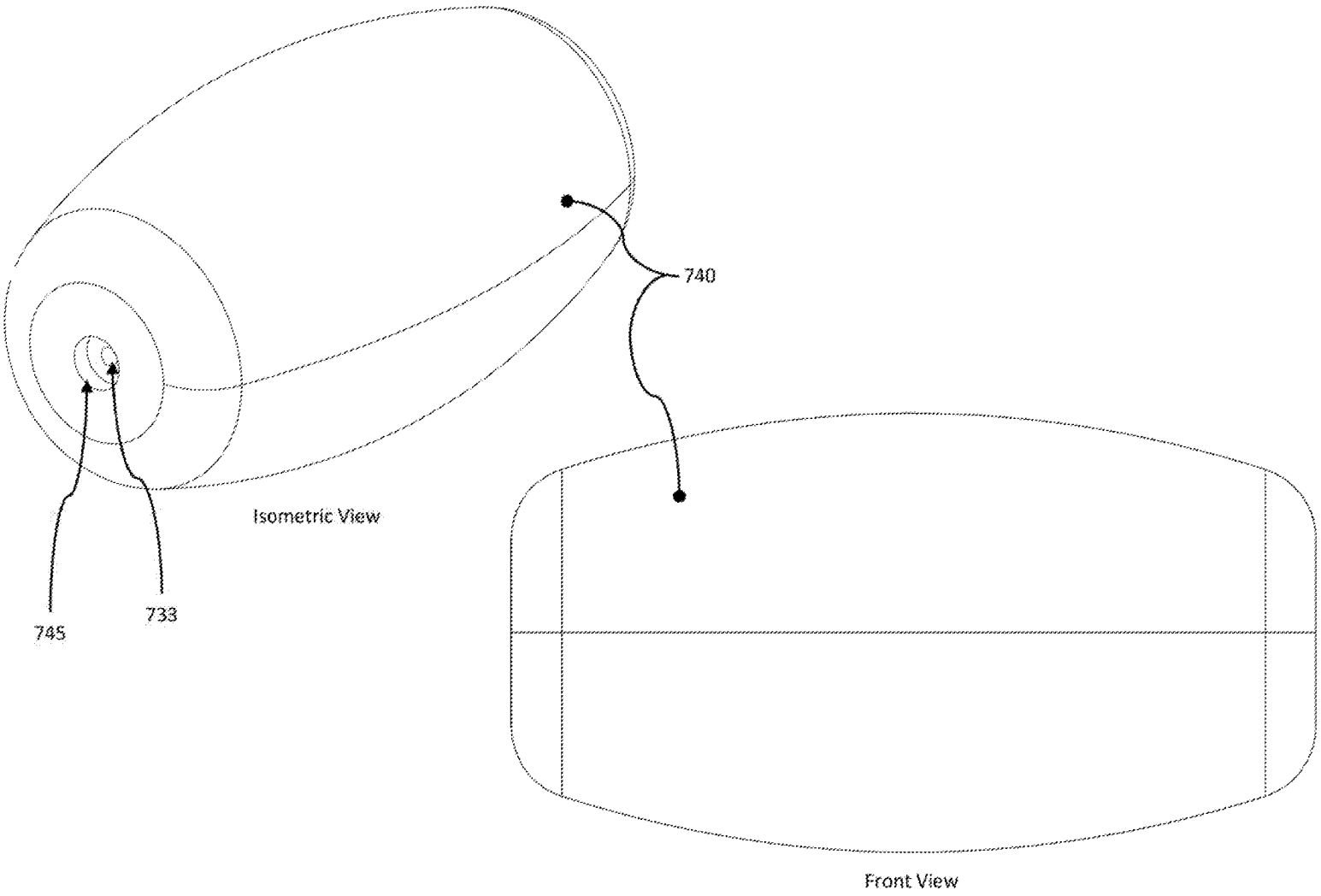

FIG. 7J is an isometric and a front view of the oval wheel 740. The isometric view shows the common elements for the insellion of the bearing spacer 738 (not shown) and bearing recess 745. The axel-rod through-hole 733 is for the axle rod 702 (see FIG. 7H). The oval wheel 740 will be the root geometry from which other shape profiles will be designed. The oval, circular, and rounded shapes are important If flat cylindrical geometries were used, rotation about the pivot-pin 720 (not shown) would require significantly more torque or be impossible to turn.

Figure 7K:
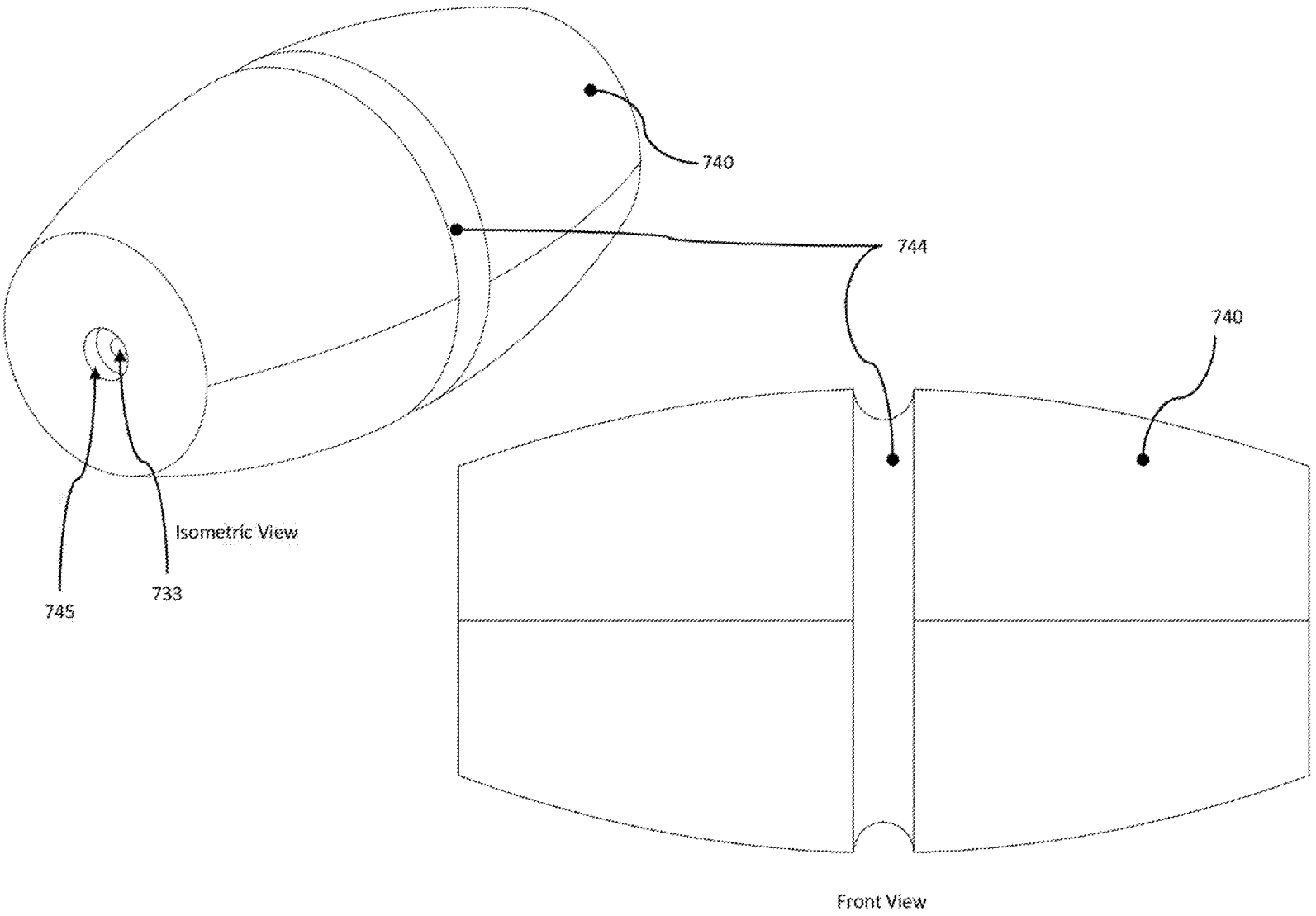

FIG. 7K is an isometric and a front view of the U-groove wheel 744. The isometric view shows the common elements for the insertion of the bearing spacer 738 (not shown) and hearing recess 745. The through-hole 733 is for the axle rod 702 (see FIG. 7H). The front view shows the U-groove wheel 744 that will give the rider the capability of riding handrails and other curvilinear surfaces. The U-groove wheel 744 is machined, molded, or formed into the oval wheel 740.

Figure 7L:
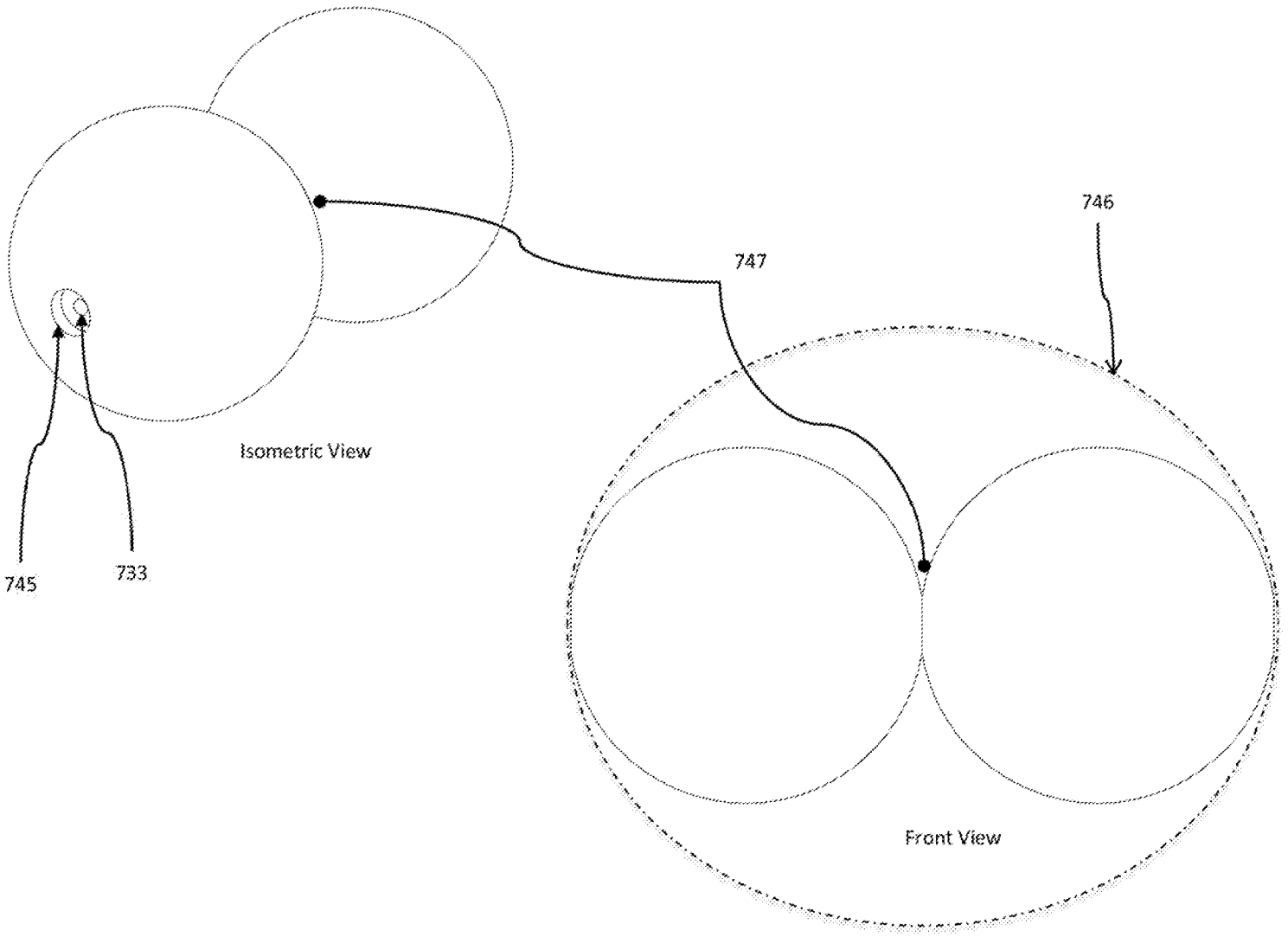

FIG. 7L is an isometric and front view of the double-sphere wheel 747. The isometric view shows the common elements for the insertion of the bearing spacer 738 (not shown) and hearing recess 745. The through-hole 733 is for the axle rod 702 (see FIG. TH). The front and isometric views show the profiles of the two spheres that will allow for riding on linear geometrical surfaces. The front view of FIG. 7L depicts the double-sphere wheel 747 expanding into a single sphere or full-sphere wheel 746 as illustrated by the dashed circle.

Figure 7M:
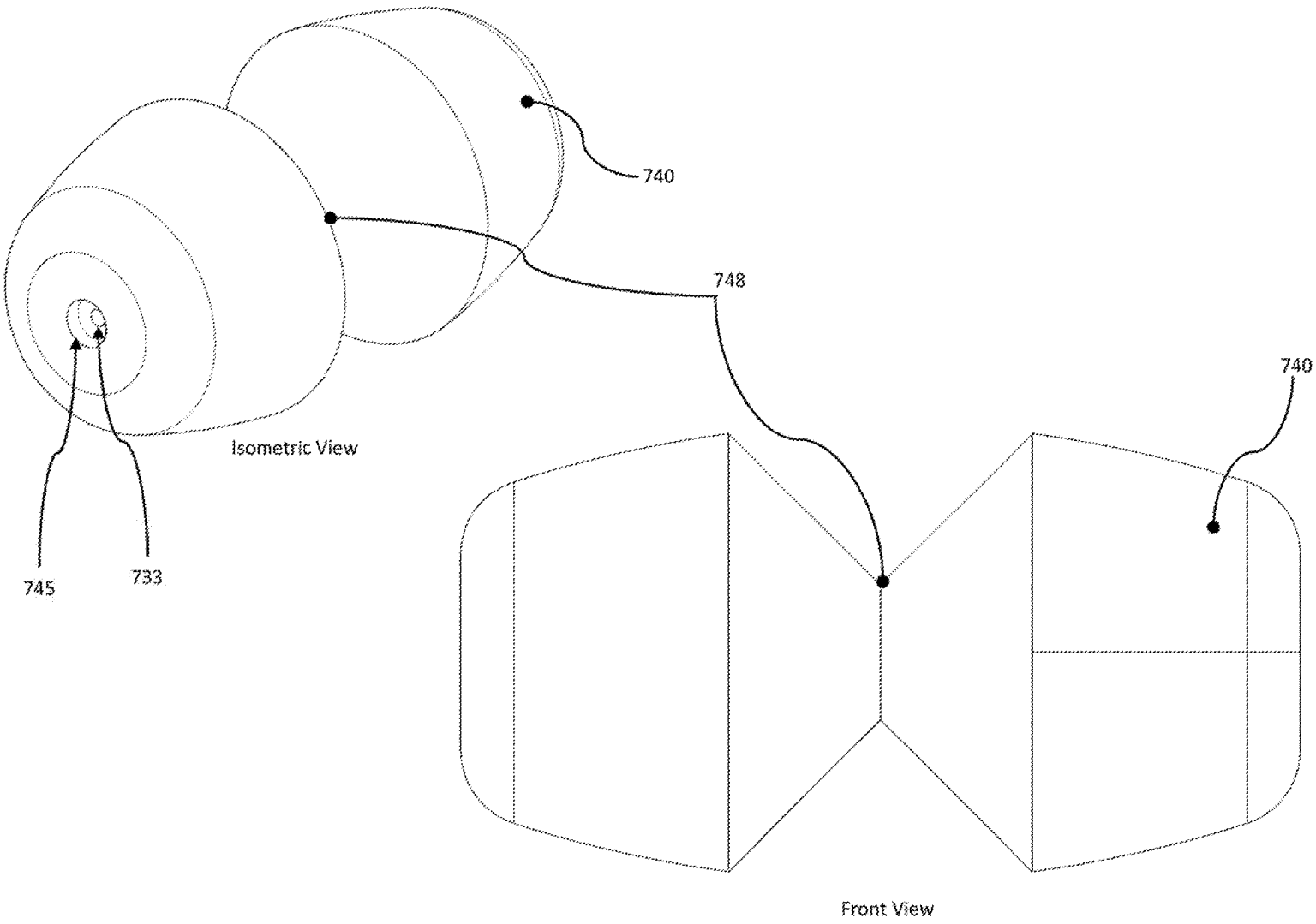

FIG. 7M is an isometric and front-end view of the deep V-grooved wheel 748. The isometric view shows the common elements for the insertion of the bearing spacer 738 (not shown) and bearing recess 745. The through-hole 733 is for the axle rod 702 (see FIG, TH). The front view shows the deep V-groove wheel 748 that will give the rider the capability to negotiate curbs, handrails and other grinding surfaces without damaging the skateboard or the riding surfaces. The deep V-groove wheel 748 is machined or molded into the oval wheel 740.

Figure 7N:
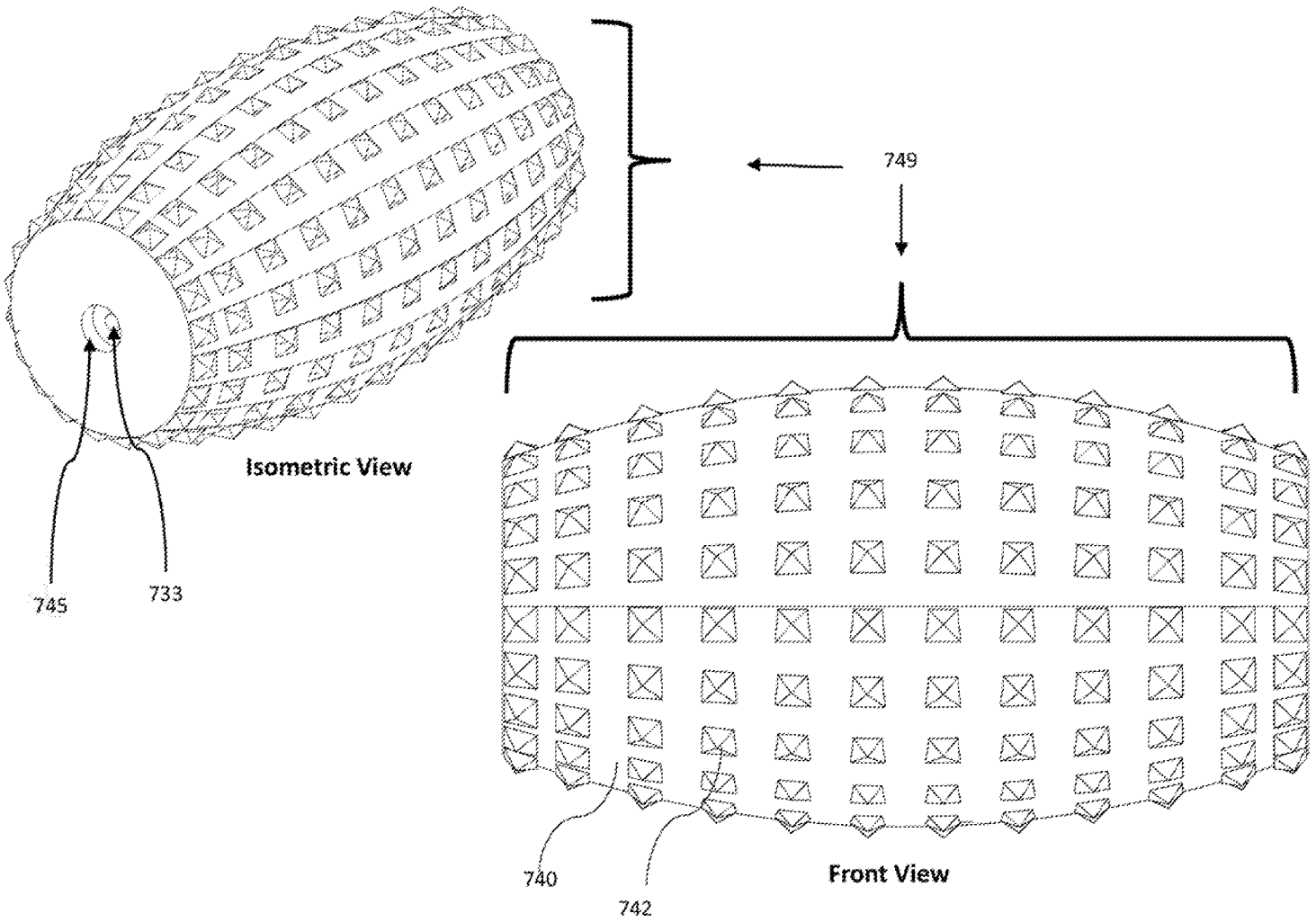

FIG. 7N is an isometric and front-end view of the stud wheel 749. The isometric view shows the common elements for the insertion of the bearing spacer 738 (not shown) and bearing recess 745. The through-hole 733 is for the axle rod 702 (see FIG. 7H). The oval wheel 740 is the starting form for stud wheel 749, and designed for Ice racing or traversing icy terrains, A stud 742 is inserted into the skateboard wheel material, which is typically polyurethane. Machining casting or forming these wheels with different compounds, such as polyurethane and the insertion or encapsulation of the studs 742 or cone structure, will create an adequate gripping surface on the ice or slippery surface. The diamond features represented by stud 742 in the stud wheel 749 need not he metal inserts.

Figure 8A:
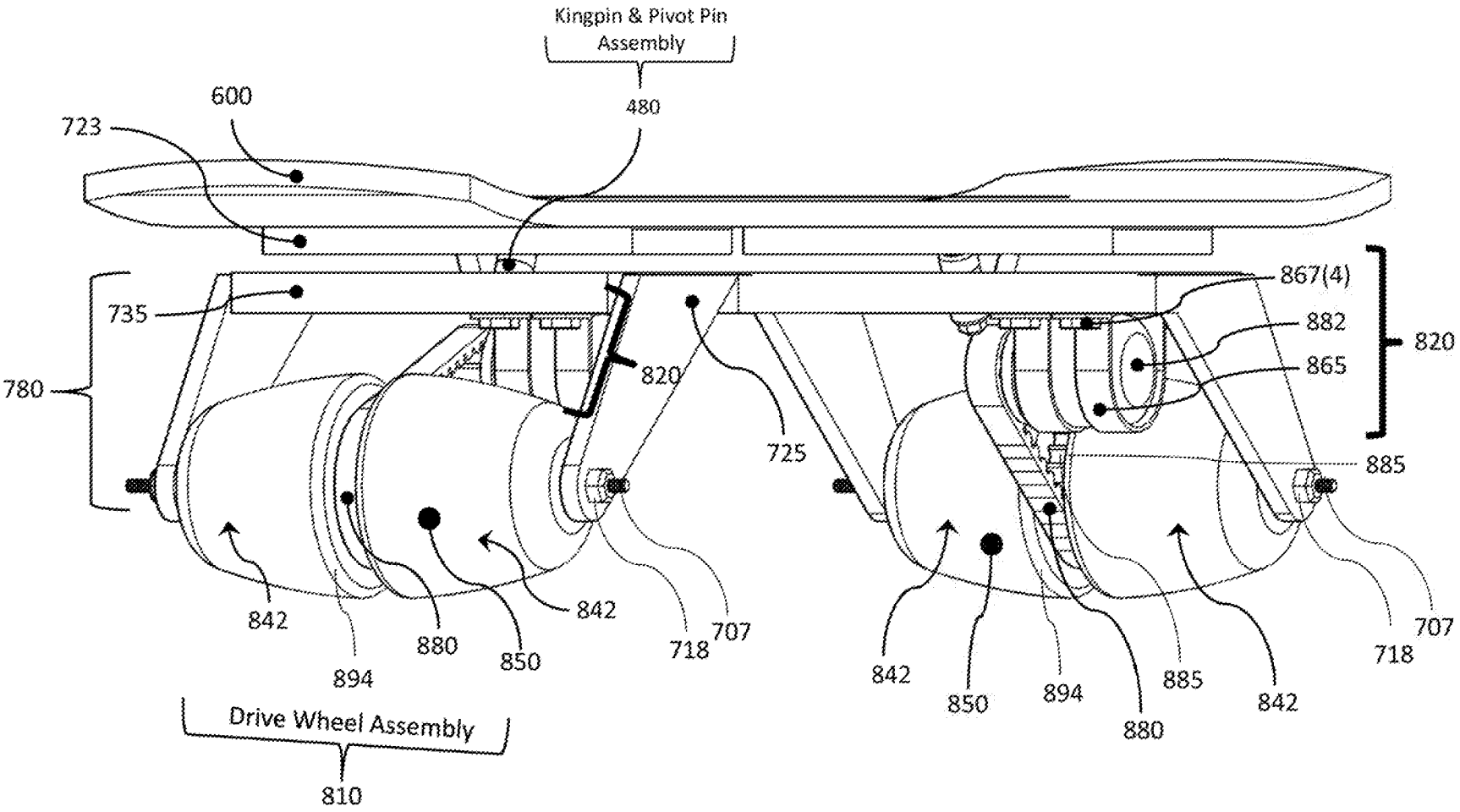
FIG. 8A is an angled side view of a motorized skateboard showing the drive-wheel assembly, the motor drive assembly and the transom fork hanger.

FIG. 8A is an angled side view of a motorized skateboard. This figure shows two motor assemblies 820 that mount on the underside of the transom plate 735. The transom fork hanger assembly 780 is comprised of the transom plate 735 and the fork hanger 725, The skateboard deck 600, formerly skateboard deck 100 in FIG. 1, is fastened to the base plate 723 in the same manner as described in FIG. 4B. The kingpin & pivot pin assembly 480 attaches the base plate 723 and to the transom plate 735 as described in FIG. 4B. Attached to the fork hanger 725 is the drive wheel assembly 810. The drive wheel assembly 810 is mounted to the transom fork manner assembly 780 as described in FIG. 7H. The mounting of the drive wheel assembly 810 is identical to the drive wheel assembly 630 with the exception that the drive belt 880 is added to the wheel drive gear 885 before assembly. The oval drive wheel 850, used in the drive wheel assembly 810, is a specialized wheel and has a wheel drive gear 885 mounted between two identical oval wheel hubs 842. The drive belt 880 drives the drive gear 885. The motor 882 is mounted to the underside of the transom plate 735 with the motor mounting clamps 865 and secured with bolts 867.

Figure 8B:
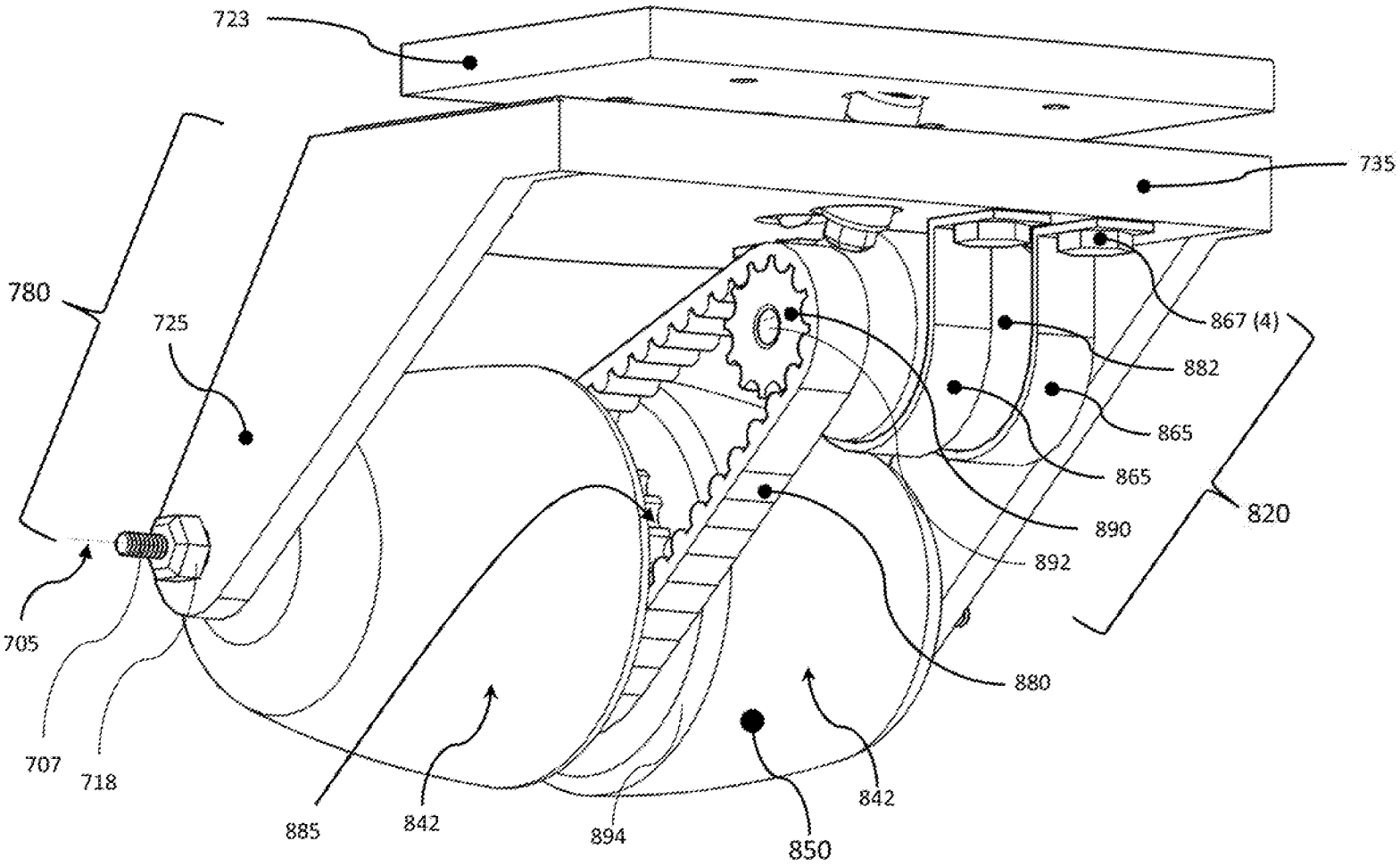
FIG. 8B is a lower side view of the underside of the transom fork hanger illustrating the relationship of the motor assembly and the oval drive wheel.

FIG. 8B is a lower side view of the underside of the transom fork hanger 780. This view better illustrates the relationship of the motor assembly 820 and the oval drive wheel 850. The motor assembly 820 includes the motor mounting bolts 867, motor mounting clamps 865, motor 882, the drive gear 890, motor spindle 892 and not shown, the drive gear setscrew 881, The transom plate 735 has mounted to its underside a motor 882, which is held in place by two motor mounting clamps 865, The motor mounting clamps 865 are affixed to the underside of the transom plate 735 by four bolts 867. The underside-mounted motor 882 has attached to its motor spindle 892 a drive gear 890. The drive gear 890 turns the drive belt 880, which drives the wheel drive gear 885. The wheel drive gear 885 rotates the two oval wheel hubs 842 about the axis of rotation 705.

Figure 8C:
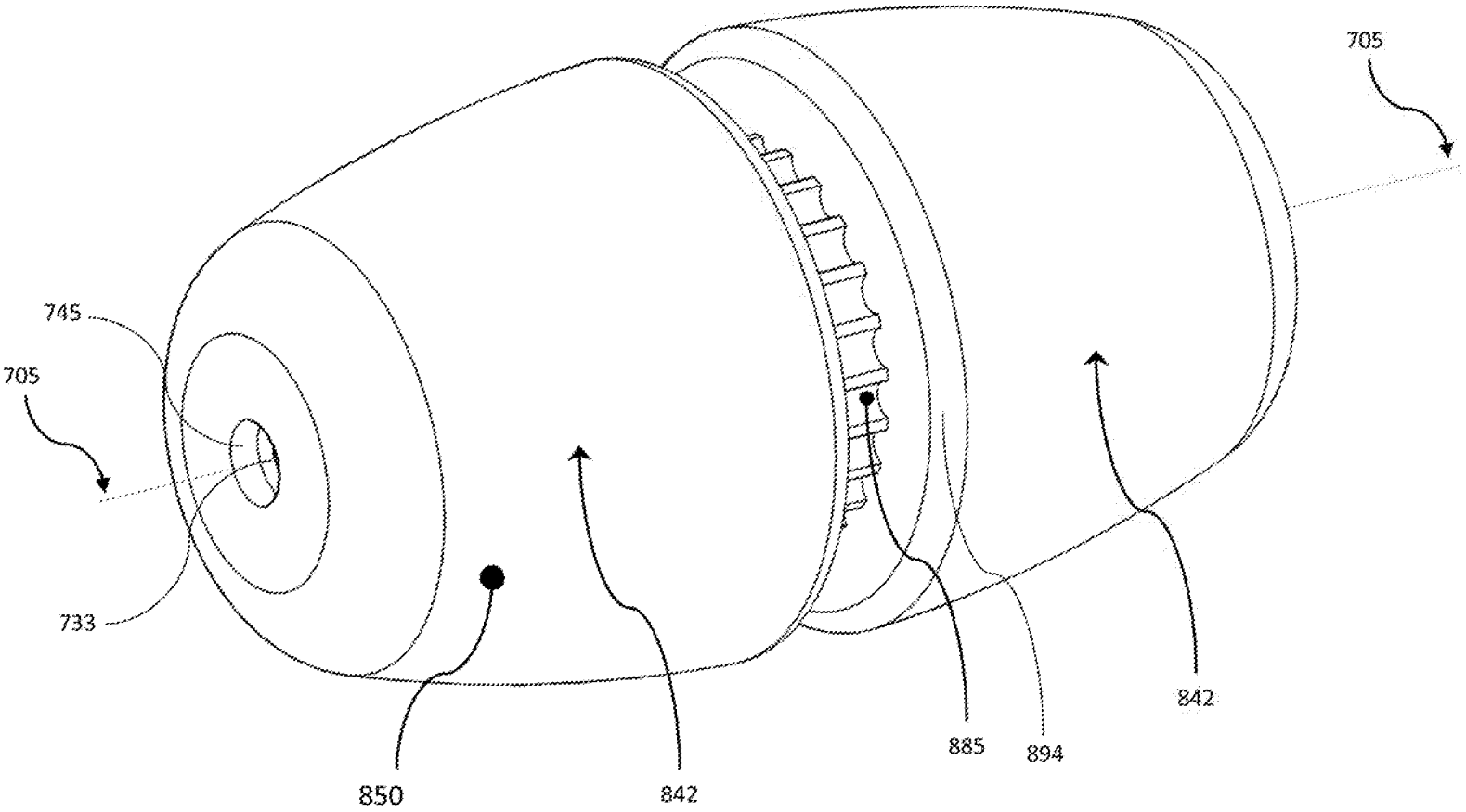
FIG. 8C is an isometric view of the oval drive wheel.

FIG. 8C is an isometric view of the oval drive wheel 850. The oval drive wheel 850 can be a monolithic piece manufactured by molding, casting or other forming methods. The oval drive wheel 850 has two oval wheel hubs 842 with an interposing wheel drive gear 885. The isometric view shows the common elements for the insertion of the bearing spacer 738 (not shown) and hearing recess 745. The through-hole 733 is for the axle rod 702 (see FIG. 7H). There is a chamfer 894 on the inside of the oval wheel hubs 842. The chamfer 894 maintains alignment of the drive heh 880 (see FIG. 8B) and prevents unnecessary wear by keeping it centered.

Figure 8D:
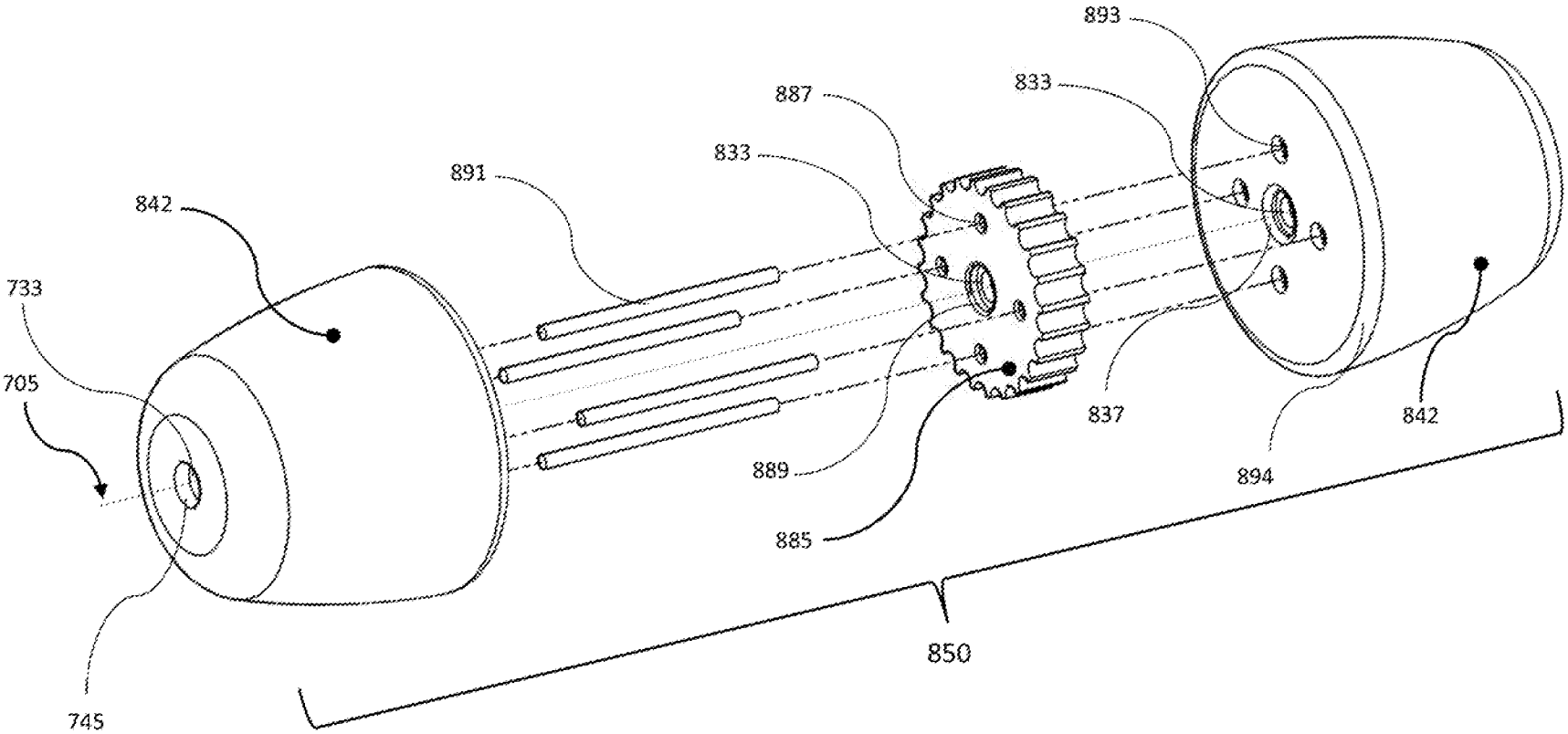
FIG. 8D is an isometric view of the oval drive wheel and illustrates the relationship of the drive gear to the oval wheel halves.
Figure 8E:
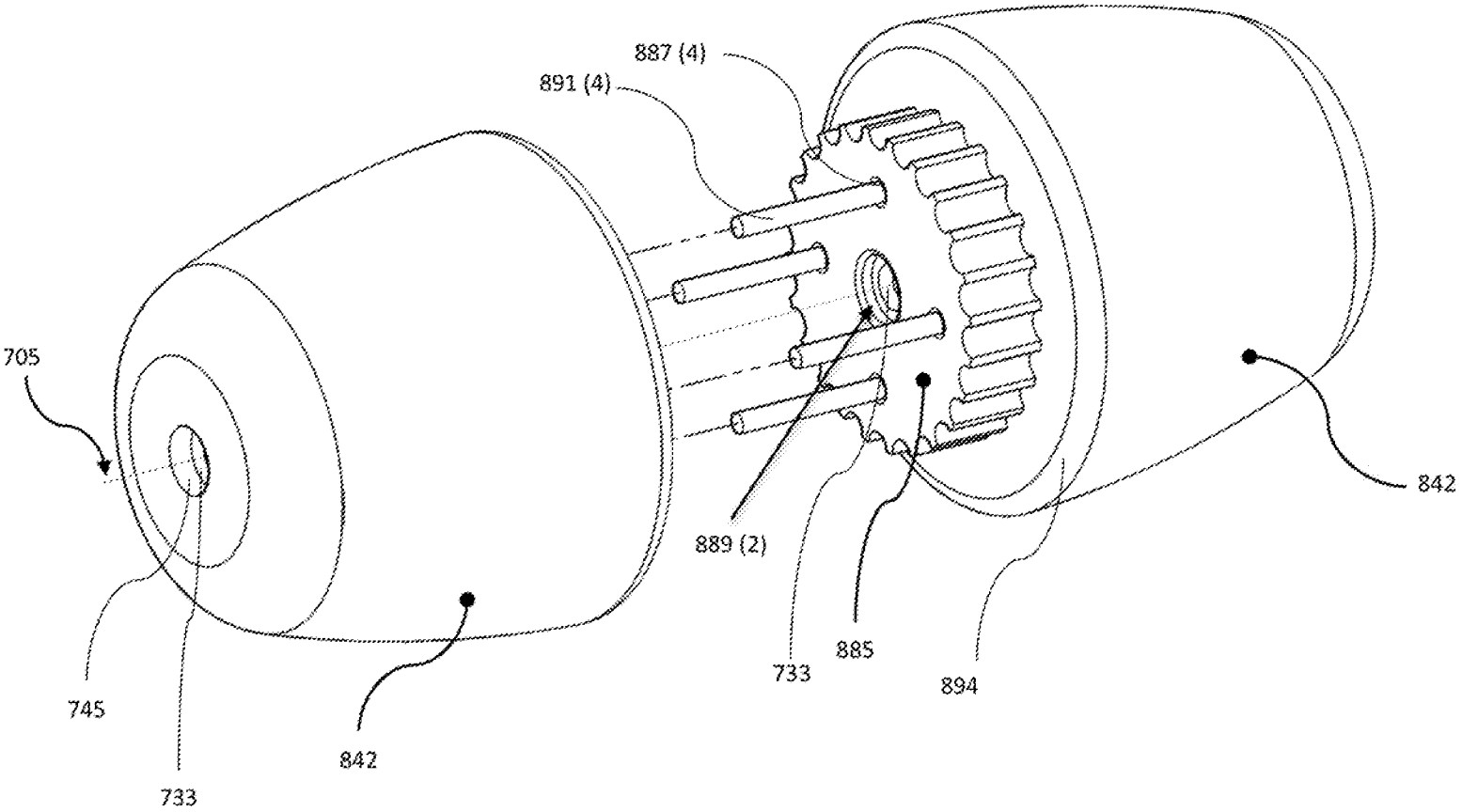
FIG. 8E is an isometric view of a partially assembled drive wheel.
Figure 8F:
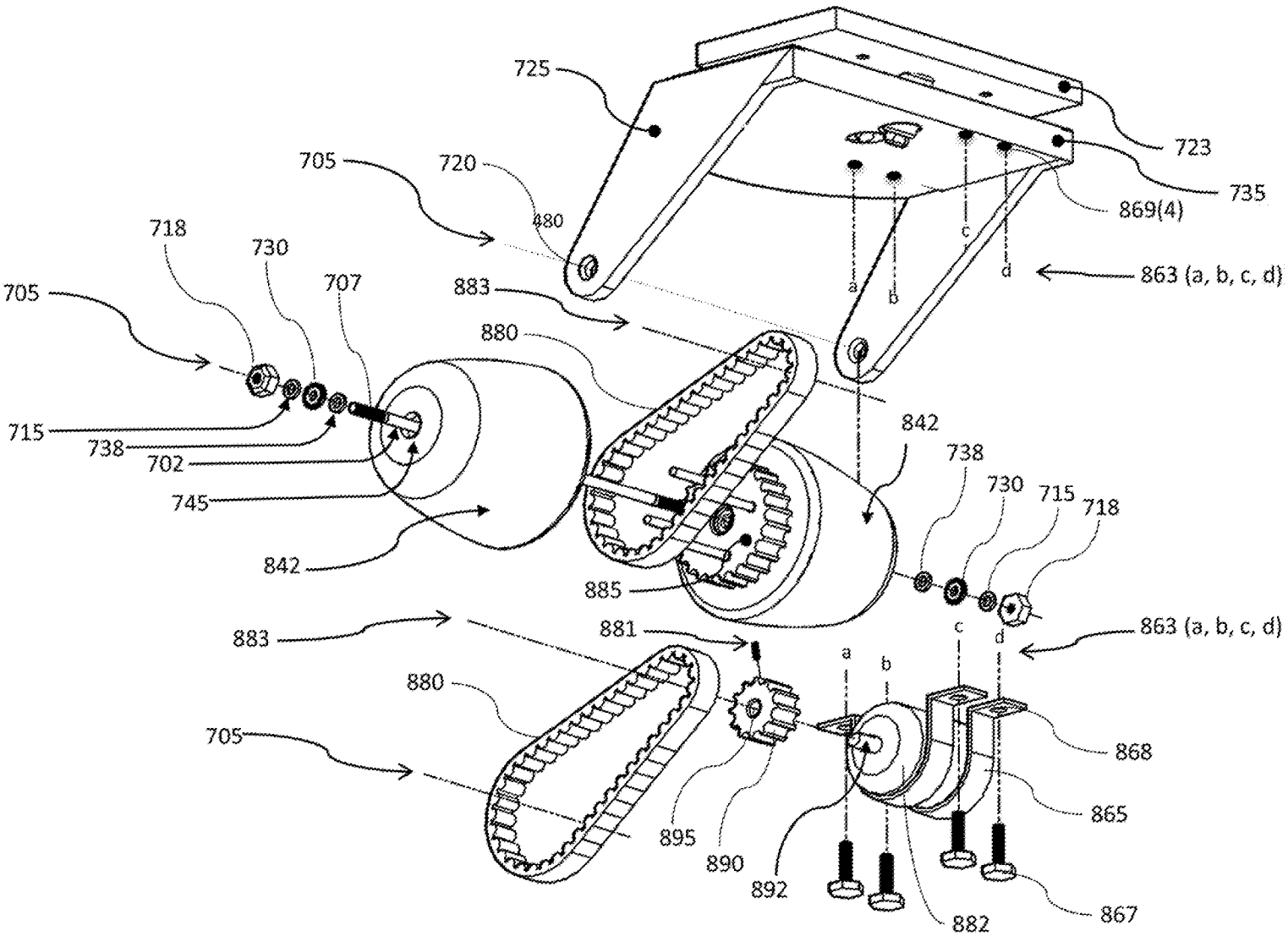
FIG. 8F shows an expanded isometric view of the undercarriage of the transom plate and the staging of the component assembly.

FIG. 8D is an expanded elevated off-axis view of the oval drive wheel 850 and illustrates the relationship of the drive gear 885 to the wheel halves 842. In contrast to the monolithic body in FIG. 8C, this design shows a reconfigurable oval drive wheel 850, The two wheel halves 842 are joined together with wheel drive gear 885, which can be large or small. The size of the wheel drive gear 885, in conjunction with the drive gear 890 (not shown), dictates speed. The alignment rods 891 pass through the wheel drive gear 885 through through-holes 887 and are press-fit into the receiving holes 893 of the wheel hubs 842. The invention also incorporates a bearing recess 889 within the wheel drive gear 885. This bearing recess 889 is located on both sides of the wheel drive gear 885 and is on the axis of rotation 705. A bearing recess 837 is located on the inside of the wheel hubs 842. This bearing recess 837 is a load sharing option. This optional bearing recess 837 is for heavy loads or large skateboards to distribute the weight more uniformly. A bearing recess 745 is located on the outside of the wheel hub 842. Axel-rod through-hole 733 provides a pass through for the axel-rod 702 (see FIG. 7H). Axel-rod through-holes 833 are used for wheel drive gear 885 assembly, FIG. 8E is an isometric view of a partially assembled drive wheel 850. The wheel axis of rotation is 705. The bearing recess is located at 745. Inserting the alignment rods 891 into the receiving holes shown in FIG. 8D completes the assembly of the wheel drive gear 885. The gear bearing recess 889 is also part of the access hole 733 for the axel-rod 702 (not shown). Pushing these two wheel hubs 842 together for a completed drive gear wheel 850 completes the oval drive wheel assembly 850. Just visible is the axel-rod through-hole 733 for the axel 702, which passes through all of the components of the drive wheel 850, FIG. 8F shows an expanded isometric view of the undercarriage of the transom plate 735 and the staging of attaching the components. The transom plate 735 is attached to the base plate 723 through the kingpin & pivot pin assembly 480 (see FIG. 8A).

There are two axis of rotation in FIG, SF that involve drive belt 880. The first axis of rotation is 883 of the motor spindle 892 and the second axis of rotation is 705 of the drive wheel assembly 850 as shown in FIG. 8D. Although one drive belt 880 is used in the assembly, it is represented twice to illustrate its function with regard to the two axis of rotation 883 and 705.

The motor 882 is attached to the bottom of the transom plate 735 by using two motor mounting damps 865 along with four attachment bolts 867. These attachment bolts 867 follow the alignment markings 863 (*a, b, c, d*) through the through-holes 868 of the motor mounting clamps 865 to the threaded-holes 869 in the bottom of the transom plate 735. The drive gear 890 is mounted on the motor spindle 892 and held in place with setscrew 881.

The oval drive "Wheel assembly 850 is assembled as indicated in FIG. 8D. The drive belt 880 is placed into position around the wheel drive gear 885. The oval drive wheel assembly 850 (see FIG. 8C) is placed between the hanger forks 725. The axel-rod 702 is introduced through the hanger forks 725 through the through-hole 720, which also defines the axis of rotation 705. The bearing to wheel spacer 738 is placed on the axel-rod 702 along with the bearing 730. The bearing 730 is seated in the bearing recess 745. Next, the appropriate hearing to fork spacer 716 is added, if needed, as shown in FIG. 7H, The axel-rod 702 spans both hanger forks 725 through the respective through-holes 720. On both sides of the hanger forks 725 are spacers 715 placed onto the threaded section 707 of the axel-rod 702, The locking nuts 718 are added and tighten on the threaded section 707, The drive belt: 880 is coupled to the drive gear 890, which is aligned to the axis of rotation 883 of the motor spindle 892.

Figure 8G:
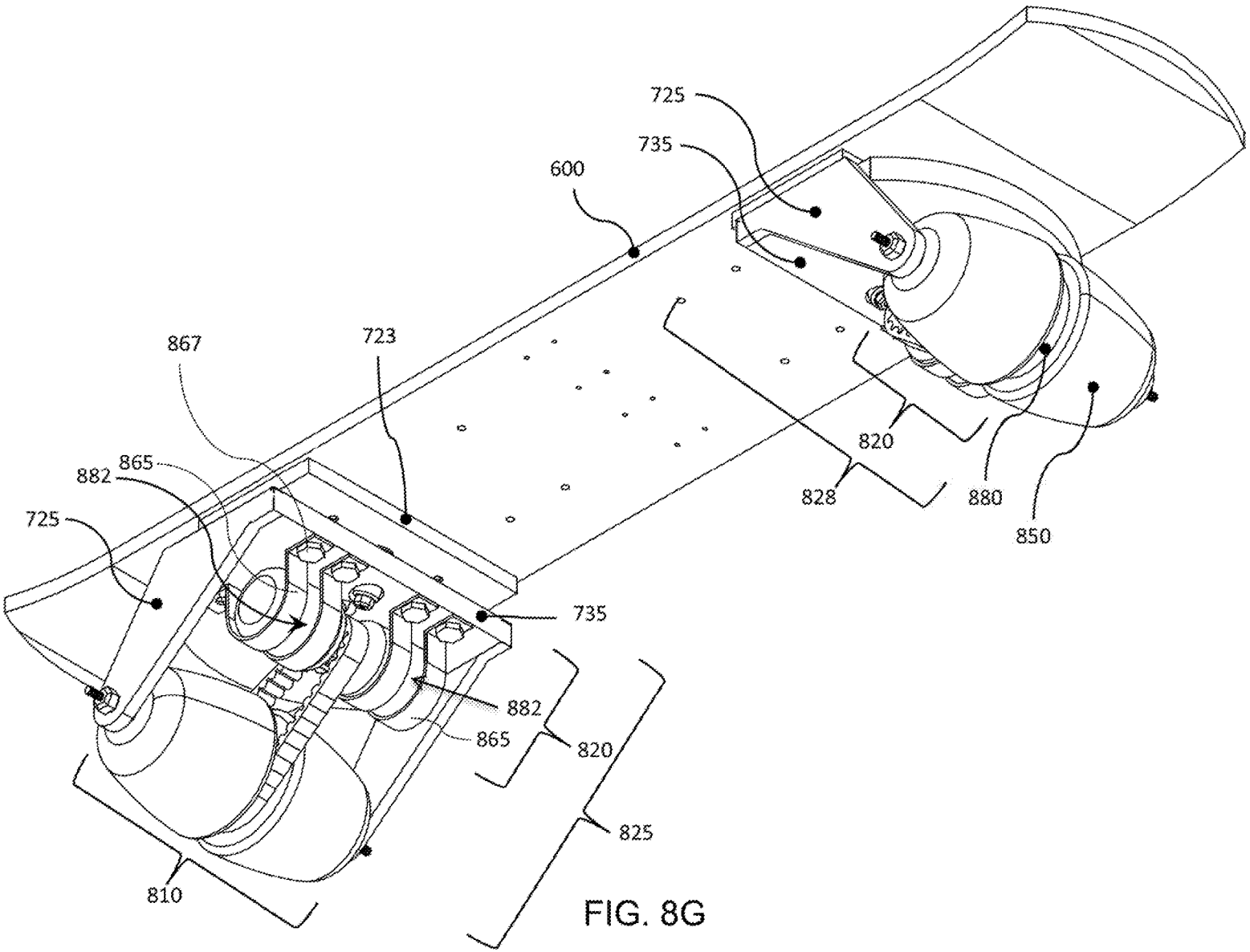
FIG. 8G is the off-axis underside view of the skateboard deck showing a two motor drive assemblies molmted on one transom fork hanger truck assembly.

FIG. 8G is the off-axis underside view of the skateboard deck 600 showing a dual motor transom fork hanger truck assembly 825. The dual motor transom fork hanger truck assembly 825 is made from assemblies: drive wheel assembly 810, two motor assemblies 820, and transom fork hanger assembly 780 (see FIG. 8B). This underside view shows there is room to incorporate another motor onto the same transom plate 723. Multiple motors will enhance the uphill capabilities speed or torque to distribute power. Also shown is a single motor transom hanger fork truck assembly 828.

Figure 8H:
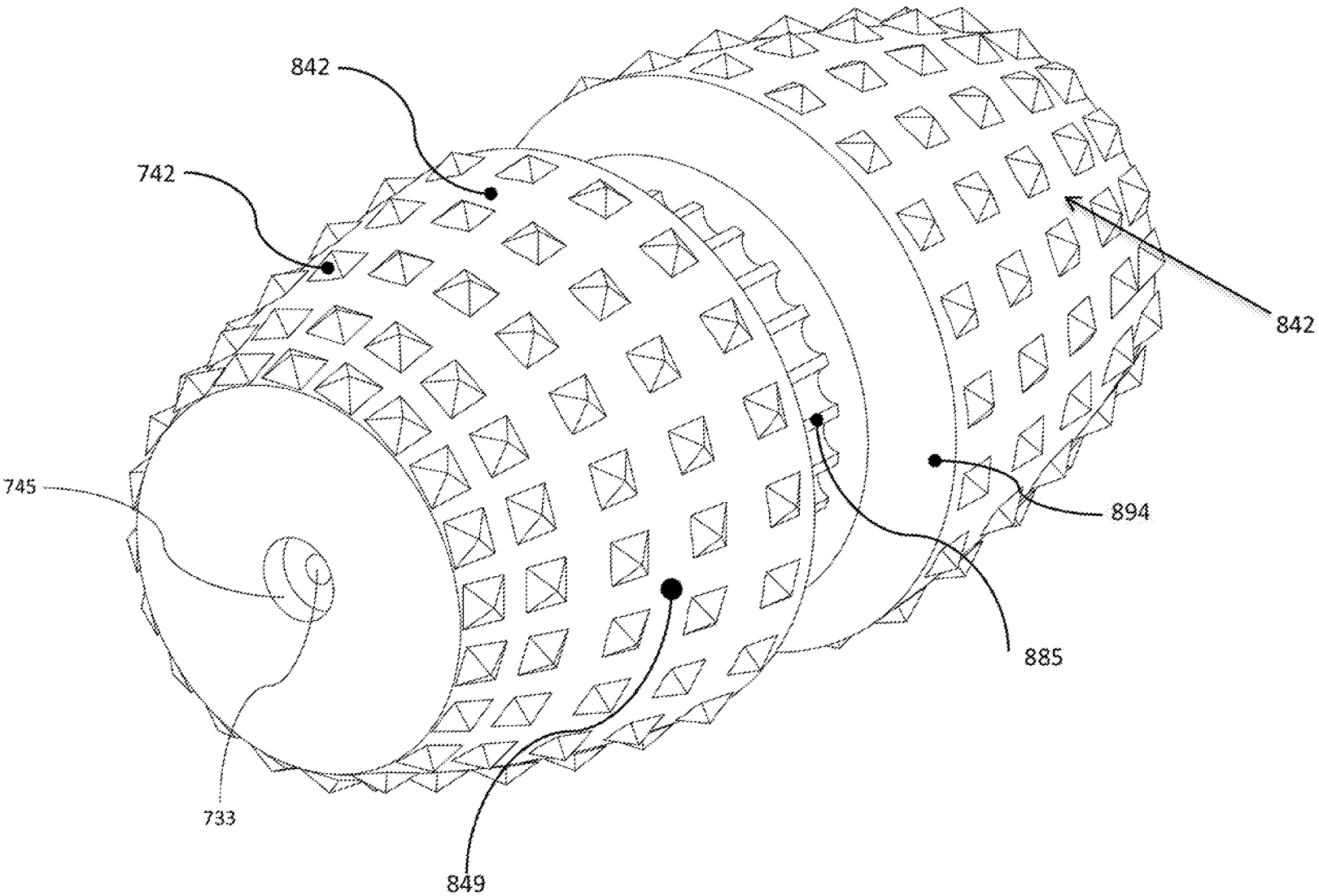
FIG. 8H is an isometric view of the studded drive wheel.

FIG. 8H is an isometric view of the studded drive wheel 849. The studded drive wheel 849 can be a monolithic piece manufactured by molding, casting or other forming methods. The studded drive wheel 849 has two oval wheel hubs 842 have an interposing wheel drive gear 885. The two oval wheel hubs 842 have studs 742 incorporated into or onto the surfaces. The isometric view shows the common elements for the insertion of the bearing spacer 738 (not shown) and bearing recess 745. The axel-rod through-hole 733 is for the axle-rod 702 (see FIG. 7H). There is a chamfer 894 on the inside of the oval wheel hubs 842. The chamfer 894 maintains alignment of the drive belt 880 (see FIG. 8B) and prevents wear by keeping it centered.

Figure 8I:
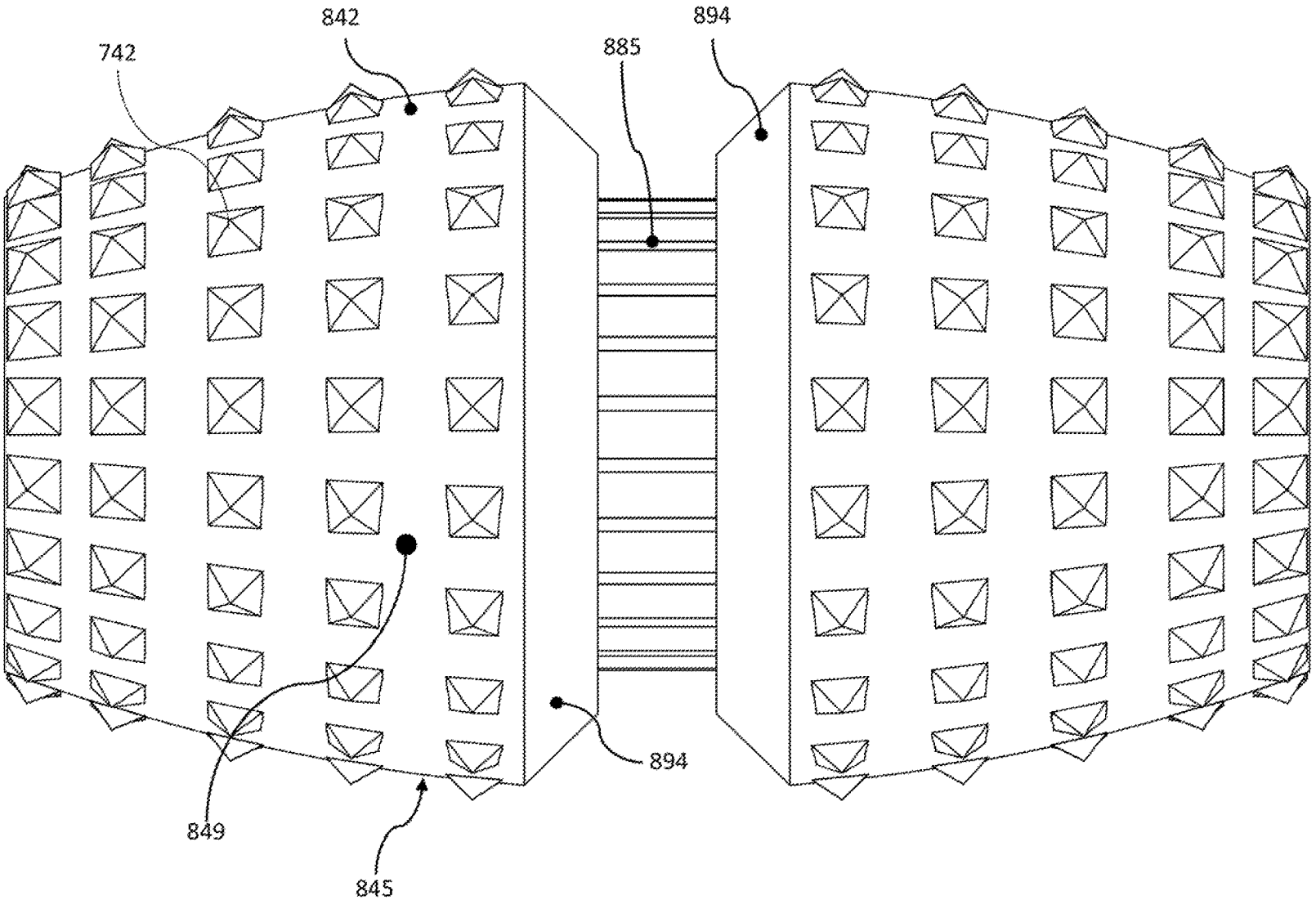
FIG. 8I is a front-end view of the studded drive wheel.

FIG. 8I is a front-end view of the studded drive wheel 849. The important elements of this studded drive wheel 849 include the tapering curve 845 of the oval wheel hubs 842 indicated by the tapering curve 845 and the high degree of traction provided by the studs 742. This studded drive wheel 849 can he manufactured by a molding, casting or forming process or assembled from parts similar to the method outlined in FIG. 8D.

Figure 8J:
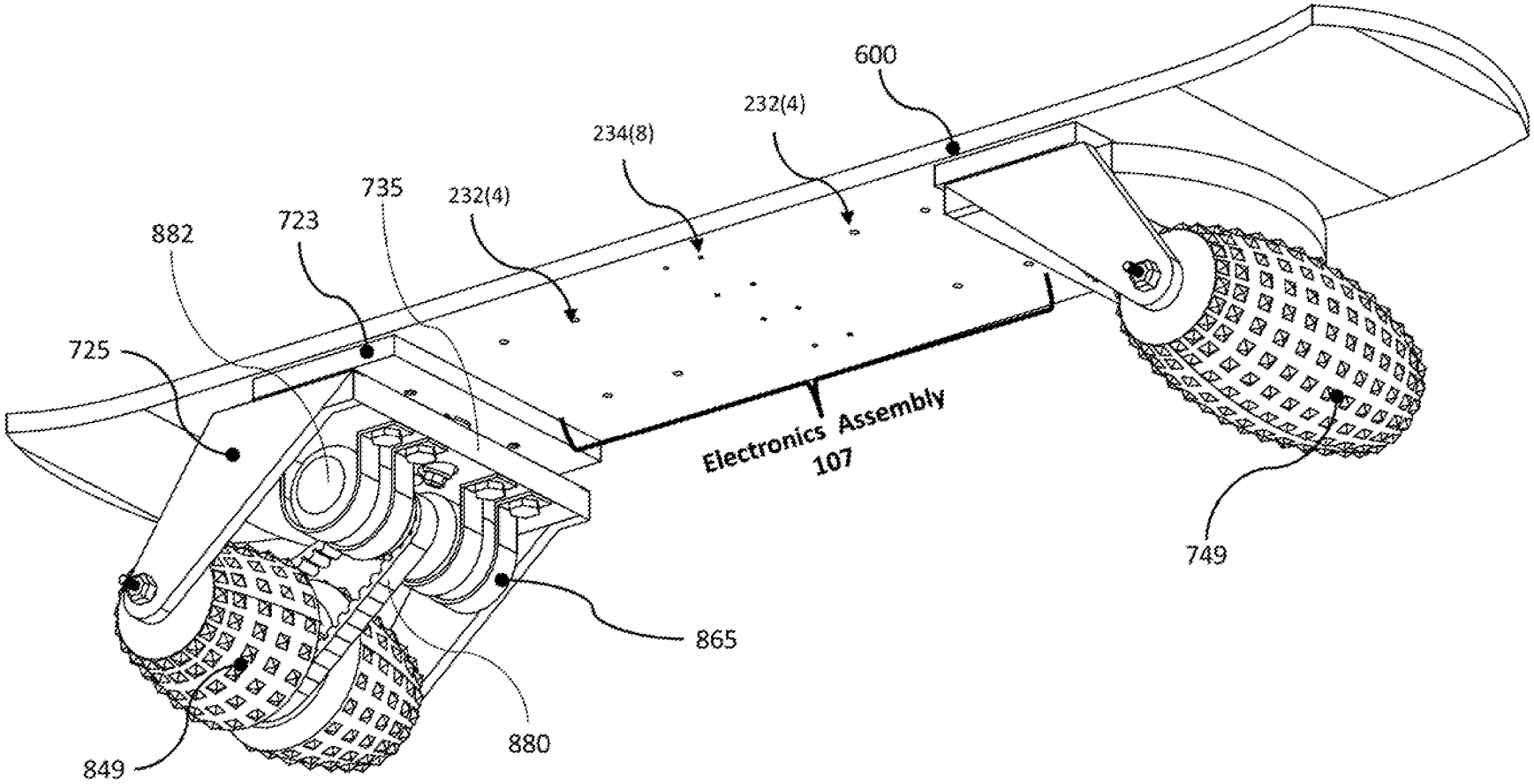
FIG. 8J is an underside isometric view of a dual motor transom fork hanger truck assembly with studded drive wheel and the non-motorized front-end transom fork hanger assembly with studded oval wheel.

FIG. 8J is fill underside isometric view of a dual motor transform fork hanger truck assembly 825 (see FIG. 8G) and the non-motorized front-end transom fork hanger assembly 780 with studded oval wheel 749. Skateboard deck 600 is ready for the attachment of the electronic assembly 107 via the through-holes 232, 234, and 232.

Figure 9A:
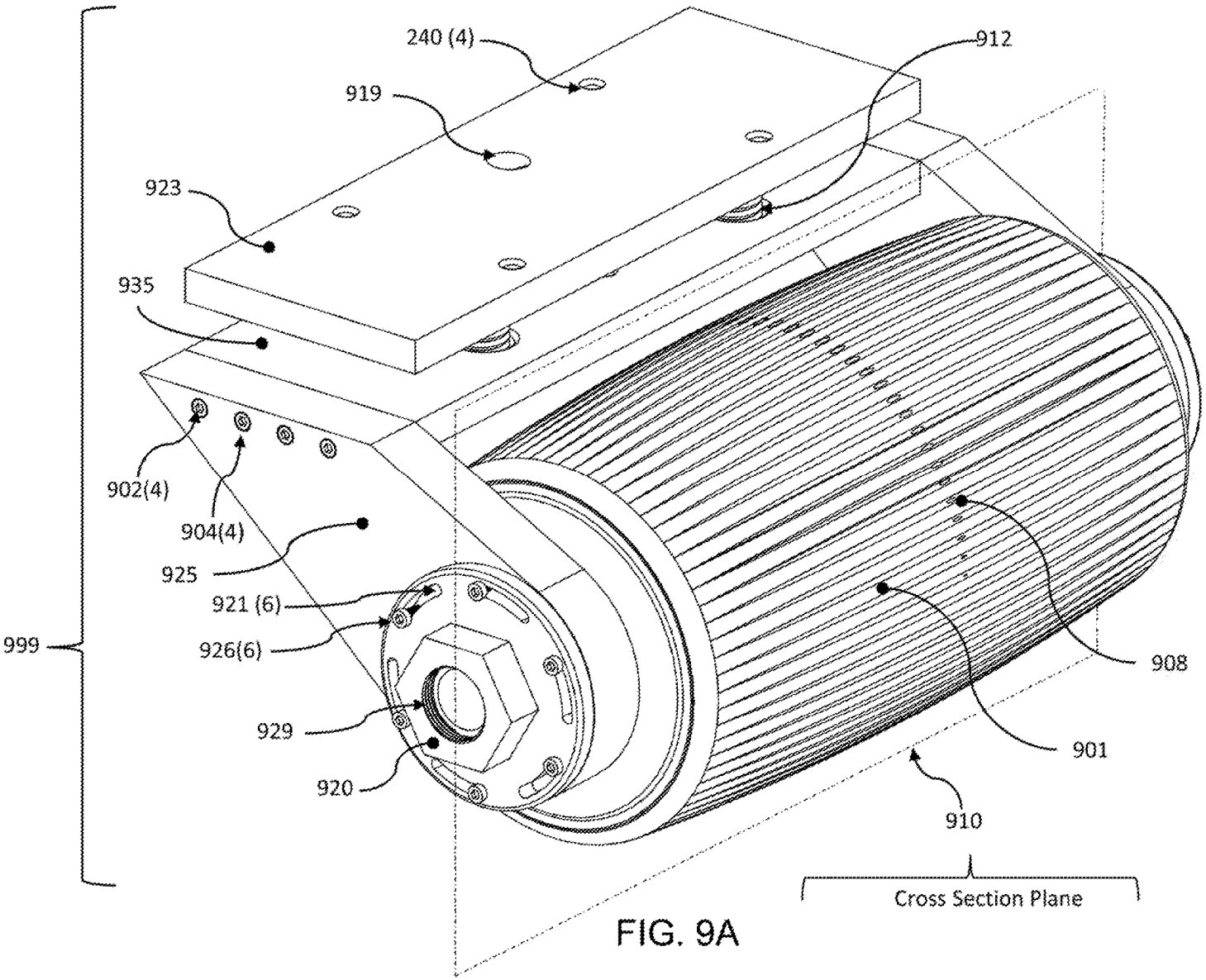
FIG. 9A is an isometric view of a two-bearing_transom fork hanger truck assembly.

FIG. 9A is an isometric view of a two-bearing transom fork hanger truck assembly 999. Also shown is the dashed line cross-section plane 910 that will be referenced in FIG. 9G. In this figure, the base plate 923 has threaded-holes 240. These threaded-holes 240 are used to fasten the skateboard deck 100 to the base plate 923 with component fasteners 220. The base plate 923 is similar to baseplate 250 in FIG. 2 and. to base plate 410 in FIG. 4. However, the base plate 923 is slightly wider to accommodate springs 912. The base plate 923 is connected to the transom plate 935 in the same manner as shown in FIG. 4B with the kingpin & pivot pin assembly 480. The fork hanger 925 is attached to the transom plate 935 'With bolts 902, which are inserted into through-holes 904. Also shown in this drawing is the motor axle flange-locking nut 920. This motor axle flange-locking nut 920 is fastened to the fork hanger 925 with bolts 926. These bolts 926 pass through slotted through-holes 921 and engage threaded-holes 928 (not shown) in the fork hanger 925. Also shown in FIG. 9A is the tire tread 901 with weep-holes 908 to allow excess adhesives to weep out from under the tire to minimize bubbling which would cause a bumpy ride.

Figure 9B:
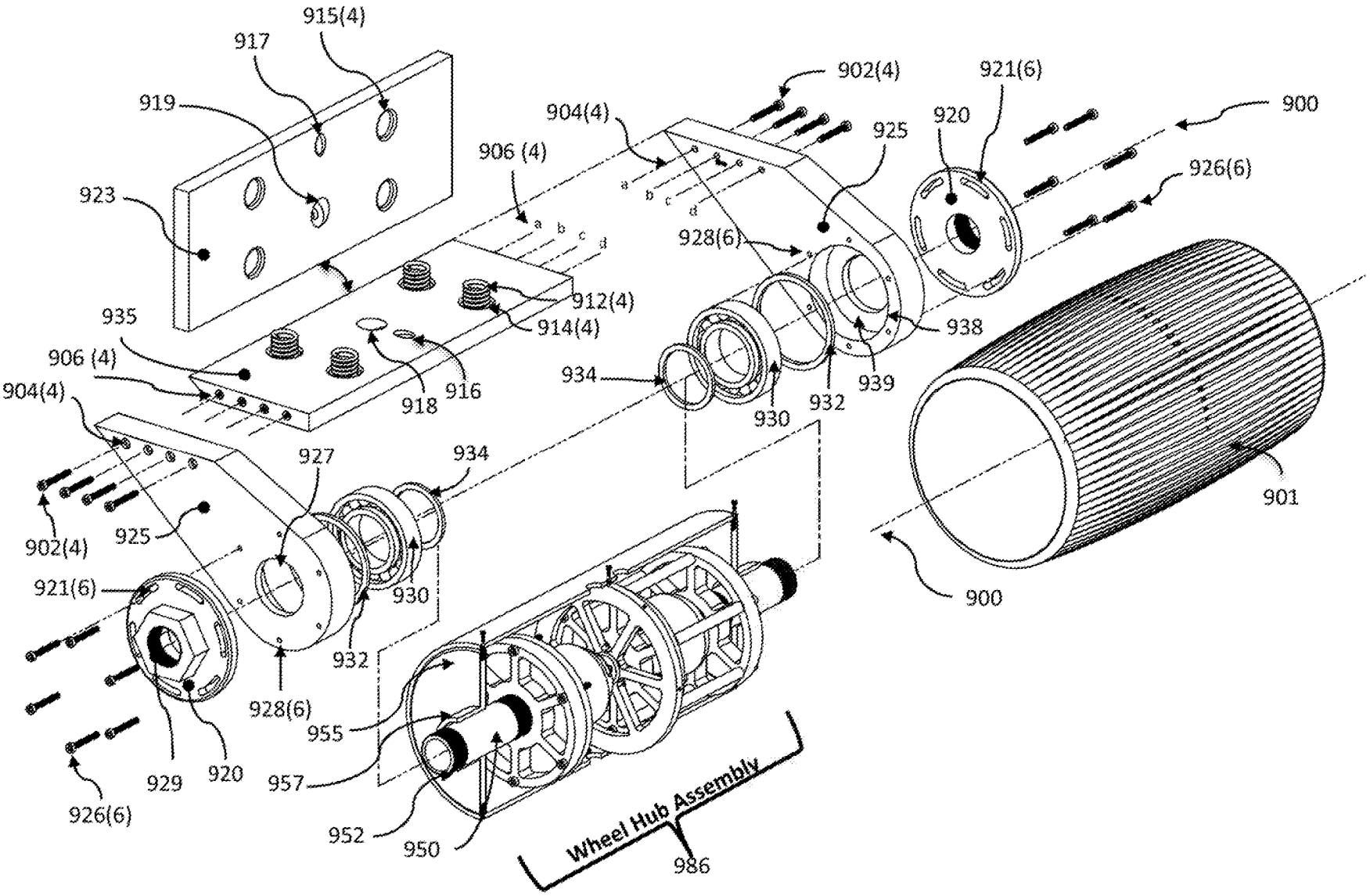
FIG. 9B is a compound expanded isometric view of the two bearing transom fork hanger truck assembly.

FIG. 9B is a compound expanded isometric view of the two-bearing transom fork hanger truck assembly 999. Base plate 923 has been rotated 90° out of its normal orientation to expose details that have been added. The base plate 923 has incorporated spring retaining-holes 915 into the bottom. The spring retaining-holes 915 will secure the top part of the spring 912 when the base plate 923 is in its normal horizontal position. The spring retaining-holes 914 located in the top surface of the transom plate 935 are required to contain springs 912. The pivot pin retaining-hole 916 is identical to pivot pin retaining-hole 402, see FIG. 48. Kingpin through holes 919 and 918 are in the base plate 923 and the transom plate 935, respectively. The transom plate 935 and the fork hanger 925 are bolted together with bolts 902. The bolts 902 pass through through-holes 904 and are tightened into the threaded holes 906 in the side of the transform plate 935, This is symmetric with regard to the opposite fork hanger 925.

Figure 9C:
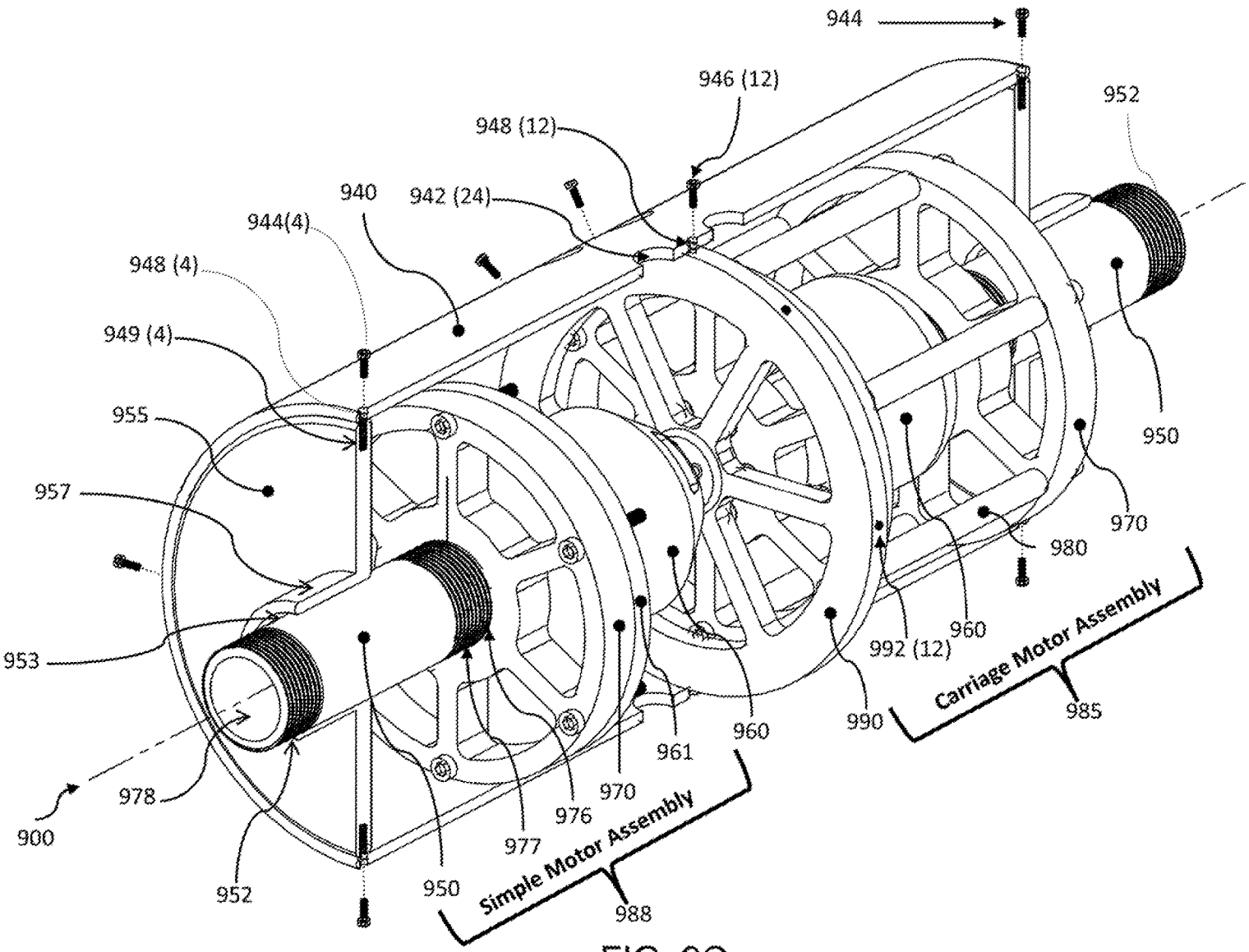
FIG. 9C is an isometric cross-sectional view of the wheel hub assembly and an isometric side view of the internal components of the carriage motor assembly and the simple motor assembly.

The fork hanger 925 has a bearing retention hole 938 and a stop wall reference 939. The large bearing spacer 932 fits into the hearing retention hole 938 and rests against the stop wall reference 939. Bearing 930 is seated into the bearing-retaining hole 938 flush with the large bearing spacer 932 preventing any binding of the hearing surfaces that would cause friction. The tire skin 901 is shown off of the wheel hub assembly 986. The tire skin 901, wheel hub assembly 986, and inner race of bearing 930 al I rotate about the axis of rotation 900. The small bearing spacer 934 is placed on the wheel hub axel 957. The small bearing spacer 934 will prevent the outer bearing race of bearing 930 from rubbing the wheel hub flange 955. With the large bearing spacer 932 and small bearing spacer 934 in place, the wheel hub assembly 986 can slide into the bearing 930. The inner bearing race of bearing 930 fits snugly over the wheel hub axel 957. This will allow the external threads 952 of the hollow motor axle union 950 to pass through the fork hanger through-hole 927, By tightening the motor axle flange-locking nut 920 onto the external threads 952 of the stationary hollow motor axle union 950, while engaging its internal threads 929 with the external threads 952, will secure the wheel hub assembly 986. The tire skin 901 is placed on the wheel hub assembly 986 prior to it being installed within the fork hangers 925. This will allow the wheel hub assembly 986 to freely rotate with the tire skin 901. The wheel hub assembly 986 and its contents will be described in FIG. 9C FIG. 9C is an isometric cross-sectional view of the wheel hub assembly 986, an isometric side view of the internal components of the carriage motor assembly 985, and the simple motor assembly 988, which will be described in FIG. 9E and FIG. 9F, respectively. The wheel hub assembly 986 is made up of the wheel hub flange 955, wheel hub axel 957, the wheel hub drum 940, and the motor torque transfer wheel 990. The wheel hub flange 955 and the wheel hub drum 940 are fastened together with fasteners 944, The fasteners 944 are received by the threaded-holes 949 and passed through the countersunk through-holes 948. The interior of the wheel hub assembly 986 contains the torque transfer wheel 990. This motor torque transfer wheel 990 is fastened to the wheel hub drum 940 with fasteners 946. These fasteners 946 are screwed into threaded-holes 992 on the circumference of the motor torque transfer wheel J90. This motor torque transfer 'Wheel 990 will be described in detail in FIG. 90.

The wheel hub assembly 986 rotates around the axis of rotation 900. The through-hole 978 of the stationary hollow, motor axle union 950 serves as a passage for the electrical conduit 328 from the batteries 310 (see FIG. 3) to the motors 960. The non-interference zone 953 is an open space between the inside surface of wheel hub axel 957 and the outside surface of the stationary hollow motor axle union 950. The external threaded end 977 of the stationary hollow motor axle union 950 engages the motor mount flange 970 of the simple motor assembly 988, by threading into the internal threads 976. Similarly, the external threaded end 977 of the stationary hollow motor axle union 950 engages the motor mount flange 970 of the carriage motor assembly 985, by the threading into the internal threads 976 as shown in FIG. 9E.

Figure 9D:
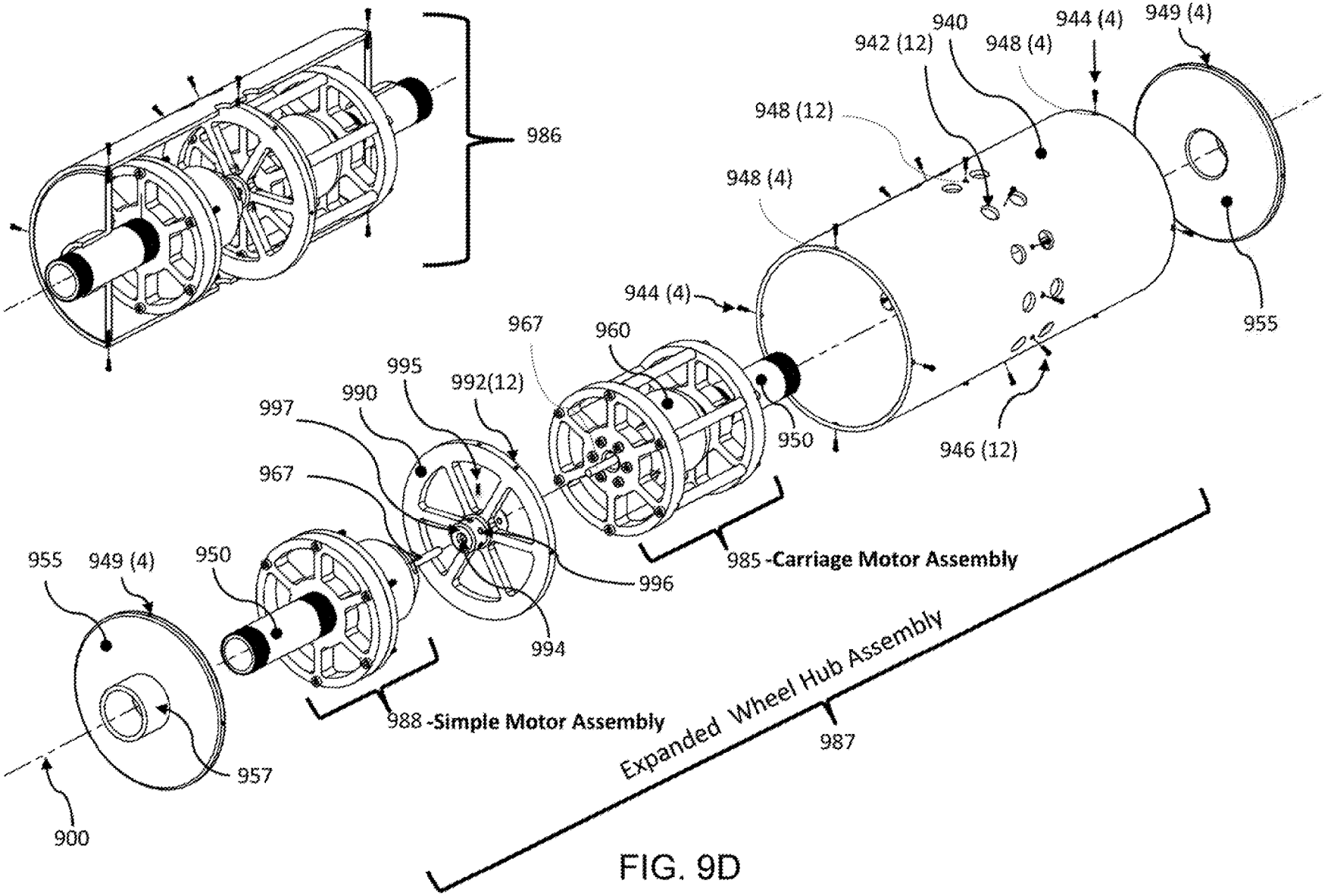
FIG. 9D is an isometric view of the wheel hub assembly and shows the expanded perspective view of the internal contents that drive the wheel hub assembly.

FIG. 9D shows isometric views of the wheel hub assembly 986 (inset) and the internal contents of the expanded wheel hub assembly 987. The expanded wheel hub assembly 987 is made up of the wheel hub flange 955, wheel hub axel 957, the wheel hub drum 940, the motor torque transfer wheel 990, the simple motor assembly 988, and the carriage motor assembly 985. The wheel hub drum 940 has counter sunk through-holes 948 for the fasteners 946 that thread into the threaded-holes 992 of the motor torque transfer wheel 990. The motors 960 are connected to the motor torque transfer wheel 990 by locking the motor spindle 967 into the motor spindle locking hub through-hole 994, The motor spindle 967 is locked into the motor spindle locking hub through-hole 994 by setscrews 995. The setscrews 995 are loaded into threaded-holes 996 around the motor spindle-locking hub 997 of motor torque transfer wheel 990. There are six threaded-holes 996 on the motor spindle locking hub 997 that lock in place the motor spindles 967 for redundancy. There are two kinds of motor hub assemblies. One is a simple motor assembly 988, which has mounting screws in the back of the motor that allows for easy motor mounting. A more complex mounting scheme is needed for motors that only have mounting holes on the same side that the active motor spindle is located. This mounting configuration is referred to as the carriage motor mount assembly 985.

Figure 9E:
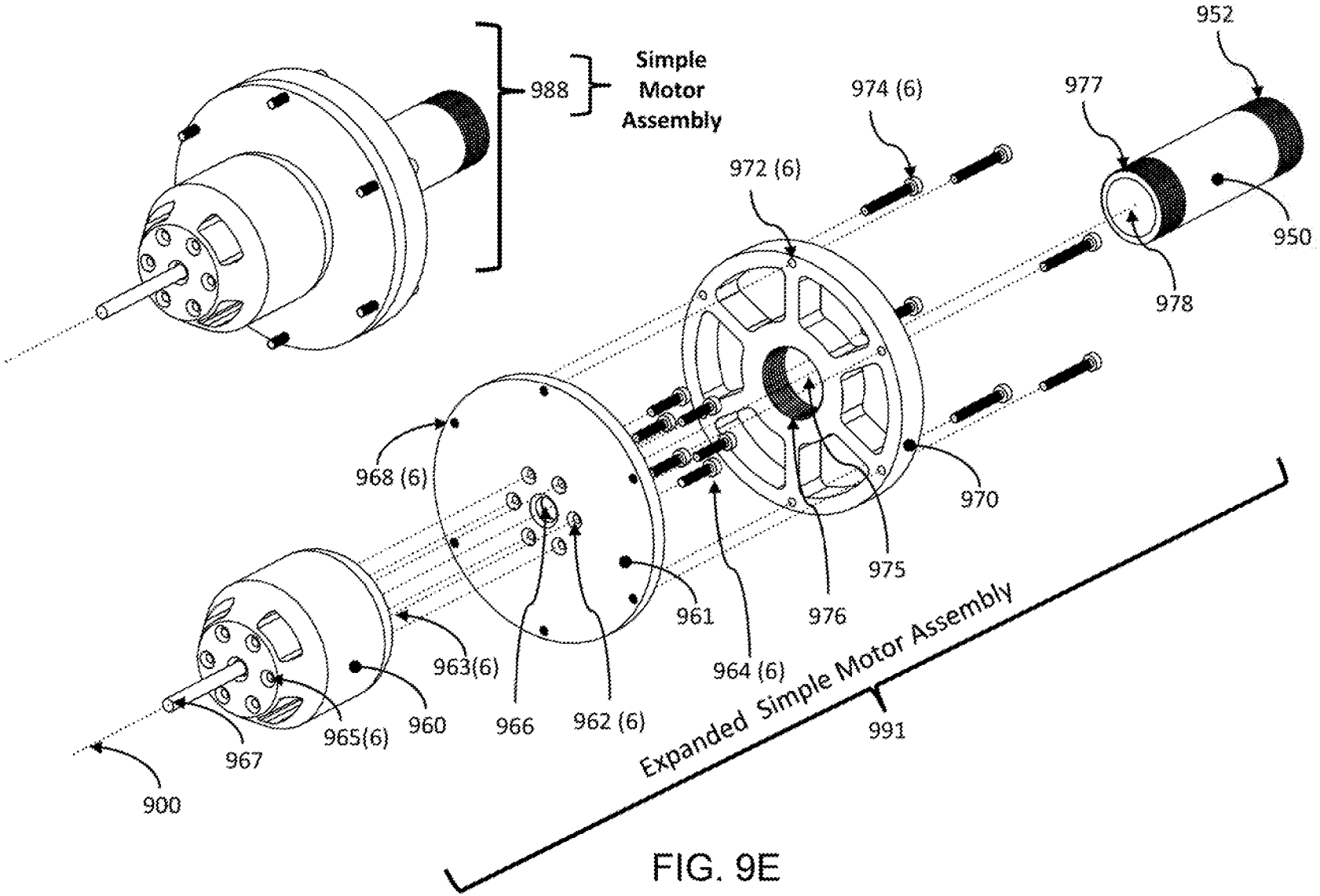
FIG. 9E is an isometric view of the expanded simple motor assembly and an isometric view of the assembled simple motor mount assembly as an inset.

FIG. 9E is an isometric view of the expanded simple motor assembly 991 and an isometric view of the assembled simple motor assembly 988 shown as an inset. The mounting of the motor 960 to fit on the stationary hollow motor axle union 950 is accomplished by using a simple motor mounting adapter plate 961 which has a motor spindle through-hole 966 and through-holes 962 for attaching the motor mounting bolts 964 to the back of the motor 960 to the rear motor threaded-holes 963 (not shown; identical to front threaded-holes 965). The simple motor mounting adapter plate 961 is mounted onto the motor mount flange 970. The simple motor mounting adapter plate 961 is secured to the motor mount flange 970 by bolts 974 that pass into through-holes 972 and into the threaded-holes 968 of the simple motor mounting adapter plate 961. The stationary hollow motor axle union 950 is threaded into the motor mount flange 970 by threading the external threads 977 into the internal threads 976, which are contained in the large threaded through-hole 975. This completes the formation of the simple motor mount assembly 988.

Figure 9F:
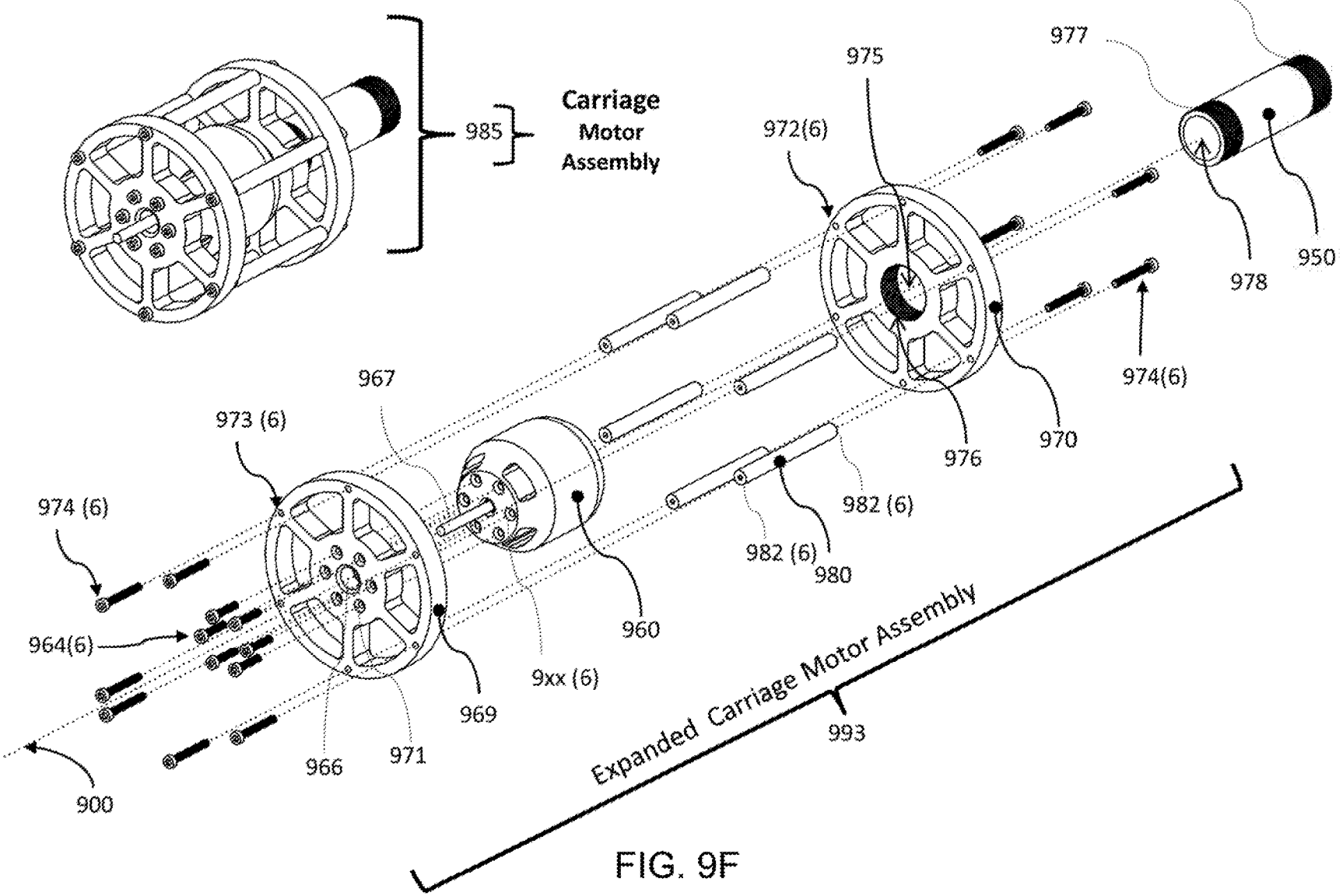
FIG. 9F is an expanded isometric view of the carriage motor assembly and an inset of a completed carriage motor assembly.

FIG. 9F is an expanded isometric view of the expanded carriage motor assembly 993 and an inset of a completed carriage motor assembly 985. Carriage motor assembly 985 is used to accommodate motors that do not have threaded mounting holes on the back of the motor. To form the carriage motor assembly 985, the motor 960 with threaded-holes 965 on the side of the motor spindle 967, is fastened to the carriage motor mounting adapter plate 969 by using motor mounting bolts 964, which pass through through-holes 971, and into the threaded-holes 965 of the motor 960. The carriage motor mounting adapter plate 969 is mounted to the motor mount flange 970 by using carriage support rods 980 that have threaded ends 982. The motor mount flange 970 and carriage motor mounting adapter plate 969 are joined together by using carriage support rods 980. Bolts 974 are passed through the through-holes 973 of the carriage motor mounting adapter plate 969 and screw into the threaded-holes 982 of the carriage support rods 980. Bolts 974 are passed through the through-holes 972 of the motor mount flange 970 and. screw into the threaded-holes 982 of the carriage support rods 980. The stationary hollow motor axle union 950 is threaded into the motor mount flange 970 by threading the external threads 977 into the internal threads 976, which are contained in the large threaded through-hole 975. This forms the carriage motor assembly 985.

Figure 9G:
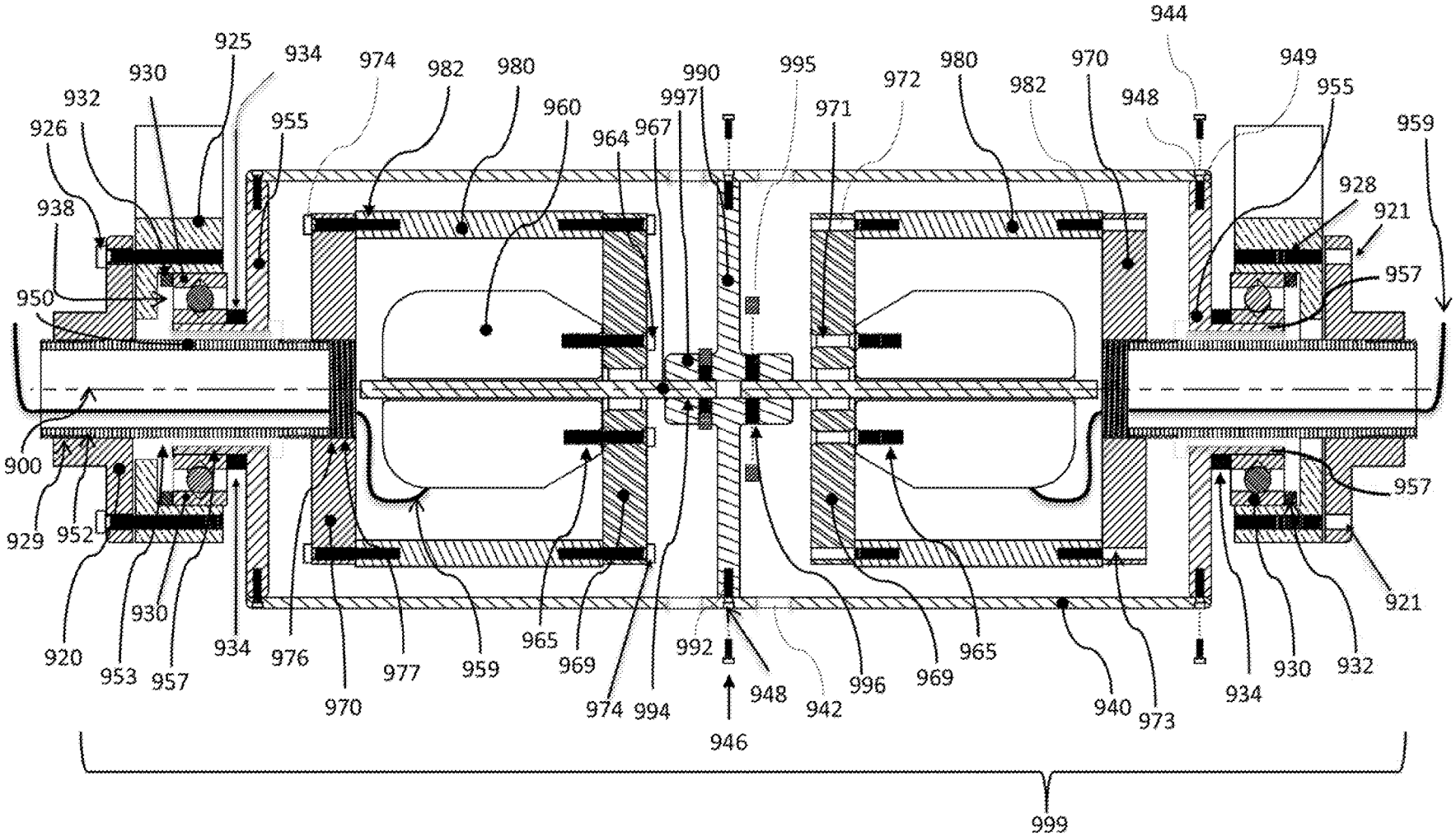
FIG. 9G is a front-end cross-sectional view defined by the cross-section plane in FIG. 9A, FIG. 10A this perspective view shows the entire configuration of the treaded skateboard assembly from the skateboard deck, the electronic assembly, the transom fork hanger assembly and the wheel assembly with a tread instead of the tire skin.

FIG. 9G is a front-end cross-sectional view defined by the cross-section plane 910 in FIG. 9A. The cross-section plane 910 cuts the fork hanger 925 through the plane that shows a cross-section of components that rotate about the axis of rotation 900 or seated on the axis of rotation 900, such as the bearing-retaining hole 938 and the fork hanger through-hole 927. Within the bearing-retaining hole 938 is seated the large bearing spacer 932 that keeps the bearing 930 properly positioned when both are inserted into the bearing-retaining hole 938. Small bearing spacer 934 provides the proper separation of the bearing 930 from the wheel hub flange 955. The bearing 930 and the small hearing spacer 934 slide onto the stationary hollow motor axle union 950. Wheel hub flange 955 connects to the wheel hub drum 940 using fasteners 944 that pass through the counter-sunk through-holes 948, and thread into the threaded-holes 949. The cross-section plane 910 shows the motor 960 mounted to the carriage motor mounting adapter plate 969 with motor mounting bolts 964 that pass through the through-holes 971 of the carriage motor mounting adapter plate 969, and are thread into the threaded-holes 965 of the motor 960. The motor torque transfer wheel 990 is secured to the wheel hub drum 940 using fasteners 946 that pass through the countersunk through-holes 948, and screw into the threaded-hole 992, This is done in multiple places to secure the motor torque transfer wheel 990 to the motor hub drum 940. The motor spindle 967 is secured to the motor torque transfer wheel 990 by inserting the motor spindle 967 into the motor spindle locking hub through-hole 994 of the motor spindle locking hub 997, and tightening the multiple setscrews 995 that are inserted into the threaded-holes 996 of the motor spindle locking hub 997. The tightening of the setscrews 995 is accomplished by inserting a setscrew wrench through an access hole 942.

The carriage motor mounting adapter plate 969 is fastened to the motor mount flange 970 with multiple carriage support rods 980. Bolts 974 pass through the through-holes 973 of the motor mount flange 970 and into the threaded-holes 982 of the carriage support rods 980. The carriage motor mounting adapter plate 969 is fastened to the other end of the carriage support rod 980 with bolts 974 that pass through the through-holes 972, and thread into the threaded-holes 982 in the carriage support rods 980. The external threaded end 977 of stationary hollow motor mount axel union 950 is threaded into the internal threads 976 of the motor mount flange 970, This forms the complete carriage motor mount assembly 985 (see inset 986 in FIG. 9D).

The opposite external threaded end 952 of the stationary hollow motor mount axel union 950 is passed through the inside of the wheel hub axel 957 and through the fork hanger through-hole 927 of the fork hanger 925, and threaded onto the motor axle flange-locking nut 920 by engaging the internal threads 929 of the motor axle flange-locking nut 920, and the external threads 952 of the stationary hollow motor mount axel union 950. Once the motor axle flange-locking nut 920 is tightly threaded onto the stationary hollow motor mount axel union 950, the motor axle flange-locking nut 920 is tightened to the fork banger 925 with bolts 926 that pass through slotted through-holes 921 of the motor axle flange-locking nut 920, and thread into the threaded-holes 928 of the fork hanger 925, The electrical conduit 959 provides a path for power to the motors 960. The electrical conduit 959 passes through die inside of the stationary hollow motor mount axel union 950, motor mount flange 970, and to the motor 960. This completes the two-bearing transom fork hanger truck assembly 999.

Figure 10A:
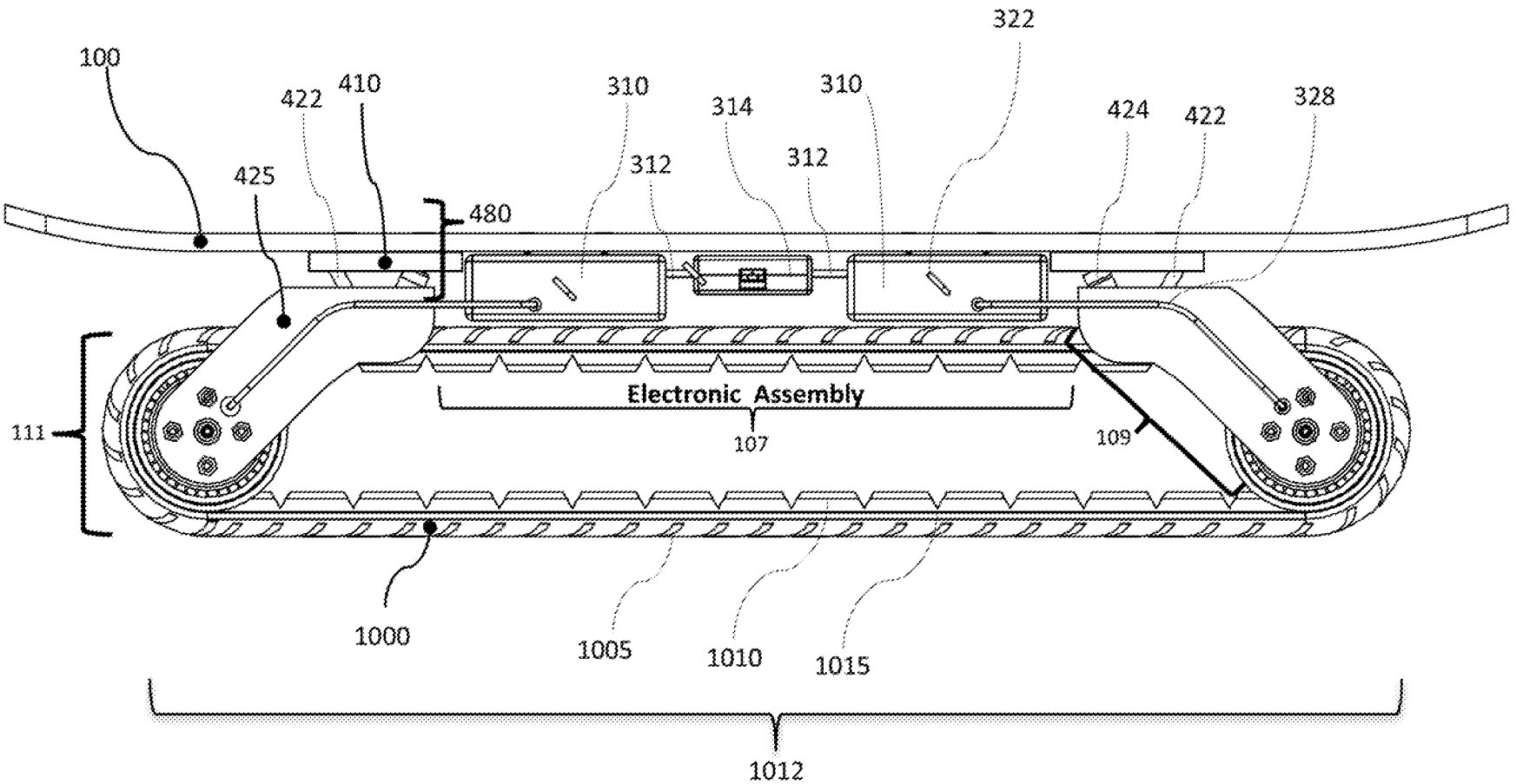
FIG. 10B is an expanded isometric view of the treaded skateboard assembly and its components that are attached to the underside of the skateboard deck.
FIG. 10C is an isometric side view of the treaded skateboard assembly showing the internal perspective view of the inside of the thread and the mechanical fasteners system implemented on the motorized skateboard as shown in FIG. 2.
FIG. 10D is an isometric view of the tread is shown in its normal constrained shape as it is traverses around the wheel hub assemblies with an unobstructed view of the inside of the tread.
FIG. 10E is the front-end view of the treaded skateboard assembly and a cross-sectional front view of the tread as it is wrapped around the wheel hubs that form the wheel hub assembly and the tread riser guide channel.
FIG. 10F is a front view of the fully motorized treaded skateboard assembly with tread depressions for gripping surfaces and preventing hydroplaning and showing the curvature of the tread that enables steering and turning capabilities.
FIG. 10G is an expanded isometric view of the tread drive hub assembly showing the incorporation of the positive sprocket drive gear.
FIG. 10H is an isometric cross-sectional view of only the tread riser found within the tread and the isometric profile of the positive sprocket drive gear.
FIG. 10I is an isometric view of the smooth tread, showing internal structure of the tread riser incorporated into the inside surface of the smooth skin tread.
FIG. 10J is an isometric view of the depression tread.
FIG. 10K is an isometric view of the riser tread with riser treads.
FIG. 10L is an isometric view of the studded tread skin with the main characteristic of this tread being the studs.
FIG. 10M is an enlarged isometric view of the inset of the forward section of the studded treat skin shown in FIG. 10*l;*
FIG. 10N is an isometric view of a vertical cog-tooth tread-drive hub assembly showing the outside cog-teeth and the inside cog-teeth that are attached to the circumference of the two wheel hubs.
FIG. 10O is an expanded isometric view of the vertical cog-tooth tread-drive hub assembly with the bearing-hub adapter assembly.
FIG. 10P is an expanded isometric view of the vertical cog-tooth tread-drive hub assembly with the axel-hub adapter assembly.
FIG. 10Q is an enlarged isometric view of the inset in FIG. 10O and FIG. 10P, This is a close-up view of the outside cog-teeth and the inside cog-teeth and how they are secured to the cog hubs.
FIG. 10R is an isometric view of the vertical cog-tread drive assembly.

FIG. 10A is a side view of the treaded skateboard assembly 1012. This view shows the entire configuration of the treaded skateboard assembly 1012 from the skateboard deck 100, the electronic assembly 107, the transom fork hanger assembly 109, the wheel assembly 111, a tread 1000 instead of the tire skin 501, and the kingpin & pivot pin assembly 480 that are identical to FIG. 1 through FIG. 5.

Motorized and non-motorized versions of the wheel-based skateboard see in FIG. 1, are transformed into a treaded skateboard assembly 1012 by adding a tread 1000 to the front and rear wheel hub assemblies 599 (see FIG. 5A) Sizes and proportions are related to the size of treads to he used and whether or not the skateboards are motorized or non-motorized. The side view in FIG. 10A illustrates the tread 1000 and the parts that make it unique. The tread riser 1010 is a vertical part of the tread 1000. The tread riser 1010 and the V-notches 1015 are incorporated into the body of the tread 1000 during the molding or forming process. The tread 1000, the tread riser 1010, the V notches 1015, and the tread depressions 1005 are molded or formed as one solid piece. In order to provide traction on different surfaces the tread 1000 has tread depressions 1005.

Figure 10B:
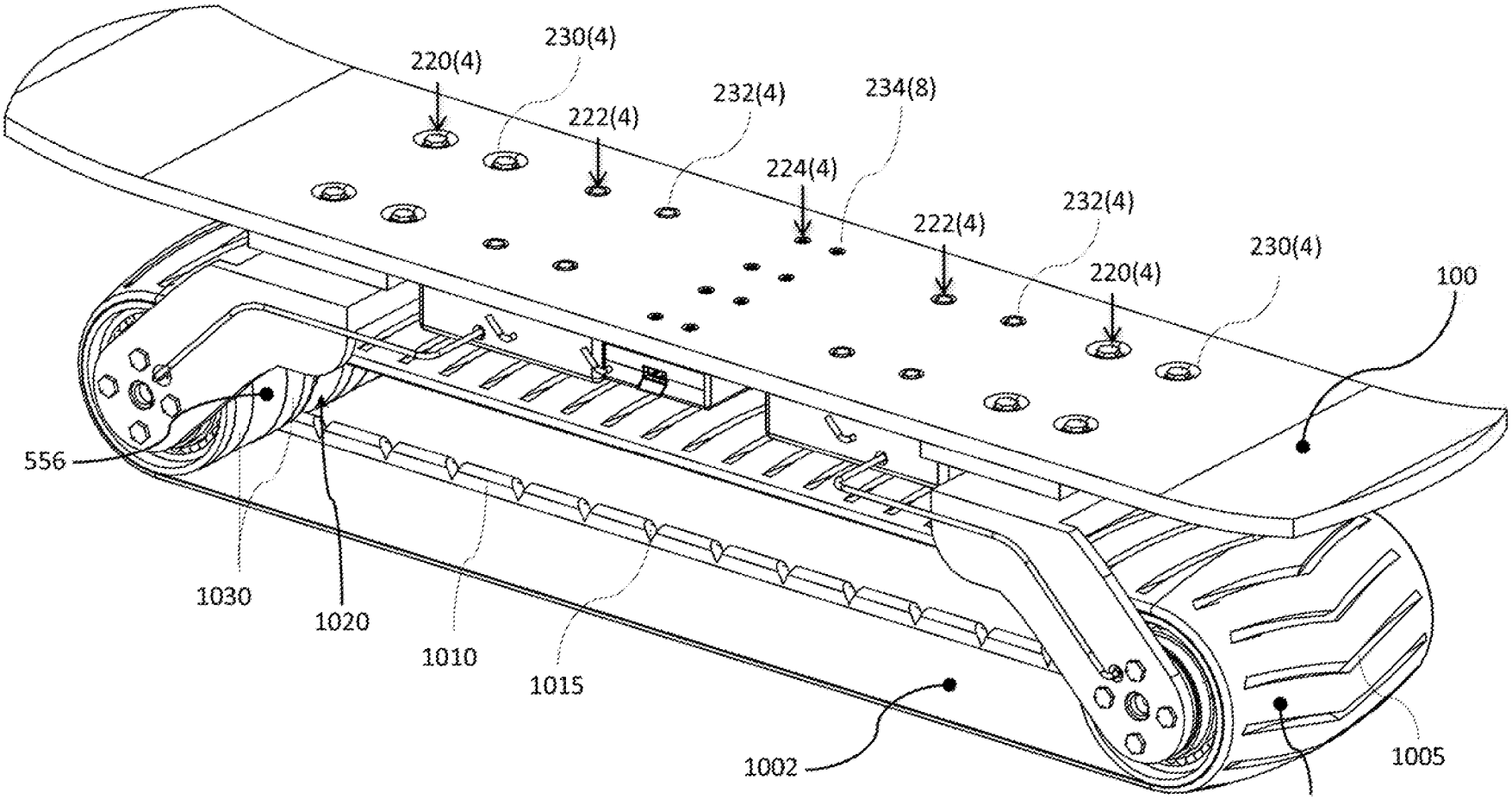

FIG. 10B is an isometric side view of the treaded skateboard assembly 1012 showing the mechanical fasteners system implemented on the motorized skateboard as shown in FIG. 2.

Figure 10C:
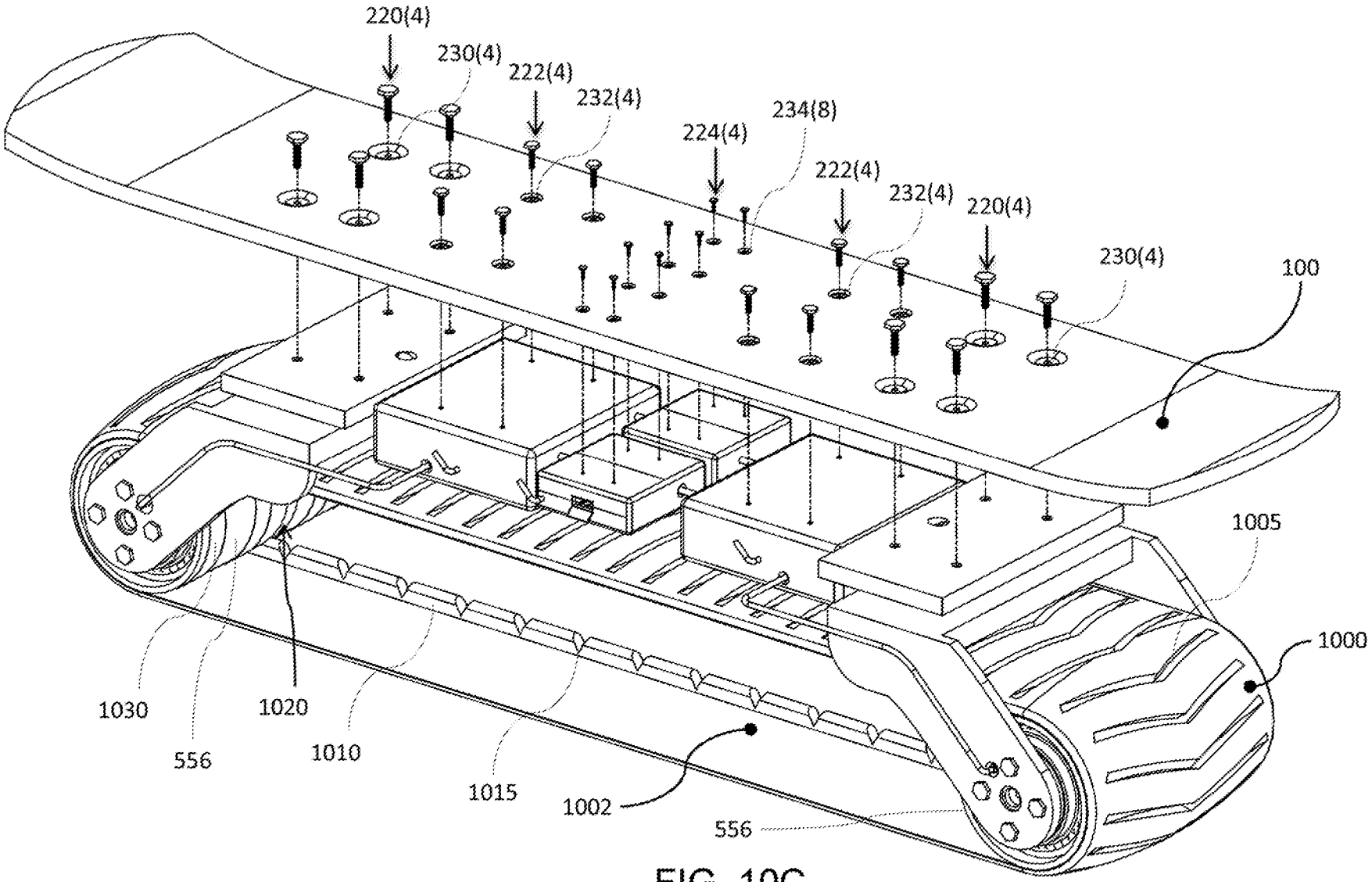

FIG. 10C is an expanded isometric view of the treaded skateboard 1012 and its components. Shown in this view are two-wheel hubs 556 that engage the inside surface 1002 of the tread 1000. There is a tread riser guide channel 1020, formerly space 543, between the two wheel hubs 556 as seen in FIG. 5A that forms by the thickness of the spacer 542, which separates the two hubs 556 of the wheel hub assembly 599, This space 1020 is now called the tread riser guide channel 1020. The tread riser guide channel 1020 is constraining the tread riser 1010 by preventing the tread 1000 from walking off the surface of the hub assemblies 556, and keeps the tread 1000 aligned in the direction the skateboard is traveling. Also shown in FIG. 10B is a sealing band 1030 that seals the outside bearing through-holes 536 and the inside bearing through-holes 537. This prevents moisture and debris from entering the inside of the wheel hub assembly 599 (see FIG. 5A).

Figure 10D:
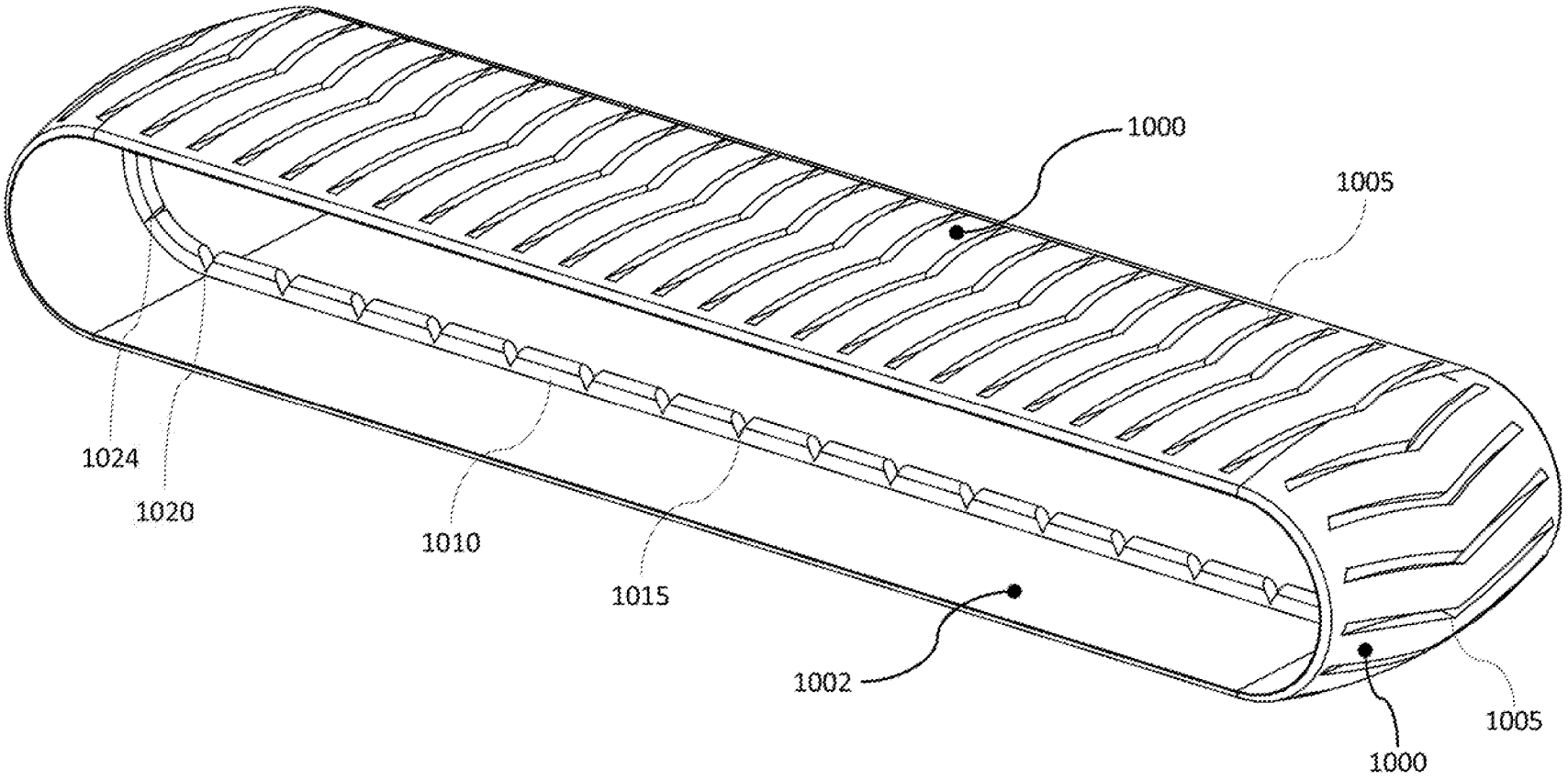

FIG. 10D is an isometric view of the tread 1000 as shown in its normal constrained shape as it traverses around the wheel hub assemblies 599. The V-notch 1015 is required to allow the maneuvering of the tread around the wheel hub assembly 599. Based on the hardness of the tread material, it may compress, bulge or tear if the V-notches 1015 are not incorporated into the tread riser 1010, A compressed V-notch 1024 is shown to illustrate how the tread riser 1010 conforms to the wheel hub assembly 599 (see FIG. 5A).

Figure 10E:
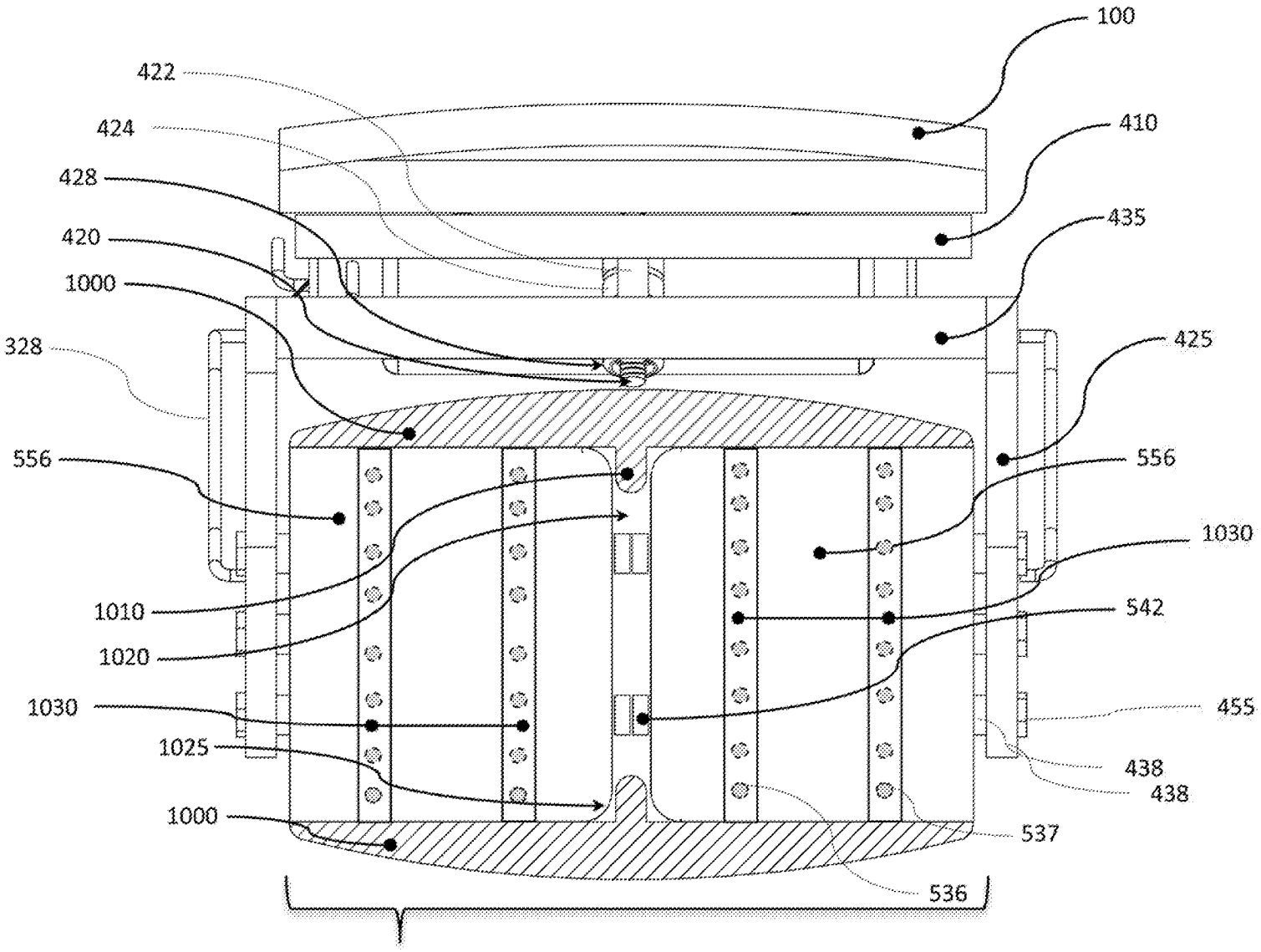

FIG. 10E shows the front-end view of the treaded skateboard assembly 1012 and a cross-sectional front view of the tread 1000 as it is wrapped around the wheel hubs 556 that forms the wheel hub assembly 599, and the tread riser guide channel 1020, The wheel hubs 556 have outside bearing through-holes 536 and the inside bearing through-holes 537, represented by the dashed circles, that are covered with a sealing band 1030 to prevent contamination such as sand, water, and other debris from compromising the internal components contained within the wheel hub assembly 599, This view best shows the hub fillet 1025. The hub fillet 1025 is on both inside edges of the wheel hubs 556, and smoothens the edges of the tread riser guide channel 1020 for the tread riser 1010. The tread riser guide channel 1020 retains the tread riser 1010 of the tread 1000 and holds the tread 1000 on the wheel hub assembly 599 by preventing die tread 1000 front walking off of the wheel hub assembly 599, The motor hub assembly 590 (not shown, see FIG. 5G) is installed within the wheel hub assembly 599 and attached to the fork hanger 425.

Figure 10F:
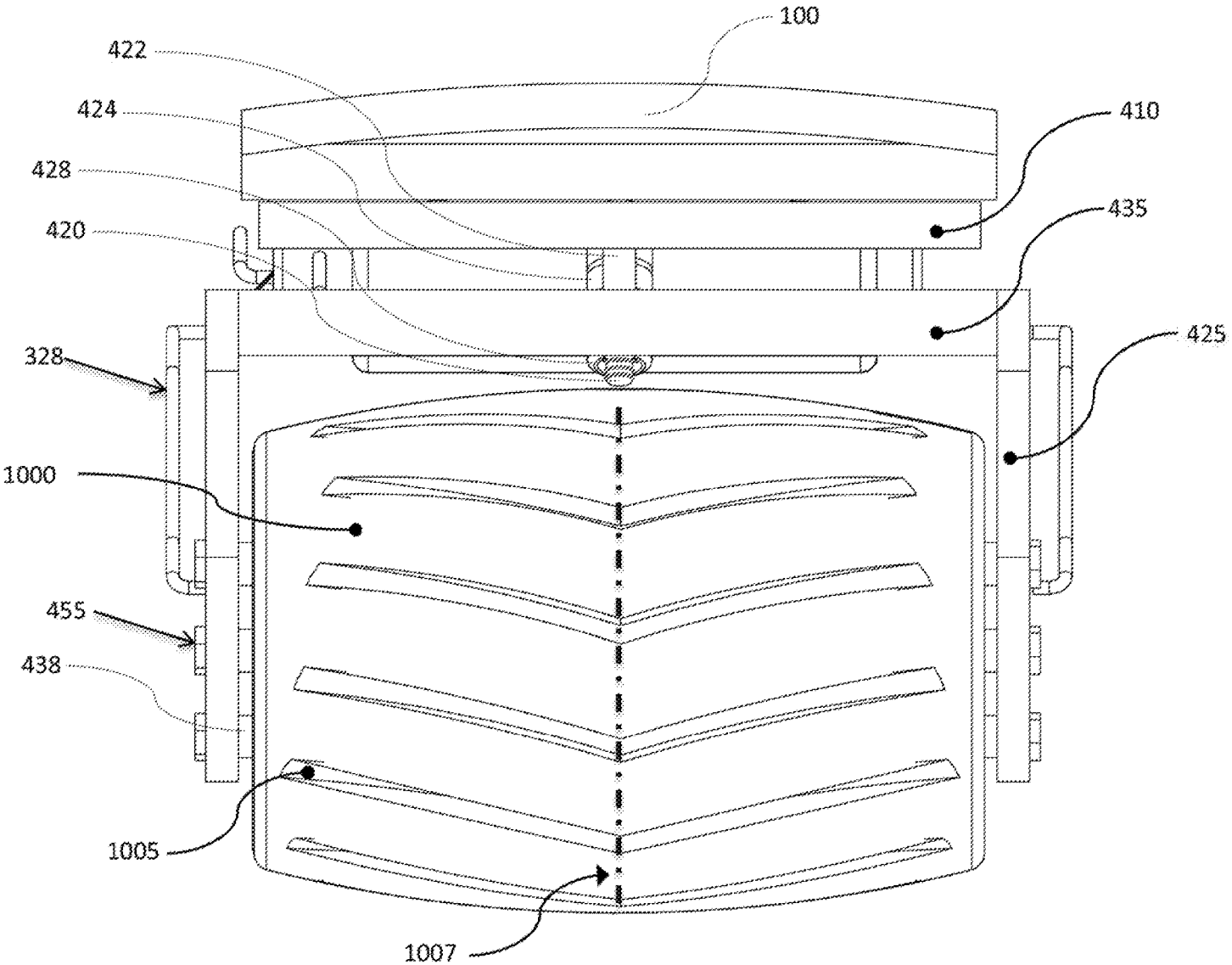

FIG. 10F is a front view of the fully motorized treaded skateboard assembly 1012. Tread depressions 1005 are for gripping surfaces and preventing hydroplaning. Another important feature is the curvatures of the treads 1000 that allows steering and turning capabilities. By keeping the tread 1000 oval in shape, or partially rounded, the transom fork hanger assembly 109 rotates about the pivot pin 422 and about the tread oval axis of symmetry 1007 of the tread 1000. The tread 1000 is normally stretched between the two wheel hub assemblies 599. When rotation is initiated, the inside portion of the tread 1000 on the inside of the turn, is shortened. The tighter the radius of curvature required for the turn, the inside of the tread 1000 retracts, causing the tread 1000 to tilt and rotate about the tread oval axis of symmetry 1007.

Figure 10G:
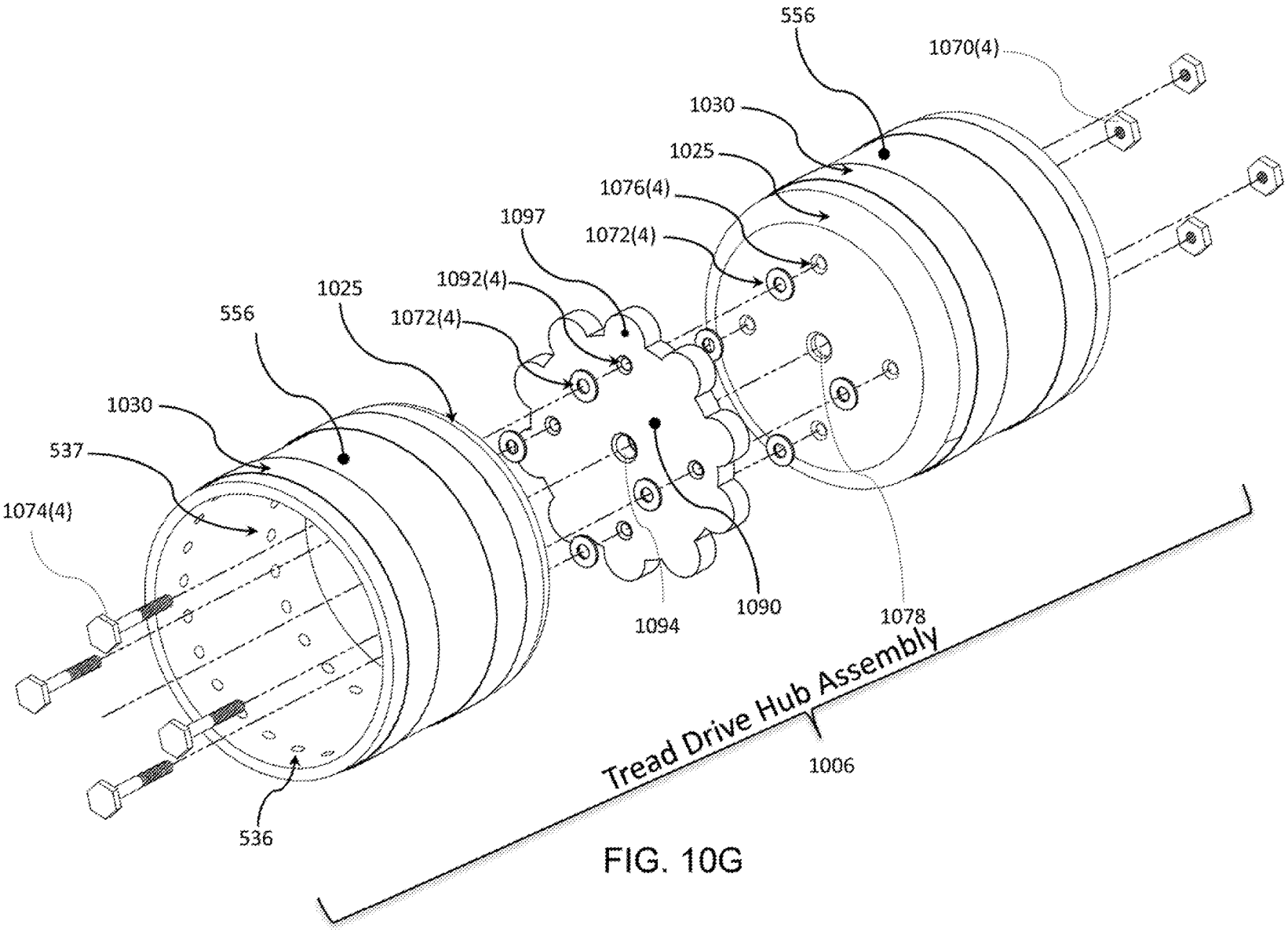

FIG. 10G is an expanded isometric view of the tread drive hub assembly 1006 showing the incorporation of the positive sprocket drive gear 1090. In previous versions of the wheel hub assembly 599, the spacers 542 were used to provide the tread riser guide channel 1020 for the tread riser 1010 to stabilize the tread 1000, and to prevent the tread 1000 from walking off or sliding off of the wheel hubs 556. The tread drive hub assembly 1006 is redesigned to function in the same manner with regard to the tread riser guide channel 1020 but with an additional improvement of incorporating a positive sprocket drive gear 1090. This positive sprocket drive gear 1090 replaces the spacers 542. The thickness of the positive sprocket drive gear 1090 is similar to the thickness of the spacers 542, which maintained the proper spacing between the wheel hubs 556 so that the tread riser 1010 moves freely between the two wheel hubs 556 and stabilizes the position of the tread 1000. With the addition of this positive sprocket drive gear 1090, better traction is delivered to the tread 1000 to prevent slipping in the event sand and other debris is captured between the surface 1002 and the surface of the wheel hub 556 (see FIG. 10B).

The tread drive hub assembly 1006 is assembled in the same manner as the wheel hub assembly 599 as shown in FIG. 5D. The two wheel hubs 556 are bolted together with bolts 1074, which pass through the through-holes 1076, the appropriate thin washer 1072, the positive sprocket drive gear 1090, the thin washer 1072, on the other side of the positive sprocket drive gear 1090, the through-holes 1076 on the second hub 556, and finally tightened in place with locking nuts 1070. The wheel hubs 556 have outside hearing through-holes 536 and the inside bearing through-holes 537 that are covered with a sealing band 1030 to prevent contamination such as sand, water, and other debris from compromising the internal components contained within the tread drive hub assembly 1006.

Figure 10H:
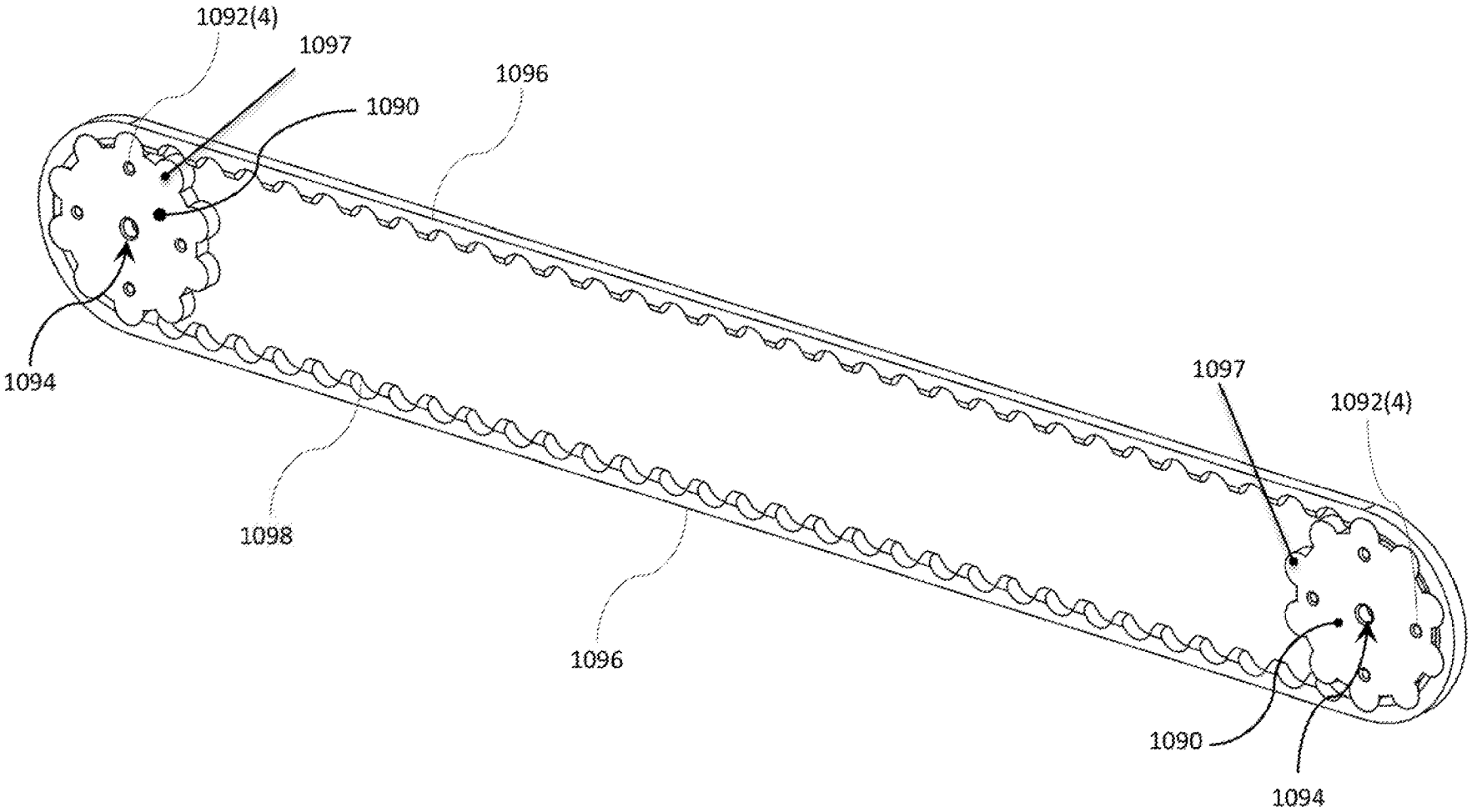

FIG. 10H is an isometric cross-sectional view of only the tread riser guide 1096 found within the tread 1000 and the isometric profile of the positive sprocket drive gear 1090. The receiver sprocket 1098 of the tread riser guide 1096 couples to the positive sprocket drive gear 1090 by engaging the sprocket tooth 1097. This addition to the tread riser guide 1096 prevents wheel hub 556 slippage between the tread drive hub assemblies 1006 and the inside surface 1002 of the tread 1000, The receiver sprocket 1098 also functions to prevent the over compression and distortion of the tread riser guide 1096 as the V-notches 1015 did in FIG. 10B. This maintains a positive driving force on both tread drive hub assemblies 1006 and the inside of tread 1000 to prevent sand, water, snow, ice, and other debris from being lodged between the two surfaces: the inside surface 1002, refer to FIG. 10C, and the surface of the tread drive hub assembly 1006.

Figure 10I:
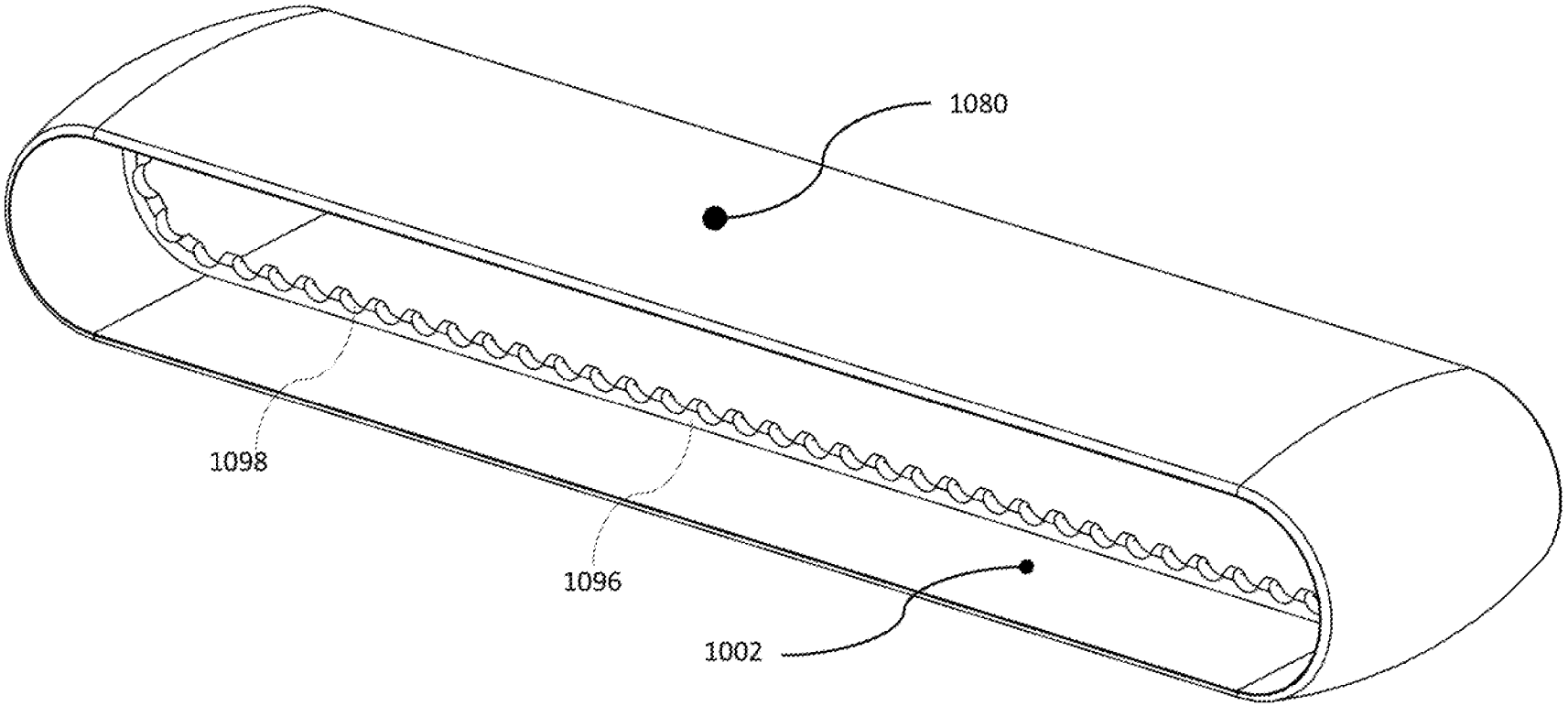

FIG. 10I is an isometric view of the smooth tread 1080 showing internal structure of the tread riser guide 1096 incorporated into the inside surface 1002 of the smooth skin tread. 1080. The receiver sprocket 1098 couples to the sprocket tooth 1097 of the positive sprocket drive gear 1090 (see FIG. 10H). The receiver sprocket 1098 serves the same purpose as the V notches 1015 as shown on FIG. 10C. The receiver sprockets 1098 also eliminates over compression of the tread riser guide 1096 when traversing the tread drive hub assembly 1006. If these geometries, the receiver sprockets 1098 or the V-notches 1015 as shown on FIG. 10C are not present, then over compression of the material will eventually fatigue and fail. This would result in the tread riser guide 1096 cracking and splitting away from the main part of the smooth tread 1080.

Figure 10J:
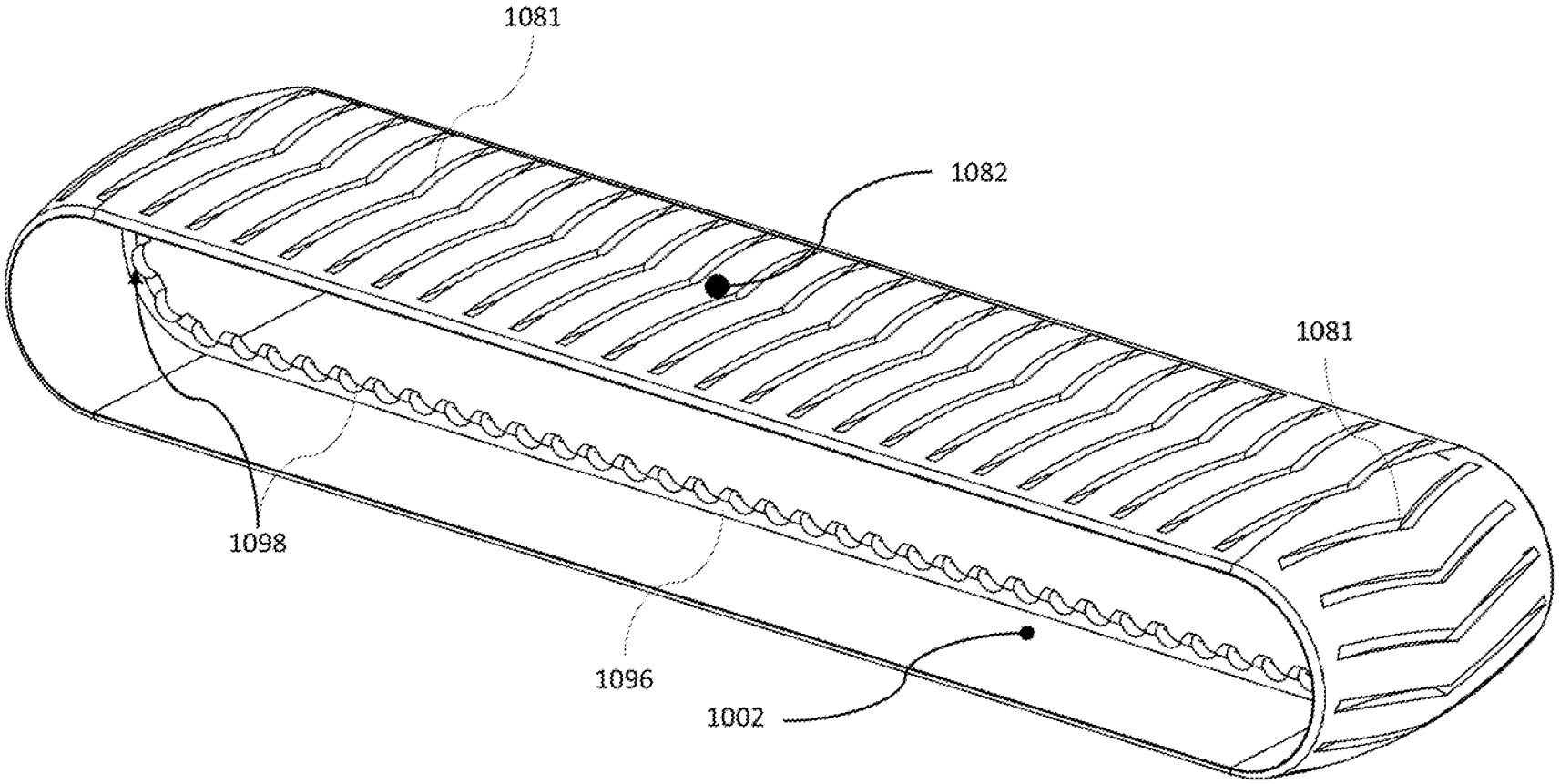

FIG. 10J is an isometric view of the recessed tread skin 1082. The recessed tread skin 1082 shows the tread recesses 1081 for traction and evacuating water to prevent hydroplaning. Also shown is the internal construction of the tread riser guide 1096 incorporated into the inside surface 1002. The receiver sprocket 1098 couples to the sprocket tooth 1097 of the positive sprocket drive gear 1090 as shown in FIG. 10H. The receiver sprocket 1098 serves the same purpose as the V-notches 1015 as shown on FIG. 10C.

Figure 10K:
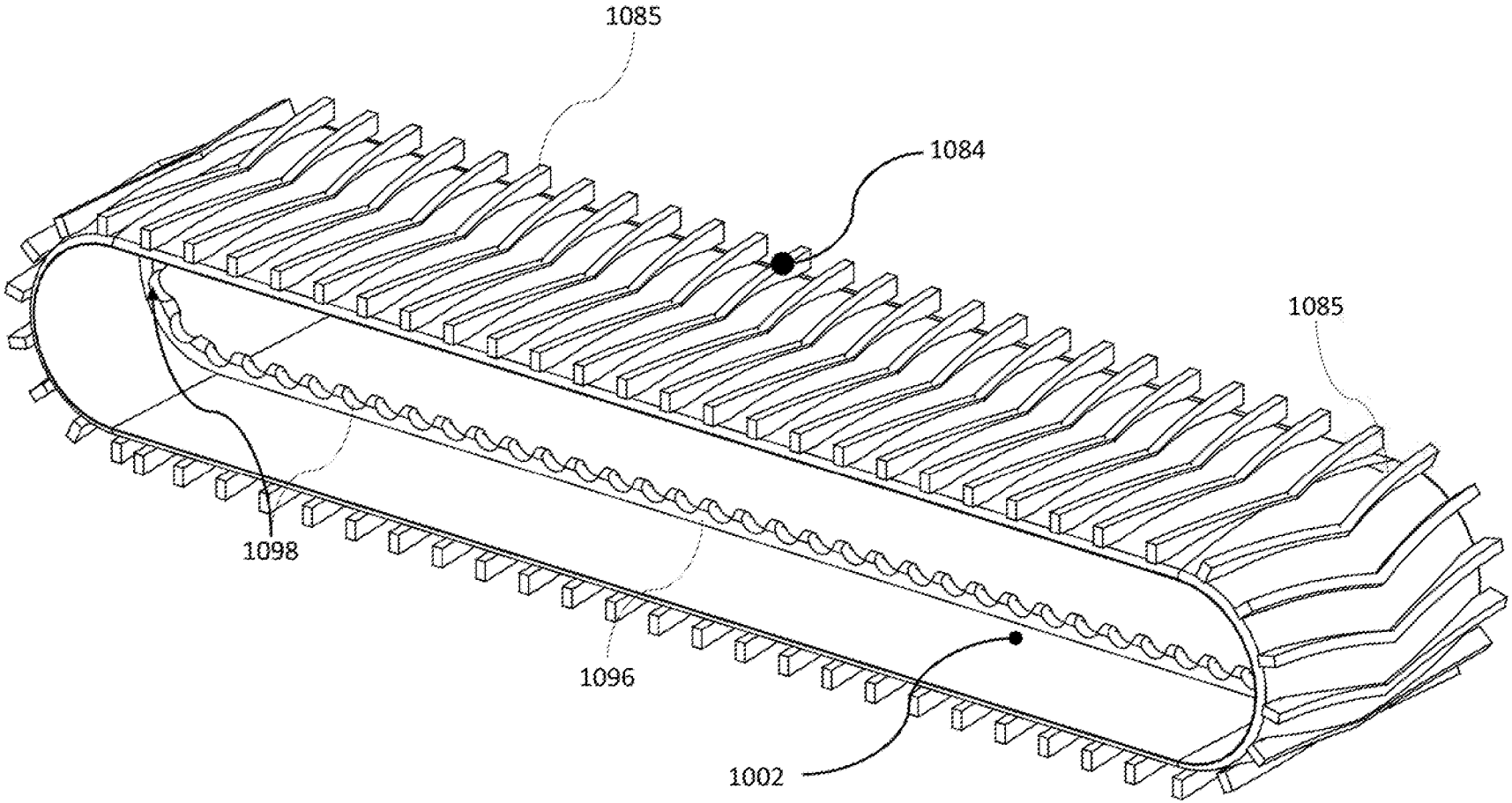

FIG. 10K is an isometric view of the riser tread skin 1084 with riser treads 1085 and showing internal structure of the tread riser guide 1096 incorporated into the inside surface 1002 of the riser tread skin 1084. The receiver sprocket 1098 couples to the sprocket tooth 1097 of the positive sprocket drive gear 1090 (see FIG. 10H). The receiver sprocket 1098 serves the same purpose as the V-notches 1015 as shown on FIG. 10C. The riser treads 1085 are outward projections of the former geometry of the tread depressions 1005. These riser treads 1085 projecting out of the plane of the riser tread skin 1084 offer superior gripping and digging characteristics when confronted with sand, snow, ice, and mud.

Figure 10L:
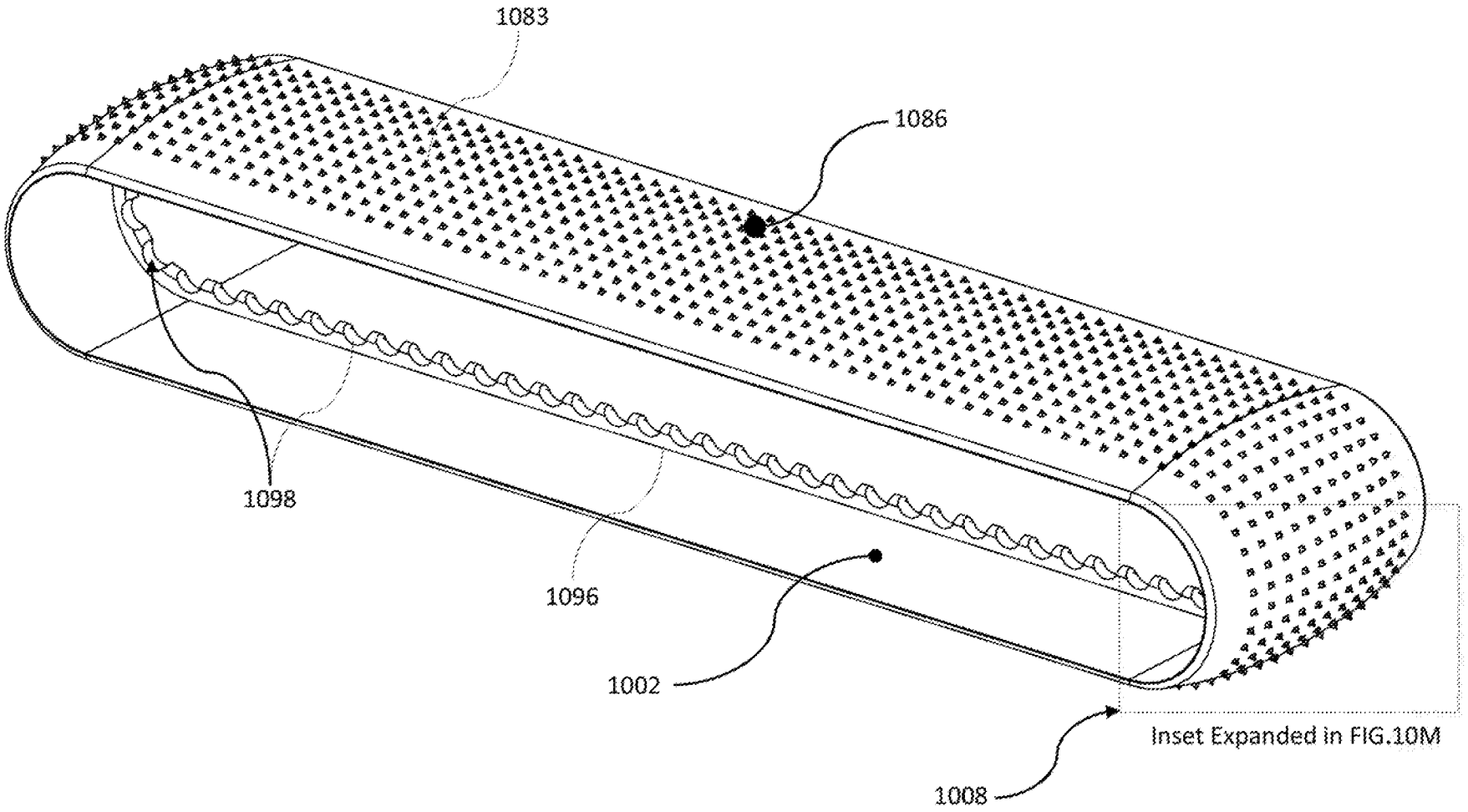

FIG. 10L is an isometric view of the studded tread skin 1086 with the main characteristic of this tread being the studs 1083. The inset area 1008 shown in this figure will be enlarged in FIG. 10M to show greater detail of the studs 1083. FIG. 10L shows internal structure of the tread riser guide 1096 incorporated into the inside surface 1002 of studded tread skin 1086. The receiver sprocket 1098 couples to the sprocket tooth 1097 of the positive sprocket drive gear 1090 (see FIG. 10H). The receiver sprocket 1098 serves the same purpose as the V-notches 1015 as shown in FIG. 10C. These studs 1083 projecting out of the plane of the tread 1086 offer superior gripping and digging characteristics when confronted with sand, snow, ice, and mud.

Figure 10M:
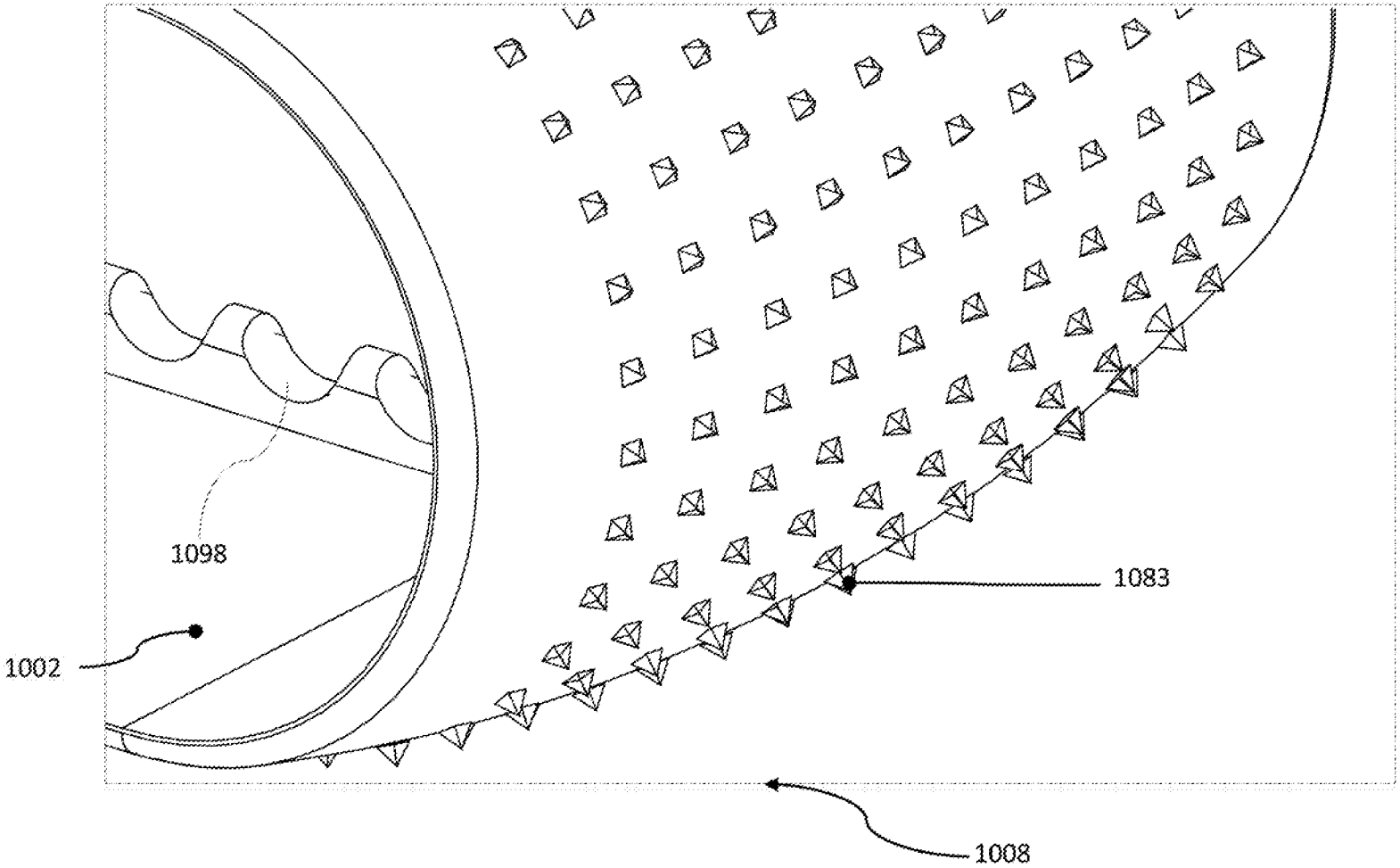

FIG. 10M is an enlarged isometric view of the inset 1008 of the forward section of the studded tread skin 1086 shown in FIG. 101. The studs 1083 can he metal or hard plastic and the geometries can be simple round posts or diamond shape. Metal studs would be preferred for riding on ice and compacted snow. Other composite materials may be used for mud, snow, or sandy terrain.

Figure 10N:
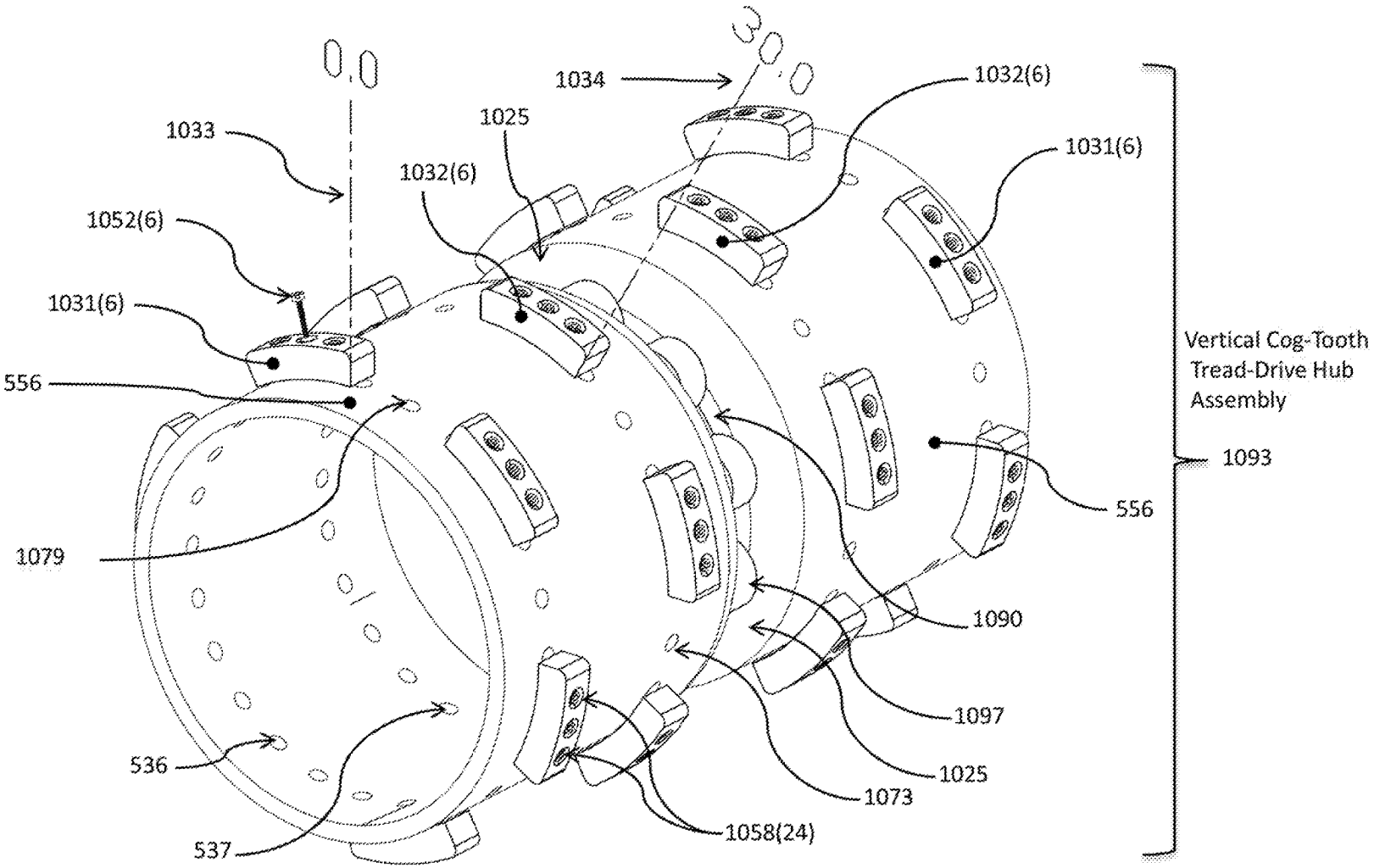
Figure 10O:
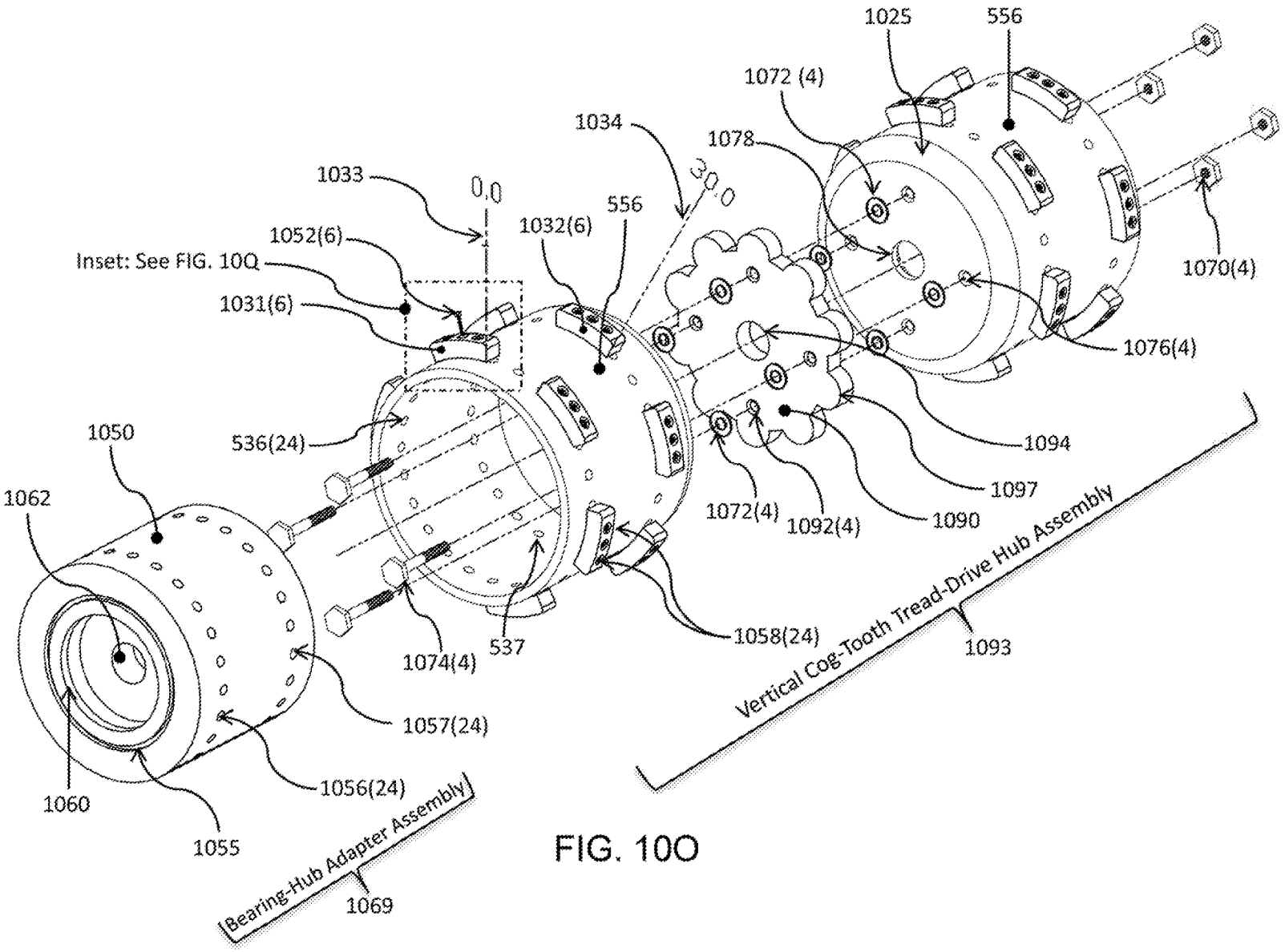

FIG. 10N is an isometric view showing the vertical cog-tooth tread-drive bub assembly 1093. It is comprised of the outside cog-teeth 1031 and the inside cog-teeth 1032 that are attached to the circumference of the two wheel bubs 556 as shown in FIG. 10G. The circumferential outside cog-teeth 1031 and the circumferential inside cog-teeth 1032 have a clocking associated with them. This docking is approximately 30° rotation of the inside cogs-teeth 1032 relative to the outside cog-teeth 1031 as represented by the angle between outside cog-teeth 1031 using reference line 1033 and the inside cogs-teeth 1032 using reference line 1034. This vertical cog-tooth tread-drive hub assembly 1093 has, as an option, the positive sprocket drive gear 1090, as shown in FIG. WG. When viewed from the side the outside cog-teeth 1031 and inside cog-teeth 1032 form a circle around the vertical cog-tooth tread-drive hub assembly 1093 with respect to the outside circumference of the outside cog-teeth 1031 and inside cog-teeth 1032. This will produce a smooth transition from one cog-tooth to the other. The outside cog-teeth 1031 and the inside cog-teeth 1032 are fastened to the vertical cog-tooth tread-drive hub assembly 1093 with fasteners 1052. The fasteners 1052 pass through the countersunk through-holes 1058 in the outside cog-teeth 1031 and inside cog-teeth 1032. The fasteners 1052 secure the outside cog-teeth 1031 and inside cog-teeth 1032 to the vertical cog-tooth tread-drive hub assembly 1093 by screwing into foe outside bearing threaded-holes 536 and inside bearing threaded-holes 537. The vertical cog-tooth tread-drive hub assembly 1093 replaces the wheel hub assembly 599. Not all of the outside hearing threaded-holes 536 and inside bearing threaded-holes 537 are used to secure outside cog-teeth 1031 and inside cog-teeth 1032 to the vertical cog-tooth tread-drive hub assembly 1093. The extra unused outside bearing threaded-holes 536 and inside bearing threaded-holes 537 are designated as through-holes 1079 and through-holes 1073, respectively that can be used to secure motor hub assemblies 590 as shown in FIGS. 5D and 5E.

In FIG. 10N no motor hub assemblies 590 are incorporated into the vertical cog-tooth tread-drive hub assembly 1093. However, motor assemblies can be added to the vertical cog-tooth tread-drive hub assembly 1093 as shown in FIG. 5D. A motor hub assembly 590 can be inserted into one or both of the wheel hubs 556 of the vertical cog-tooth tread-drive hub assemblies 1093. The motor hub assemblies 590 can be secured to the wheel hubs 556 with longer fasteners 1052 that pass through the countersunk through-holes 1058, and through the through-holes 1073 and through-holes 1079. The outside cog-teeth 1031 and the inside cog-teeth 1032 to the vertical cog-tooth tread-drive hub assemblies 1093 with longer fasteners 1052, which are used to secure the motor hub assembly 590 (see FIG. 5D) to vertical cog-tooth tread-drive hub assembly 1093. Outside bearing through-holes 536 are used to secure the outside bearing 527 of the motor hub assembly 590 (see FIG. 50), whereas inside bearing through-holes 537 of the motor hub assembly 590, are used to secure inside bearing 530 (see FIG. 5D).

Figure 10P:
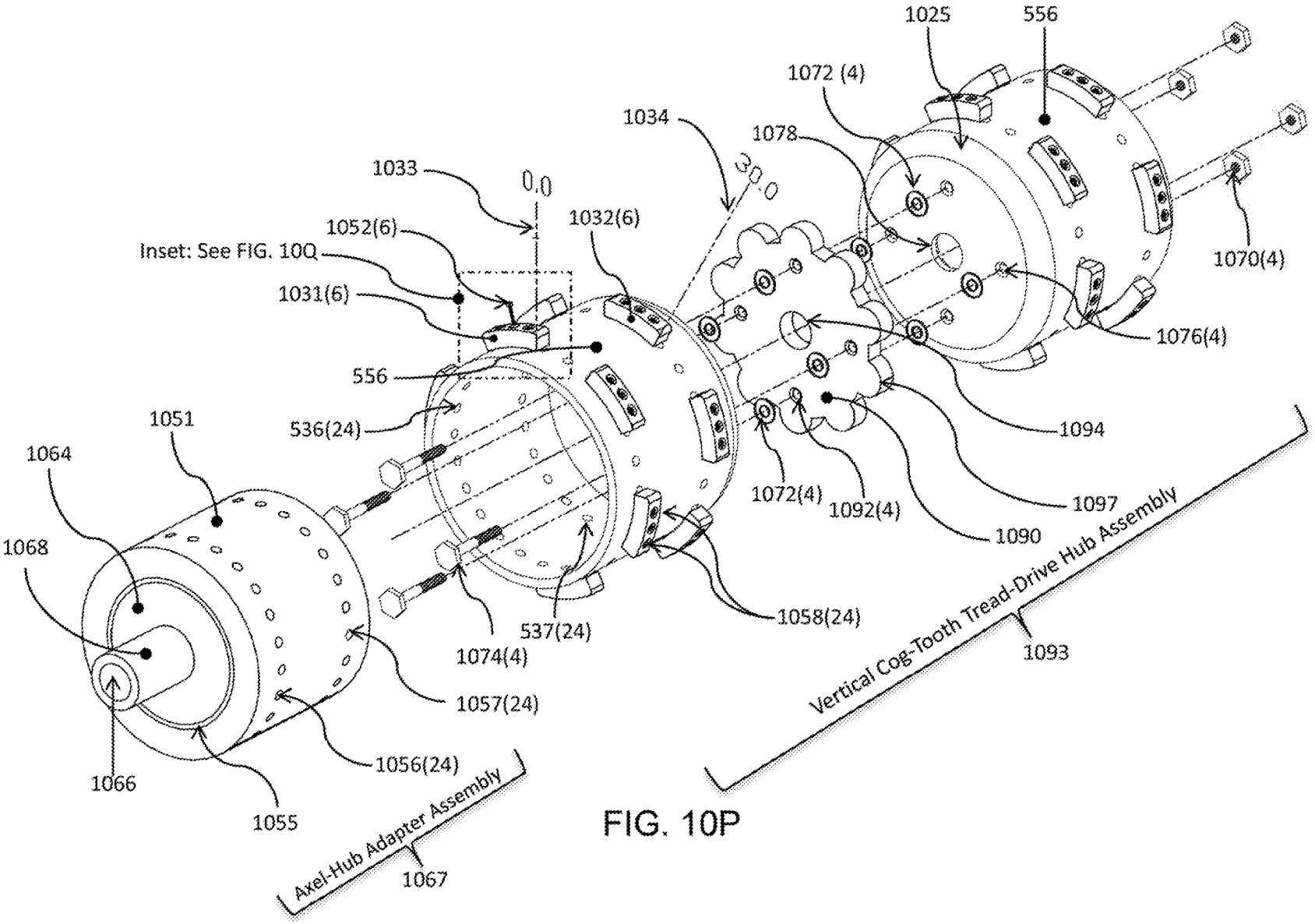
Figure 10Q:
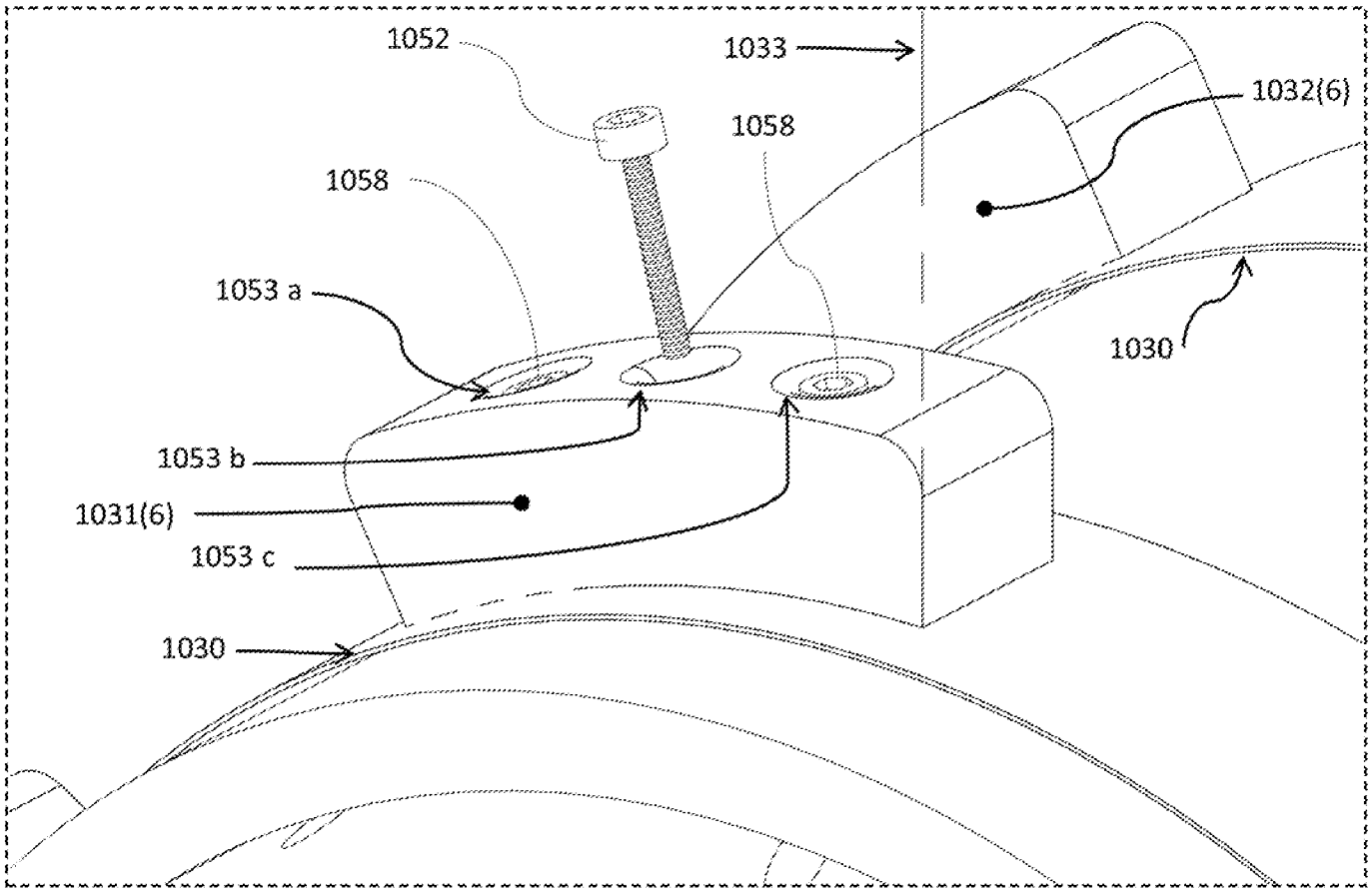

FIG. 100 is an expanded isometric view of the vertical cog-tooth tread drive hub assembly 1093. The new component, the bearing hub adapter assembly 1069, is shown with bearing recess 1060, axel through-hole 1062, protective cap retaining recess 1055, inner threaded-holes 1057, and outer threaded-holes 1056. These inner threaded-holes 1057 and outer threaded-holes 1056 me used to attach the bearing hub adapter 1050, when inserted into the, wheel hub 556 of the vertical cog-tooth tread-drive hub assembly 1093. The axel through-holes 1062, 1094, and 1078 are collinear. This bearing hub adapter 1050 is attached to the vertical cog-tooth tread-drive hub assemblies 1093 with fasteners 1052. Each cog-tooth has a set of three fastener countersunk through-holes: 1053*a*, 1053*b*, and 1053*c*. as shown in FIG. 10Q. The three fastener countersunk through-holes 1053*a*, 1053*h*, and 1053*c*, and through-holes 537 and through-holes 536, shown in FIG. 10P, are used for the fasteners 1052 to fasten the bearing hub adapter 1050. The fasteners 1052 pass through all of the outer cog-teeth 1031 and inner cog-teeth 1032, which will securely hold the hearing hub adapter 1050 in place.

FIG. 10P is an expended isometric view of the vertical cog-tooth tread-drive hub assemblies 1093 and the axel-hub adapter assembly 1067. The axel hub adapter 1051 allows for mounting without the motor hub assemblies 590 incorporated into the wheel hub assemblies 599 as shown in FIG. 5D. This conFIGuration will allow the bearing spacer 934 and the bearing 930 (not shown, see FIG. 9B) to be placed over hub axel 1068. The hub axel 1068 has a through-hole 1066 for passing wires for sensors or motors. A protective cap retaining recess 1055 is machined or formed into the sidewall of the hub axle flange 1064. The axel hub adapter 1051 is mounted internally to the cog-tooth hub assembly 1093 with fasteners 1052 that are screwed through the outside cog-teeth 1031 and the inner cog-teeth 1032, as shown in the inset in FIG. 10P or see FIG. 10Q, for the full view of this inset Not all of the outside bearing through-holes 536 and not all of inside bearing through-holes 537 are used to secure outside cog-teeth 1031 and inside cog-teeth 1032 to the cog-tooth hub assembly 1093.

FIG. 10Q is an isometric view of the inset in FIG. 100 and FIG. 10P, The outside cog-teeth 1031 and the inside cog-teeth 1032 have countersunk through-holes 1053*a*, 1053*b*, and 1053*c*. The countersunk through holes 1053*a* and 1053*c* are used to secure the tooth to the cog-tooth hub assembly 1093 with fasteners 1052, The center countersunk through-hole 1053*b* is used to secure one of the two hub adapters: axel hub adapter 1051 or bearing hub adapter 1050 with longer fasteners 1052. The axel hub adapter 1051 or the bearing hub adapters 1050 are secured fasteners 1052. Both the outside cog-teeth 1031 and the inside cog-teeth 1032, which are fastened with fasteners 1052, can be fastened with an intervening layer of tape, referred to as a sealing band 1030. This will minimize particulate contamination and mitigate water from entering the hubs directly. This tape serves as an occlusive seal.

Figure 10R:
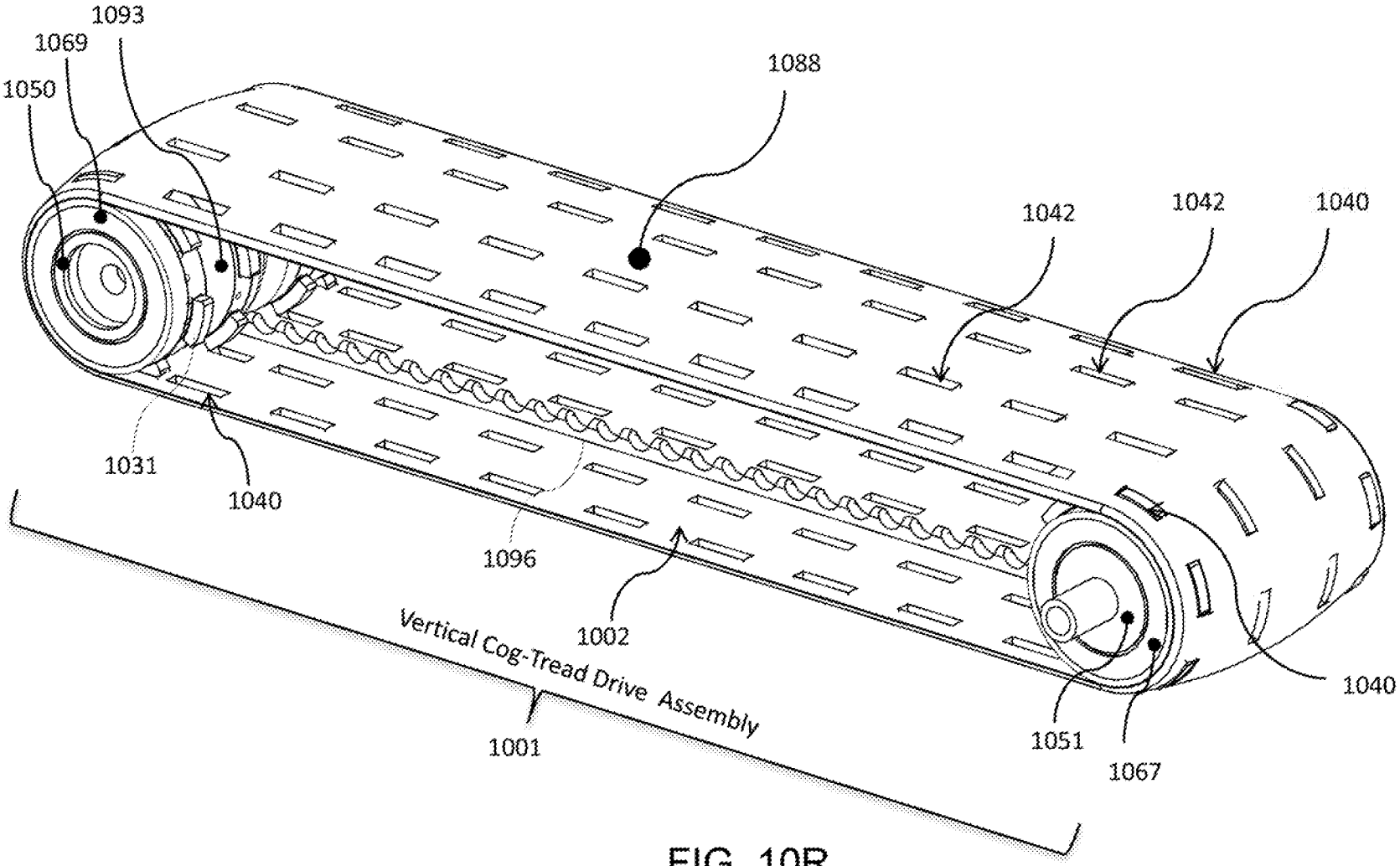

FIG. 10R is an isometric view of the vertical cog-tread drive assembly 1001, which is comprised of a vertical cog-tread skin 1088, a set of axel hub adapter 1051, a set of bearing hub adapters 1050, and for each adapter set there is a vertical cog-tooth tread-drive hub assembly 1093. The vertical cog-tooth tread-drive hub assembly 1093 has a bearing hub adapter 1050 and an axel hub adapter 1051. The vertical cog-tread skin 1088 has outer cog-tread openings 1040 and inner cog-tread openings 1042. These outer cog-tread openings 1040 and inner cog-tread openings 1042 engage the outer cog-teeth 1031 and the inner cog-teeth 1032, respectively. The outer cog-tread openings 1040 and inner cog-tread openings 1042 provide an escape path for the dirt, sand, mud, snow, and ice that might cause the tread to slip. The outer cog-teeth 1031 and the inner cog-teeth 1032 push the debris through these openings. This system provides exceptional transfer of torque to the tread because of the grip of the outer cog-teeth 1031 and the inner cog-teeth 1032 on the outer cog-tread openings 1040 and inner cog-tread openings 1042 and the approximate 30° clocking referred to in FIG. 10N. This clocking provides a continuous force on the vertical cog-tread skin 1088. The positive sprocket drive gear 1090 and its respective riser tread guide 1096 are used in this configuration for maximum performance.

Figure 11A:
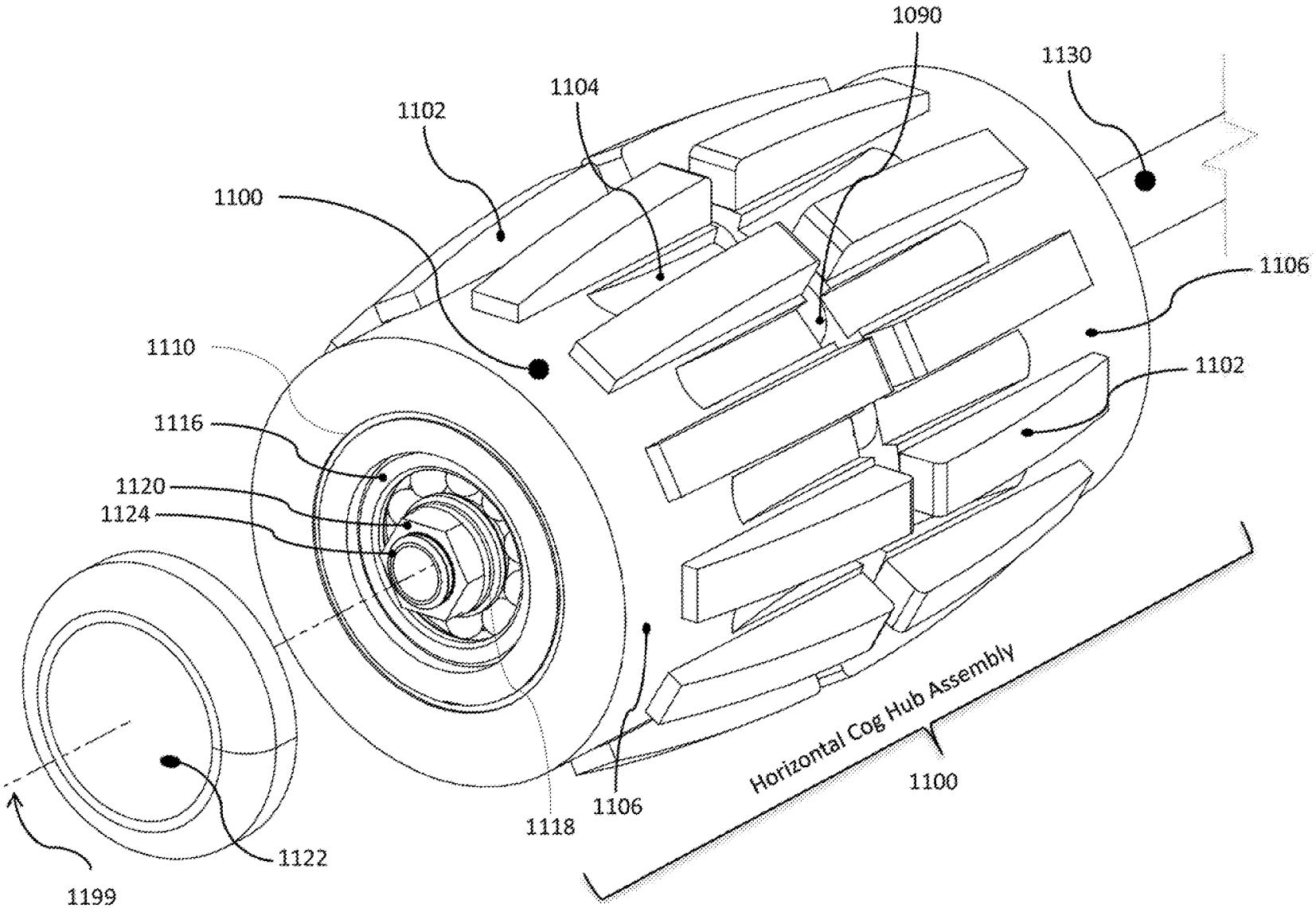
FIG. 11A is an isometric view of a horizontal cog-hub assembly with a dosed protective cap.

FIG. 11A is an isometric view of a horizontal cog-hub assembly 1100 with a closed protective cap 1122 that is placed into a dosed protective cap-retaining recess 1110. Rotating about the axis of rotation 1199 on an axle 1130 is the horizontal cog-tread hub assembly 1100. The horizontal cog-tread hub assembly 1100 is comprised of horizontal cog-teeth 1102 with intervening depressions 1104 that are formed onto and into the oval hubs 1106. These intervening depressions 1104 are used to prevent tread binding because of debris buildup. These intervening depressions 1104 can help evacuate sand, water, and other debris as the horizontal cog-hub assembly 1100 rotates. The horizontal cog-hub assembly 1100 rotates on bearings 1116 that are secured in place by a locking nut 1120 with a bearing washer 1118. The locking nut 1120 is fastened onto the axel threaded end 1124 of the axel 1130. The axel 1130 has two threaded ends 1124. Also shown is a positive sprocket drive gear 1090 that is inserted between the two oval hubs 1106.

Figure 11B:
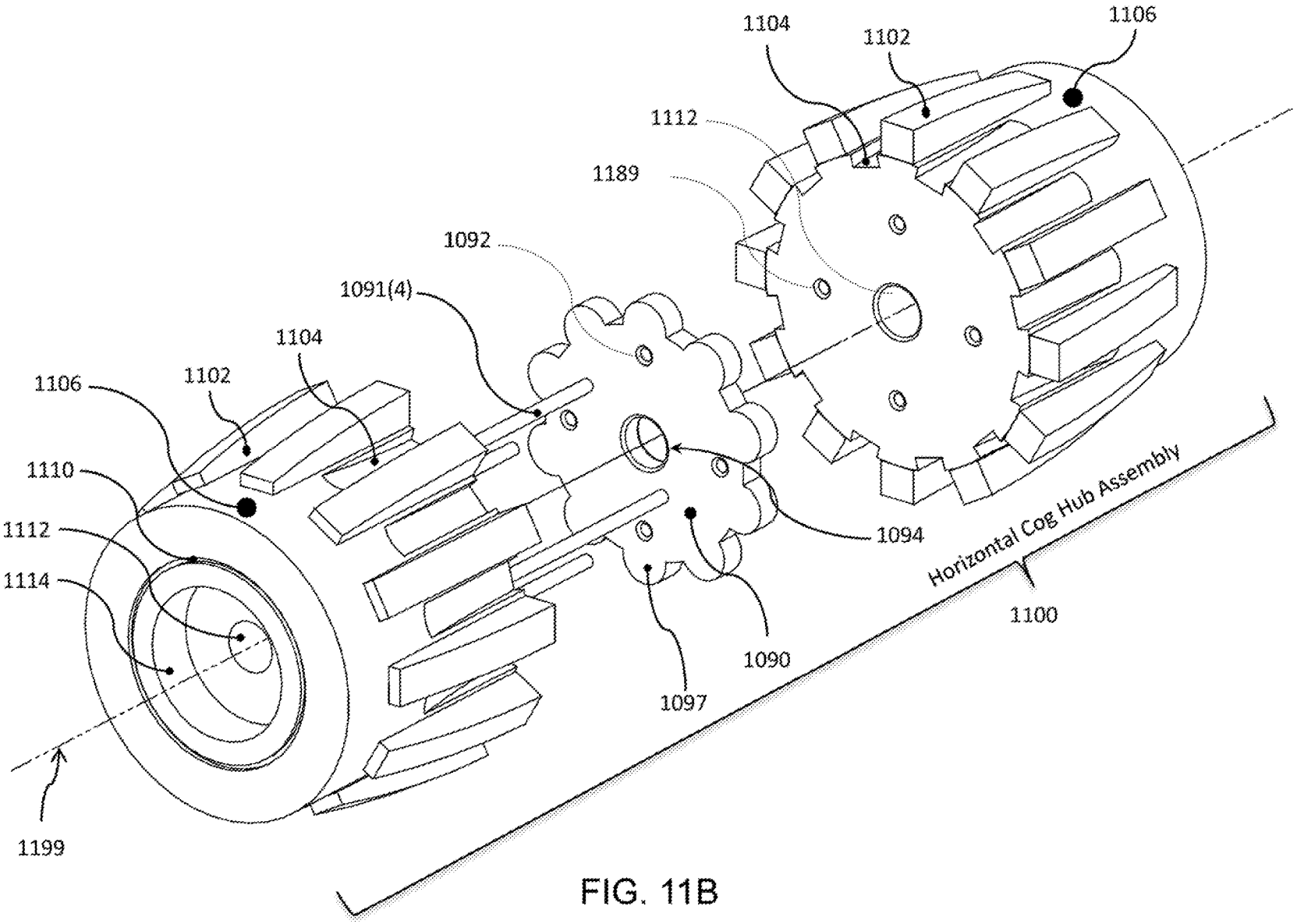
FIG. 11B is an expanded isometric view of the horizontal cog-hub assembly showing the two identical oval hubs with the horizontal cog-teeth and the intervening depressions and the positive sprocket drive gear.

FIG. 11B is an expanded isometric view of the horizontal cog-hub assembly 1100. This expanded view shows two identical oval hubs 1106 with the horizontal cog-teeth 1102 and the intervening depressions 1104. The two oval halves 1106 and the positive sprocket drive gear 1090 are joined together with friction fit alignment rods 1091. These friction fit alignment rods 1091 also register and hold in place the intervening positive sprocket drive gear 1090. The friction fit alignment rods 1091 are inserted and press fit into the friction fit seating recess 1189 of the one oval hub 1106, then pass through the through-hole 1092 of the positive sprocket drive gear 1090 and into the friction fit seating recess 1189 of the second oval hub 1106. The oval hub 1106 have axel through-hole 1112 and a bearing recess 1114 that will ride on an axel 1130 (not shown, see FIG. 10A). The positive sprocket drive gear 1090 also has an axel through-hole 1194 that is larger than the axel through-hole 1112 to prevent binding. The axel through-hole 1194 of the positive sprocket drive gear 1090 can be enlarged to accept a bearing to share axel 1130 loading forces. These parts are pressed together and form the horizontal cog-hub assembly 1100. The horizontal cog-hub assembly 1100 is designed to ride on axle 1130 as shown in FIG. 11A.

Figure 11C:
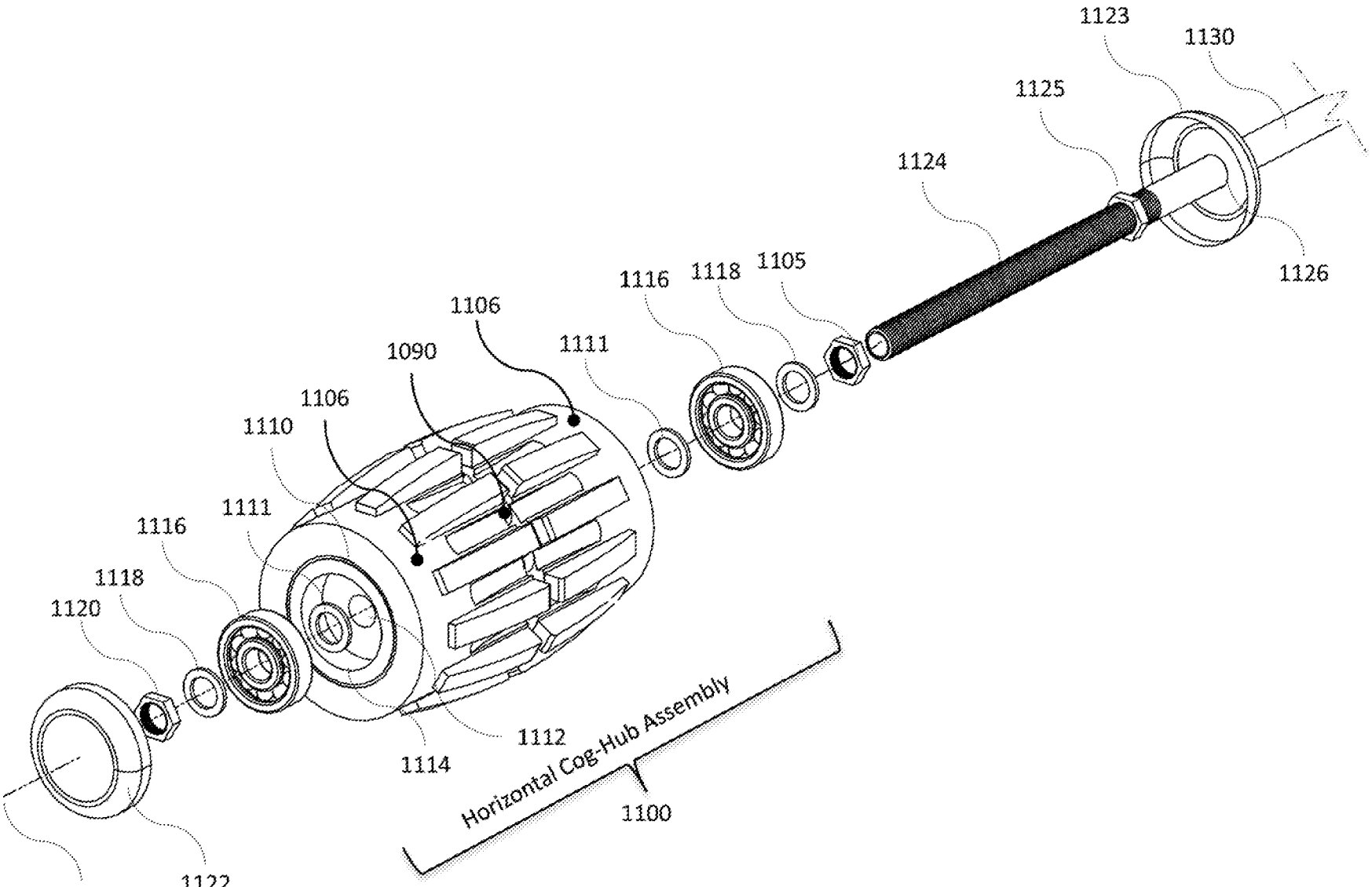
FIG. 11C is an expanded isometric view of the components used to secure the horizontal cog-hub assemblies to the axel.

FIG. 11C is an expanded isometric view of the components used to secure the horizontal cog-hub assembly 1100 to the axel 1130, A portion of the axel 1130 is shown. Beginning from the partial view of the axel 1130, there is a protective cap 1123 that slides onto the axel 1130 through the through-hole 1126, This protective cap 1123 will snap into the protective cap retaining recess 1110 to protect the bearing and other surfaces from water and debris intrusion. Flange nut 1125 acting as a flange stop is threaded onto the axel threaded end 1124 of the axel 1130 and locked in place with the locking nut 1105, The bearing washer 1118 is positioned onto the axel 1130 next to the locking nut 1105. The bearing 1116 and the bearing spacer 1111 are positioned onto the axel 1130 and simultaneously inserted into the bearing recess 1114 of the horizontal cog-hub assembly 1100. The axel threaded end 1124 of the axel 1130 will protrude from the axel through-hole 1112 of the second oval hub 1106 allowing the bearing spacer 1111 and the bearing 1116 to be seated 111 the hearing recess 1114 of oval hub 1106. To complete the assembly process, the horizontal cog-hub assembly 1100 is secured to the axel 1130 by adding the last bearing washer 1118 and the locking nut 1120 onto the axel threaded end 1124 of the axel 1130, The dosed protective cap 1122 is installed into the cover retaining recess 1110 to minimize contamination.

Figure 11D:
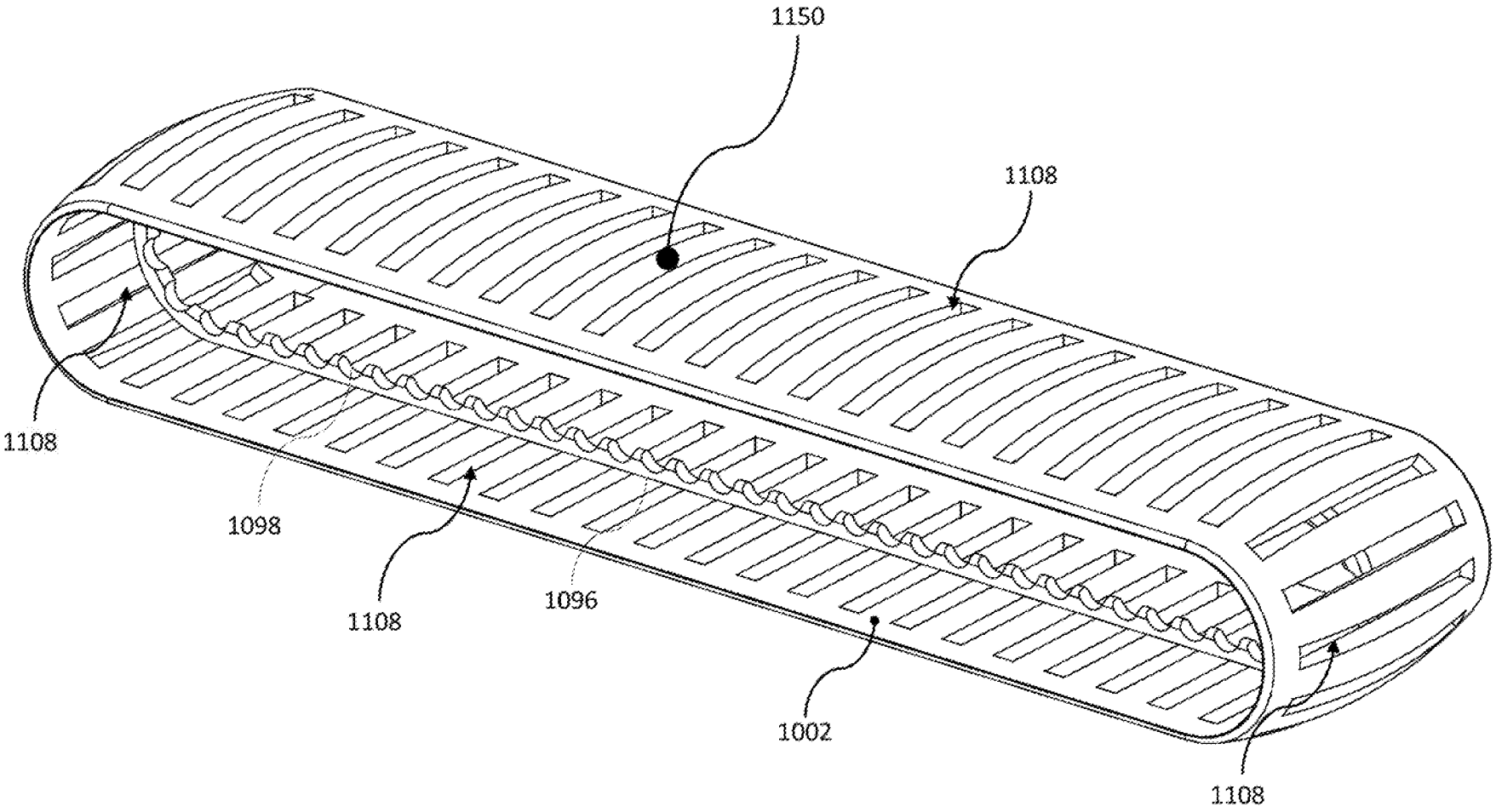
FIG. 11D is an isometric view of the horizontal cog-tread.

FIG. 11D is an isometric view of the horizontal cog-tread 1150. This view shows the horizontal cog-teeth tread openings 1108, the, inside surface 1002, the tread riser guide 1096, and the receiver sprocket 1098. All of these components and their functions will be described in the FIG. 11E.

Figure 11E:
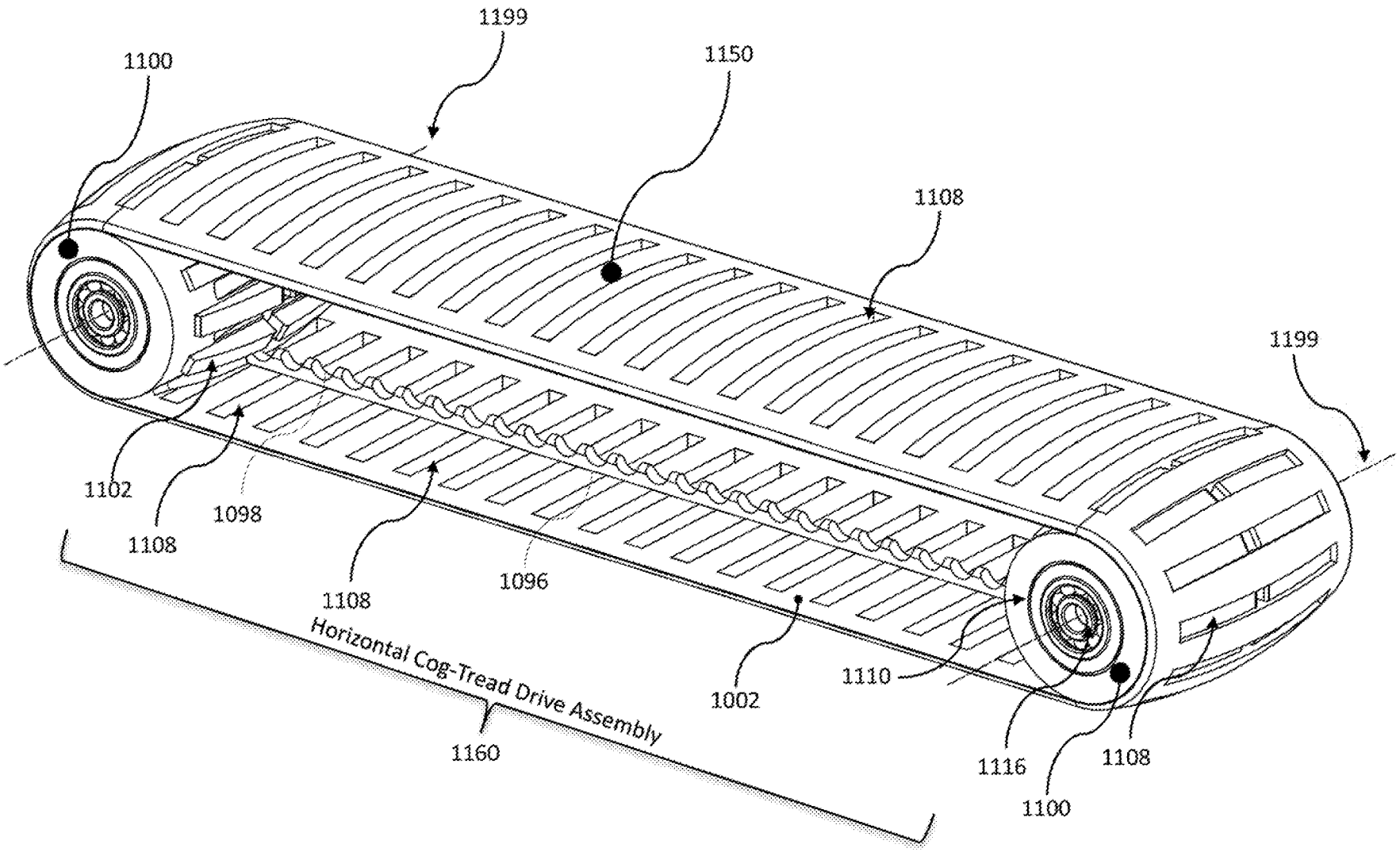
FIG. 11E is an isometric view of the horizontal cog-drive assembly.

FIG. 11E is an isometric view of the horizontal cog-tread 1150 and the horizontal cog-hub assemblies 1100 that comprise the horizontal cog-drive assembly 1160. As the horizontal cog-hub assemblies 1100 begin to rotate, the horizontal cog-teeth 1102 will engage horizontal cog-teeth tread openings 1108 moving the horizontal cog-tread 1150 forward. If there were any debris in the horizontal cog-teeth tread openings 1108, the horizontal cog-tooth 1102 expels the debris. As the horizontal cog-tread 1150 moves around the horizontal cog-hub assemblies 1100, the horizontal cog-teeth 1102 will disengage the horizontal cog-teeth tread openings 1108. These horizontal cog-teeth tread openings 1108 will act to grip mud, dirt, and grass to maintain traction until it engages the other horizontal cog-hub assemblies 1100 and continues the process. Another traction device that is implemented in this configuration is the positive sprocket drive gear 1090 (not shown, see FIG. 11B) that couples to the receiver sprocket 1098 of the tread riser guide 1096. The tread riser guide 1096 also prevents the horizontal cog-tread. 1150 from slipping off the horizontal cog-hub assemblies 1100. The horizontal cog-teeth 1102 prevent the horizontal cog-tread 1150 from slipping off the horizontal cog-hub assemblies 1100. The inside surface 1002 of the horizontal cog-teeth tread openings 1108 should he filleted to prevent the horizontal cog-teeth 1102 from riding up onto the inside surface 1002 of the horizontal cog-tread 1150, which would cause jamming and derailment of horizontal cog-tread 1150. The closed protective caps 1122 that normally reside on the vertical hub surface at 1110 have been removed to show the recessed bearings 1116.

Figure 12A:
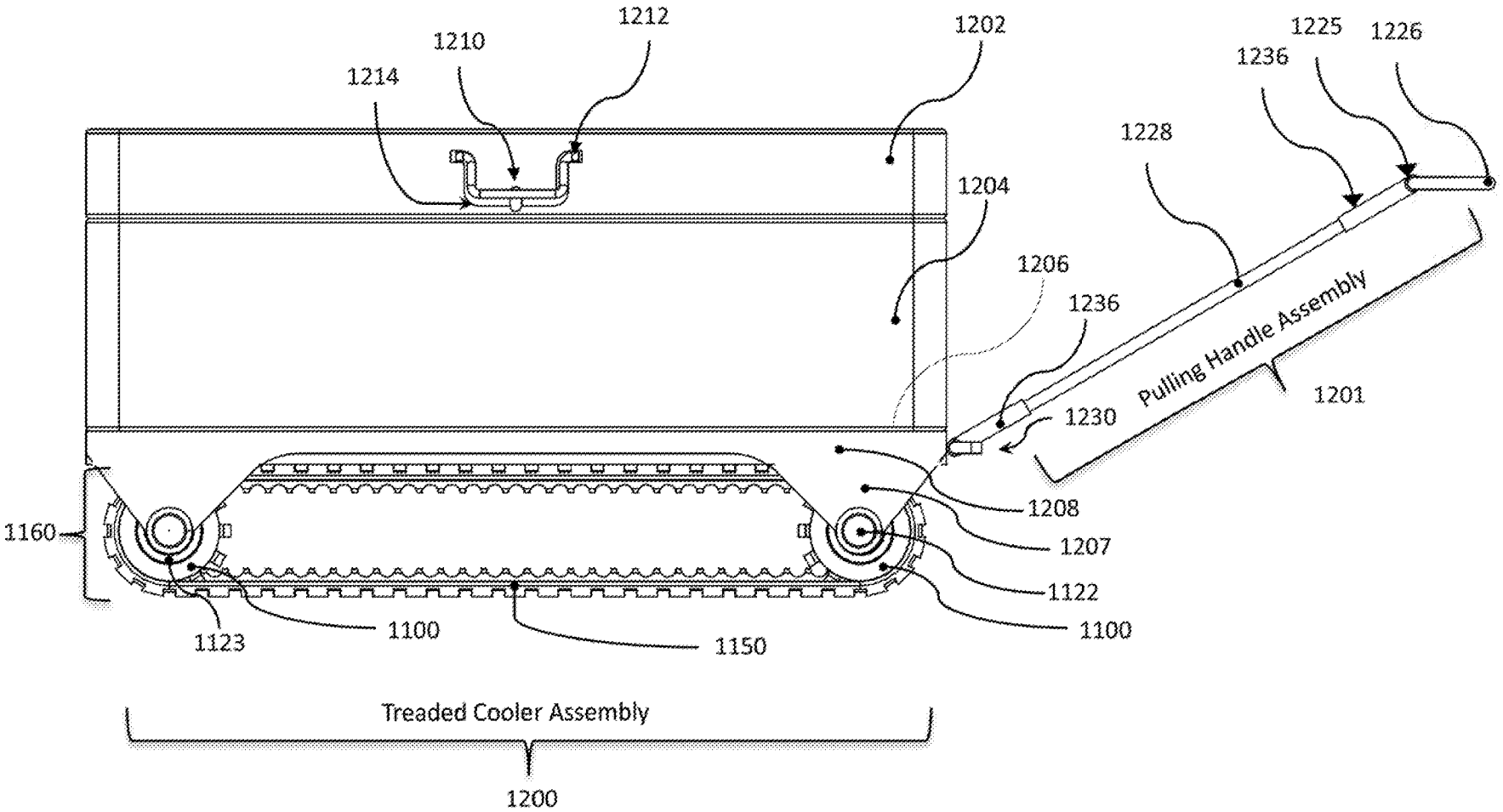
FIG. 12A is a side view of the treaded cooler assembly.
Figure 12B:
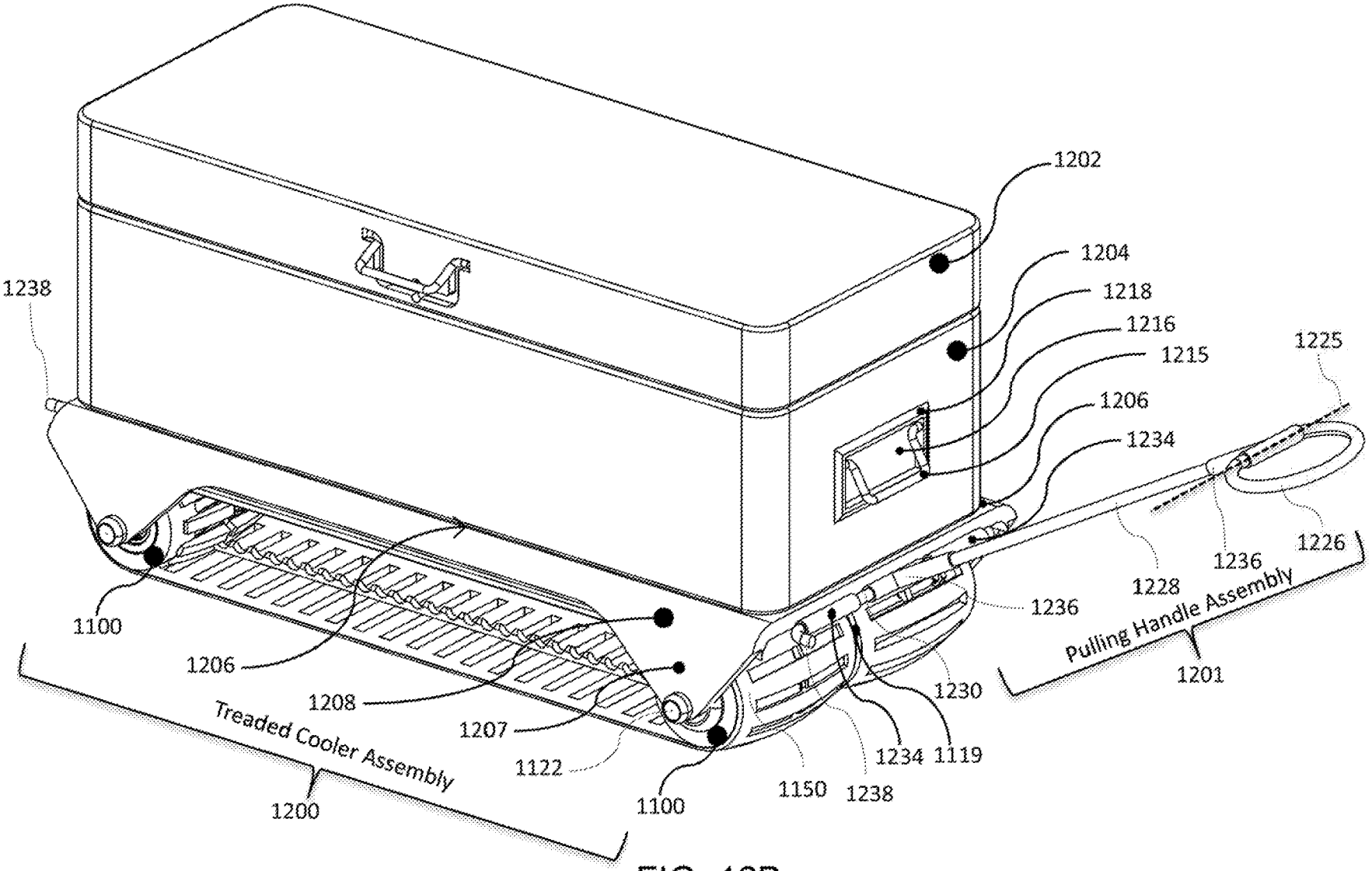
FIG. 12B is an isometric view of the treaded cooler assembly, the pulling handle assembly and the dual horizontal cog-tread drive assembly.

FIG. 12A is a side view of the treaded cooler assembly 1200, the pulling handle assembly 1201, and the horizontal cog-tread drive assembly 1160 that is comprised of the horizontal cog-hub assembly 1100 and the horizontal cog-tread 1150, The treaded cooler assembly 1200 is comprised of a cooler top 1202, a cooler body 1204, a cooler base 1208, the horizontal cog-hub assembly 1100, the horizontal cog-tread 1150, and a pulling handle assembly 1201, The cooler top 1202 has a recessed handle 1212 that is accessed through a recessed finger pull 1210. The recessed handle 1212 resides in the recessed handle pocket 1214, Cooler body 1204 sits atop a cooler base 1208. This cooler base 1208 has rigid forks 1207 that are formed by a molding, thermoforming or metal forging process. The cooler body 1204 can be welded, fused or glued to the cooler base 1208 as indicated by the bond bead or weld bead 1206. The horizontal cog-hub assembly 1100 is attached to the rigid forks 1207 of the cooler base 1208, The horizontal cog-hub assembly 1100 drives the horizontal cog-tread 1150. The pulling handle assembly 1201 maneuvers the cooler base 1208. The pulling handle assembly 1201 is comprised of a D-handle 1226, a T-union 1236, a handle arm 1228, and a second T-union 1236. The pulling handle assembly 1201 is connected to the cooler base 1208 by the axel hinge-pin 1230 and a quick disconnect pin 1232 (not shown).

FIG. 128 is an isometric view of the treaded cooler assembly 1200, the pulling handle assembly 1201, and the dual horizontal cog-tread drive assembly 1160. The dual horizontal cog-tread drive assembly 1160 is comprised of a longer axel 1130 (not shown, see FIG. 11C) and multiple hub spacers 1119 to adequately separate the two horizontal cog-hub assemblies 1160.

This view shows the side recessed cooler handle 1215 that is recessed into the side recessed cooler handle pocket 1216 and a fortified side recessed frame 1218 that distributes the forces of the full cooler load across the cooler side wall when the cooler body 1204 is lifted. This force redistribution will allow the cooler body 1204 and cooler top 1202 to he removed from the cooler base 1208 if it is not welded or bonded. The cooler body 1204 can be, for example, welded, fused, strapped, or glued to the cooler base 1208 as indicated by the bond head or weld bead 1206, which secures the cooler body 1204 to the cooler base 1208 providing maneuverability as a single monolithic body. This is another reason for strengthening the fortified side recessed frame 1218. This view shows the pulling handle assembly 1201. This view shows the D-handle 1226 inserted into the T-union 1236 and how the D-handle 1226 rotates about the axis of rotation 1225. The pulling handle assembly 1201 is connected to the cooler base 1208 by the axel hinge-pin 1230 that slides through the hollow hinge knuckle 1234 through the T-union 1236 and the second hollow hinge knuckle 1234. The axel hinge-pin 1230 also serves as a hinge-pin and passes through the two hollow hinge knuckles 1234. The pulling handle assembly 1201 can be duplicated or relocated from one end of the cooler to the other by pulling the quick disconnect pin 1232 from the locking pin through-hole 1233, and then removing the axel hinge-pin 1230 by the elbow finger-pull 1238. The axel hinge-pin 1230 is joined to identical hardware on the opposite end of the treaded cooler assembly 1200. This treaded cooler assembly 1200 uses two of the horizontal cog-tread drive assemblies 1160 as shown in FIG. 11E, the tread hub assemblies 1100 are attached to the rigid fork 1207 at each end of the cooler base 1208 with a long axel, which is axel 1130 in FIG. 11C.

Figure 12C:
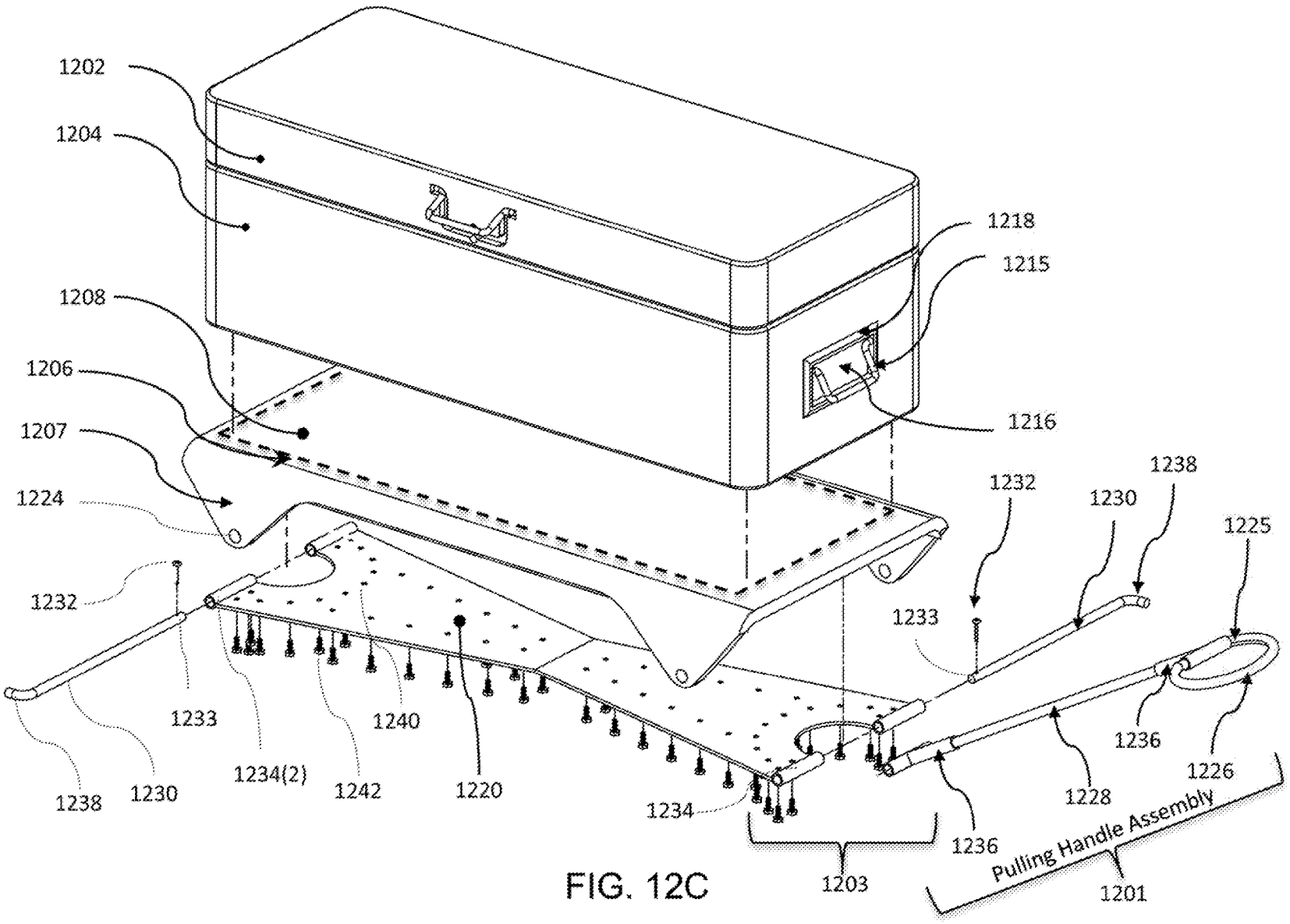
FIG. 12C is an expanded isometric view of the cooler top, cooler body, cooler base, a cooler base reinforcement plate and the pulling handle assembly.

FIG. 12C is an expanded isometric view of the cooler top 1202, cooler body 1204, cooler base 1208, a cooler base reinforcement plate 1220, and the pulling handle assembly 1201. The cooler top 1202, the cooler body 1204, and the side recessed cooler handle 1215 are shown elevated above the cooler base 1208. The dashed line 1206 represents the bond-line or weld-line if the cooler body 1204 is to be permanently fixed to the cooler base 1208. The dashed line 1206 represents the footprint of the cooler body 1204 as temporarily seated on the cooler base 1208 if strapped in place.

Common plastic materials used to make coolers would be inadequate for the forces required to pull large coolers. Therefore, cooler base reinforcement plate 1220 is generally, but not always a metal structure that is fastened to the underside of the cooler base 1208. The cooler base reinforcement plate 1220 is fastened to the underside of the cooler base, 1208 with bolts 1242. The bolts 1242 pass through the bolt through-holes 1240 and are threaded into the underside threaded-holes 1243 (not shown) of the cooler base 1208. Two hollow hinge knuckles 1234 are on opposite ends of the cooler base reinforcement plate 1220. These are called "knuckles" according to hinge anatomy and the "hinge-pin" is the axel-rod hinge-pin 1230. The two hollow hinge knuckles 1234 are welded or formed in place will function as a strong point for pulling. This will eliminate strong localized forces applied to the plastic. The axel-rod hinge-pin assembly 1203 is comprised of an axel-rod hinge-pin 1230, the hollow hinge knuckle 1234, the T-union 1236, the last hollow hinge knuckle 1234, a locking pin through-hole 1233, the elbow finger-pull 1238, and a quick disconnect-pin 1232. The axel-rod hinge-pin assembly 1203 uses the axel hinge-pin 1230 that passes through the hollow hinge knuckle 1234, the T-union 1236, and the last hollow hinge knuckle 1234 to form a hinge-like assembly, which the handle pulling assembly 1201 is free to rotate. To prevent the axel hinge-pin 1230 from sliding out, there is a locking pin through-hole 1233 in the end opposite the elbow finger-pull 1238, that will receive a quick disconnect-pin 1232. This forms a rigid structure that will be strong enough to withstand the pulling pressures of a fully loaded cooler.

Figure 12D:
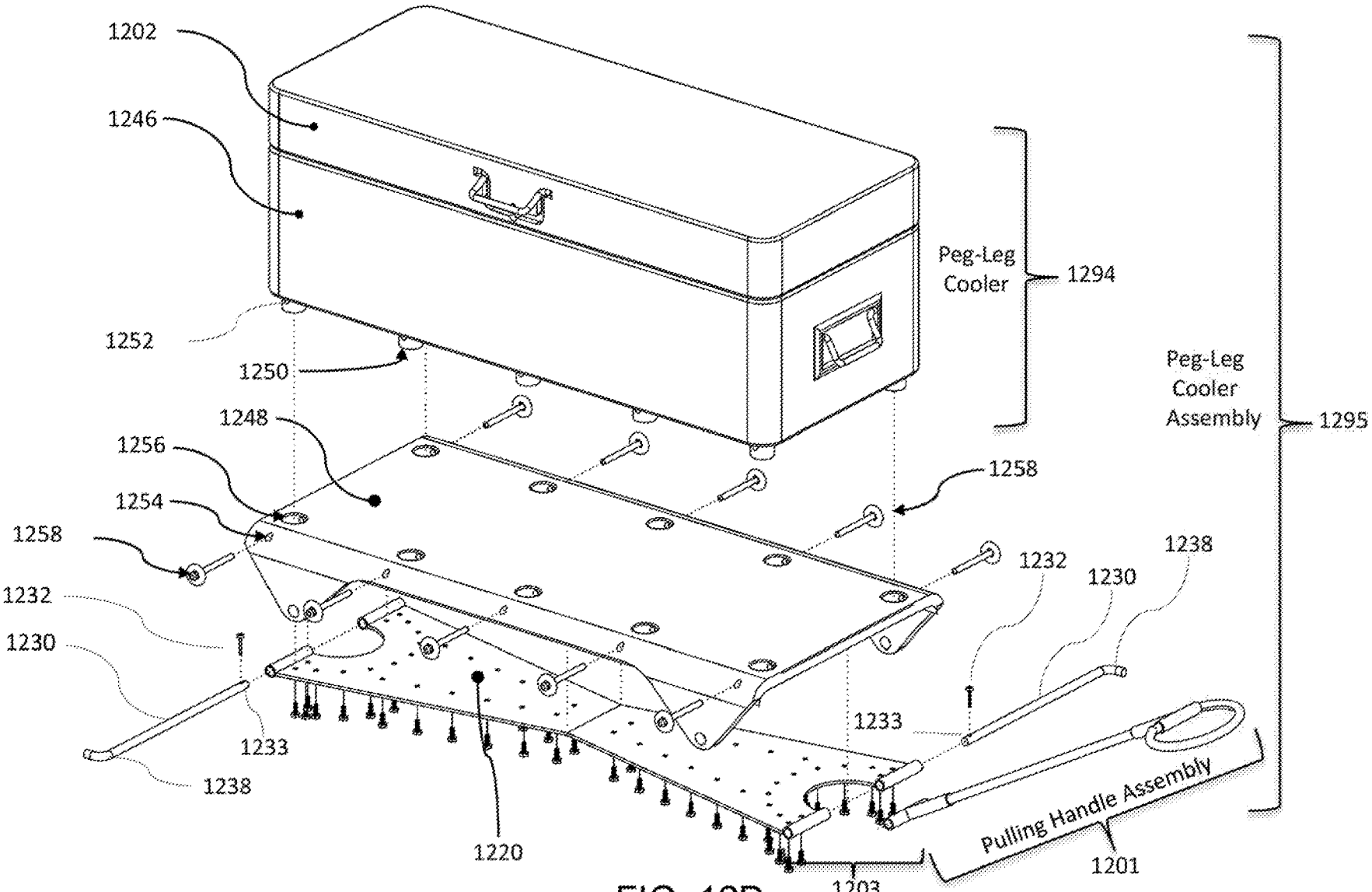
FIG. 12D is an isometric view of components that forms the peg-leg cooler assembly.

FIG. 12D is an expanded side view of a peg-leg cooler body 1246 that will be lowered onto the peg-leg cooler base 1248 and form the peg-leg cooler 1294. The peg-leg cooler body 1246 is identical to the cooler body 1204 but has cooler peg-legs 1250 formed or welded to the underside of the cooler body 1204. The peg-leg cooler base 1248 base on each side an array of cooler base peg-leg access holes 1256.

These cooler base peg-leg access holes 1256 receive the cooler peg-legs 1250 that attach to the peg-leg cooler base 1248 by inserting them into the cooler base peg-leg access holes 1256. This peg-leg cooler body 1246 is held in place by cooler base quick disconnect locking pins 1258 that pass through the cooler base quick disconnect locking pin through-hole 1254 in the peg-leg cooler base 1248 and through the peg-leg quick disconnect locking pin through-holes 252 that are machined or formed into the cooler peg-legs 1250. This forms a secure peg-leg cooler assembly 1295 that will act as a monolithic body. The same assembly method used in FIG. "12C of the cooler base reinforcement plate 1220, the axel-rod hinge-pin assembly 1203, and handle pulling assembly 1201 of the cooler base 1208, as shown in FIG. 12C, are used to construct the peg-leg cooler base 1248. In order to withstand the pulling forces due to the heavy weight of the contents of the cooler the reinforcement structure is necessary if plastic parts are used.

Figure 12E:
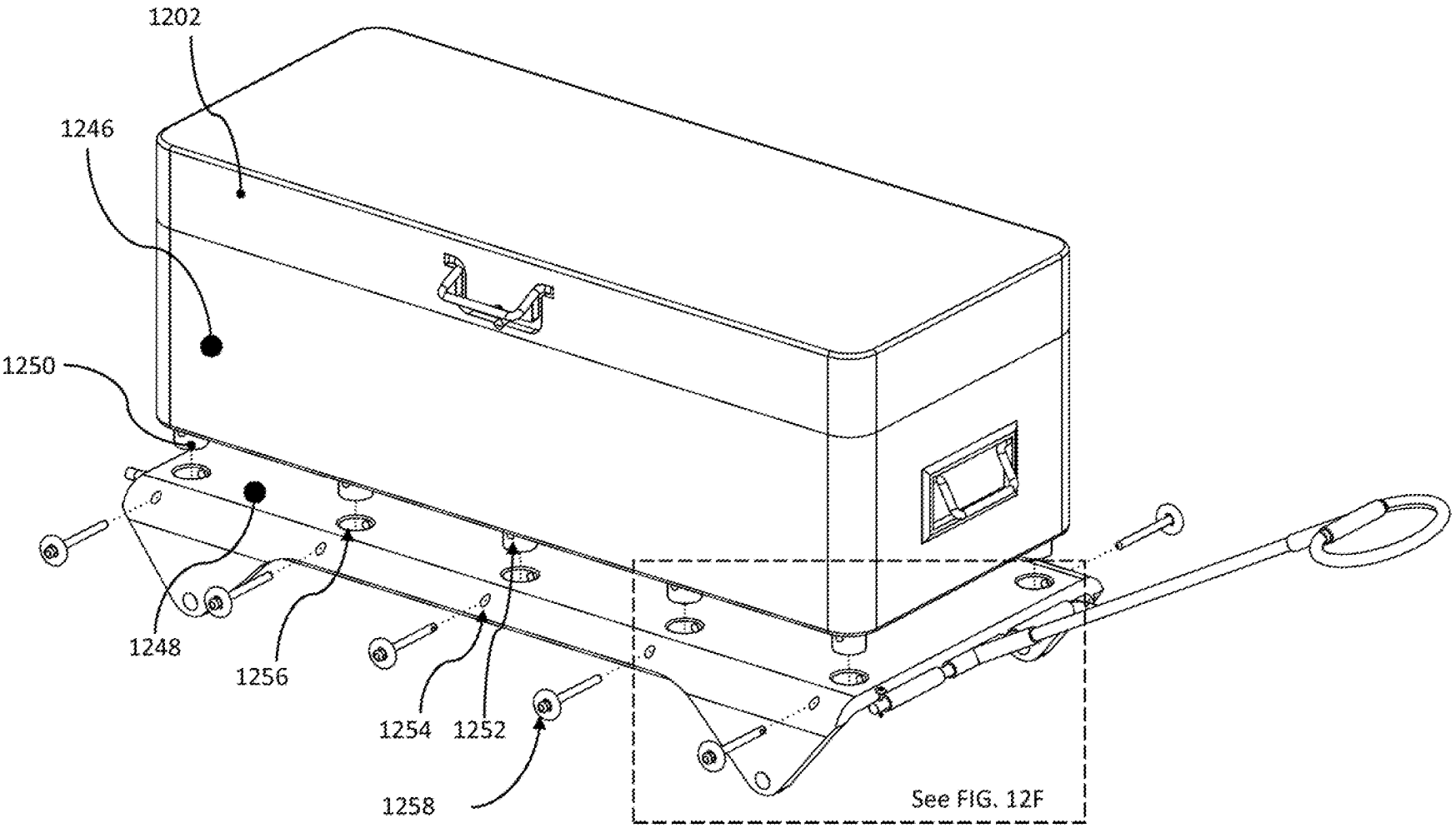
FIG. 12E is an expanded isometric view of the peg-leg cooler and the peg-leg cooler base ready to be locked in place with the quick disconnect locking pins.

FIG. 12E is an expanded isometric view of the peg-leg cooler 1294 and the peg-leg cooler base 1248 with a dashed line inset that will show a closer view of the cooler peg-leg 1250 and the cooler base quick disconnect locking pins 1258 interaction. This figure shows the cooler base peg-leg quick disconnect locking pins 1258 ready to he inserted into their respective through-holes once the peg-leg cooler body 1246 has been set in place. Once the peg-leg cooler body 1246 is properly seated on the peg-leg cooler base 1248 by sliding die cooler peg-legs 1250 into the cooler base peg-leg access holes 1256, the cooler base quick disconnect locking pins 1258 may be inserted into quick disconnect locking pin through-hole 1254 in the peg-leg cooler base 1248, and through the peg-leg quick disconnect locking pin through-holes 1252 that are machined or formed into the cooler peg-legs 1250 to secure the peg-leg cooler body 1246 onto the peg-leg cooler base 1248.

Figure 12F:
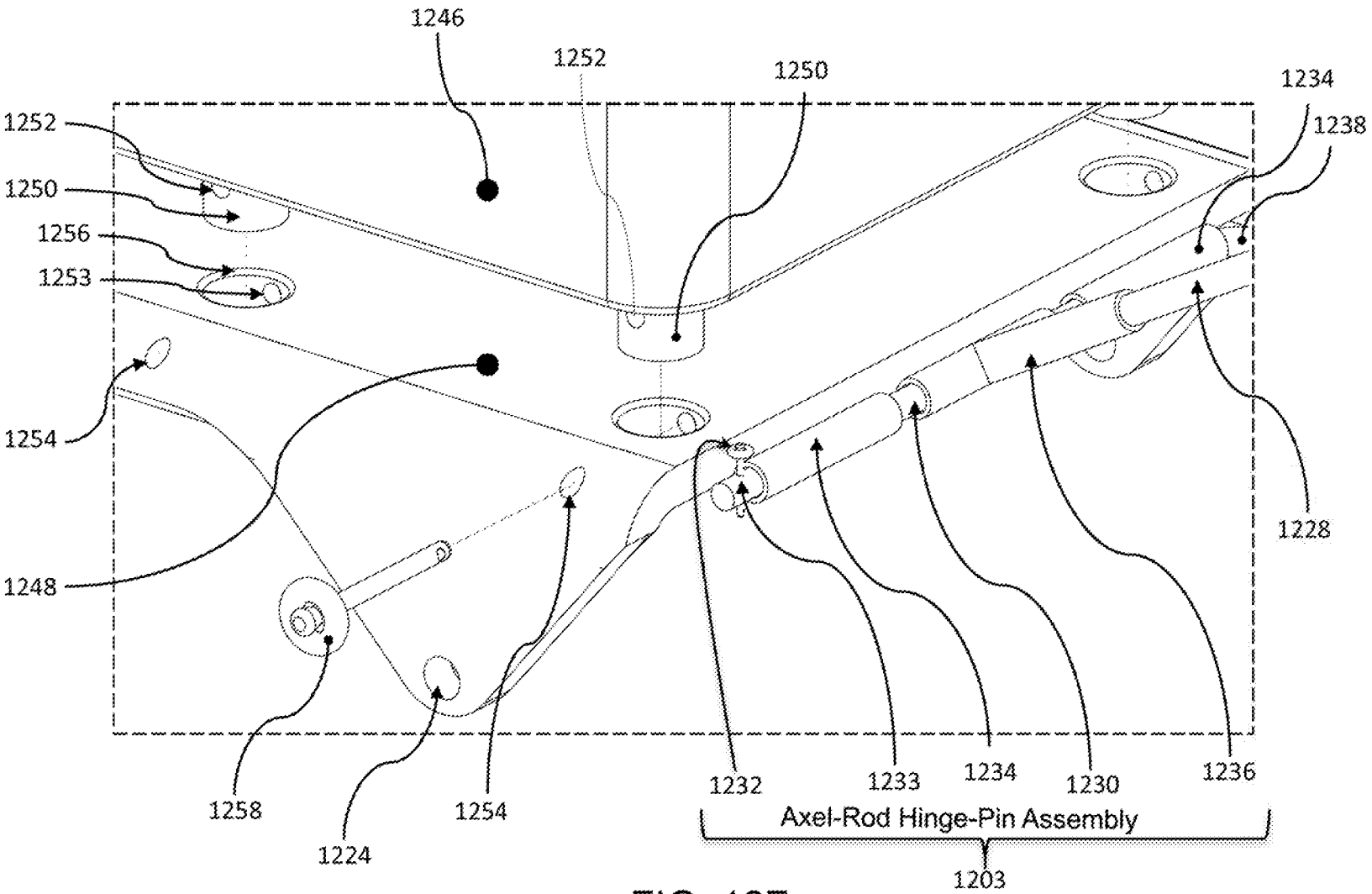
FIG. 12F is an expanded isometric view of the dashed line inset from FIG. 12E showing an enlarged view of the cooler peg-leg insertion and locking mechanisms and a closer partial view of the axel-rod hinge-pin assembly.

FIG. 12F is an expanded isometric view of the dashed line inset from FIG. 12E showing an enlarged view of the cooler peg-leg 1250 and a closer partial view of the axel-rod hinge-pin assembly 1231. The peg-leg cooler body 1246 is properly seated on the peg-leg cooler base 1248 by sliding the cooler peg-legs 1250 into the cooler base peg-leg access holes 1256, inserting the cooler base quick disconnect locking pins 1258 into the cooler base quick disconnect locking pin through-hole 1254 in the peg-leg cooler base 1248, and through the peg-leg quick disconnect locking pin through-holes 1252 that are machined or formed into the cooler peg-legs 1250 to secure the peg-leg cooler body 1246 onto the peg-leg cooler base 1248. The cooler base quick disconnect locking pins 1258 extend further into the peg-leg cooler base 1248 by seating deeper into the extended through-hole 1253.

This view also shows the axel-rod hinge-pin assembly 1231. The handle arm 1228 is connected to the lower T-union 1236, This lower T-union 1236 is held 111 place between the two hollow hinge knuckles 1234, and acts like a hinge once the axel hinge-pin 1230 is slid into the hollow hinge knuckles 1234 that are attached to the cooler base reinforcement plate 1220. The T-union 1236 is captured between the hollow hinge knuckles 1234, and the axel hinge-pin 1230 is locked into position by a quick disconnect pin 1232 that is placed into a locking pin through-hole 1233.

Figure 12G:
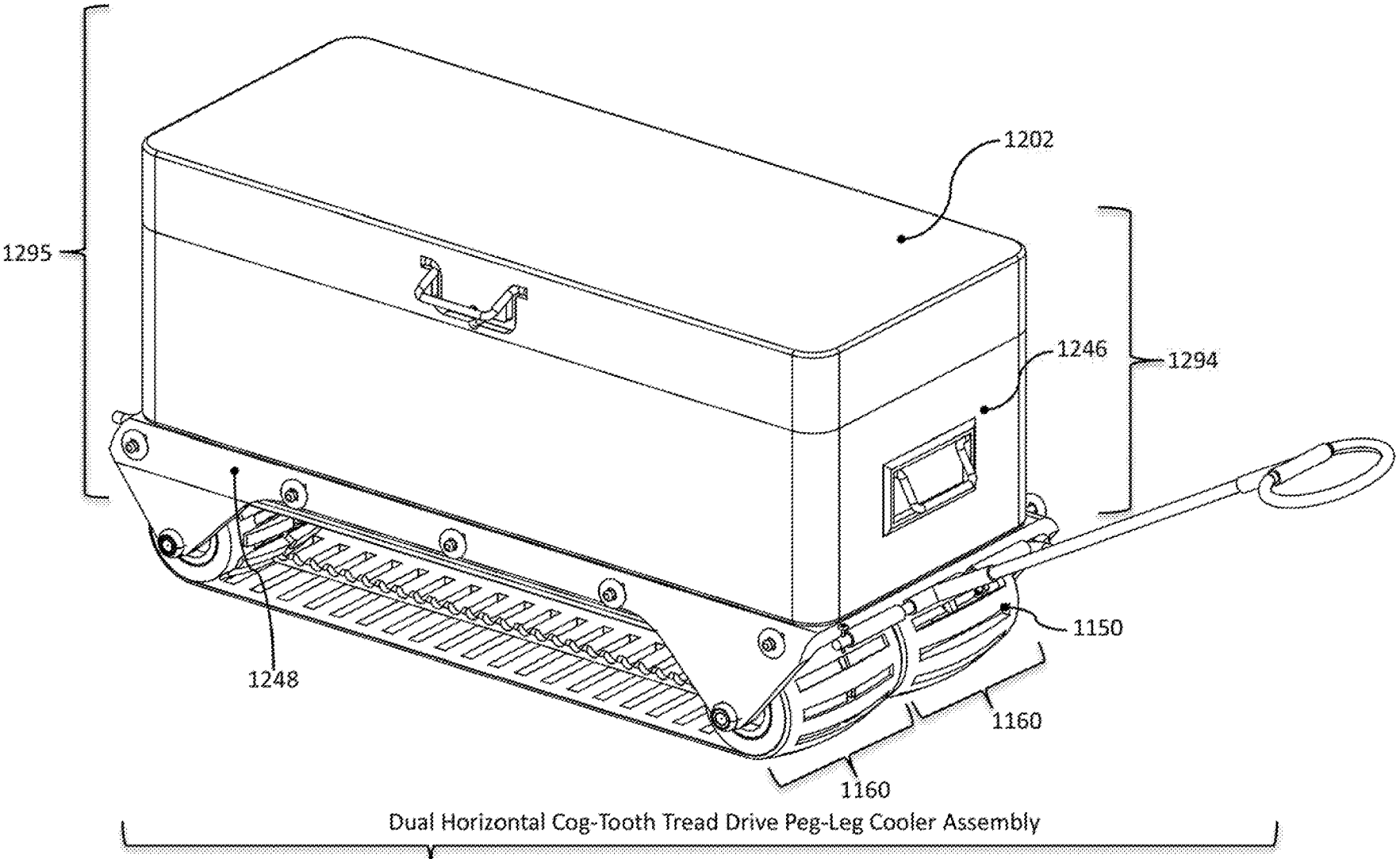
FIG. 12G an isometric view dual horizontal cog-tooth treaded drive peg-led cooler assembly.

FIG. 12G is the assembled isometric view of the peg-leg cooler assembly 1295, peg-leg cooler 1294 and the two horizontal cog-tread assemblies 1160. These items comprise the dual horizontal cog-tooth treaded drive peg-led cooler assembly 1299.

Figure 12H:
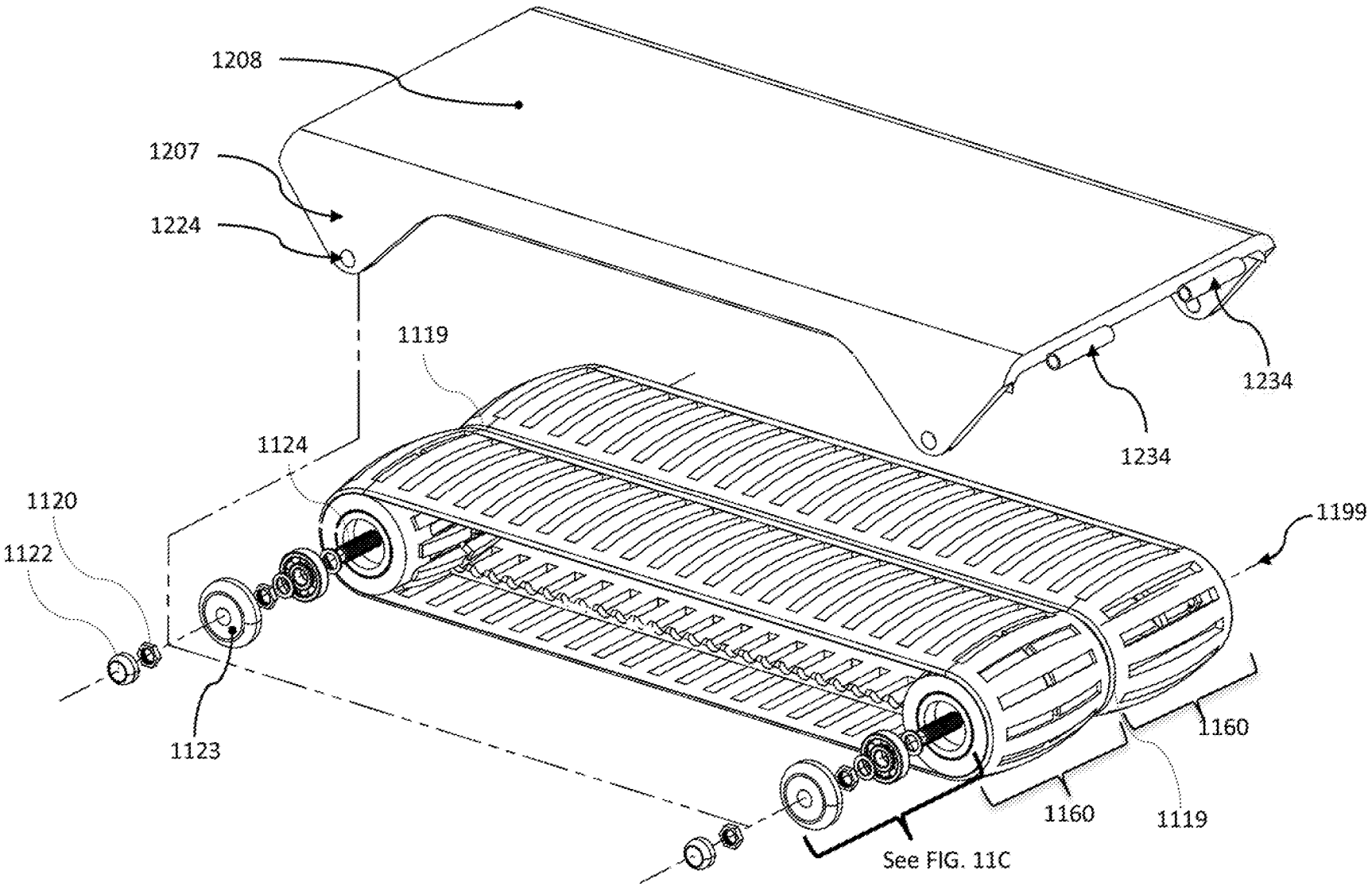
FIG. 12H is an expanded isometric view of the two horizontal cog-tread drive assemblies.
Figure 12I:
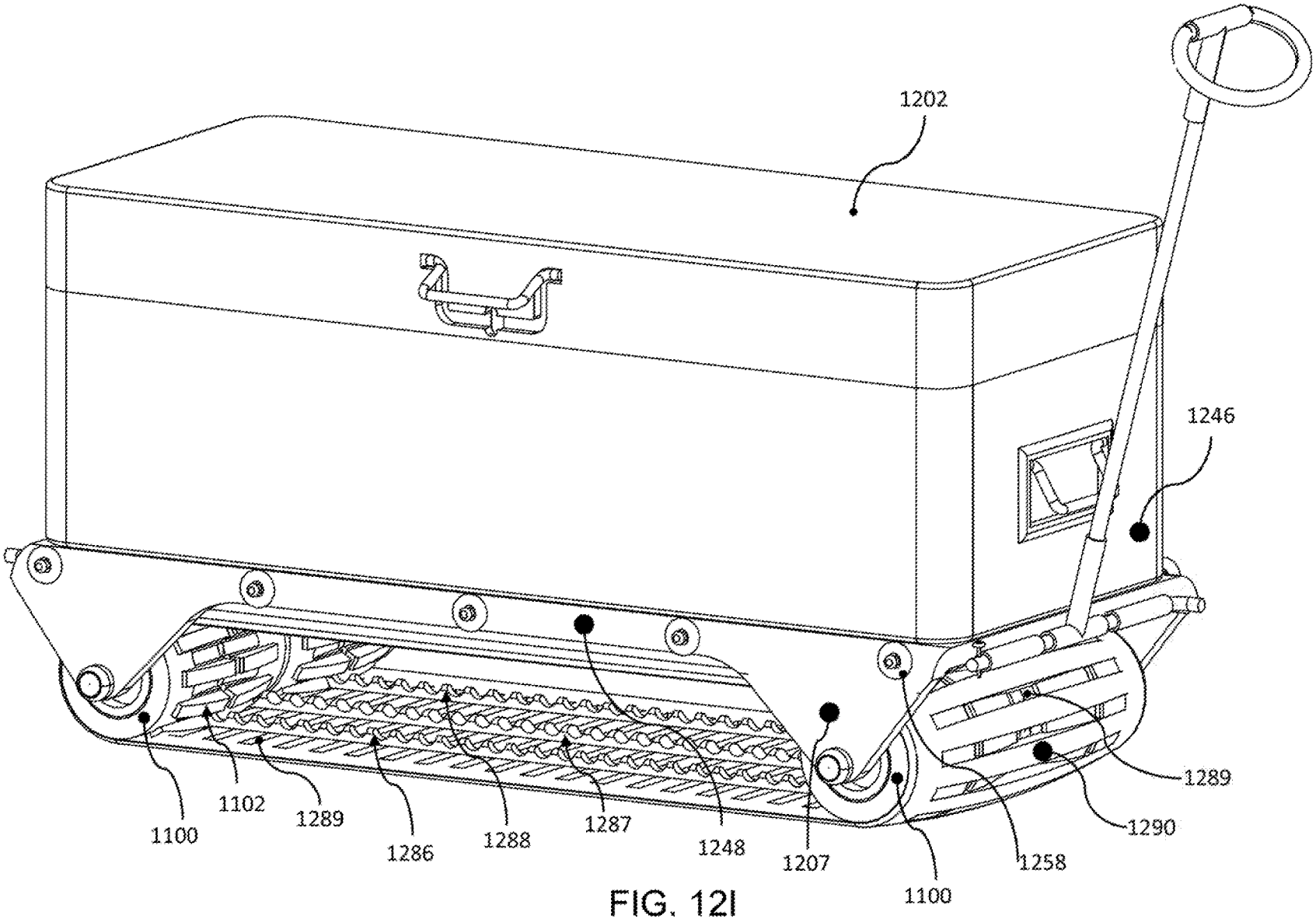
FIG. 12I is an isometric view of the peg-leg cooler assembly with a wide horizontal cog-tread.

FIG. 12H is an expanded isometric view of the two horizontal cog-tread drive assemblies 1160, which are separated by hub spacers 1119, and are fastened to the rigid fork 1207 of cooler base 1208. The cooler base 1208 is lowered over the two horizontal cog-tread drive assemblies 1160, which are separated by hub spacers 1119. The cooler base 1208 has rigid forks 1207 with fork-axel through-holes 1224 that accept the axel threaded end 1124 of the axel 1130 (not seen, see FIG. 11C), and passes through the two horizontal cog-tread drive assemblies 1160, as described in FIG. 11E, but has a large hub spacer 1119 that separates the two horizontal cog-tread drive assemblies 1160, and serves as a protective cap 1123 that keeps the internal bearings 1116 debris free. The axel threaded end 1124 passes through the other fork axel through-hole 1224 of the cooler base 1208, and is fastened in place with the locking-nut 1120 threaded onto the axel threaded end 1124, and covered with the small closed protective cap 1122 by snapping or threading onto the axel threaded end 1124.

FIG. 121 is an isometric view of the peg-leg cooler assembly 1295 with a wide horizontal cog-tread 1290. This view wide horizontal cog-tread 1290 that has three tread risers: left tread riser 1286, center tread riser 1287, and right tread riser 1288, and has two horizontal cog-tooth hubs 1100 on each axle 1130 (not shown, see FIG. 11C). This additional center tread riser 1287 provides stability to the wide horizontal cog-tread 1290. The center tread riser 1287 constrains the wide tread opening 1289 to a constant size preventing it from deforming. This deformation would result in the cog-tooth 1102 missing the wide tread opening 1289 of the wide horizontal cog-tread 1290 derailing from the horizontal cog-tooth hubs 1100. The action of pulling the treaded vehicle forward with large mass on the cooler, would cause partial collapse of the middle portion of the horizontal cog-teeth tread openings 1108. Therefore, this additional tread offers more stability.

Figure 12J:
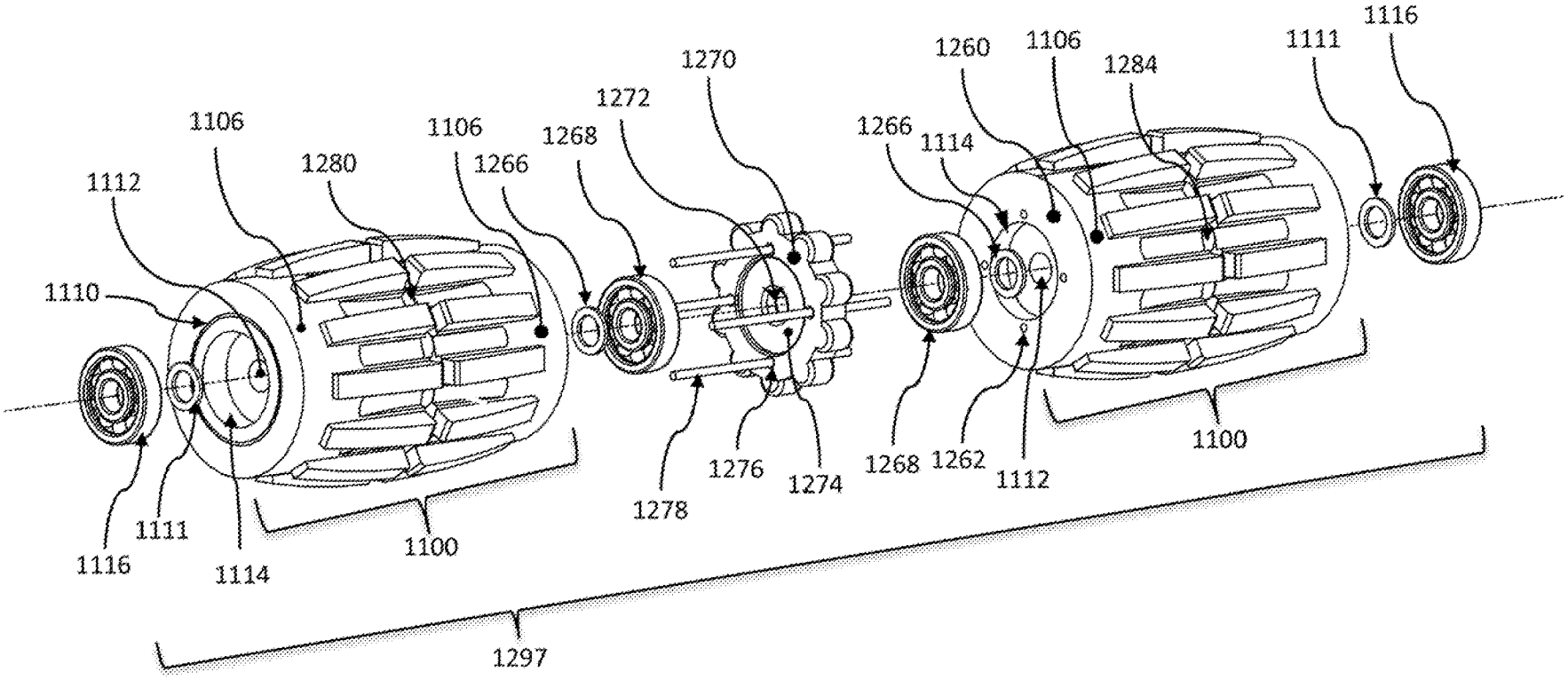
FIG. 12J is an expanded isometric view of the wide horizontal cog-bub assembly.

FIG. 12J is an expanded isometric view of the wide horizontal cog hub assembly 1297 with a wide positive sprocket drive gear 1270 incorporated between the two horizontal cog-hub assemblies 1100. Two horizontal cog-hub assemblies 1100 are joined together with an intervening wide positive sprocket drive gear 1270. On both sides of the wide positive sprocket drive gear 1270 is a bearing recess 1274 and an axle through-hole 1272. The two horizontal cog-hub assemblies 1100 and a wide positive sprocket drive gear 1270 are held together by friction fit alignment rods 1278 that are passed through the alignment rod through-holes 1276 in the wide positive sprocket drive gear 1270. These friction fit alignment rods 1278 mate into friction fit receiver-hole 1262 that are machined or formed into the inside surface 1260 of both oval hubs 1106. The bearings 1268 fit into bearing recesses 1274 on both sides of the wide positive sprocket drive gear 1270. The oval tread hubs 1106 have inside surfaces 1260, a bearing recess 1114, axle through-hole 1112, and four friction fit receiver-holes 1262. The bearings 1268 and bearing spacers 1266 are sandwiched between the wide positive sprocket drive gear 1270 and their respective tread hub assemblies 1100. The outside oval hubs 1106 have bearing recesses 1114 and axel through-holes 1112. The bearing 1116 and bearing spacer 1111 are inserted into the bearing recess 1114. The left positive sprocket drive gear 1280, the center wide positive sprocket drive gear 1270, and the right positive sprocket drive gear 1284 are the respective drive gears for the left tread riser 1286, center tread riser 1287, and right tread riser 1288 as shown in FIG. 121

Figure 12K:
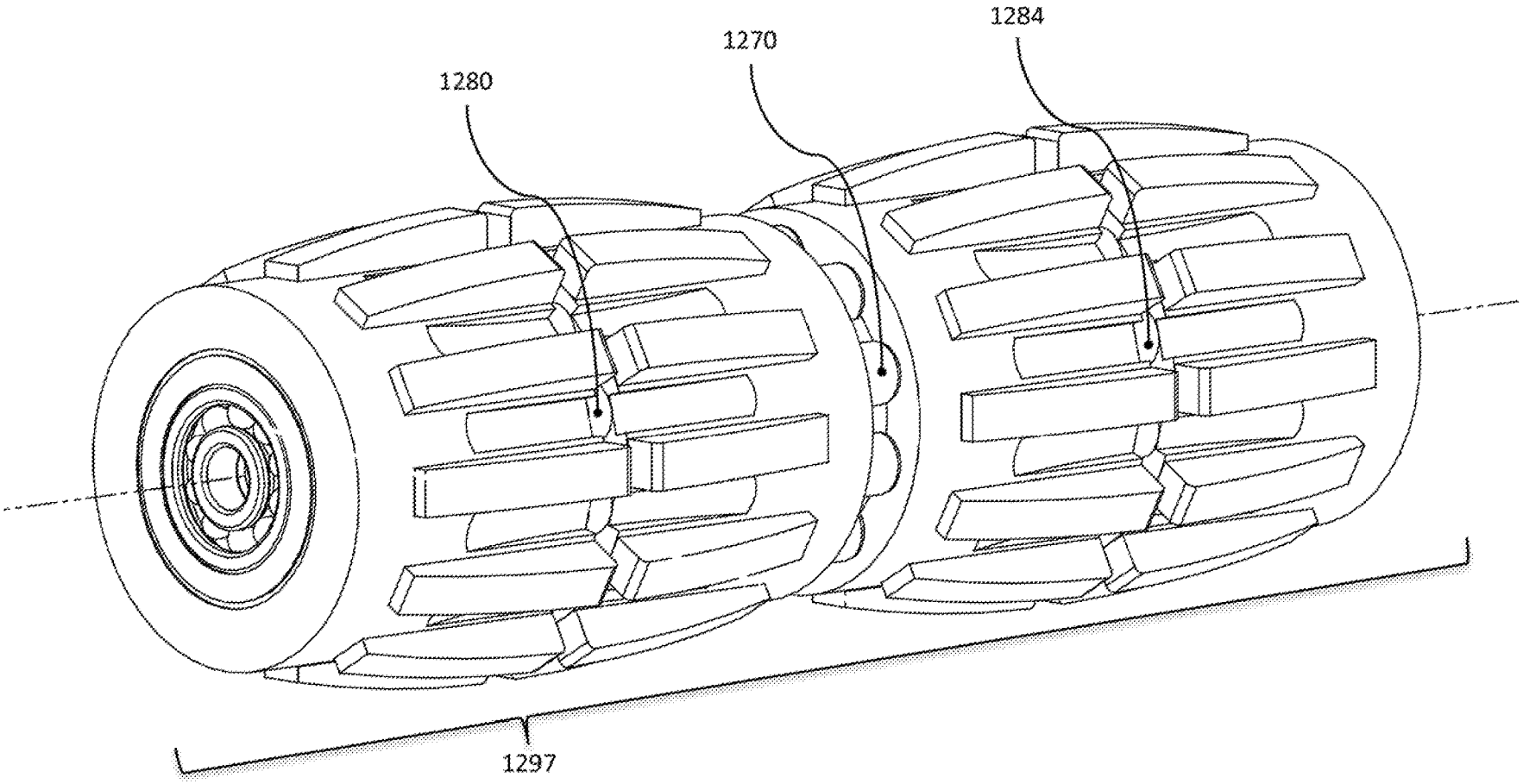
FIG. 12K is an off-axis view of the completed wide tread hub assembly.

FIG. 12K is an off-axis view of the completed wide tread hub assembly 1297 with the left positive sprocket drive gear 1280, the center wide positive sprocket drive gear 1270, and the right positive sprocket drive gear 1284.

Figure 12L:
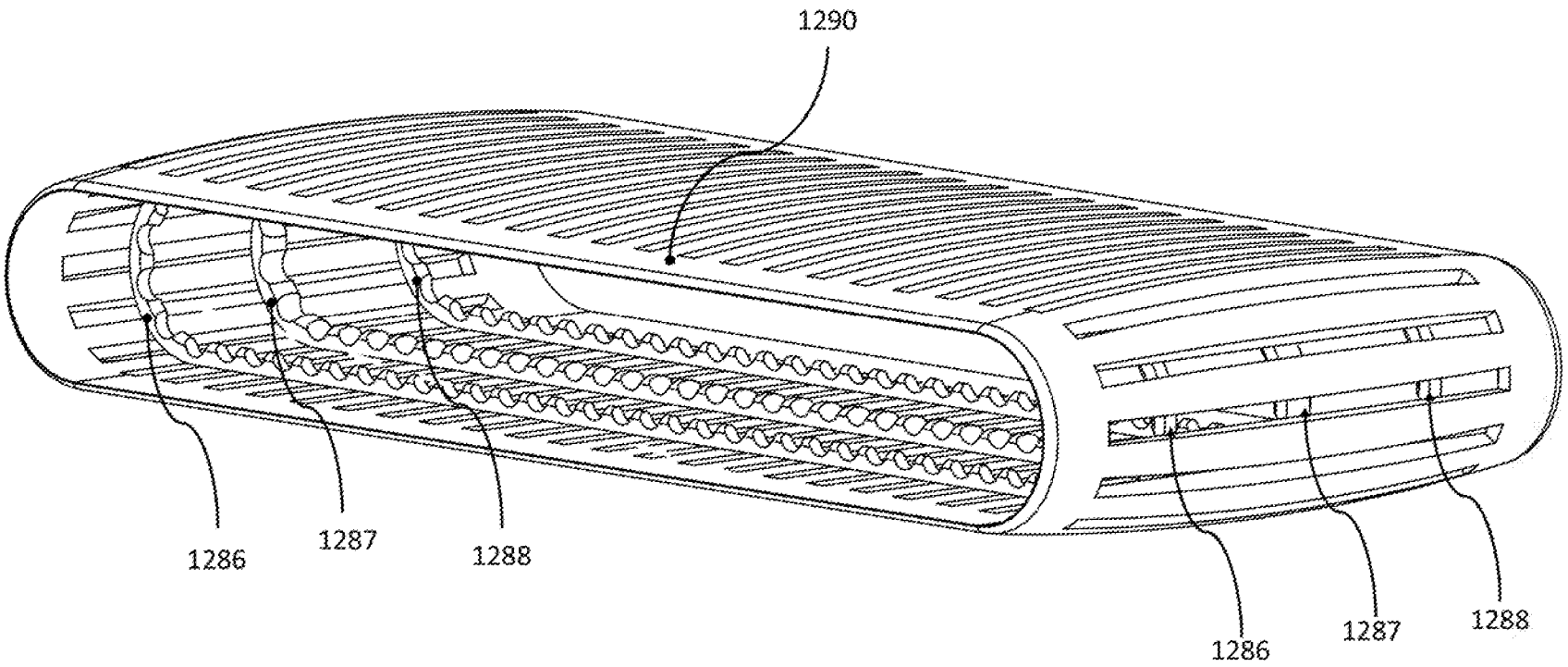
FIG. 12L is an off-axis view of the wide tread sing three risers incorporated as internal structures to the tread.

FIG. 12L is an off-axis view of the wide tread 1290. This view shows three risers incorporated as internal structures to the wide tread 1290. These risers are left tread riser 1286 center tread riser 1287, and right tread riser 1288. They engaged their respective positive sprocket drive gears: the left positive sprocket drive gear 1280, the center wide positive sprocket drive gear 1270, and the right positive sprocket drive gear 1284.

Figure 12M:
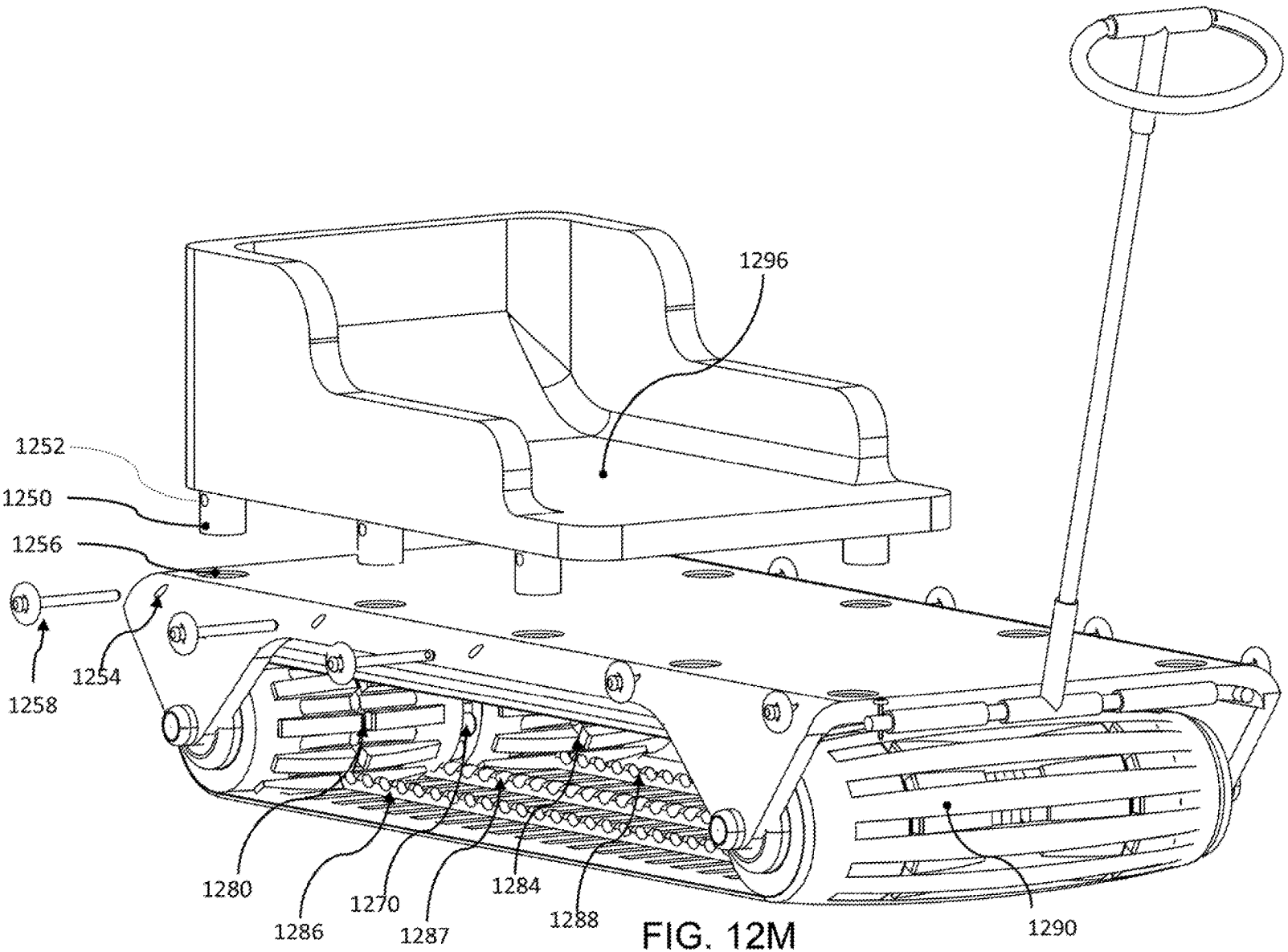
FIG. 12M is an off-axis low-level view, of a peg-leg seat that replaced the peg-leg cooler in FIG. D.

FIG. 12M is an off-axis low-level view of a peg-leg seat 1296 that replaced the peg-leg cooler 1294 in FIG. 12D. This view shows the respective positive sprocket drive gears: the left positive sprocket drive gear 1280, the center wide positive sprocket drive gear 1270, and the right positive sprocket drive gear 1284 incorporated into the wide tread hub assembly 1297 that is engaging the respective tread risers: the left tread riser 1286, center tread riser 1287, and right tread riser 1288. The peg-leg seat 1296 is an example of the versatility of the treaded peg-leg cooler assembly 1295. Other structures can be created as add-on features to this style of peg leg cooler 1294.

Figure 13A:
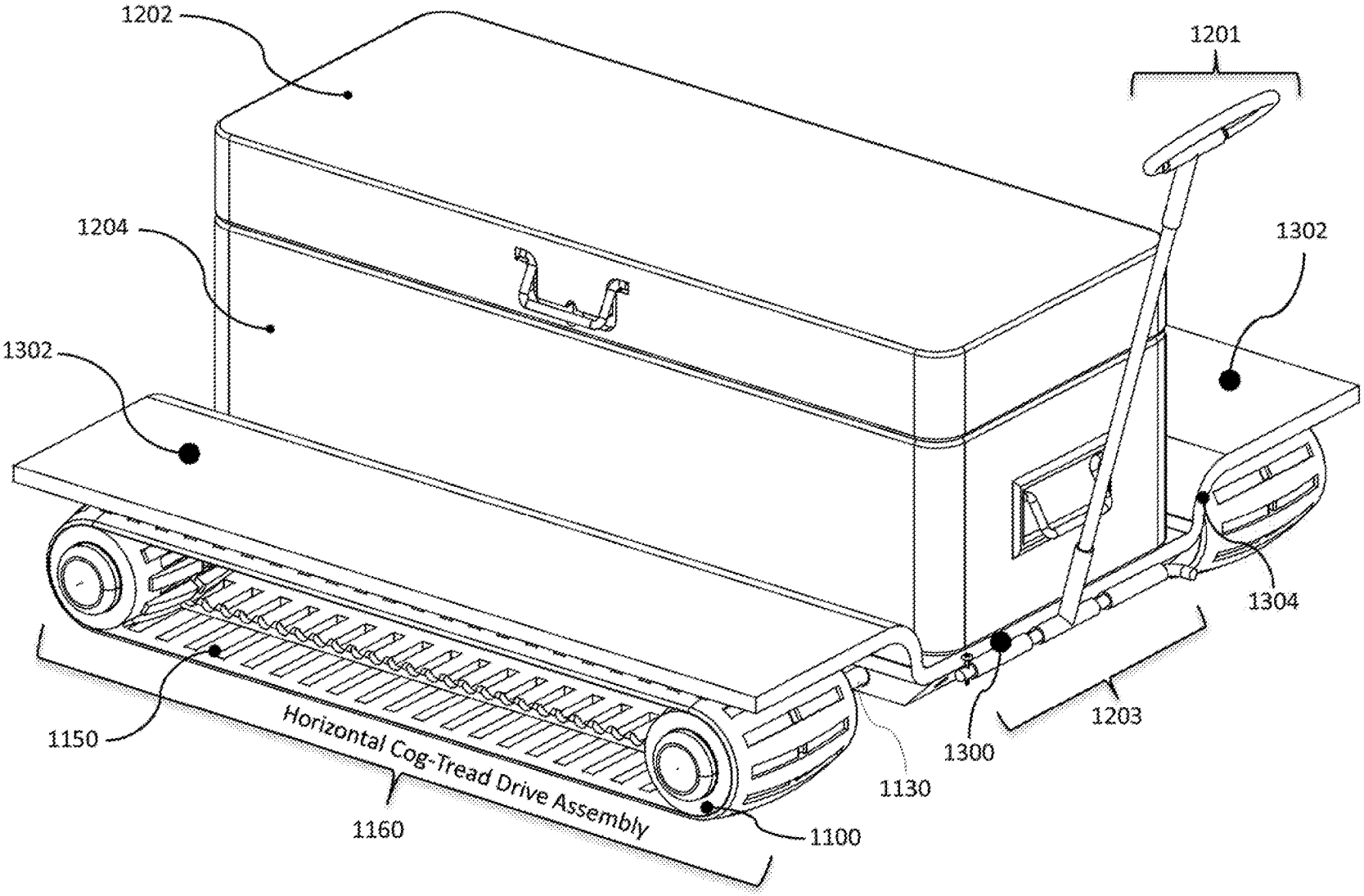
FIG. 13A is an isometric view of the outrigger treaded transport base with the horizontal cog-tread drive assembly.

FIG. 13A is an isometric view of the outrigger treaded transport base 1300, cooler body 1204, cooler top 1202, the pulling handle assembly 1201, the axel-rod hinge-pin assembly 1203, and the horizontal cog-tread drive assembly 1160. The cooler body 1204 can be, for example, glued, welded, bolted or Velcro to the surface of the outrigger treaded transport 1300. The horizontal cog-tread drive assembly 1160 uses the horizontal cog-tread 1150 and the horizontal cog-hub assemblies 1100 that are mounted onto the axel 1130.

Figure 13B:
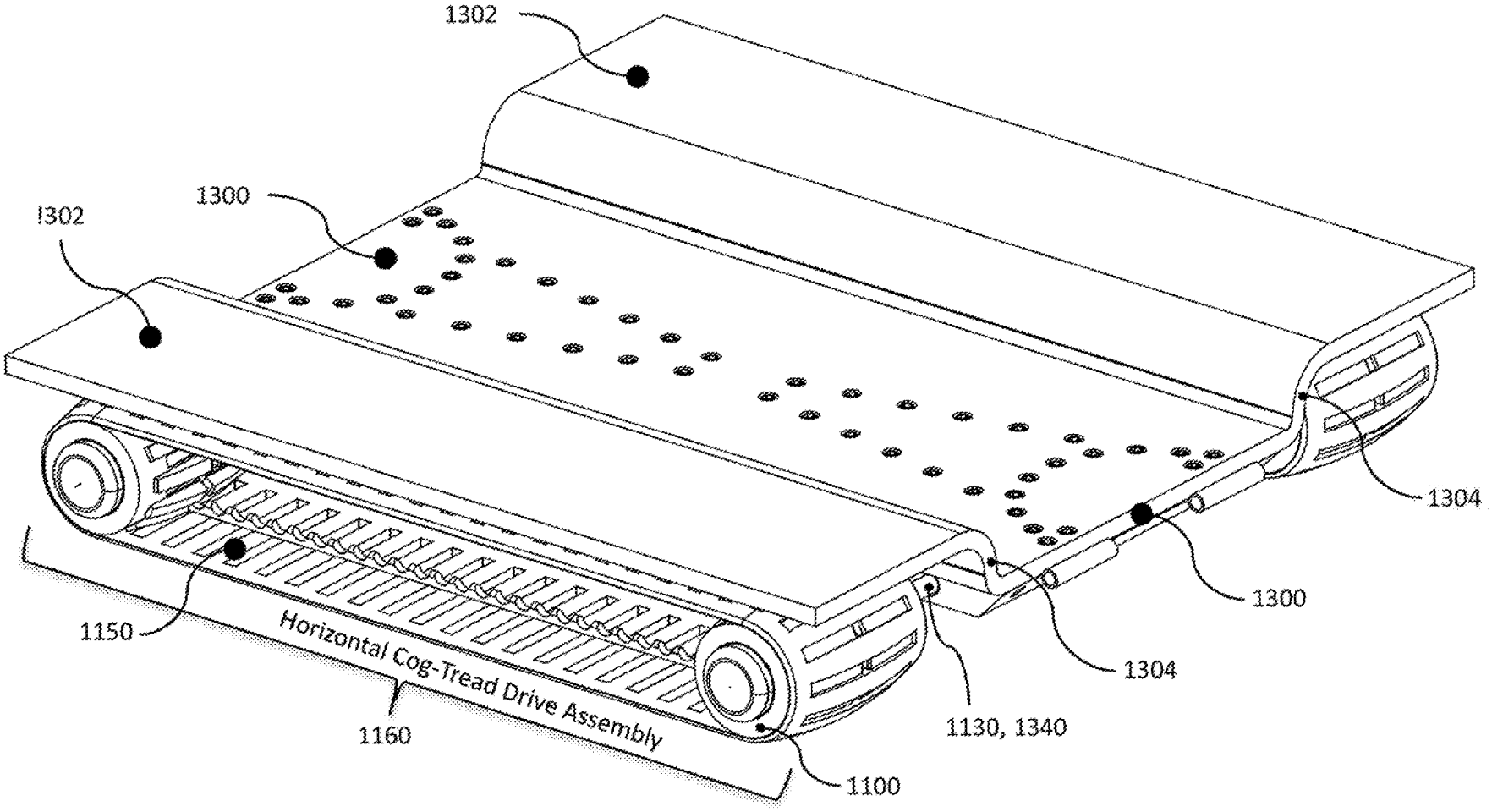
FIG. 13B is an isometric view of the outrigger treaded transport base without the cooler body.

FIG. 13B is an isometric view of the outrigger treaded transport base 1300 and the horizontal cog-tread drive assembly 1160 without the cooler body 1204 and the cooler top 1202. The monolithic outrigger treaded transport base 1300 is comprised of two fenders 1302 and fonder risers 1304 that support the fenders 1302. The tenders 1302 act as shields to prevent entanglement with clothing or flying debris from the horizontal cog-tread drive assembly 1160. The horizontal cog-tread drive assembly 1160 and components used have been described in FIG. 11E.

Figure 13C:
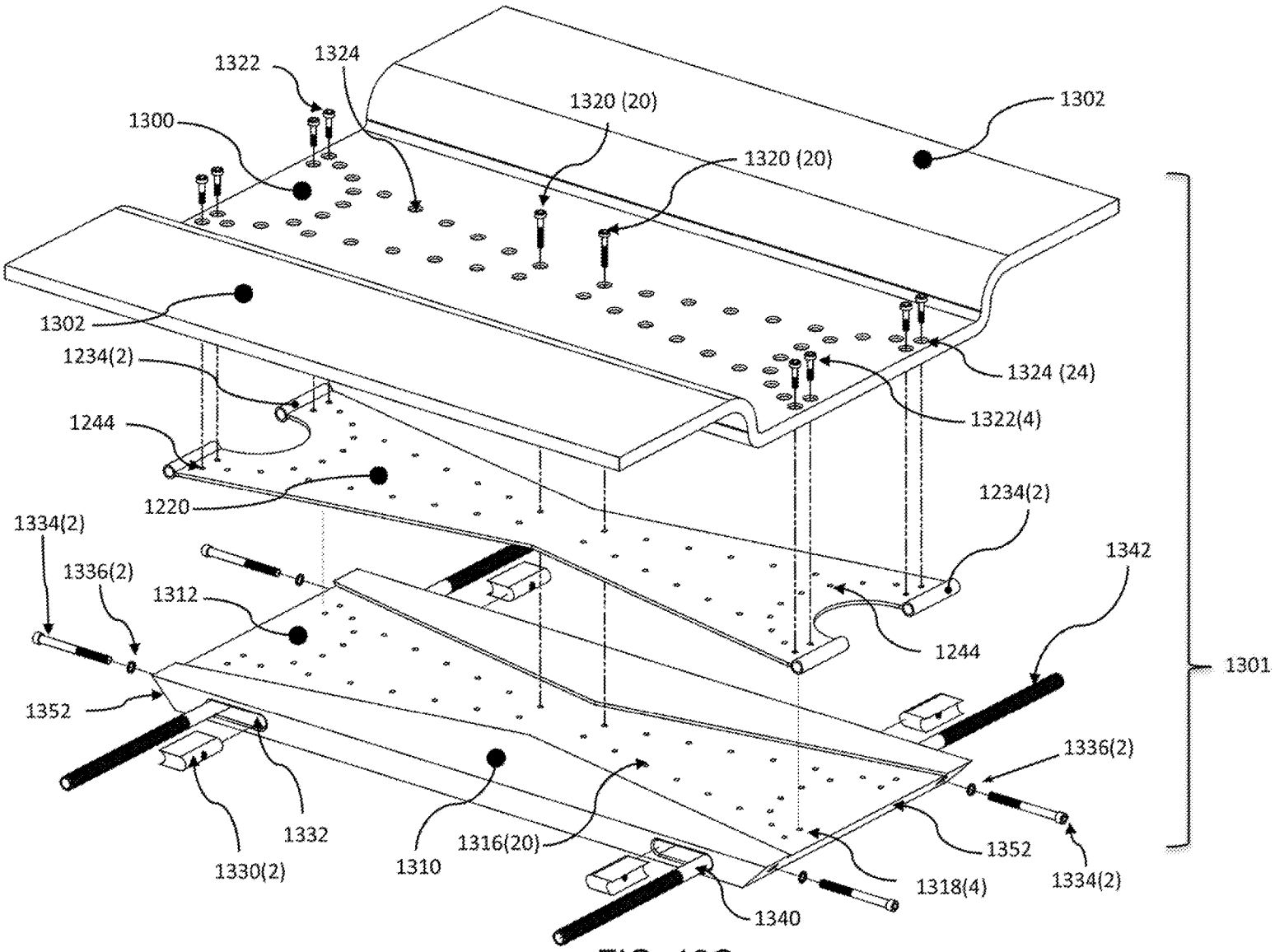
FIG. 13C is an expanded isometric view of the parts that comprise the treaded transporter assembly.

FIG. 13C is an expanded isometric view of the parts that comprise the treaded transporter assembly 1301, which are the monolithic outrigger treaded transport base 1300, the cooler base reinforcement plate 1220, and a tread transporter-mounting base 1310. The tread transporter-mounting base 1310 has a geometry recess that is called the base plate recess 1312 on the top surface that matches the geometry of the cooler base reinforcement plate 1220. The cooler base reinforcement plate 1220 fits tightly into the base plate recess 1312, and serves as a strong support structure that is sandwiched between other components such as outrigger treaded transport base 1300 and the tread transporter-mounting base 1310. When combined, the treaded transporter assembly 130 can sustain the pulling forces of the weight of the cargo that will be carried/transported. Metal is the preferred material for the cooler base reinforcement plate 1220, although other materials can be used such as Kevlar, plate, carbon fiber plates or other robust materials. Metal is preferred because at the end edges of the cooler base reinforcement plate 1220 there are two tube-like structures called hollow hinge knuckles 1234 that are easily formed and can withstand higher pulling forces and not break.

The treaded transporter assembly 1301 is assembled in the following manner: the tread transporter-mounting base 1310 will have lowered into its base plate recess 1312, the cooler base reinforcement plate 1220. The outrigger transport base 1300 will be lowered onto the cooler base reinforcement plate 1220 and flush with the tread transporter-mounting base 1310. The four short bolts 1322, on either end of the outrigger treaded transport base 1300, will then be screwed into the tread transporter-mounting base 1310 after passing through the countersunk through-holes 1324, through the through-holes 1244 of the cooler base reinforcement plate 1220, and into the threaded through-holes 1318. These short bolts 1322 need to be shorter to fit within the beveled leading edge 1352 of the front and rear of the tread transporter-mounting base 1310. The remaining longer bolts 1320 of the outrigger treaded transport base 1300 are screwed into the tread transporter mounting base 1310 after passing through the countersunk through-holes 1324, through the through-holes 1244 of the cooler base reinforcement plate 1220, and into the deeper threaded through-holes 1316. Next, the transporter axles 1340 are slid through the elongated through-holes 1332 of the tread transporter-mounting base 1310 that have been elongated to allow tensioning block 1330 to also fit into the elongated through-holes 1332. The horizontal cog-tread drive assemblies 1160 (not shown, see FIG. 13B) will be tightened by the action of a tensioning block 1330 once it is positioned in the elongated through-hole 1332 to mate up with the tensioning bolt 1334.

Figure 13D:
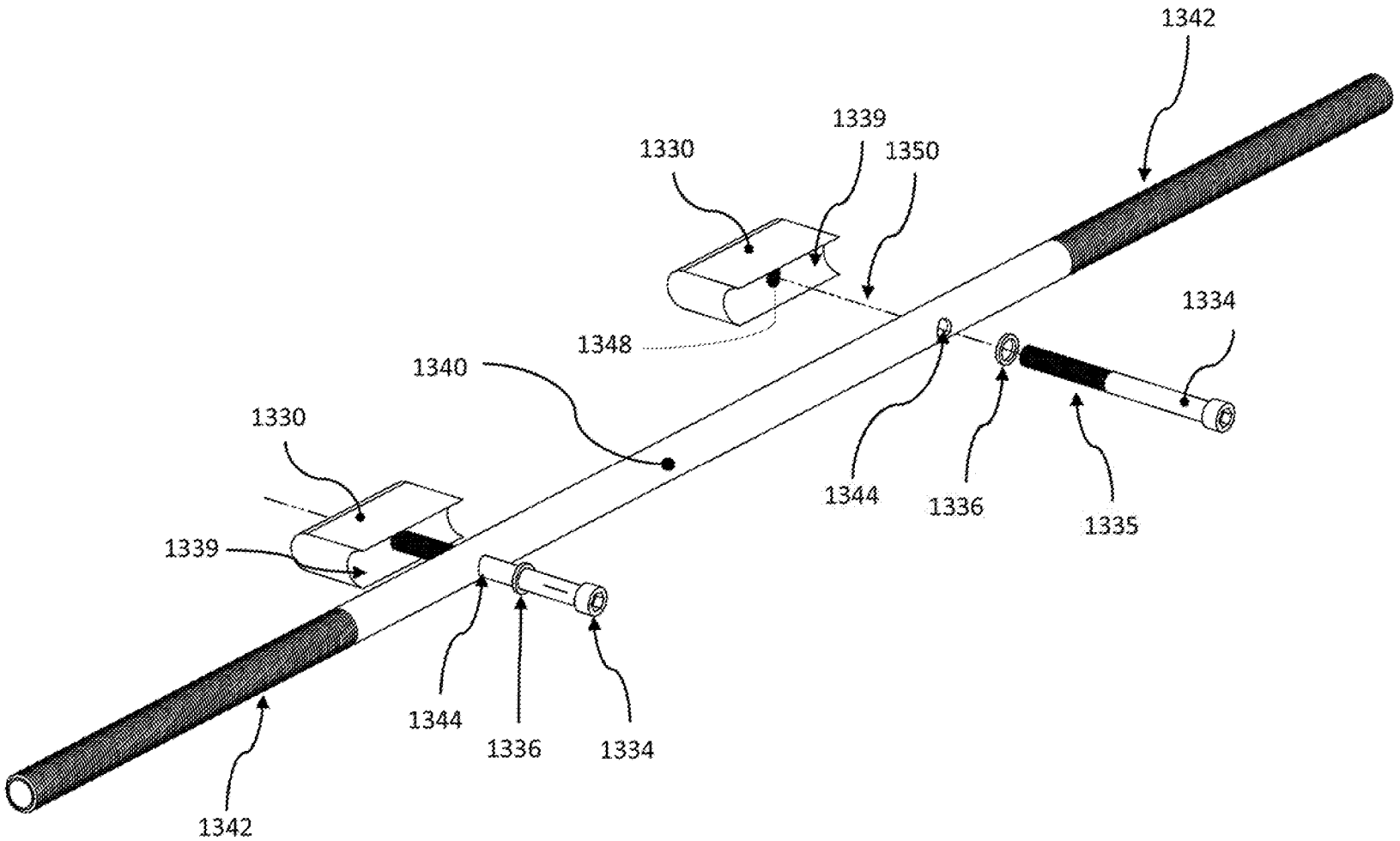
FIG. 13D is an isometric view of the tread transporter axle.

FIG. 13D is an isometric view of the transporter axle 1340, the tensioning blocks 1330, the tensioning bolts 1334, stop washers 1336, and a tensioning bolt through-hole 1344. The tensioning bolt through-hole 1344 is perpendicular to the axel 1340. This is a view of the components within the tread transporter-mounting base 1310, and, with the tread transponder-mounting base 1310 made invisible. The tensioning bolt 1334 with the stop washer 1336 passes through the tensioning bolt through-hole 1344. The tensioning bolt 1334 is introduced to the tensioning block 1330 by threading into the threaded through-hole 1348. The tensioning bolts 1334, stop washers 1336, tensioning bolt through-hole 1344, and the threaded through-hole 1348 of the tensioning block 1330 all lie on the common alignment axis 1350. The threaded axle ends 1342 are long to accommodate the horizontal cop-tread drive assemblies 1160 (not shown). The transporter axle 1340 may be hollow to accommodate electrical wires or a solid rod depending upon that load requirements and size of the coolers or accessories carried on the treaded transporter.

Figure 13E:
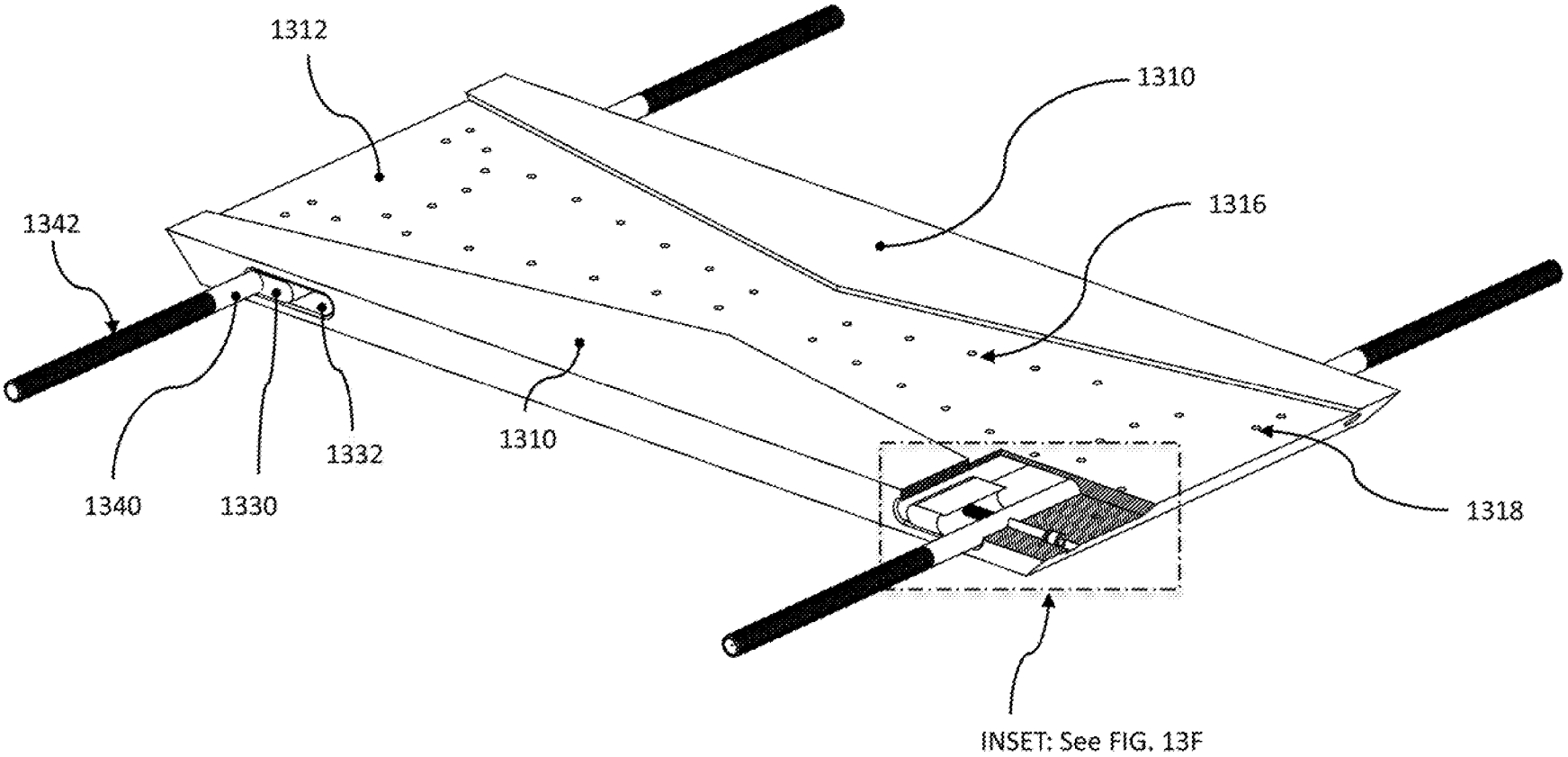
FIG. 13E is an isometric view of the tread transporter-mounting base
Figure 13F:
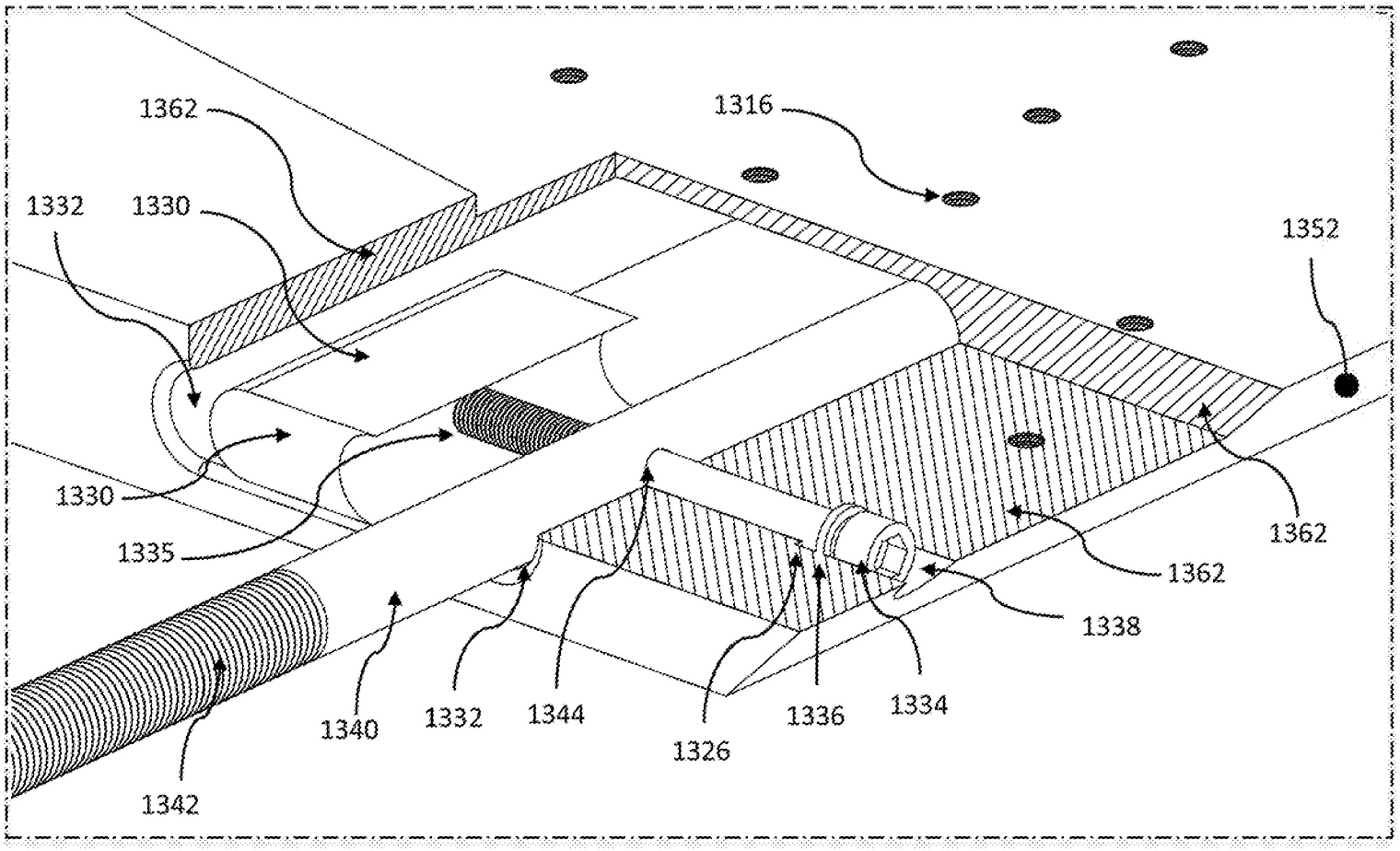
FIG. 13F is an enlarged view of the inset region of FIG. 13E.

FIG. 13E is an isometric view of the tread transporter-mounting base 1310 and the associated parts that involve the management of the tread transporter axle 1340, and an inset view to the described in FIG. 13F. In this view the transporter axle 1340 is mounted in the elongated through-holes 1332 of the tread transporter-mounting base 1310 with the tension block 1330.

FIG. 13F is an enlarged view of the inset region of FIG. 13E. It is an isometric view of the tensioning block 1330, which will be pulled tight by the tensioning bolt 1334. That threaded end 1335 of the tensioning bolt 1334 and the stop washer 1336 are inserted into the countersunk through-hole 1338 on the beveled leading edge 1352 of the tread transporter-mounting base 1310. The threaded end 1335 of the tensioning bolt 1334, threads into the threaded through-hole 1348 of the tensioning block 1330. The tensioning bolt 1334 uses the stop washer 1336 to apply uniform force around the countersunk stop hole 1326. Once the stop washer 1336 and tensioning bolt 1334 meet at countersunk stop hole 1326, the tensioning bolt 1334 continuously tightens until it pulls the tensioning block 1330 and engages the concave axel mating face 1339 with the outside face of the transporter axle 1340. Tightening continues and tension will build in the horizontal cog-tread drive assembly 1160 (not shown, see FIG. 13B) until the horizontal cog-thread 1150 is taut. The tensioning bolt 1334 should never reach the point where it pulls the transporter axle 1340 firmly up against the end-wall of the elongated through-hole 1332. The properly designed system will have some space between the transporter axle 1340 and the end-wall of the elongated through-hole 1332.

The cross-section shows the material removed from the cooler base as the crosshatched regions of 1362. The beveled leading edge 1352 of the tread transporter-mounting base 1310 acts as a plow. Since the tread transporter-mounting base 1310 will be used in environments where there is sand, mud, snow, and other kinds of debris, the function of the beveled leading edge 1352 is to push the material down and lift the cooler up. If the sand or snow is too deep, this helps reduce the pulling force required to move forward.

Figure 13G:
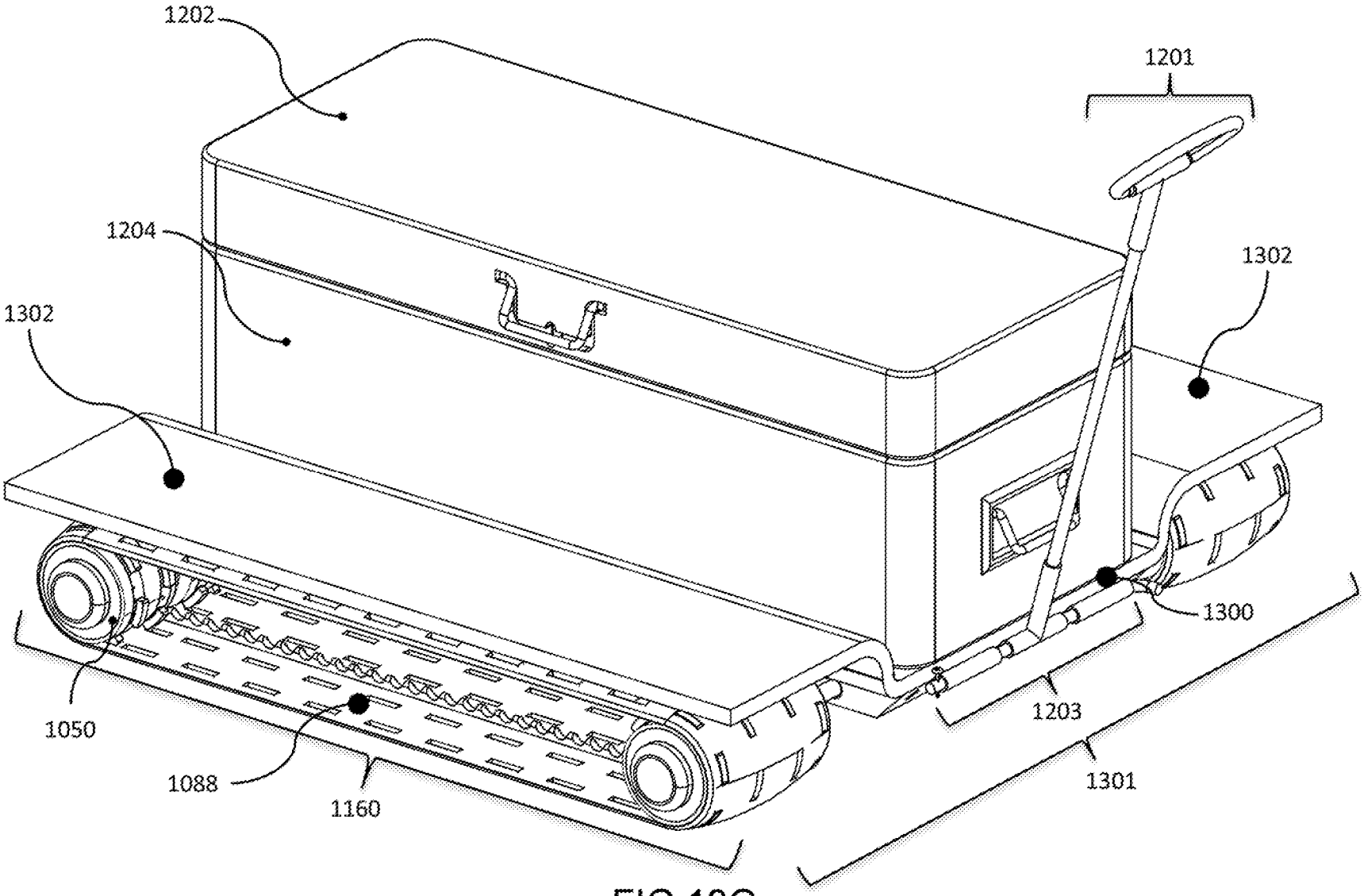
FIG. 13G an isometric view of the outrigger transport assembly with the vertical cog tread hub and the vertical cog-read.

FIG. 13G an isometric view of the treaded transport assembly 1301 with the vertical cog-tooth tread-drive hub assembly 1093, the bearing hub adapter 1050, and the vertical cog-tread skin 1088. All of the treaded systems described in FIG. 12H and FIG. 13B can be used for the treaded skateboard 1301.

Figure 13H:
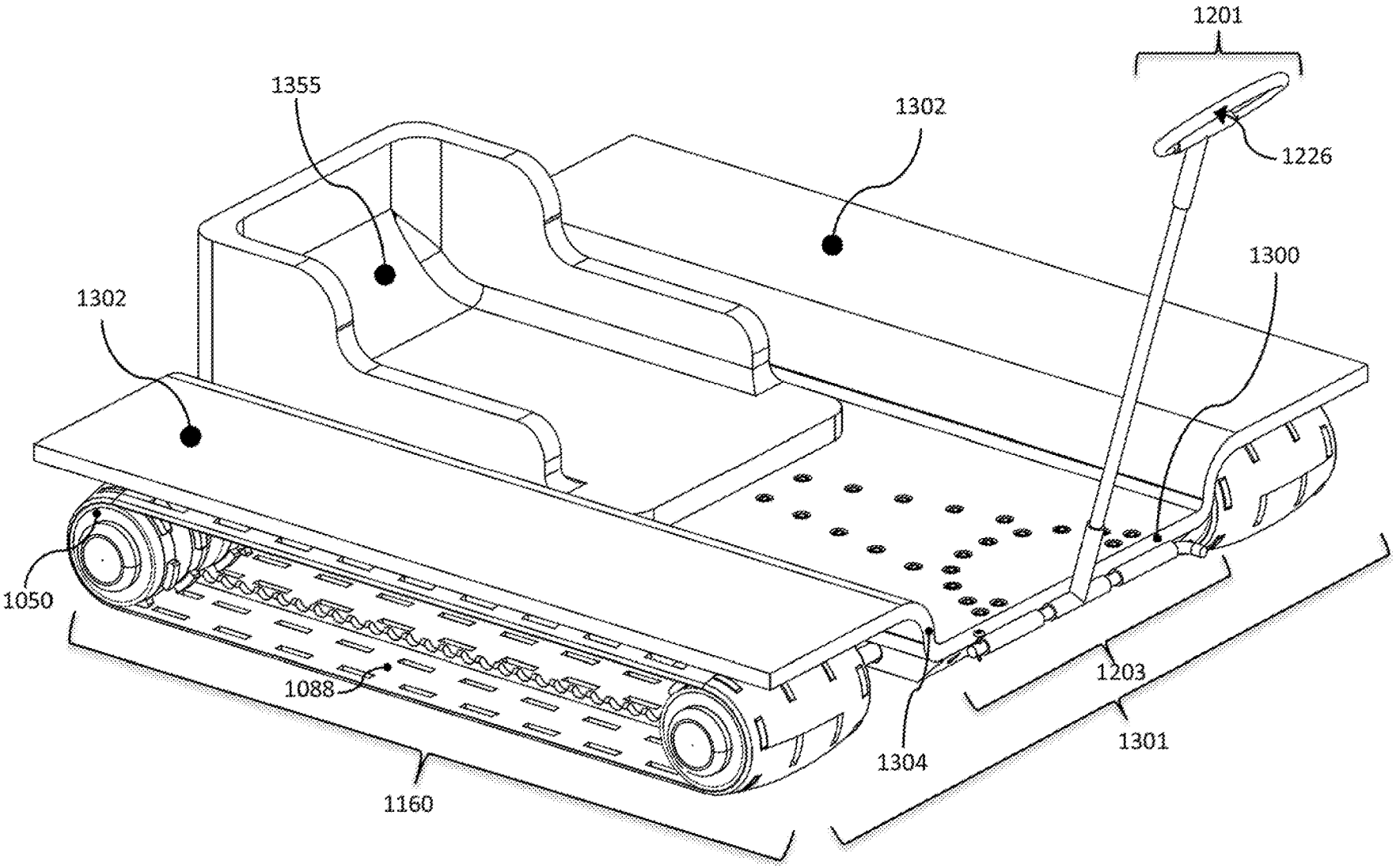
FIG. 13H is an isometric view of the outrigger treaded skateboard that has been adapted to use a seat.

FIG. 13H is an isometric view of the treaded skateboard 1301, which has been adapted to use a seat 1355 attached to the cooler platform by screws, glue, epoxy, Velcro® or quick disconnect pins.

Figure 13I:
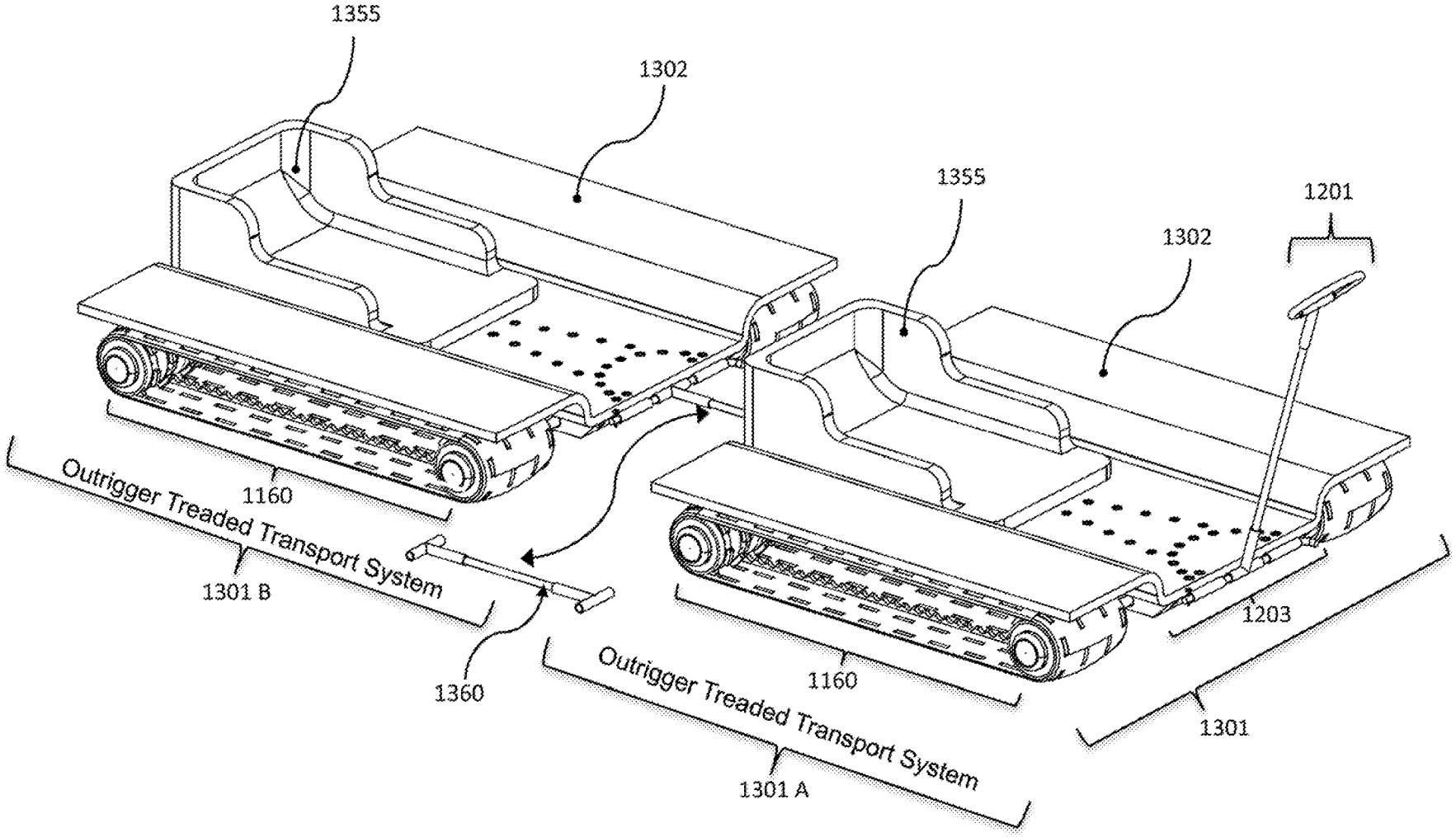
FIG. 13I is an isometric view of a caravan of coolers or seats.

FIG. 13I is an isometric view of outrigger treaded skateboard 1301A and outrigger treaded skateboard 1301B, which is a caravan of coolers, seats, or a combination of seats and coolers for transport. The double T-handle 1360 facilitates the tandem connection to the rear axel-rod hinge-pin assembly 1203 of outrigger treaded skateboard 1301 A and the front axel-rod hinge-pin assembly 1203 of the rear outrigger treaded skateboard 1301 B. The caravan is pulled forward with the pulling handle assembly 1201 of outrigger treaded skateboard 1301 A.

Figure 14A:
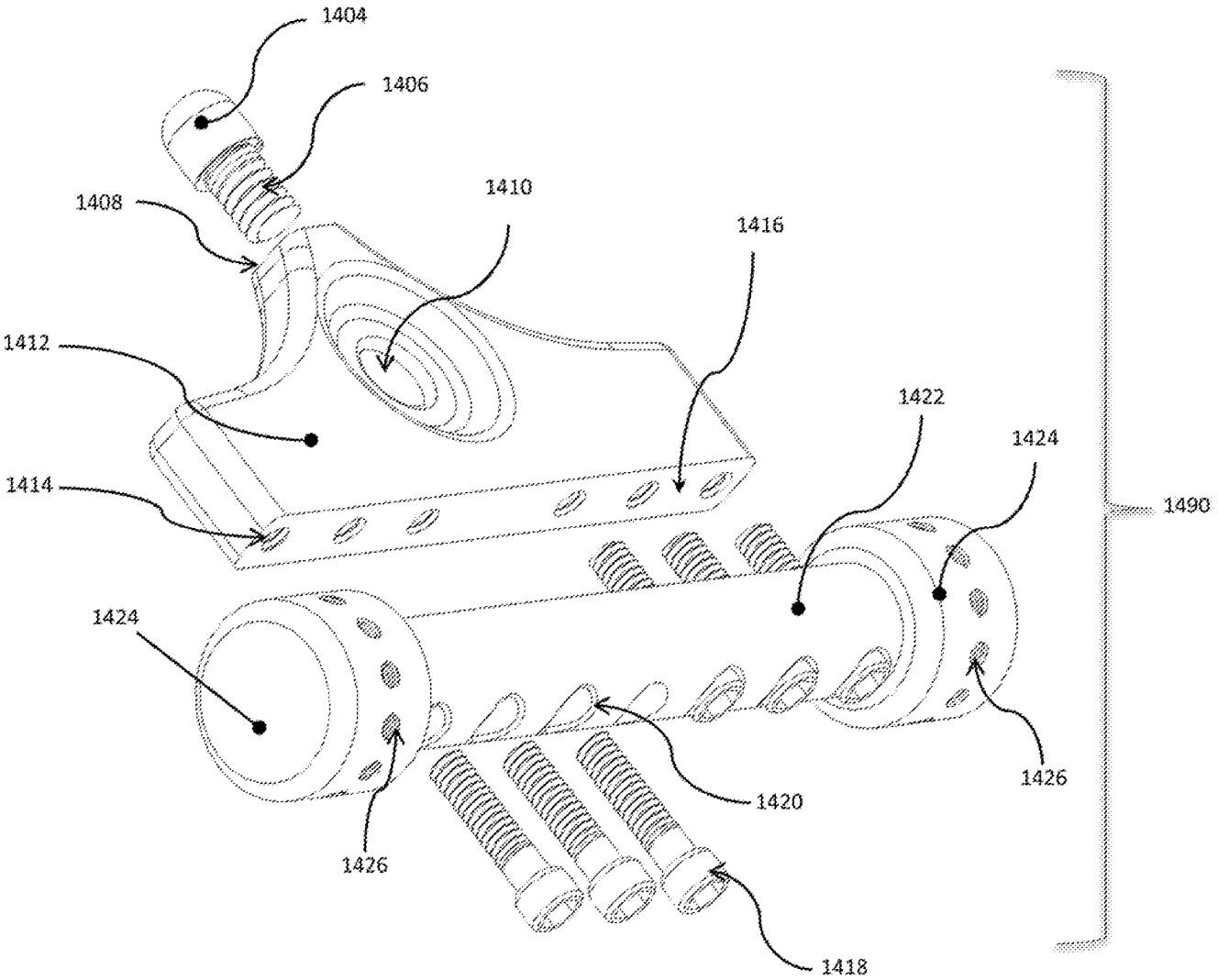
FIG. 14A shows the front-end off-axis view of the components that comprise the monolithic hanger hub assembly.

FIG. 14A shows the frontend off-axis view of the components that comprise the monolithic hanger hub assembly 1490. This figure shows adjustable pivot pin 1404, which has an adjustment thread 1406. This adjustment thread 1406 provides for tension adjustments of the hanger body 1412. The adjustment thread 1406 provides the exact placement of the kingpin 1430 (not shown) within the kingpin through-hole 1410. This will move the center of the kingpin through-hole 1410 about the kingpin 1430, and properly position hanger body 1412 so that symmetrical forces are applied to the hanger hub assembly 1490. The hanger body 1412 has attached to its bottom mating face 1416 a monolithic hub axel 1422. The monolithic hub axel 1422 has large diameter monolithic hub axel ends 1424. These monolithic hub axel ends 1424 have threaded holes 1426. The monolithic hub axel 1422 is attached to the hanger body 1412 with bolts 1418 that pass through the countersunk through-hole 1420 and fasten into the threaded-holes 1414 on the bottom mating face 1416 of the hanger body 1412.

Figure 14B:
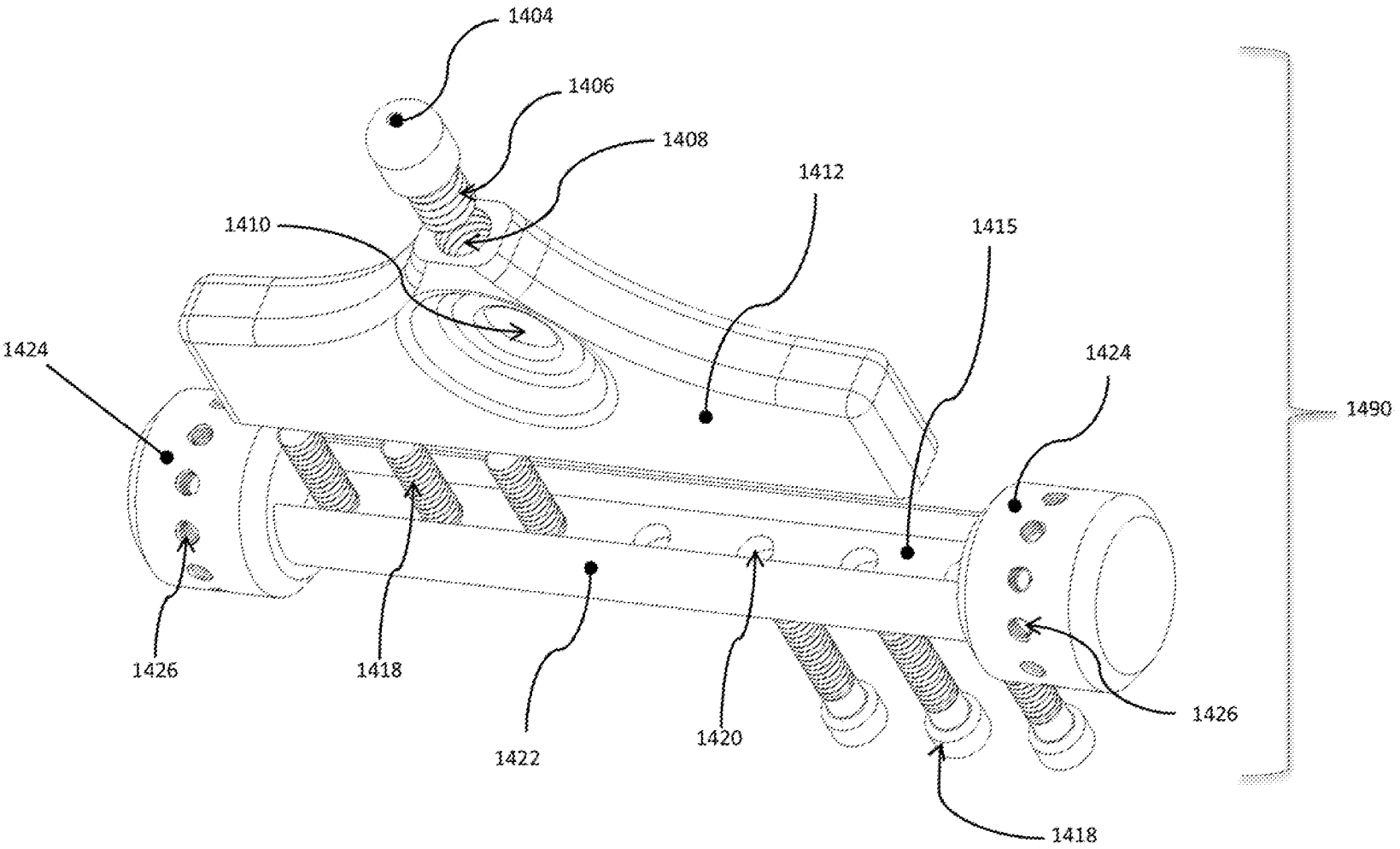
FIG. 14B is the rear off-axis view of the hanger hub assembly.
Figure 14C:
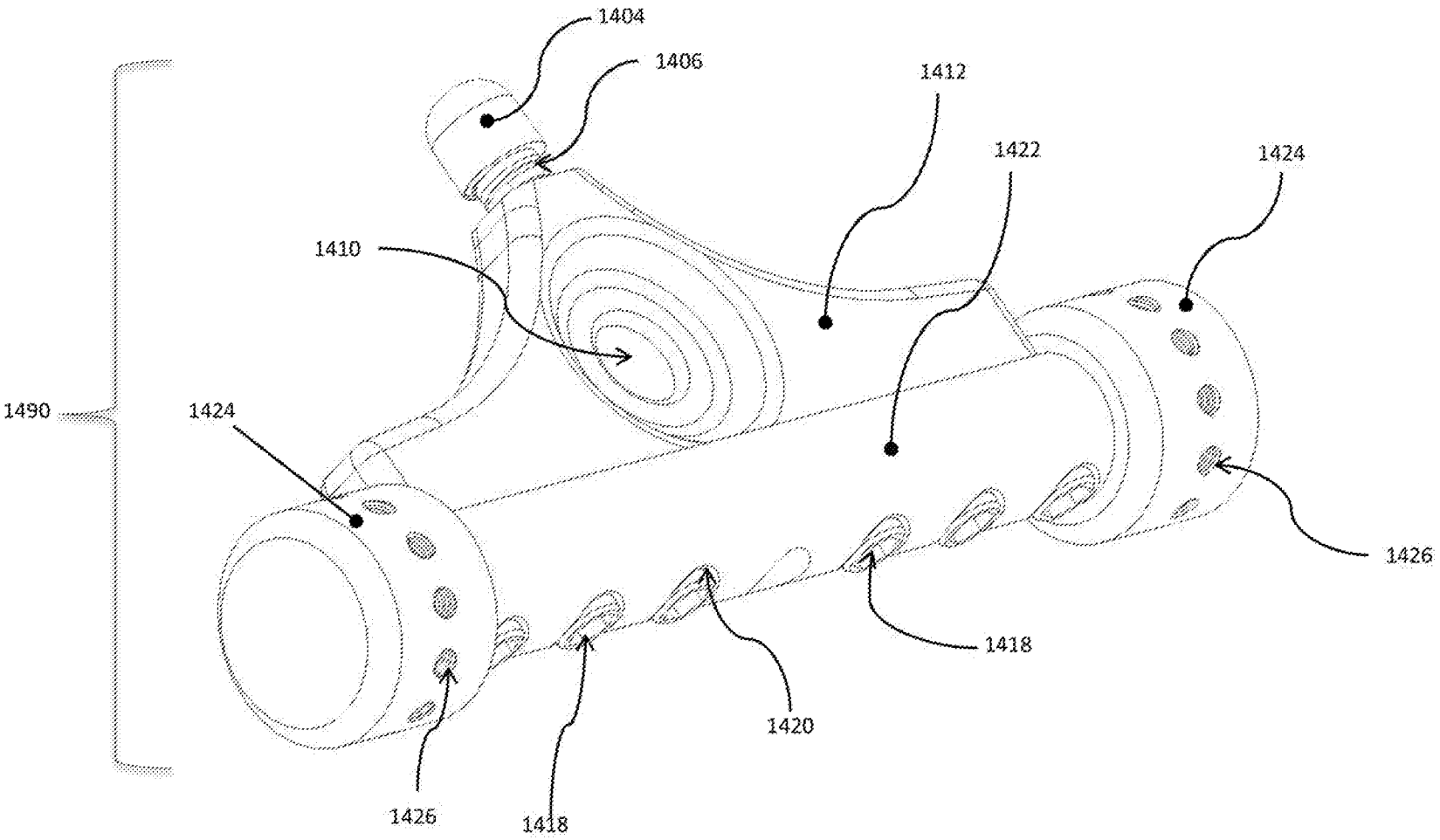
FIG. 14C is an off-axis front view of an assembled hanger hub assembly.

FIG. 14B is the rear off-axis view of the hanger hub assembly 1490. The threaded-hole 1408 receives the adjustment thread 1406 of the adjustable pivot pin 1404. This view shows the recessed mating face 1415 of the monolithic hub axel 1422. The countersunk through-holes 1420 allow bolts 1418 to pass through and secure the hanger body 1412 to the monolithic hub axel 1422. The mating surface 1416 of the hanger body 1412, as seen in FIG. 14A, and the recessed mating face 1415 of the monolithic hub axel 1422, as illustrated, are held together with the six bolts 1418. The recessed mating face 1415 provides a stronger support for the monolithic hub axel 1422.

FIG. 14B is the rear off-axis front view of an assembled hanger hub assembly 1490 with the adjustable pivot pin 1404, the hanger body 1412, and the monolithic hub axel 1422.

Figure 14D:
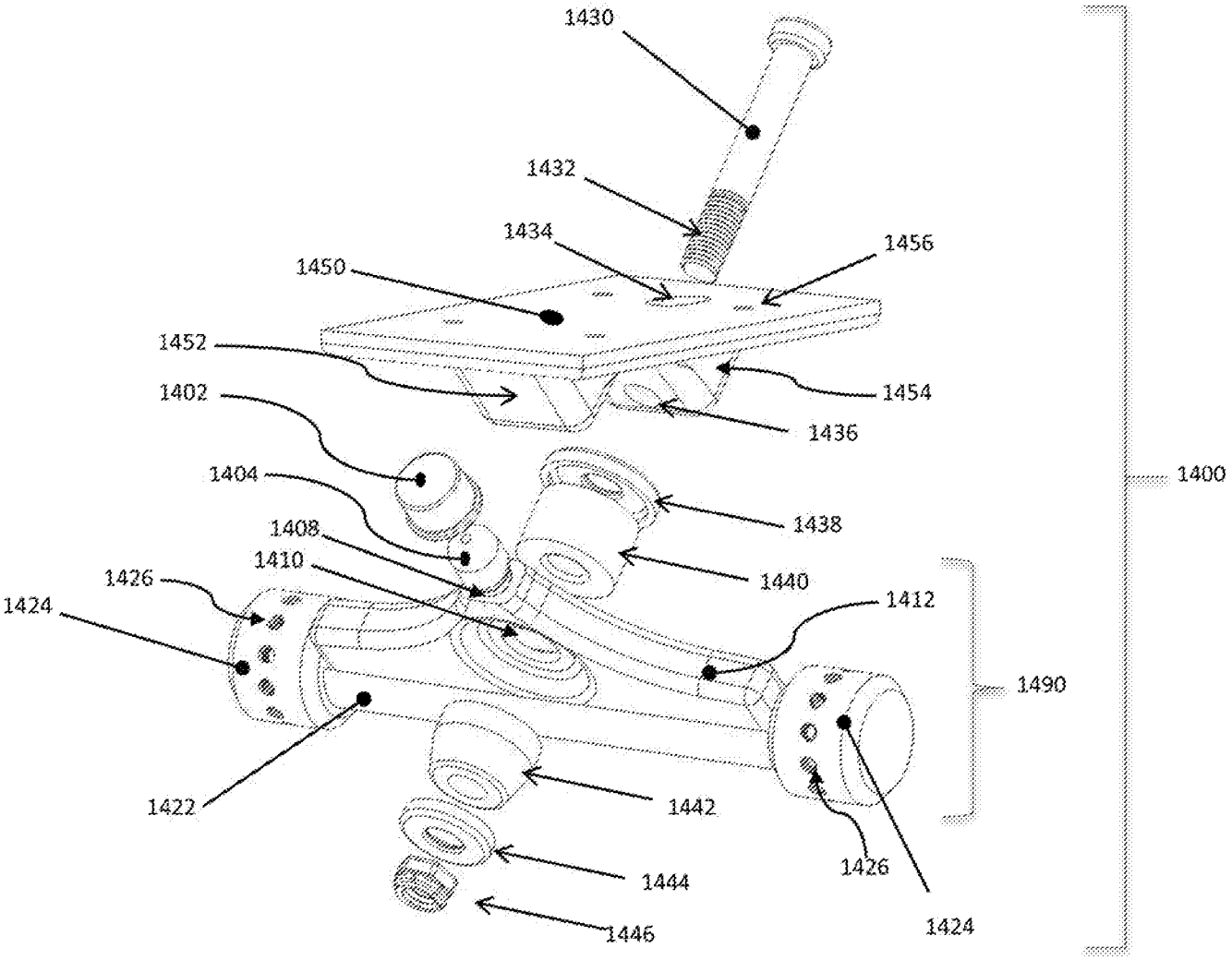
FIG. 14D is a forward off-axis and exploded isometric view of the remaining parts the will form the complete monolithic axel-hub fork-truck assembly.

FIG. 14D is a forward off-axis and exploded isometric view of the remaining parts the will form the complete monolithic axel-hub fork-truck assembly 1400. The base plate 1450 is the main attachment part. The resilient pivot pin cup 1402 is first placed into the pivot pin cup-retaining recess 1458, will be shown in FIG. 14E, located in the pivot pin bulkhead 1452. The adjustable pivot pin 1404 is threaded into the threaded-hole 1408. The kingpin 1430 is secured in the base plate 1450 by the countersunk kingpin through-hole 1434. The countersunk kingpin through-hole 1434 is located in the kingpin bulkhead 1454 of the base plate 1450. The kingpin 1430 exits the kingpin bulkhead 1454 through the kingpin bulkhead exit through-hole 1436. The kingpin 1430 then passes through top bushing washer 1438, top bushing 1440, kingpin through-hole 1410 of the hanger body 1412, bottom-bushing 1442, bottom-bushing washer 1444, and is tightened with the kingpin-locking nut 1446.

Figure 14E:
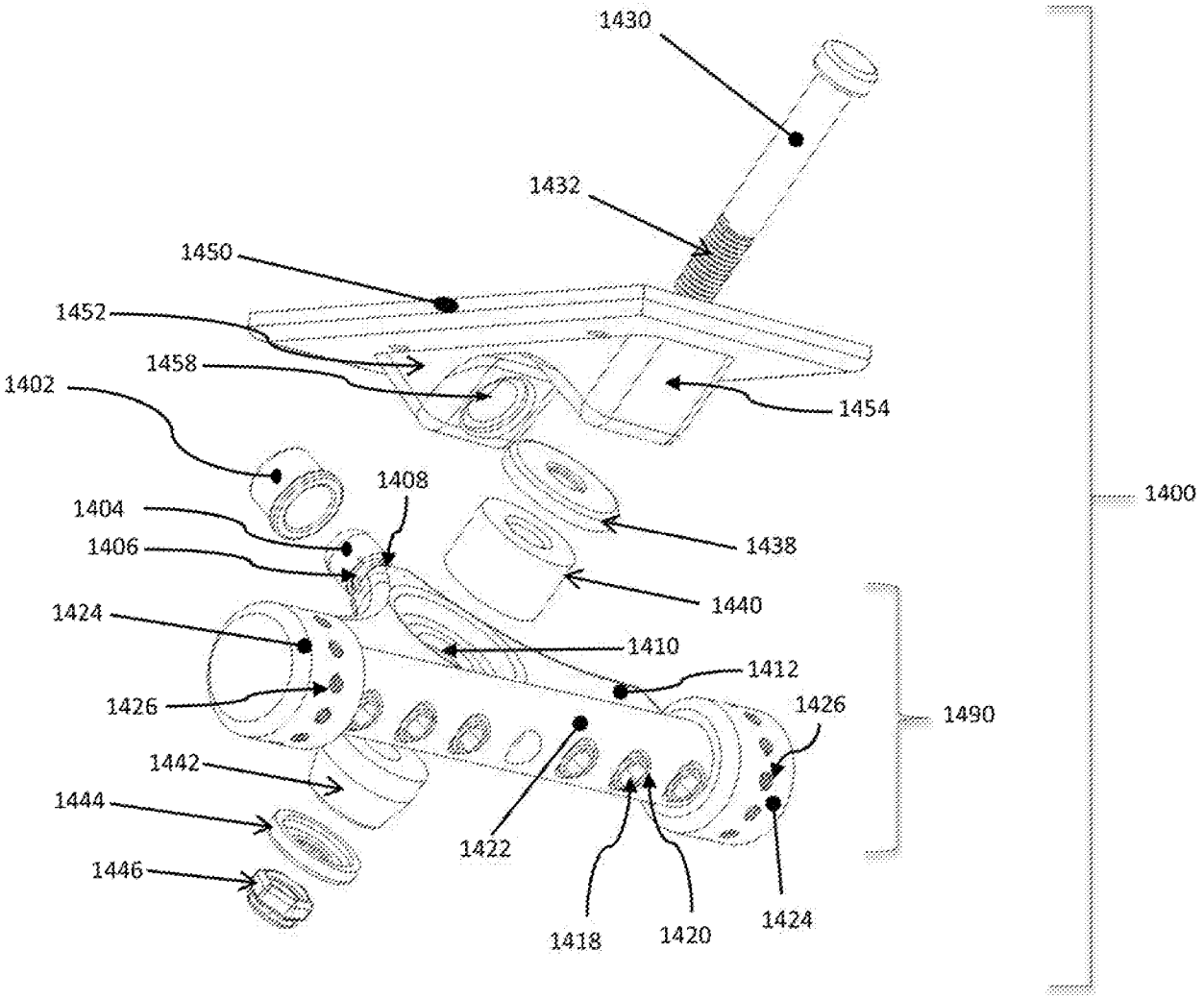
FIG. 14E is the off-axis rear view of the exploded components making up the monolithic axel-hub fork-truck assembly.
Figure 14F:
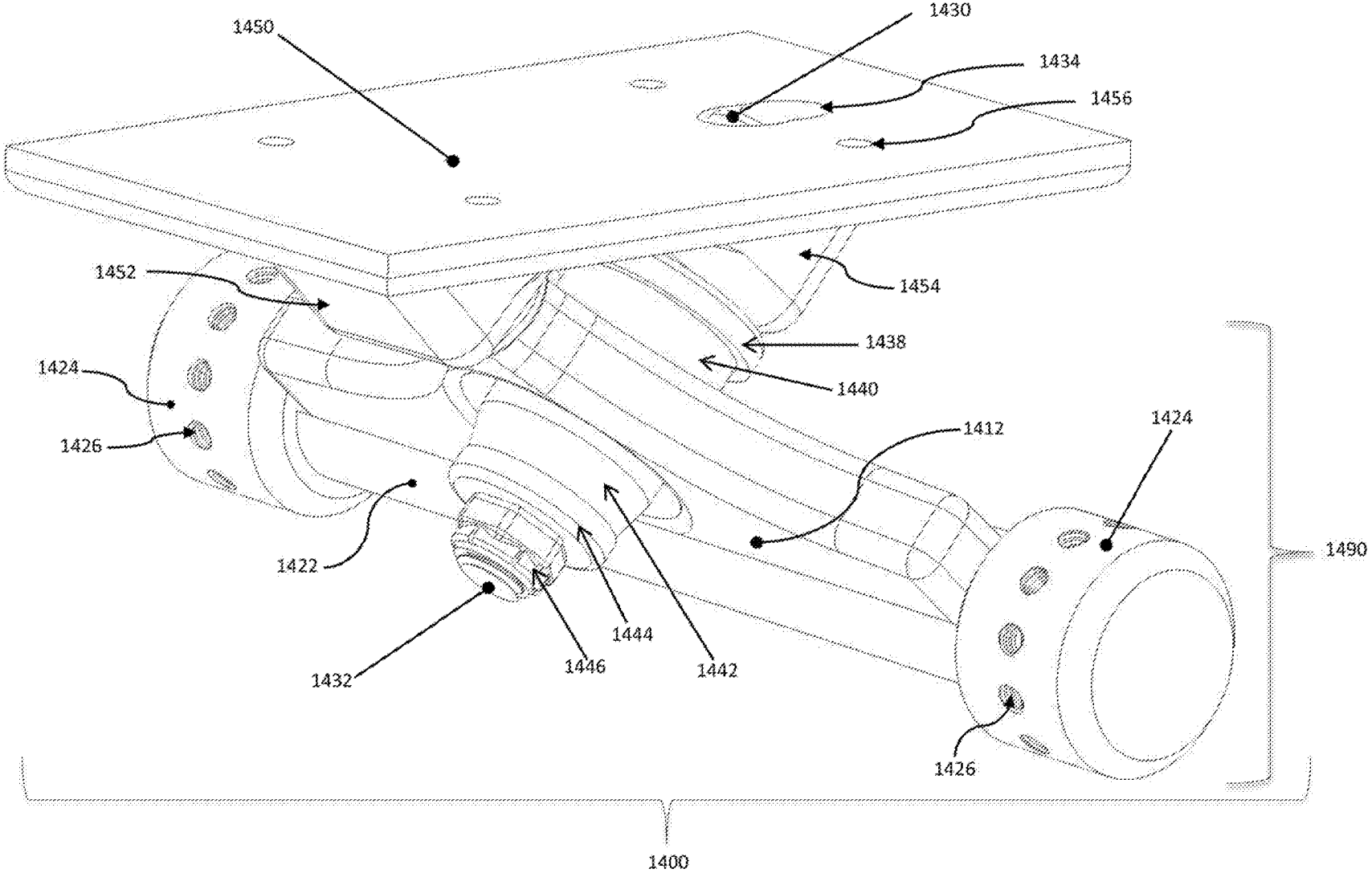
FIG. 14F is the elevated off-axis fully assembled view of the monolithic axel-hub fork-truck assembly.

FIG. 14E is the off-axis rear view of the exploded components making up the monolithic axel-hub fork-truck assembly 1400. The pivot pin retaining-cup recess 1458, which is created by a molding, machining, or forming process into the pivot pin bulkhead 1452 before the resilient pivot pin cup is inserted, FIG. 14F is the elevated off-axis fully assembled view of the monolithic axel-hub fork-truck assembly 1400.

Figure 15A:
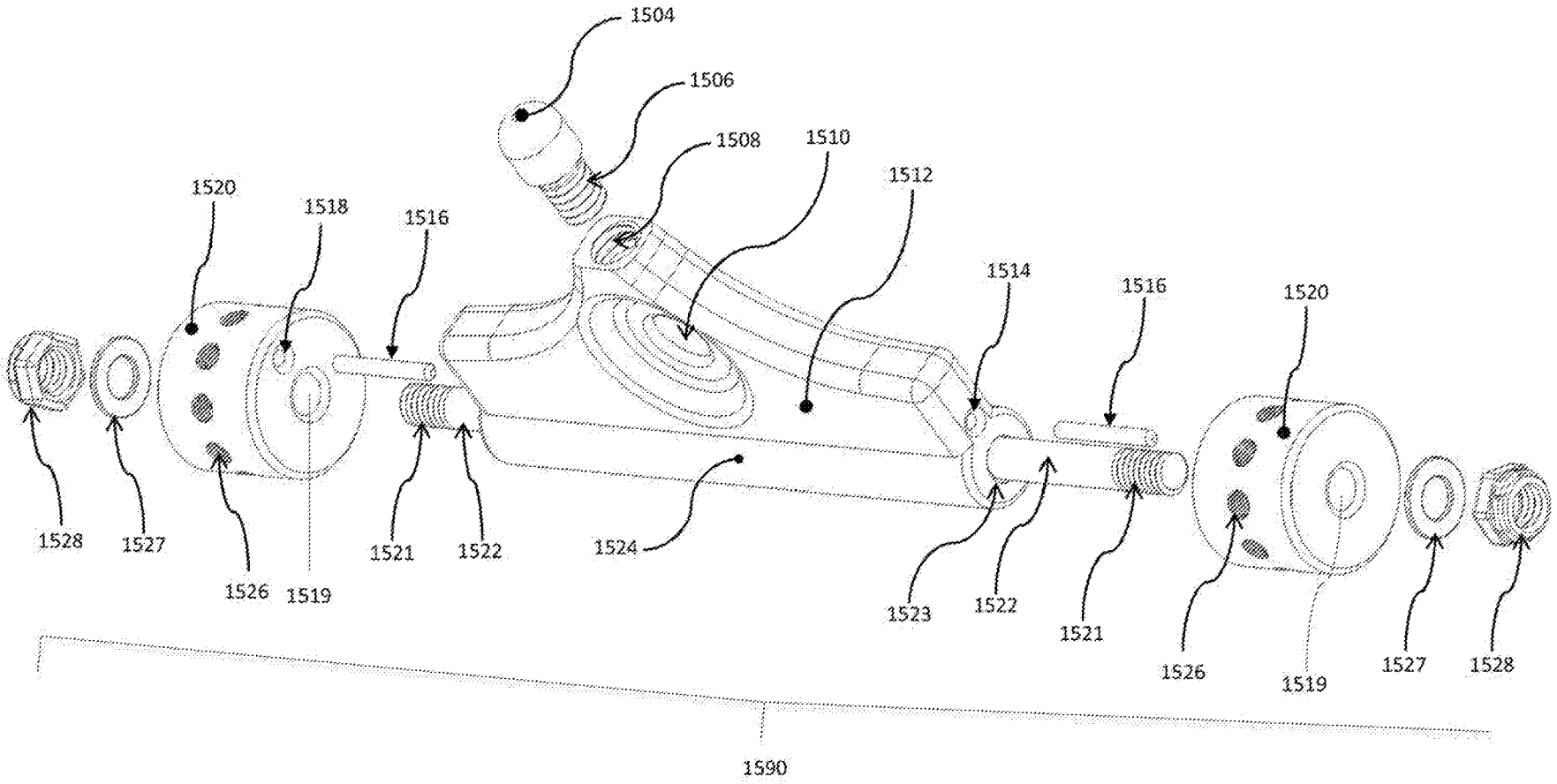
FIG. 15A is the front side view of the expanded components that comprise the hanger adapter-hub assembly.

FIG. 15A is the front side view of the expanded components that comprise the hanger adapter-hub assembly 1590. The hanger adapter-hub assembly 1590 is comprised of a hanger body 1512 with a kingpin through-hole 1510, a threaded recess 1508 for the adjustable pivot pin 1504 that is manipulated by the adjustment thread 1506, a threaded axel recess 1523 for securing the axel 1522 to the reinforced hanger body 1524, and a locking pin recess 1514 for the locking pin 1516, which prevents the hub adapters 1520 from rotating after it is slid onto the axel 1522 using the axel through-hole 1519 with the locking pin 1516 inserted into the locking pin recess 1518; the hub adapter 1520 is fastened securely in place with the washer 1527 and the locking nut 1528 is tightened onto the axel threads 1521. Without the hub adapter 1520 the hanger body 1512 and axel 1522 can be used to operate with regular skateboard wheels (not shown) that are secured onto the axel 1522 with the washer 1527 and the locking nut 1528. All conventional skateboard trucks can be modified with a hub adapter 1520 added to the wheel axel so that the forks can be added as long as there is an anti-rotation locking pin 1516 or anti-rotation device added to prevent the hub adapter 1520 from rotating.

Figure 15B:
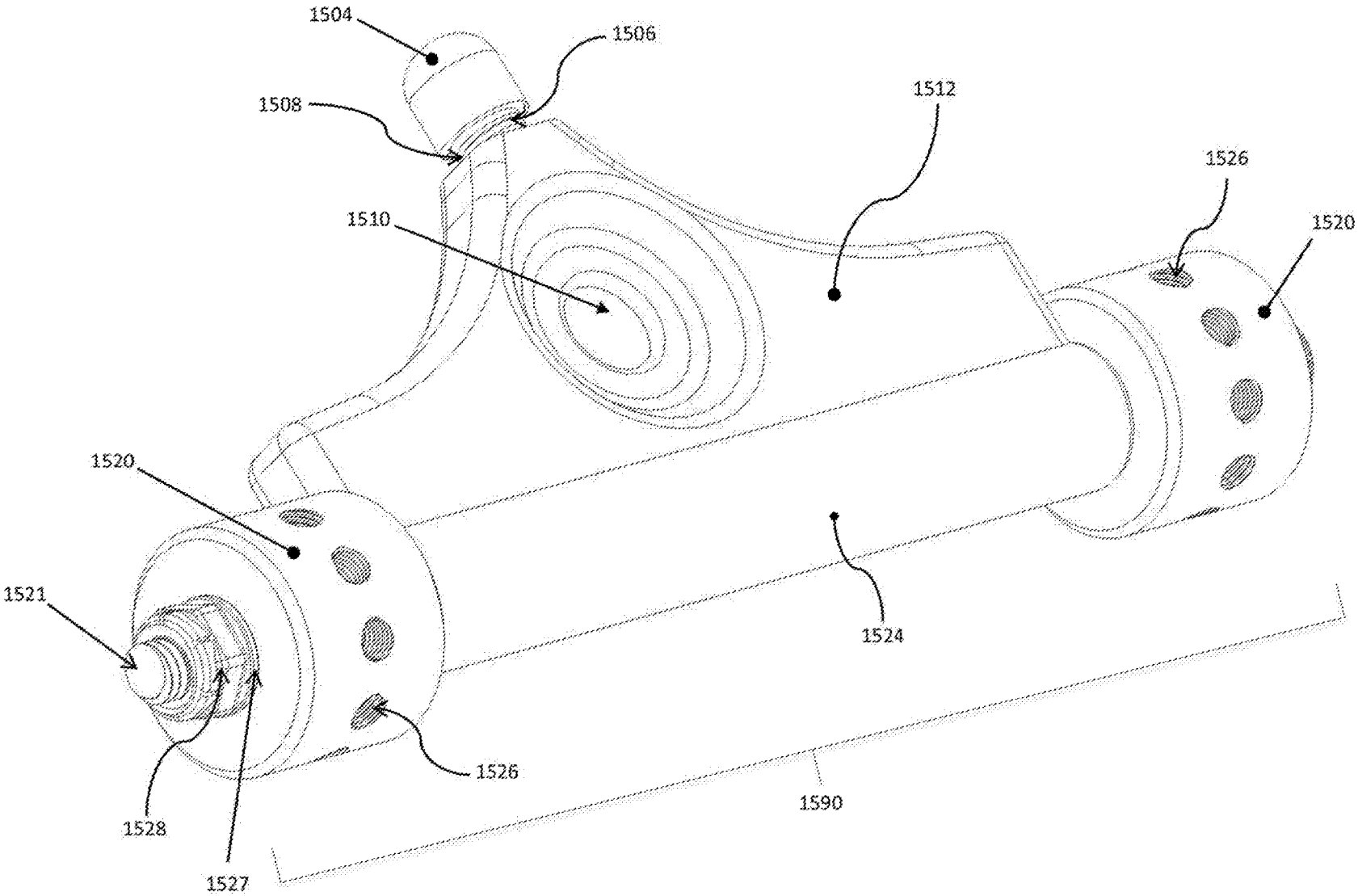
FIG. 15B is a rear side view of the hanger adapter-hub assembly.

FIG. 15B is a rear side view of the completed hanger adapter-hub assembly 1590.

Figure 15C:
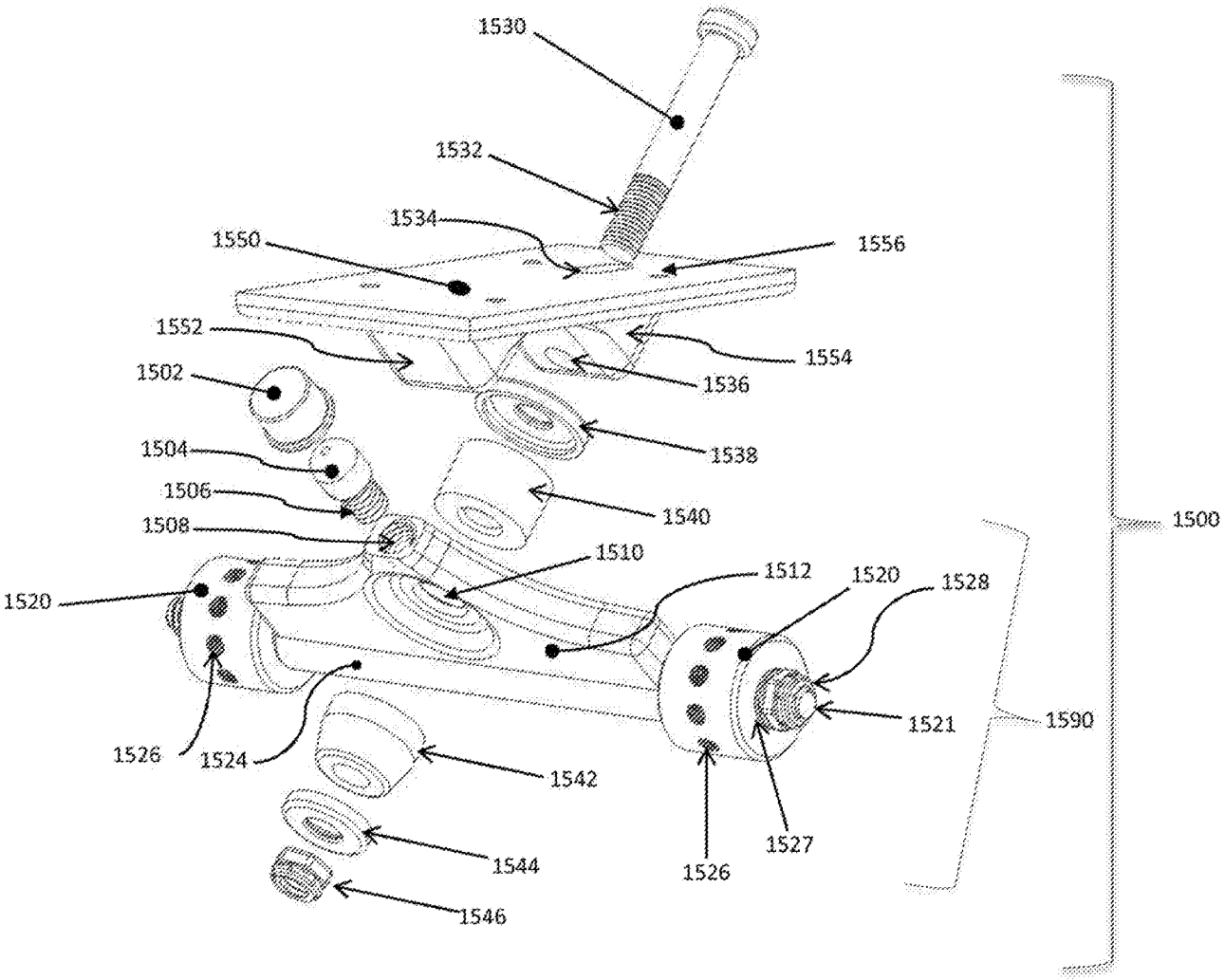
FIG. 15C is an expanded off-axis front view of all of the parts that will form the axel-hub-adapter fork-truck assembly.
Figure 15D:
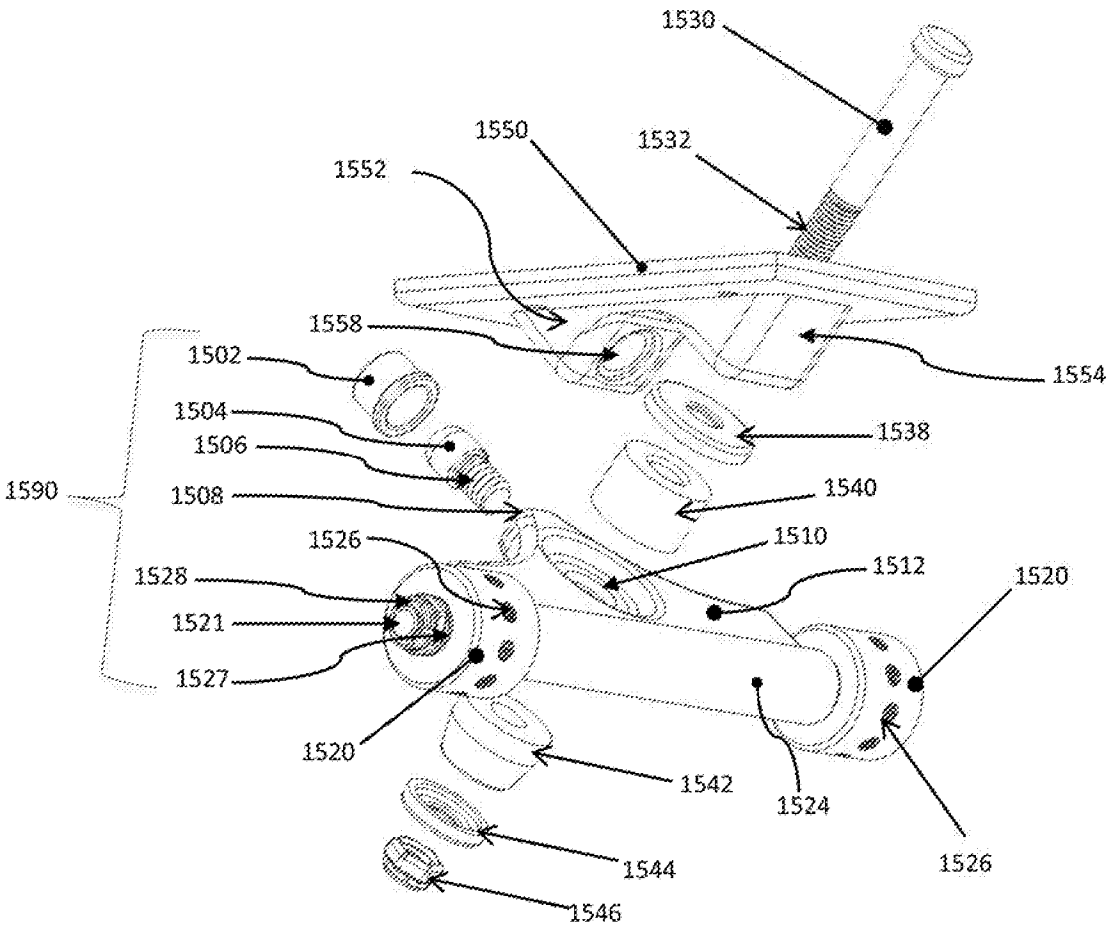
FIG. 15D is an expanded off-axis rear view of all of the parts that will form the fork hub-adapter truck assembly.

FIG. 15C is an expanded off-axis front view of all of the parts that will form the axel-hub-adapter fork-truck assembly 1500. The resilient pivot pin cup 1502 is press fit into the pivot pin recess hole 1558 as shown in FIG. 15D, of the pivot pin bulkhead 1553. With the adjustable pivot pin 1504 mated to the hanger body 1512 via the adjustable threads 1506 that engages the threaded recess 1508, the adjustable pivot pin 1504 is inserted into the resilient pivot pin cup 1502. The kingpin 1530 is placed into the countersink kingpin through-hole 1534 of the base plate 1550. The kingpin 1530 is held in place within the kingpin bulkhead 1554 by allowing only the smaller body of the kingpin 1530 to exit the kingpin exit through-hole 1536 of the kingpin bulkhead 1554. The remaining portion of the kingpin 1530 passes through the kingpin exit through-hole 1536. The kingpin 1530 is long enough to pass through the top bushing-retaining washer 1538, the top bushing 1540, the hanger body through-hole 1510, the bottom bushing 1542, the bottom bushing retaining washer 1544, and the locking nut 1546. The locking nut 1546 is firmly tightened onto the threaded end 1532 of the kingpin 1530, FIG. 15D is an expanded off-axis rear view of all of the parts that will form the axel-hub-adapter fork-truck assembly 1500. This view shows the pivot pin recess hole 1558 in the pivot pin bulkhead 1552, which is where the resilient pivot pin cup 1502 will be inserted and followed by the adjustable pivot pin 1504 and the remainder of the hanger adapter-hub assembly 1590.

Figure 15E:
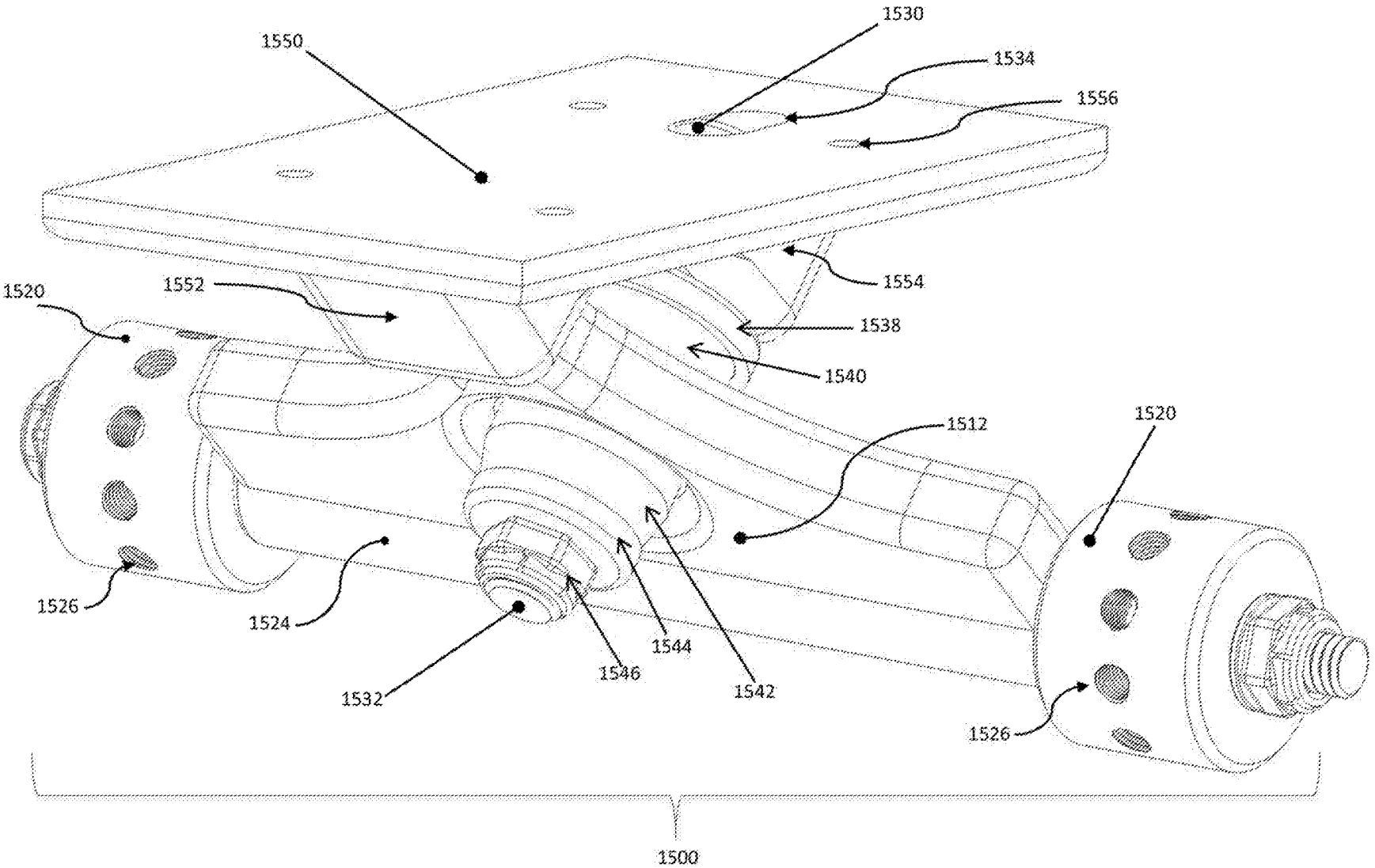
FIG. 15E is an isometric front view of the completed fork hub-adapter truck assembly.

FIG. 15E is an isometric front view of the completed axel-hub-adapter fork-truck assembly 1500.

Figure 16A:
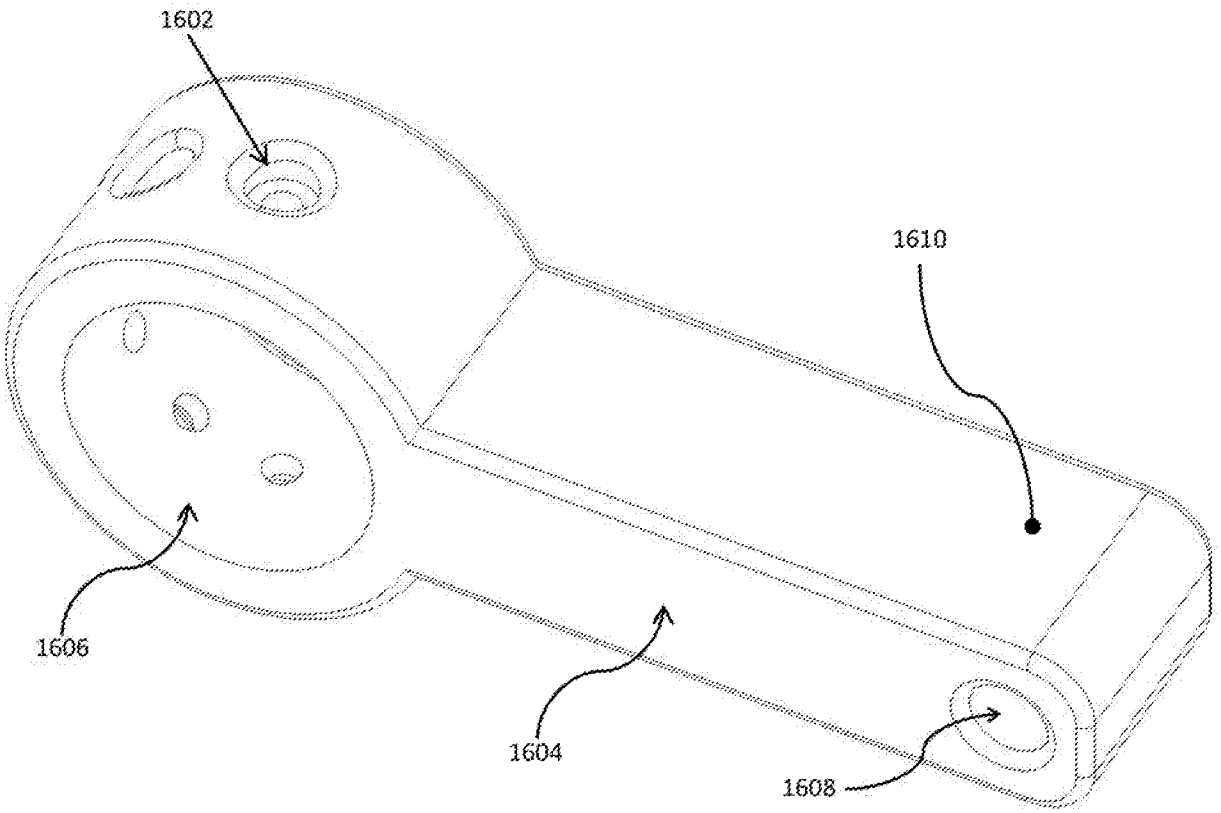
FIG. 16A is an isometric view a solid fork tine.
Figure 16B:
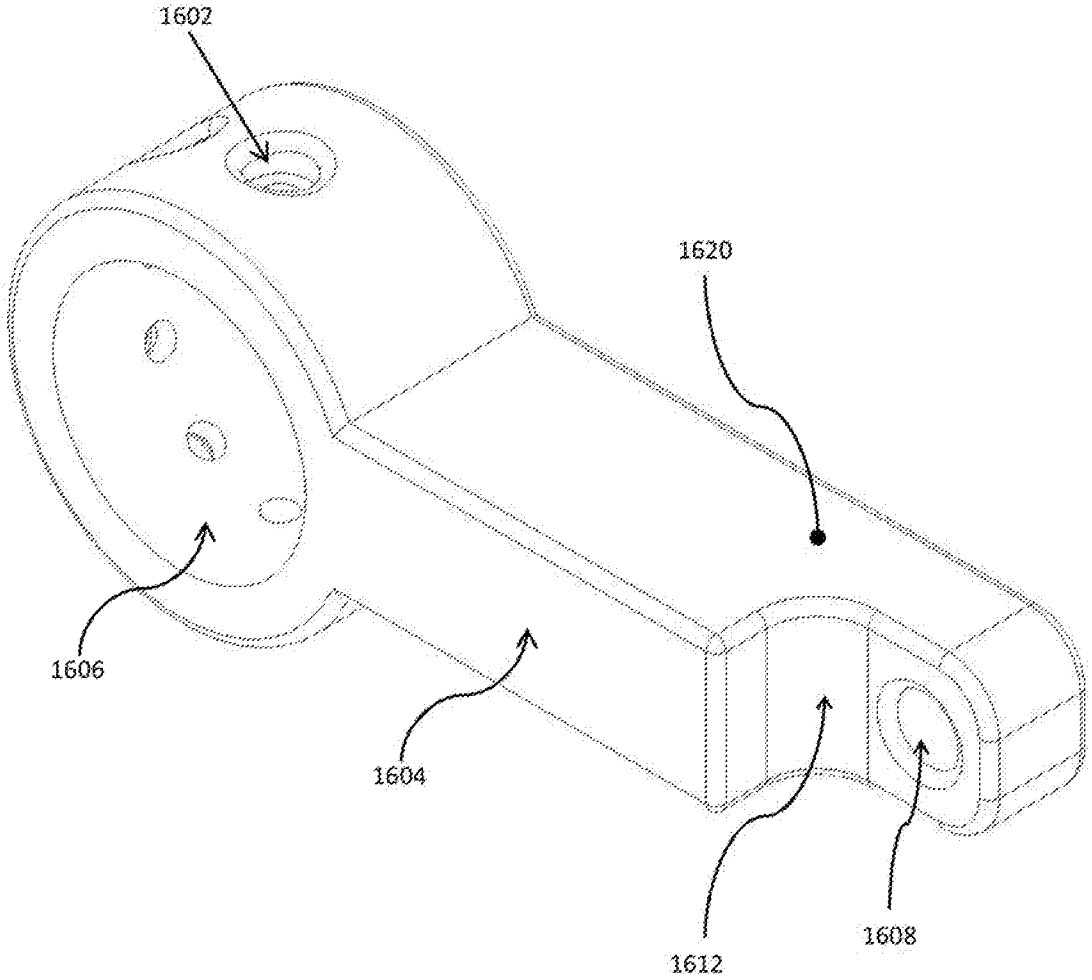
FIG. 16B is an isometric view of a modified solid fork tine.

FIG. 16A is an isometric view of a solid fork tine 1610. This solid fork tine 1610 has a solid fork arm 1604 that extends from the hub through-hole 1606 to an axel through-hole 1608. There are six countersunk through-holes 1602.

FIG. 168 is an isometric view of a modified solid fork tine 1620. The modified solid fork tine 1620 has a solid fork arm 1604 that extends from the hub through-hole 1606 to an axel through-hole 1608, and the end of the solid fork arm 1604 is modified with a recess 1612. There are six countersunk through-holes 1602.

Figure 16C:
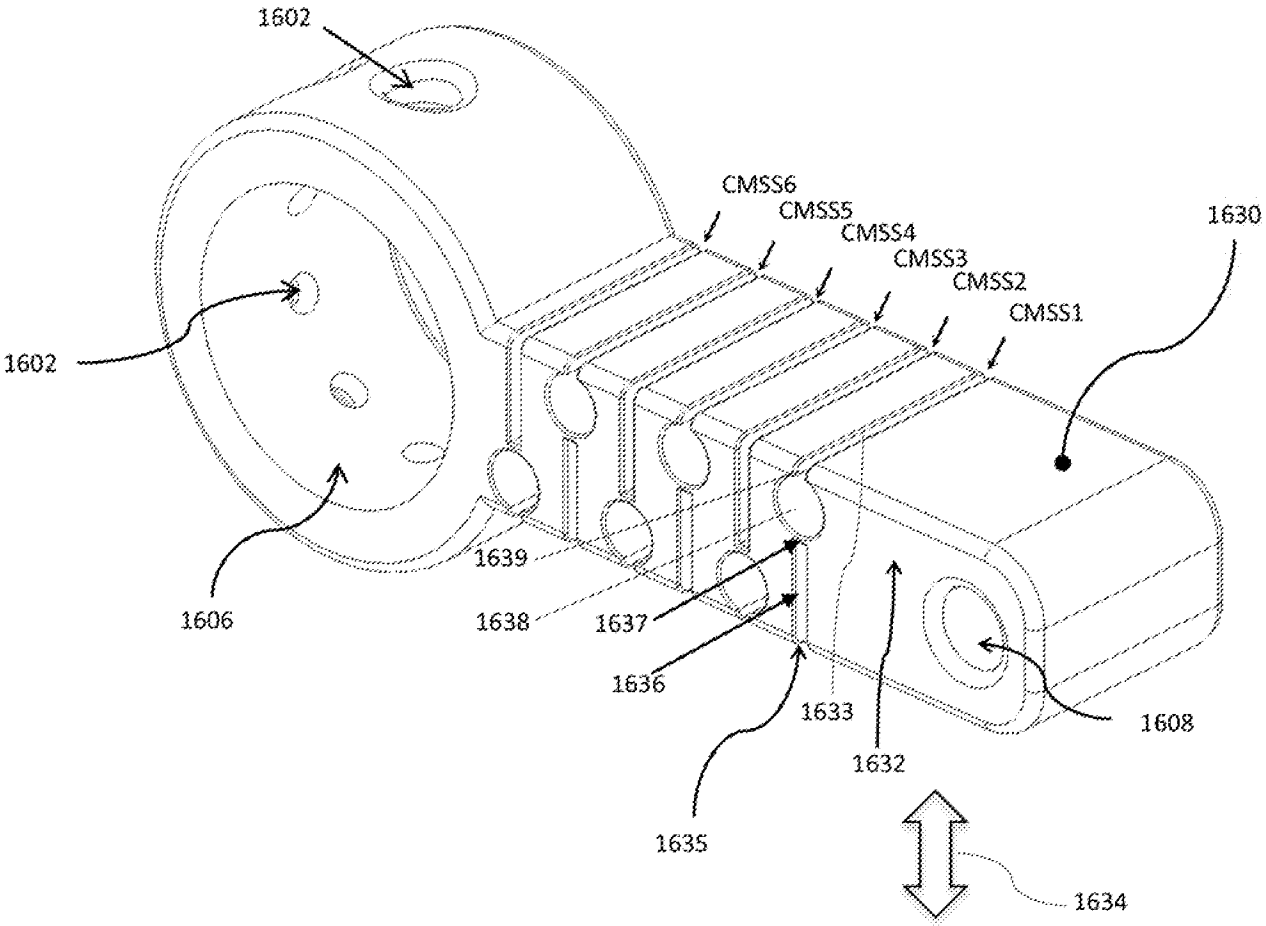
FIG. 16C is an upper isometric view of a shock-absorbing fork tine.

FIG. 16C is an upper isometric view of a shock absorbing fork tine 1630. The shock-absorbing fork tine 1630 has a fork arm 1632 that extends from the hub through-hole 1606 to an axel through-hole 1608. There are six countersunk through-holes 1602. Nearly identical to solid fork tine 1610 and the modified solid fork tine 1620, this shock-absorbing fork tine 1630 has an array of geometries that act as a Compound Monolithic Scissor Spring (CMSS). CMSS1 through CMSS6, The rotation point 1637, of the spring CMSS1, is formed by the circular through-hole 1638 and the large rectangular through-hole 1636, which extend through the entire thickness of fork arm 1632. There is a smaller rectangular through-hole 1639 at the top of the circular through-hole 1638. The rotation stop edges 1635 of the large rectangular through-hole 1636 and the rotation stop edge 1633 of the small rectangular through-hole 1639, serve as rotation stops. When an upward force 1634 is applied to the shock-absorbing fork tine 1630, a rotation or deflection occurs about the rotation point 1637 in a counter-clockwise direction. If the force is very large, the counter-clockwise rotation will continue until the rotation stop edge 1633 is fully closed and the rotation is transferred to the next element in the CMSS array (CMSS1 through CMSS16). When a downward force 1634 is applied to the shock-absorbing fork tine 1630, a rotation or deflection occurs about the rotation point 1637 in a clockwise direction. If the force is very large, the clockwise rotation will continue until the rotation stop edges 1635 is fully closed and the rotation is transferred to the next element in the CMSS array (CMSS1 through CMSS6), The work done in the rotatory motion or deflective motion of the CMSS array (CMSS1 through CMSS16) dissipates the shock of bumps encountered during the ride.

Figure 16D:
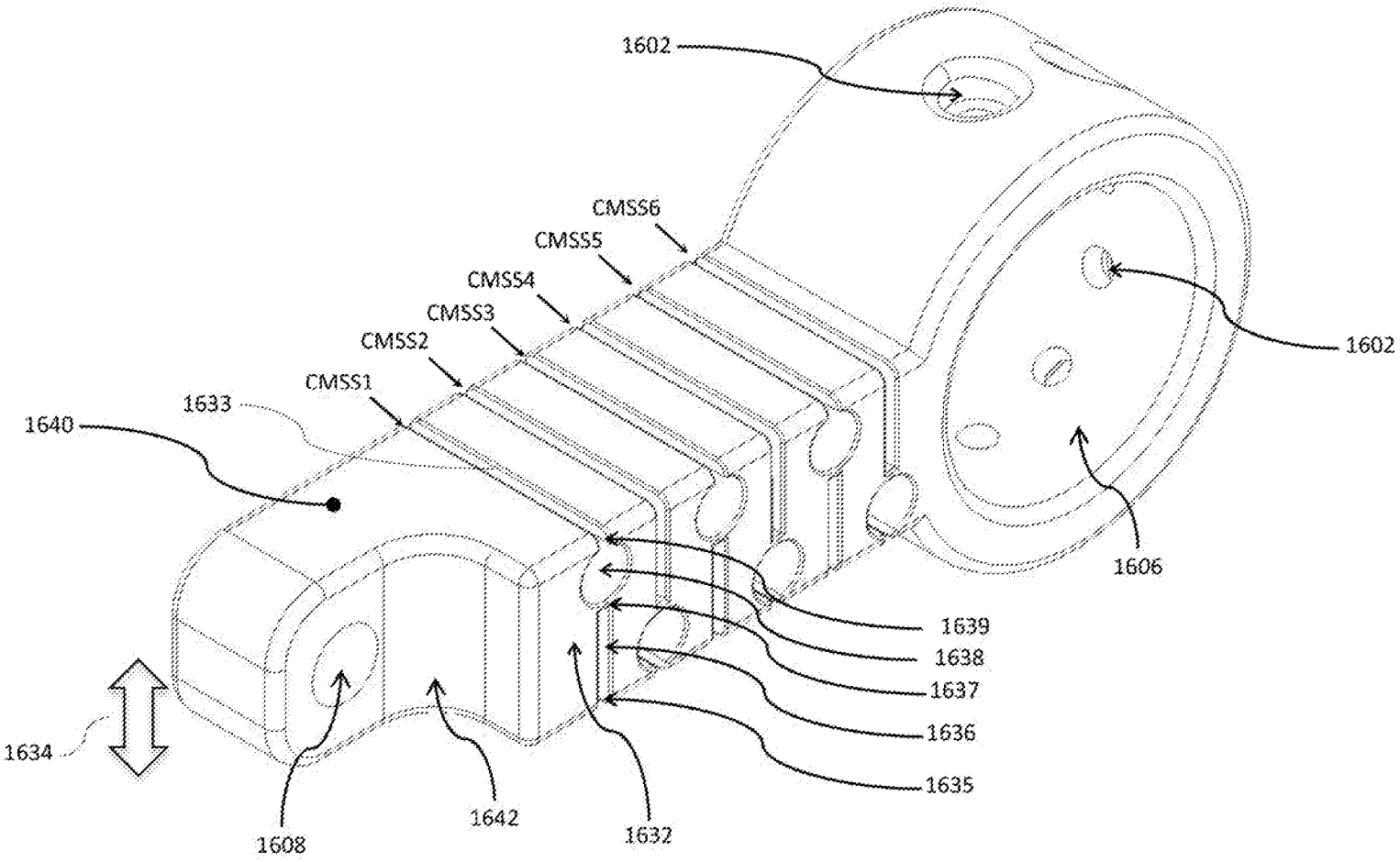
FIG. 16D is an upper isometric view of a modified shock-absorbing fork tine.

FIG. 16D is an upper isometric view of a modified shock-absorbing fork tine 1640. The modified shock-absorbing fork tine 1640 has a fork arm 1632 that extends from the hub through-hole 1606 to an axel through-hole 1608. The modified shock-absorbing fork tine 1640 has a recess 1642 at the end of fork arm 1632. There are six countersunk through-holes 1602. The modified shock-absorbing fork tine 1640 is identical to the shock-absorbing fork tine 1630 in FIG. 16C.

Figure 16E:
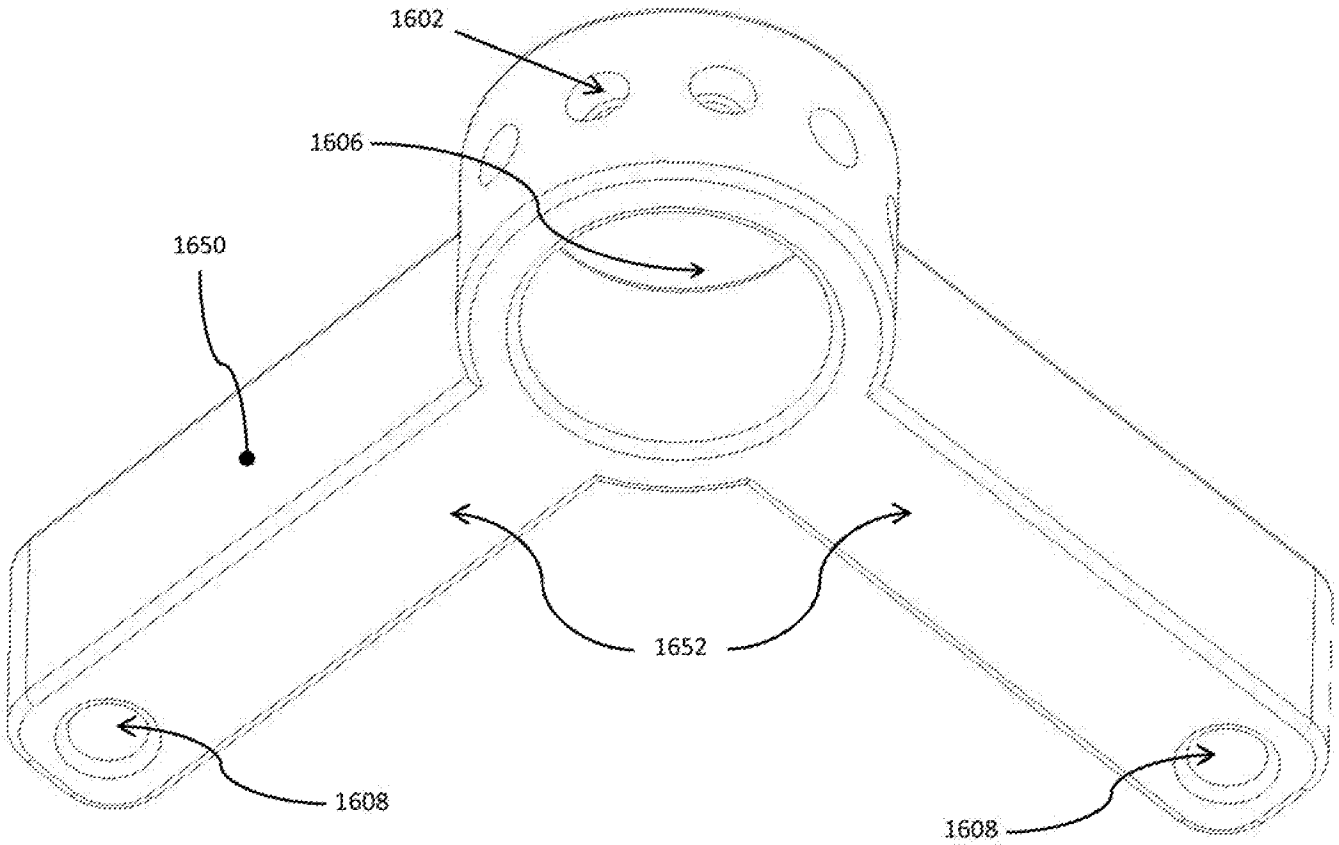
FIG. 16E is an elevated isometric view of the solid dual fork tine.

FIG. 16E is an elevated isometric view of the solid dual fork tine 1650. The fork arms 1652 support two axels (not shown) that use through-holes 1608. This solid dual fork tine 1650 has two fork arms 1652 that extend from the hub through-hole 1606 to each axel through-hole 1608. There are six countersunk through-holes 1602.

Figure 16F:
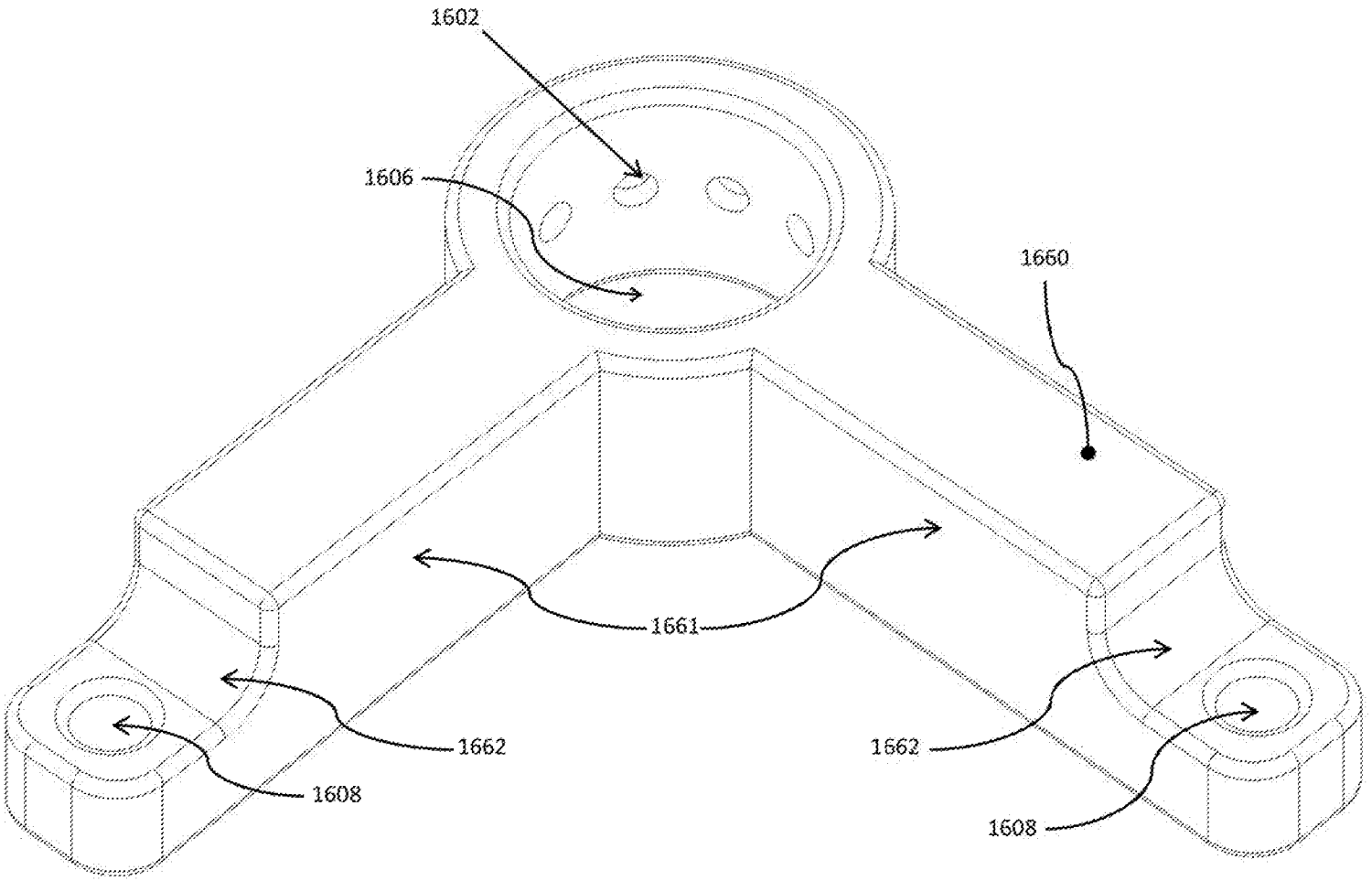
FIG. 16F is a lower side view of the modified solid dual fork tine.

FIG. 16F is a lower side view of the modified solid dual fork tine 1660, The fork arms 1660 support two axels (not shown) that use through-holes 1608. This modified solid dual fork tine 1660 has two fork arms 1661 that extend from the hub through-hole 1606 to each axel through-hole 1608 and a recess 1662. There are six countersunk through-holes 1602.

Figure 16G:
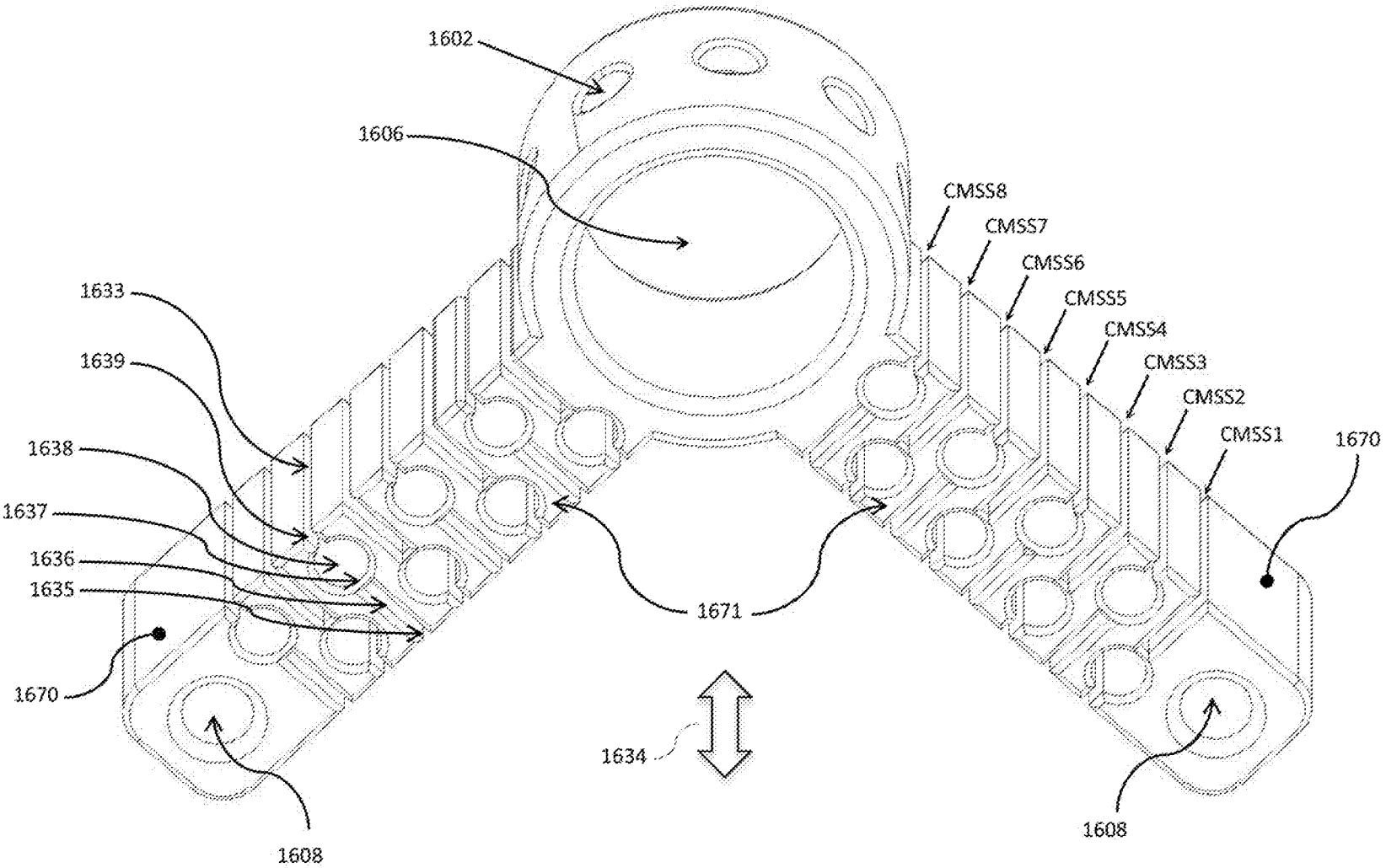
FIG. 16G is an elevated side view of the dual shock-absorbing dual-fork tine.

FIG. 16G is an elevated side view of the dual shock-absorbing dual-fork tine 1670. The dual shock-absorbing dual-fork tine 1670 has two fork arms 1671 that extend from the hub through-hole 1606 to each axel through-hole 1608. There are six countersunk through-holes 1602. The function of the dual shock absorbing dual-fork tine 1670 is identical to shock-absorbing fork tine 1630 described in FIG. 16C This dual shock-absorbing dual-fork tine 1670 has an array of geometries on each fork arm 1671 that act as a Compound Monolithic Scissor Spring (CMSS), CMSS1 through CMSS8. The rotation point 1637, of the spring CMSS1, is formed by the circular through-hole 1638 and the large rectangular through-hole 1636, which extend through the entire thickness of fork arm 1632. There is a smaller rectangular through hole 1639 at the top of the circular through-hole 1638. The rotation stop edges 1635 of die large rectangular through-hole 1636 and the rotation stop edges 1633 of the small rectangular through-hole 1639, serve as rotation stops. When an upward force 1634 is applied to the dual shock-absorbing dual-fork tine 1670, a rotation or deflection occurs about the rotation point 1637 in a counter-clockwise direction. If the force is very large, the counter-clockwise rotation will continue until the rotation stop 1633 is fully closed and the rotation is transferred to the next element in the CMSS array (CMSS 1 through CMSS8). When a downward force 1634 is applied to the shock-absorbing fork tine 1630, a rotation or deflection occurs about the rotation point 1637 in a clockwise direction. If the force is very large, the clockwise rotation will continue until the rotation stop edge 1635 is fully closed and the rotation is transferred to the next element 111 the CMSS array (CMSS1 through CMSS8). The work done in the rotatory motion or deflective motion of the CMSS array (CMSS1 through CMSS8) dissipates the shock of bumps encountered during the ride. The counter clockwise rotation applies to the forward fork arm 1671; the opposite fork arm 1671 will rotate in the clockwise direction.

Figure 16H:
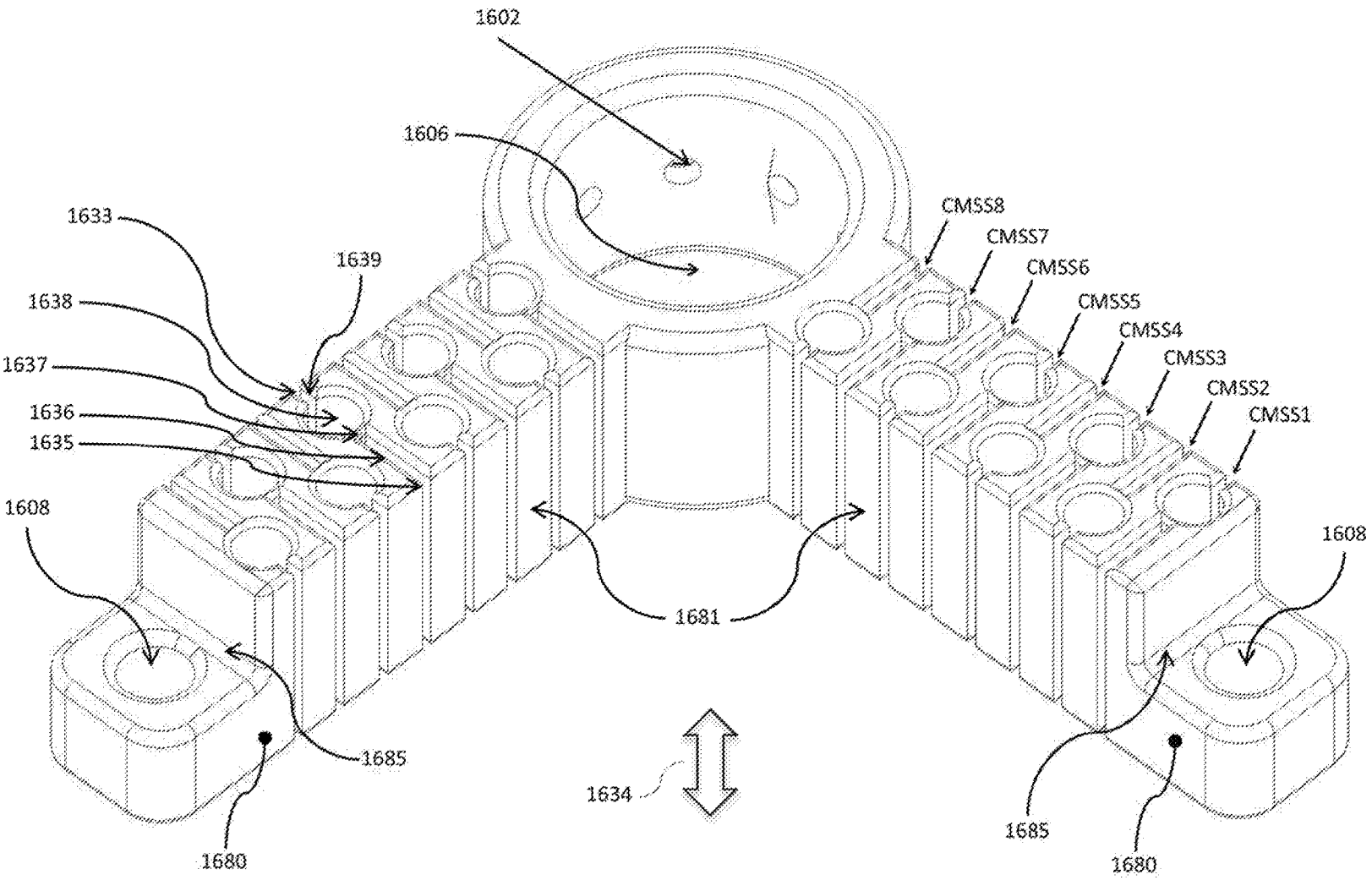
FIG. 16H is a lower side view of the modified dual shock-absorbing dual-fork tine.

FIG. 16H is a lower side view of the modified dual shock-absorbing dual-fork tine 1680. The modified dual shock-absorbing dual-fork tine 1680 has two fork arms 1681 that extend from the hub through-hole 1606 to each axel through-hole 1608. The modified dual shock-absorbing dual-fork tine 1680 has a recess 1685 at each end of fork arm 1681. There are six countersunk through-holes 1602. The function of the modified dual shock-absorbing dual-fork tine 1680 is identical to dual shock-absorbing dual-fork tine 1670 described in FIG. 16G.

Figure 17A:
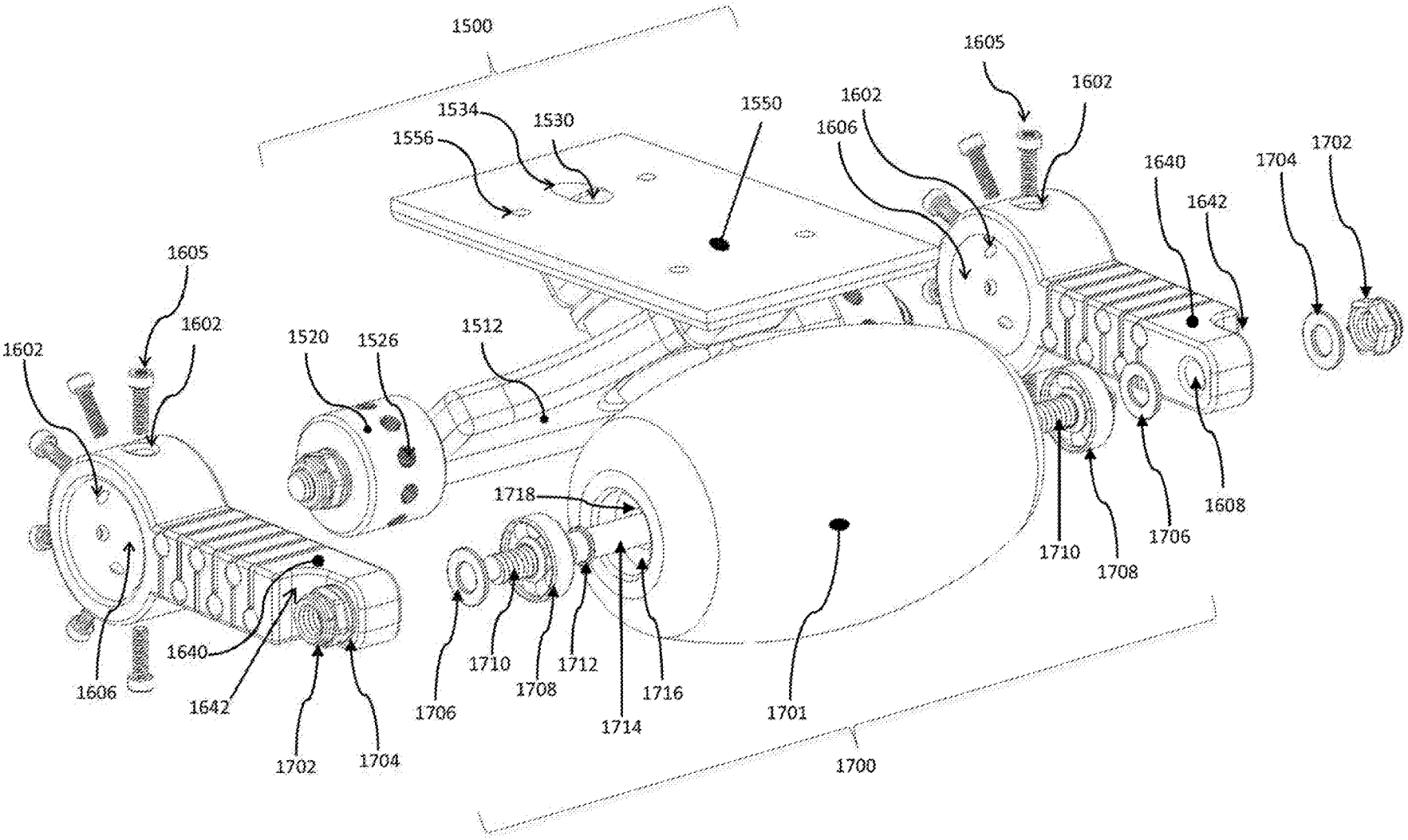
FIG. 17A is an expanded side view of the single wheel axel assembly, the skateboard fork hub adapter truck assembly and the modified shock-absorbing fork tines.

FIG. 17A is an expanded side view of the single wheel axel assembly 1700, the axel-hub-adapter fork-truck assembly 1500, and the modified shock-absorbing fork tines 1640. The assembly is made from all of the components shown in FIG. 17A that are in the 1700 number grouping. The wheel 1701 has an axel 1714 that passes through the axel through-hole 1718. On the axel 1714 there is a washer 1712 that separates the bearing 1708 from the wheel 1701 that resides in the bearing recess 1716. The axel 1714 passes through the axel through-hole 1608 of the modified shock-absorbing fork tine 1640. To prevent friction of the bearing 1708 and the inside wall of the modified shock-absorbing fork tine 1640, there is another washer 1706 that slides on to the axel 1714. The axel 1714, wheel 1701, and the other mounting components are secured in place with the washer 1704 and locking nut 1702. The locking nut 1702 and washer 1704 are tightened onto the threaded end 1710 of the axel 1714 in the recess 1642. Prior to the assembly of the wheel axel assembly 1700, the modified shock-absorbing fork tines 1640 are fastened to the axel-hub-adapter fork-truck assembly 1500. Other fork tines can be used; however, for this example, the modified shock-absorbing fork tines 1640 were chosen. The modified shock absorbing fork tines 1640 are fastened onto the hub adapter 1520 by sliding the fork through-hole 1606 onto the hub adapters 1520 and secured in place by passing fasteners 1605 that pass through the countersunk through-holes 1602 and tightening them into the threaded-holes 1526.

Figure 17B:
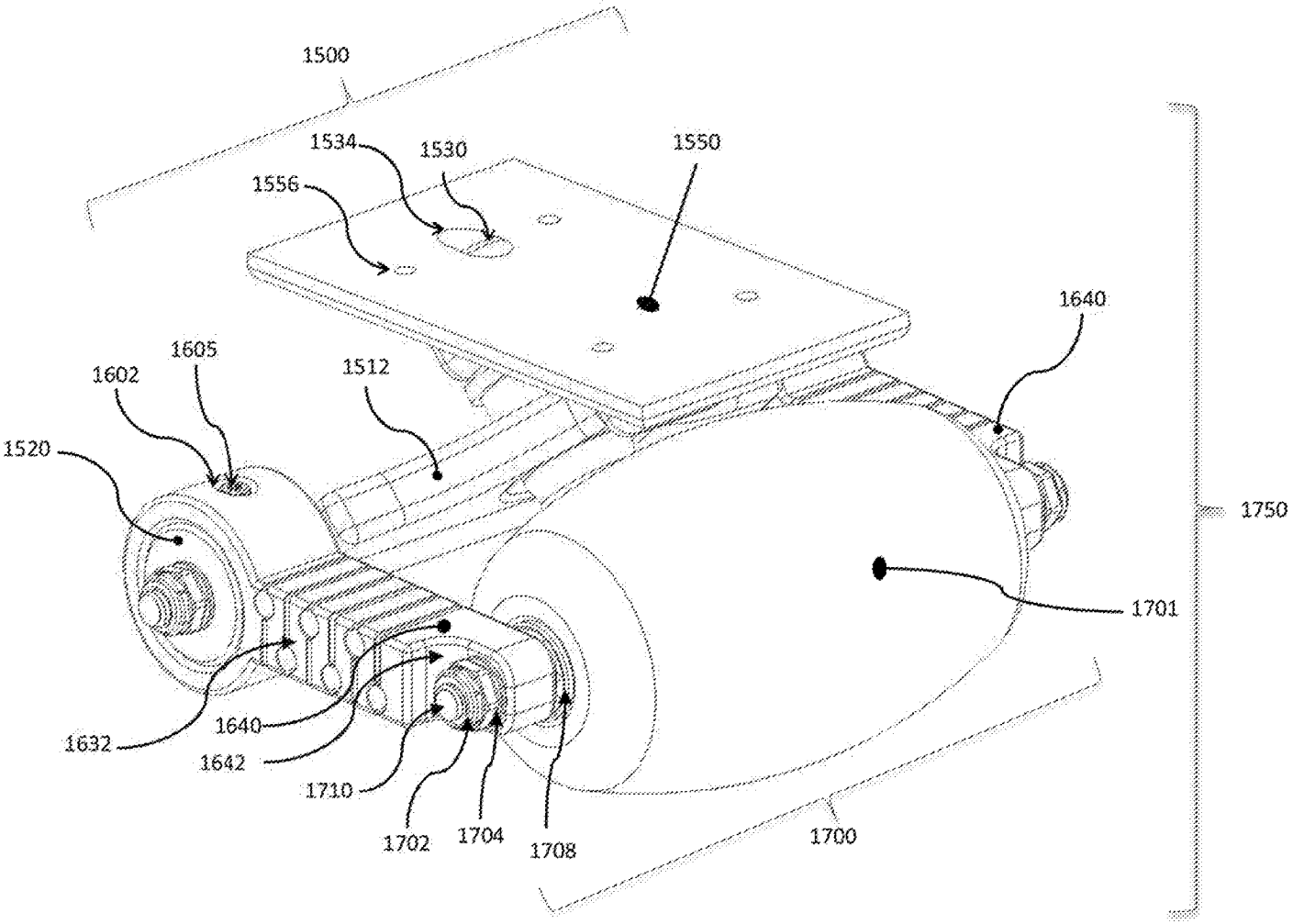
FIG. 17B is the isometric view of the complete single wheel fork truck assembly.

FIG. 17B is the isometric view of the complete single wheel fork truck assembly 1750 that is comprised of the single wheel axel assembly 1700, axel-hub-adapter fork-truck assembly 1500, and the modified shock-absorbing fork tines 1640.

Figure 17C:
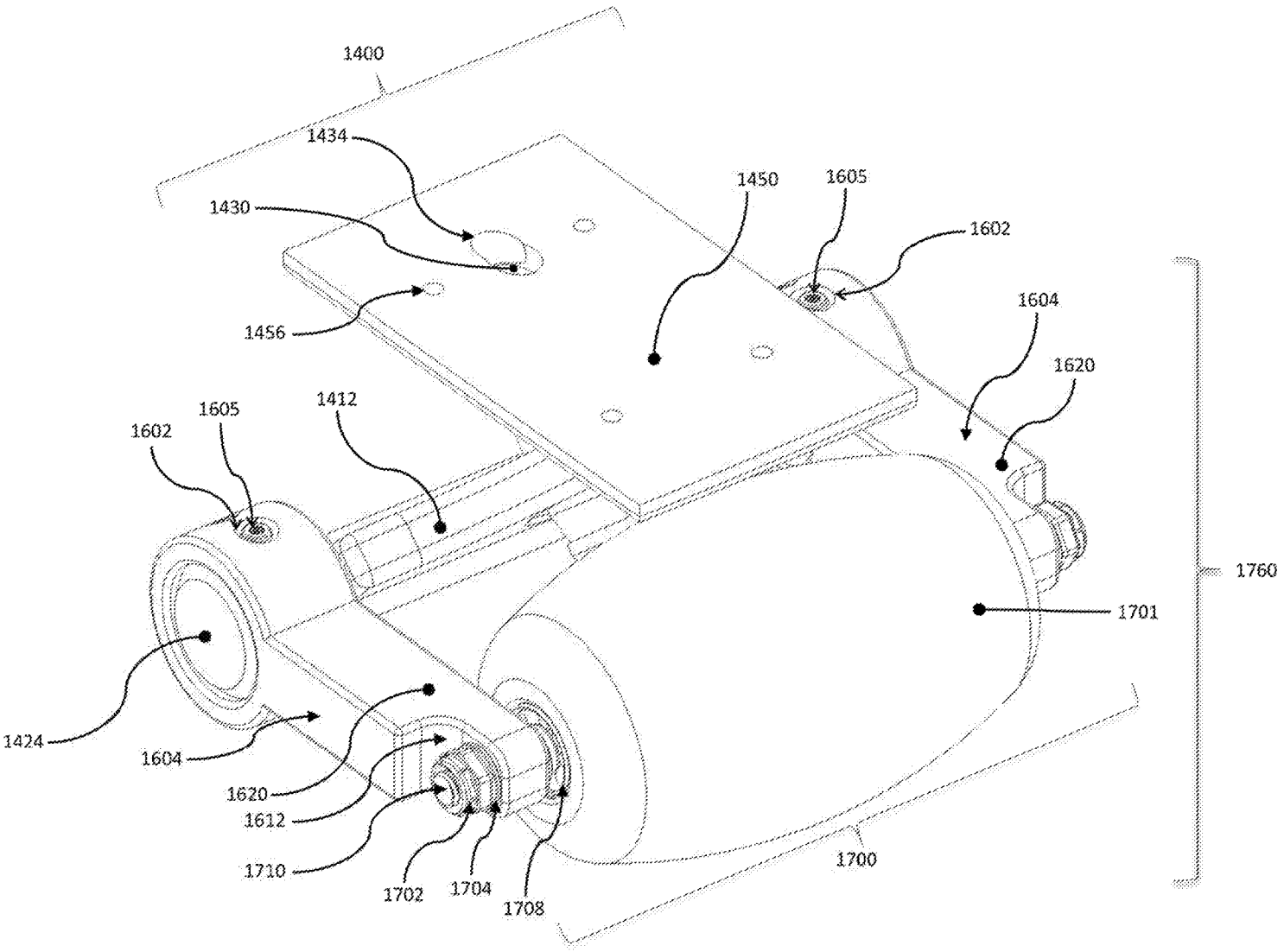
FIG. 17C is the isometric view of the complete single wheel fork truck assembly.

FIG. 17C is the isometric view of the complete single wheel fork truck assembly 1760 that is comprised of the single wheel axel assembly 1700, monolithic axel-hub fork-truck assembly 1400, and the modified solid fork tines 1640.

Figure 17D:
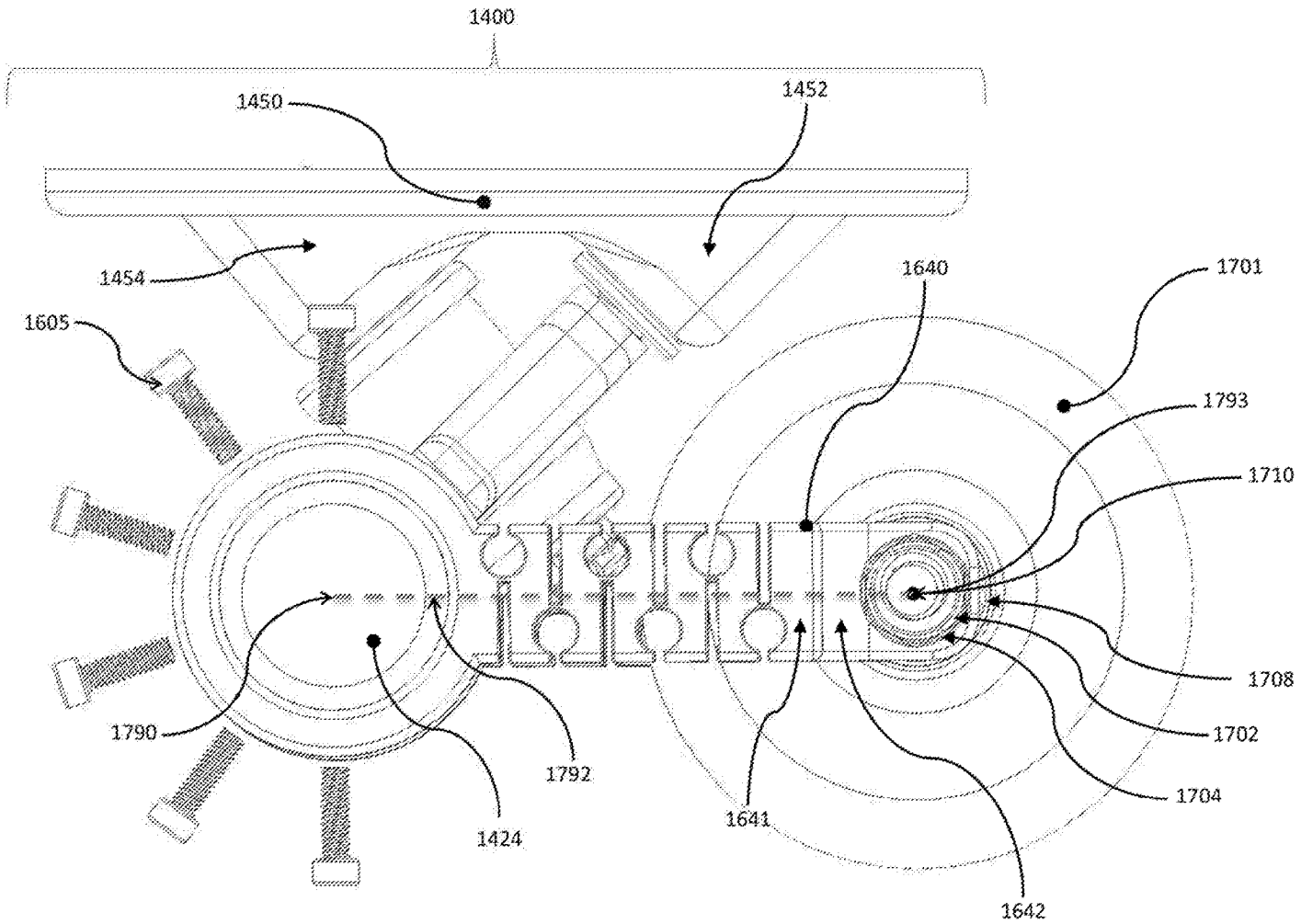
FIG. 17D is a side view of the single wheel axel assembly attached to the modified shock absorbing fork tines, which was fastened to the monolithic axel hub fork-truck assembly.

FIG. 17D is a side view of the single wheel axel assembly 1700 attached to the modified shock-absorbing fork tines 1640, which was fastened to the monolithic axel-hub fork-truck assembly 1400. This view references the single wheel axel assembly 1700 before a reconfiguration of the single wheel axel assembly 1700 and modified shock-absorbing fork tines 1640. The fasteners 1605 have been withdrawn to accomplish a rotation of the modified shock-absorbing fork tines 1640 about the monolithic hub axel ends 1424, the center of which is indicated by the end 1790 of the dashed reference line 1792. The other end of the dashed reference line 1792 is endpoint 1793 (start) and coincident to the center point of the threaded end 1710 of axel 1714 and the radius point that will be rotating about the monolithic hub axel ends 1424. Note the fasteners 1605 clocking orientation in this example. There can be many different clocking angles for the orientation of the modified shock-absorbing fork tines 1640. In this illustration the clocking angles are approximately in 36° increments.

Figure 17E:
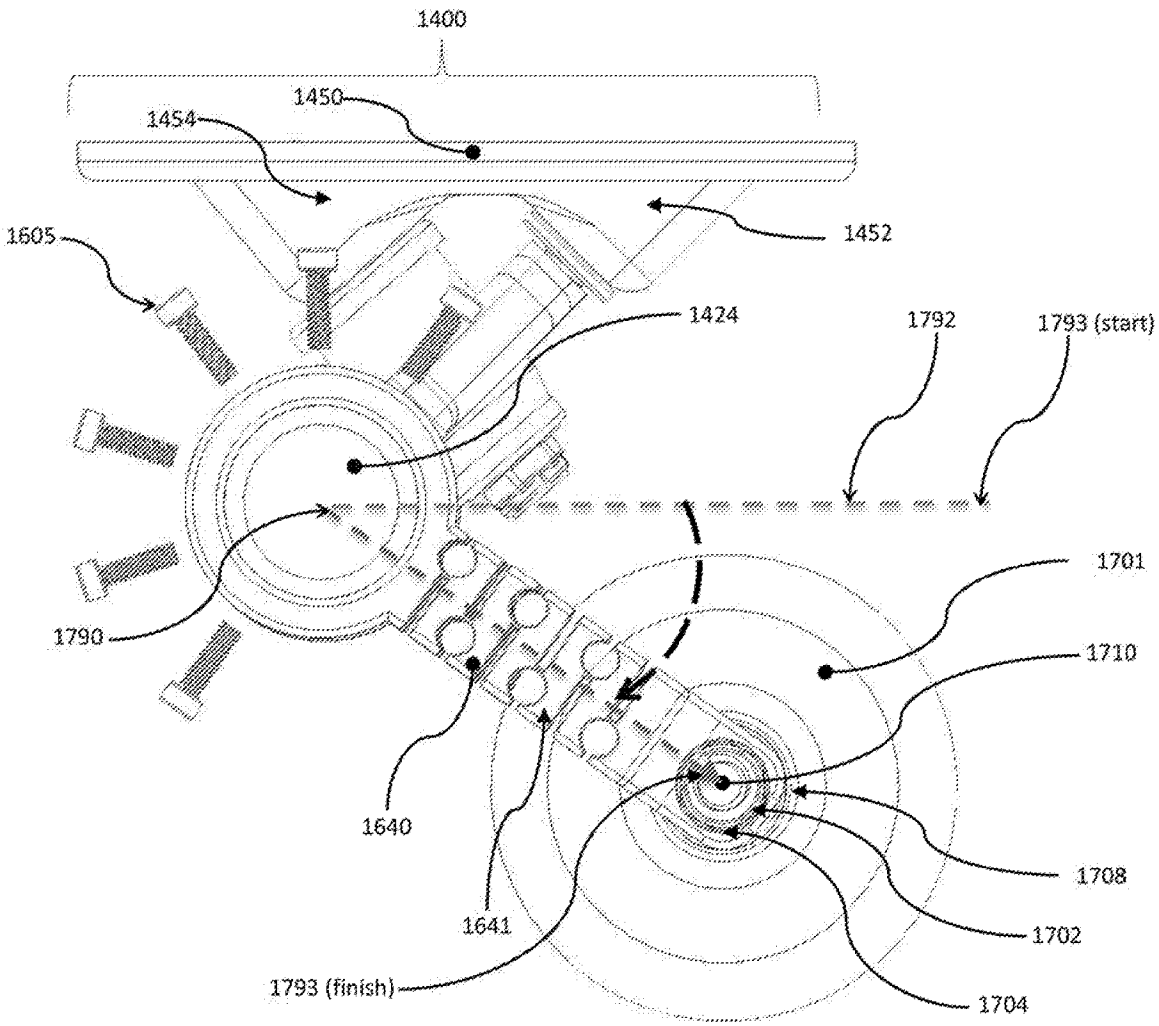
FIG. 17E shows the side view as the modified shock-absorbing forks are rotated one docking increment—36° from its original position.
Figure 17F:
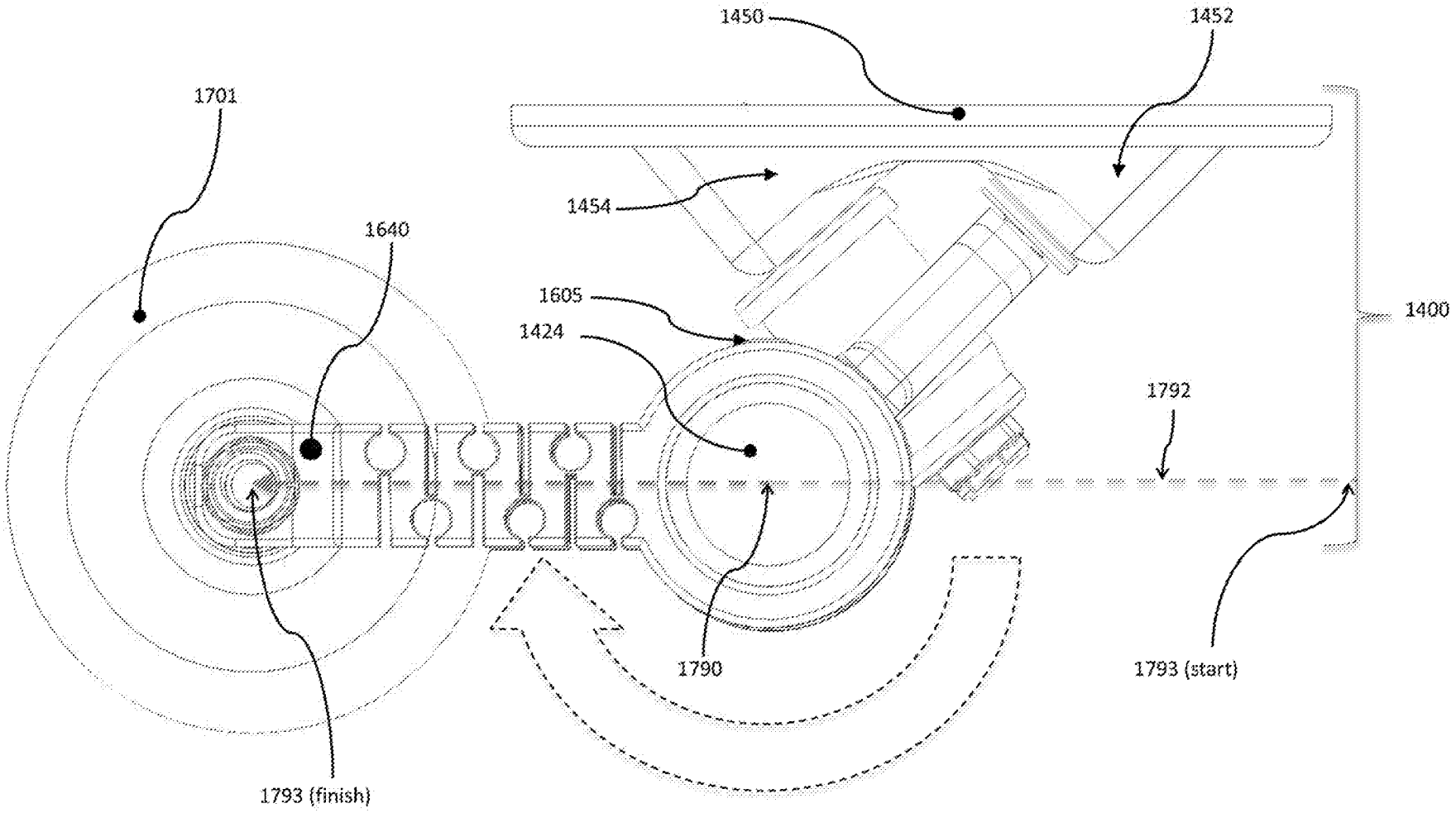
FIG. 17F is the side view showing 180° rotation.

FIG. 17E shows the side view as the modified shock-absorbing forks tines 1640 are rotated one clocking increment of approximately 36° from its original position as indicated by the endpoint 1793 (finish) of the dashed reference line 1792. The fasteners 1605 can be secured into the threaded-holes 1426 at this point fixing in place the modified shock-absorbing fork tines 1640 to the monolithic hub axel ends 1424 and the skateboard ride would be elevated, FIG. 17F is the side view showing the 180° rotation, represented by the dashed arrow, of the modified shock absorbing fork tines 1640 with the single wheel axel assembly 1700 about the center point 1790 of the monolithic hub axel ends 1424, from the endpoint 1793 (start) to the endpoint (finish), which is part of monolithic axel-hub fork-truck assembly 1400.

Figure 17G:
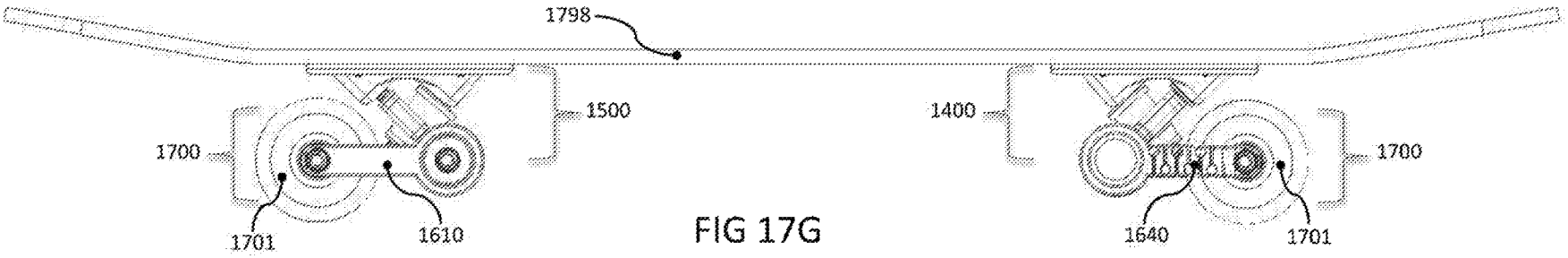
FIG. 17G show the side view of a fully configured skateboard deck with modified shock-absorbing forks with the single wheel axel assembly and wheel now in the rear of monolithic axel-bub fork-truck assembly

FIG. 17G shows the side view of a fully configured skateboard deck 1798. On the right side of the skateboard deck 1798 is a combination of a monolithic axel-hub fork-truck assembly 1400, the modified shock absorbing forks tines 1640, and a single wheel axel assembly 1700 with wheel 1701. On the left side attached to the skateboard deck 1798 is the combination of the axel-hub-adapter fork-truck assembly 1500, the solid forks 1610, and a single wheel axel assembly 1700 with wheel 1701. Assuming the forward direction is to the right, FIG. 17G represents the normal running skateboard configuration.

Figure 17H:
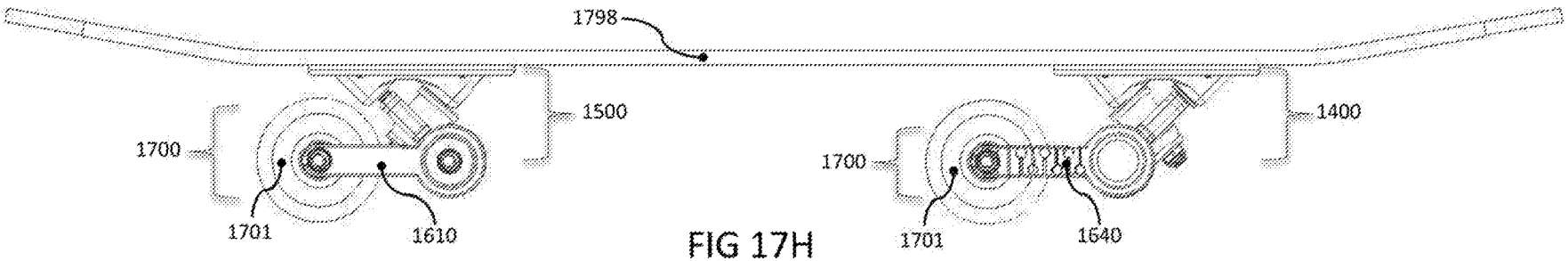
FIG. 17H shows the modified shock-absorbing forks fully rotated by 180° with the single wheel axel assembly and wheel now in the rear of monolithic axel-hub fork-truck assembly.

FIG. 17H shows the modified shock-absorbing forks 1640 fully rotated by 180° with the single wheel axel assembly 1700 with wheel 1701 now in the rear of the monolithic axel-hub fork-truck assembly 1400. This re-arrangement or reconfiguration of the modified shock absorbing fork tines 1640 provides a more streamlined ride for high-speed downhill run.

Figure 17I:
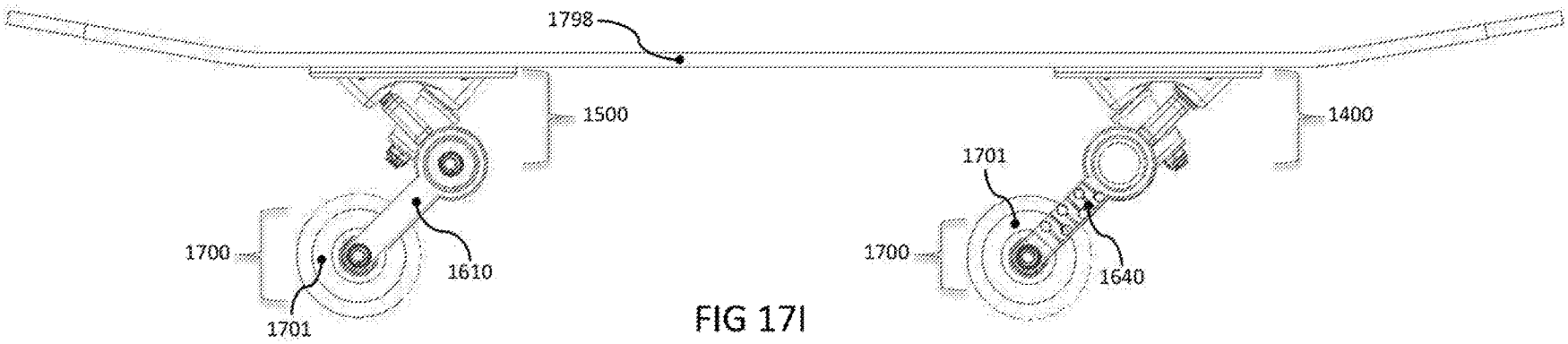
FIG. 17I shows the reconfiguration combinations and variations of the truck assemblies and fork arm hangers for different riding environments/conditions.

FIG. 17I shows the reconfiguration combinations and variations of the reorientation of the respective truck assemblies for different riding environments/conditions such as high water or muddy terrain or in general meeting different riding challenges. In this view the modified shock-absorbing fork tines 1640 and the single wheel axel assembly 1700 with wheel 1701 have been rotated by approximately 144° from its normal riding position as shown in FIG. 17G. On the left the solid fork 1610 and the single wheel axel assembly 1700 with wheel 1701 have been rotated by approximately 36° from its normal riding position as shown in FIG. 17G.

FIG. 18A shows the partially expanded off-axis elevated view of the dual shock-absorbing dual-fork tine 1670, the monolithic axel-hub fork-truck assembly 1400 with dual single wheel axle assemblies 1700, and the wheels 1701. The two dual shock-absorbing dual-fork tines 1670 are attached to the monolithic hub axel ends 1424 of monolithic axel-hub fork-truck assembly 1400 by sliding the through-hole 1606 of the dual shock-absorbing dual-fork tines 1670 onto the monolithic hub axel ends 1424, and fastening in place with fasteners 1605 that pass through the countersunk through-holes 1602 and thread into the threaded-holes 1426 of the monolithic hub axel ends 1424. The wheels 1701 can now be attached to each fork arm 1671 by inserting the axel 1714 through the through-hole 1608 of the dual shock-absorbing dual-fork tines 1670, through the washer 1706, bearing 1708, washer 1712, axel through-hole 1718, washer 1712, bearing 1708, washer 1706, and the through-hole 1608 of the other dual shock absorbing dual fork tines 1670. Both sides of the dual shock-absorbing dual-fork tines 1670 will have the threaded ends 1710 of the wheel axel 1714 protruding; the washers 1704 and locking nuts 1702 are tightened to secure the single wheel axle assemblies 1700 and the wheels 1701. This dual shock-absorbing dual-fork tine 1670 and dual single wheel axle assemblies 1700 will be referenced as dual shock-absorbing dual-fork assembly 1800.

FIG. 18B shows the isometric view of the fully assembled dual shock-absorbing dual-fork assembly 1800.

FIG. 18C shows an isometric view of the fully assembled dual shock-absorbing dual-fork assembly 1800 attached to a skateboard deck 1798, with front and rear locations that use the monolithic axel-hub fork-truck assembly 1400.

FIG. 19A shows a tread 1901. The tread 1901 is constructed from traditional robust elastomeric material and has grooves 1903 that help to expel water and other debris. Also ridges 1902 make contact with the riding surfaces. The tread riser 1907 is located on the inner tread surface 1909. The tread riser 1907 is in the middle of the tread 1909's inner surface and has circular geometries that serve as a sprocket gear receiver notch 1905.

FIG. 19B is an expanded isometric view of the components of the tread drive hub assembly 1950. The tread drive hub assembly 1950 is comprised of a sprocket gear 1920 with positive sprockets 1926 that is sandwiched between two hubs 1940 and hub 1930. The hub 1930 has threaded-holes 1932 that will receive fasteners 1916 that pass through the countersunk through-holes 1942 of the hub 1940, and through the through-holes 1922 of the sprocket drive gear 1920. The hub 1940 has an axel through-hole 1944 and a bearing recess 1946 which will hold a bearing washer 1912 and a hub hearing 1914. Likewise, the hub 1930 has an axel through-hole 1934 and a bearing recess 1946 (not shown), which will hold a bearing washer 1912 and a hub bearing 1914.

FIG. 19C is a partially expanded isometric view of the tread-drive dual-fork truck assembly 1900, which is comprised of the tread 1901 and treads drive hub assembly 1950. Also shown is the monolithic axel-hub fork-truck assembly 1400 and the dual shock-absorbing dual-fork tines 1670. The two dual shock-absorbing dual-fork tines 1670 are attached to the monolithic hub axel ends 1424 of monolithic axel-hub fork-truck assembly 1400 by sliding the tine through-hole 1606 of the dual shock-absorbing dual-fork tines 1670 onto the monolithic hub axel ends 1424, and fastening in place with fasteners 1605 that pass through the countersunk through-holes 1602 and thread into the threaded-holes 1426 of the monolithic hub axel ends 1424. With the tread 1901 mounted onto the tread drive hub assembly 1950, and positioned between the dual shock-absorbing dual-fork tines 1670 that are fastened to the monolithic hub axel ends 1424, the axel 1714 is inserted through the through-hole 1608 of the dual shock-absorbing dual-fork tines 1670, through the washer 1706, bearing through-hole 1918 of the tread drive hub assembly 1950, and out the other end, through washer 1706 (not seen), and the through-hole 1608 of the other dual shock-absorbing dual-fork tines 1670. Both outsides of the dual shock-absorbing dual-fork tines 1670 will have the threaded ends 1710 of the axel 1714 protruding through the through-holes 1608 of the dual shock-absorbing dual-fork tines 1670. Washers 1704 and locking nuts 1702 are placed onto the threaded ends 1710 and are tightened to secure the tread 1901 and the tread drive hub assembly 1950. The washer 1706 is used to prevent the tread drive hub assembly 1950 or the tread 1901 from rubbing against the inner surface of the dual shock-absorbing dual-fork tines 1670.

FIG. 19D is an elevated side view of the tread-drive dual-fork truck assembly 1900 attached to the dual shock-absorbing dual-fork tines 1670, which is attached to the monolithic axel-hub fork-truck assembly 1400. The modified dual shock-absorbing dual-fork tine 1680, the solid dual fork tine 1650, and the modified solid dual fork tine 1660 could be used in place of the dual shock-absorbing dual-fork tines 1670. Likewise, the fork axel-hub adapter fork-truck assembly 1500 could be used instead of the monolithic axel-hub fork-truck assembly 1400.

FIG. 19E is a side view of a skateboard deck 1798 with attached monolithic axel-hub fork-truck assembly 1400, the dual shock-absorbing dual-fork tine 1670, and the tread-drive dual-fork truck assembly 1900.

FIG. 19F is a side view is a hybrid configuration showing the monolithic axel-hub fork-truck assembly 1400, the dual shock-absorbing dual-fork tines 1670, the tread-drive dual-fork truck assembly 1900, and tread 1901 attached to the rear of the skateboard deck 1798. Also shown is the fork hub-adapter truck assembly 1500, the dual shock-absorbing dual-fork tines 1670, the tread-drive dual-fork truck assembly 1900, and tread 1901 attached to the front of the skateboard deck 1798.

FIG. 19G is a side view is a hybrid configuration showing the monolithic axel-hub fork-truck assembly 1400, the dual shock-absorbing dual-fork tines 1670, the tread-drive dual-fork truck assembly 1900, and tread 1901 attached to the rear of the skateboard deck 1798. Also shown is the axel-hub-adapter fork-truck assembly 1500, the solid dual fork tine 1650, the tread-drive dual-fork truck assembly 1900, and tread 1901 attached to the front of the skateboard deck 1798.

FIG. 19H is a side view of a hybrid configuration showing the monolithic axel-hub fork-truck assembly 1400, the dual shock-absorbing dual-fork tines 1670, the tread-drive dual-fork truck assembly 1900, and tread 1901 attached to the rear of the skateboard deck 1798. Also shown is the monolithic axel-hub fork-truck assembly 1400, skateboard deck 1798, wheels 1701, and the dual shock-absorbing dual-fork assembly 1800.

FIG. 20A is the forward isometric view showing a solid monolithic hanger 2012 with a threaded-hole 2008 that function as a seat for the adjustable threaded pivot pin 2004. The height of the adjustable threaded pivot pin 2004 can be adjusted by inserting the threaded section 2006 of the adjustable threaded pivot pin 2004 into the threads of the threaded-hole 2008 of the solid monolithic hanger 2012. The adjustable threaded pivot pin 2004 is adjusted with a wrench that uses the adjustable pivot pin flats 2005 on the sides of the adjustable threaded pivot pin 2004. The kingpin through-hole 2010 lies below the threaded-hole 2008. The two axel through holes 2018 are located at the ends of the fork arms 2016. The fork arms 2016 are extended out front the transom 2020. The transom 2020 was formed by the bend 2014, which formed an angle of approximately 45°. The leading edge of the transom 2020 has a tire recess 2022 that makes the solid monolithic hanger 2012 more compact. This solid monolithic hanger 2012 can be manufactured by casting, machining, molding or formed from bending from flat sheets or plates of metal.

FIG. 20B shows an isometric view of the solid monolithic hanger 2012, the base plate 2050 (not shown), the adjustable threaded pivot pin 2004, the kingpin suspension system 2029 consisting of the kingpin 2030 that passes through the top-bushing washer 2038, top-bushing 2040, kingpin through-hole 2010, bottom bushing 2042, bottom bushing washer 2044, and secured with the locking nut 2046 that threads onto the threaded end 2032 of the kingpin 2030.

FIG. 20C shows side view of the completed solid monolithic hanger assembly 2000 with the base plate 2050 attached to the components from FIG. 20B. The kingpin 2030 passes through the countersunk kingpin through-hole 2034 of the base plate 2050 and resides in the kingpin bulkhead 2054. The adjustable threaded pivot pin 2004 (not shown), resides in the pivot pin bulkhead 2052.

FIG. 20D is a review of the wheel axel assembly 1700 and wheel 1701. The axel 1714 passes through the axel through-hole 1718 of the wheel 1701. The wheel 1701 will rotate smoothly about the axel 1714 when bearing 1708. pressed into the bearing recess 1716, To prevent bearing drag, a bearing separator washer 1712 is first: slid onto the axel 1714 before the bearing 1708 is seated into the bearing recess 1716. On the outside of bearing 1708, an external washer 1706 is placed onto the axel 1714. This is done to prevent external bearing drag and maintain proper mechanical separation.

FIG. 20E is an isometric view of the assembled wheel assembly 1700. Wheel 1701 is a simple representation of a wheel described in FIG. 7J through FIG. 7N.

FIG. 20F is an isometric view of the completed solid monolithic hanger assembly 2000. This view includes the solid monolithic hanger 2012, the adjustable threaded pivot pin 2004, the base plate 2050, kingpin suspension system 2029, and the wheel assembly 1700 with wheel 1701. The through-holes 2056 are for attachment common skateboard decks.

FIG. 21A is an isometric view of a simple reconfigurable hanger system 2190 that incorporates the use of the fork arm 2116 secured with bolts 2123*a* and bolts 2125*a*. The versatility of the simple reconfigurable hanger system 2190 arises from the fact that larger wheels can be used by placing large or small stand-off washers (not shown) on the bolts 2123*a* and 2125*a*, or longer fork arms 2116 can be used that have a larger separation between the axel through-hole 2118 and the through hole 2121*b*. Longer bolts 2123*a* and 2125*a* may be required for wider wheels. This view shows the reconfigurable monolithic hanger body 2112 with a threaded-hole 2108, which functions as a seat for the adjustable pivot pin 2104. The height of the adjustable pivot pin 2104 can be adjusted by inserting the threaded section 2106 of the adjustable pivot pin 2104 into the threads of the threaded-hole 2108 of the reconfigurable monolithic hanger body 2112. The adjustable pivot pin 2104 is adjusted with a wrench that uses the adjustable pivot pin flats 2105 on the sides of the adjustable pivot pin 2104. Adjusting the adjustable pivot pin 2104 will help center the kingpin 2110 (not shown) within the kingpin through-hole 2110. A wheel recess contour 2122 makes the reconfigurable monolithic hanger body 2112 more compact. Fork arms 2116 are attached to the reference face 2113 with bolts 2123*a* and bolts 2125*a* that pass through the through-holes 2121*a* and through-holes 2121*b*, respectively, and are tightened to the threaded-holes 2124 and the threaded-holes 2126, respectively. The fork arms 2116 have axel through-holes 2118 located at the far end. The axel through-holes 2118 are used to mount the wheel axel assembly 1700 and wheel 1701 shown in FIG. 20E. The wheel recess contour 2122 provides a compact design by having the wheel assembly 1700 and wheel 1701 (not shown) to he mounted closer on shorter fork arms 2116. The simple reconfigurable hanger system 2190 is illustrated by the use of the bolts 2123*a* and 2125*a*.

FIG. 21B is an isometric view of a simple reconfigurable hanger system 2180 that incorporates the use of the fork arm 2116, which is identical in all respects to FIG. 21A, with the substitution of the double threaded lag-bolts 2123*b* for the bolt 2123*a*, and the double threaded lag-bolt 2125*b* substituted for the bolt 2125*a*. The versatility of the simple reconfigurable hanger system 2180 arises from the fact that larger wheels can be used by placing large or small stand-off washers (not shown) on the double threaded lag-bolt 2123*b* and double threaded lag-bolt 2125*b* between fork arms 2116 and the reference face 2113, or longer fork arms 2116 can be used that have a larger separation between the axel through-hole 2118 and the through-hole 2121*b*. Larger double threaded lag-bolt 2123*b* and double threaded lag-bolt 2125*b* may be required for larger wheels. The double threaded lag-bolts 2123*b* and double threaded lag-bolts 2125*b* use the same threaded-holes 2124 and threaded-holes 2126, respectively. The double threaded lag-bolts 2123*b* and double threaded lag-bolts 2125*b* require washers 2119 and locking nuts 2120 to fasten the truck arms 2116 securely to the reference face 2113 of the reconfigurable monolithic hanger body 2112. The simple reconfigurable hanger system 2180 is distinguished from the simple reconfigurable hanger system 2190 by the double threaded lag-bolt 2123*b* and double threaded lag-bolt 2125*b*.

FIG. 21C is a side view of the simple reconfigurable hanger system 2190 with reconfigurable monolithic hanger body 2112, attached fork arms 2116, the adjustable pivot pin 2104, and the wheel assembly 1700 with wheel 1701. This view illustrates the intersecting planes parallel to A and B that define the transition zone 2114 and axis C (not shown) that projects in and out of the plane of the drawing.

FIG. 21D is an upper view of the simple reconfigurable hanger system 2190 with reconfigurable monolithic hanger body 2112, attached fork arms 2116, the adjustable pivot pin 2104, and the wheel assembly 1700 with wheel 1701. This view better illustrates the wheel recess contour 2122 that makes the wheel 1701 fit closer to the reconfigurable monolithic hanger body 2112, making the assembly more compact.

FIG. 21E is an isometric overview of the completed simple reconfigurable fork hanger truck assembly 2100 with simple reconfigurable hanger sister 2190, and, heel axel assembly 1700 with the wheel 1701. The base plate 2150 is fully integrated with the reconfigurable monolithic hanger body 2112 with the kingpin 2130 inserted into the countersunk through-hole 2134. The kingpin 2130 further travels through the kingpin bulkhead 2154, and then passes through the top-bushing washer 2138, top bushing 2140, kingpin through-hole 2110 see FIG. 21D, bottom bushing 2142, bottom bushing washer 2144, and the locking nut 2146 that is tightened onto the threaded end 2132 is the kingpin 2130.

A countersink channel 2129 is added to streamline the modified fork arm 2117. The countersunk channel 2129 allows the bolt heads of bolts 2123*a* or bolts 2125*a* to be recessed into the countersunk channel 2129. Another through-hole 2121*c* is added to provide for larger or smaller wheels like wheel 1701. If a wheel smaller than wheel 1701 were used, the bolts 2123*a* and bolts 2125*a* are removed, and the modified fork arm 2117 is moved back, the bolts 2123*a* and bolts 2125 are reinserted, bolt 2125*a* would now be placed into the through-hole 2121*c* and bolt 2123*a* would be placed into through-hole 2121*b*. The base plate 2150 is secured to any conventional skateboard with common fasteners (not shown) that are threaded into the threaded-holes 2156. This forms the complete simple reconfigurable fork hanger truck assembly 2100.

FIG. 22A is view of a monolithic reconfigurable fork hanger body 2212 with reconfigurable attachment features. On the reference face 2213 of the monolithic reconfigurable fork hanger body 2212, there are threaded-holes 2224 and threaded-holes 2226. Above the threaded-hole 2224 and threaded-hole 2226, is a bolt-mounting boss 2227. This bolt-mounting boss 2227 has through-hole 2228*a*, through-hole 2228*b*, and through-hole 2228*c*. On the same reference face 2213, there is a through-hole 2215 that cuts through the entire monolithic reconfigurable fork hanger body 2212. This through-hole 2215 forms a leaf spring pivot point 2217. The monolithic reconfigurable fork hanger body 2212 has a kingpin through-hole 2210 and a threaded-hole 2208 that will receive an adjustable pivot pin 2204 (not shown).

FIG. 22B is an expanded isometric view of the monolithic reconfigurable fork hanger body 2212 and full complement of parts. Double threaded lag bolts 2223*b* and double threaded lag-bolts 2125*b* are threaded into threaded-holes 2224 and threaded-holes 2226. Fork arm 2216 is slid onto the double threaded lag-bolts 2123*b* and double threaded lag-bolts 2125*b*, using that respective fork arm through-holes 2221*a* and arm through-holes 2221*b*. The fork arm 2216 is finally secured to the reference face 2213 by tightening the washers 2219 and locking nuts 2220 onto the double threaded lag-bolts 2223*b* and double threaded lag-bolts 2225*b*. On the same reference face 2213, there is a through-hole 2215 that cuts through the entire monolithic reconfigurable fork hanger body 2212. This through-hole 2215 forms a leaf spring pivot point 2217. The monolithic reconfigurable fork hanger body 2212 has a kingpin through-hole 2210 and a threaded-hole 2208 that will receive an adjustable pivot pin 2204. The threaded-hole 2208 receives the adjustable pivot pin 2204 by inserting the threaded end 2206 of the adjustable pivot pin 2204 and tightening it in place with a wrench that uses the wrench facets 2205.

FIG. 22C is an expanded isometric view of the monolithic reconfigurable fork hanger body 2212. The fork arm 2216 is firmly secured to the reference face 2213 by tightening the bolts 2223*a* and the bolts 2225*a* into the threaded-holes 2224 and threaded-holes 2226. On the same reference face 2213, there is a through-hole 2215 that cuts through the entire monolithic reconfigurable fork hanger body 2212. This through-hole 2215 forms a leaf spring pivot point 2217 that acts as a shock absorber. The monolithic reconfigurable fork hanger body 2212 has a kingpin through-hole 2210 and a threaded-hole 2208 that will receive adjustable pivot pin 2204. The threaded-hole 2208 receives the adjustable pivot pin 2204 by inserting the threaded end 2206 of the adjustable pivot pin 2204 and tightening it in place with a wrench that uses the wrench facets 2205.

FIG. 22D is a partially expanded view of components that will form a complete reconfigurable skateboard fork hanger truck assembly 2200 with wheel axel assembly 1700 and wheel 1701. The baseplate 2250 has a countersunk kingpin through-hole 2234 through which passes the kingpin 2230. To secure the base plate 2250 to a skateboard deck 1798 (not shown) are four through-holes. The kingpin 2230 passes through the base plate 2250 through a through-hole 2236 in the kingpin bulkhead 2254. The top-bushing washer 2238 and the top-bushing 2240 are slid onto the kingpin 2230 from the kingpin threaded end 2232 as it exits the through-hole 2236 of the kingpin bulkhead 2254. The resilient cup 2202 is mounted into the recess hole 2258 (not seen) in the pivot pin bulkhead 2252. The threaded end 2206 of adjustable pivot pin 2204 is threaded into the threaded-hole 2208 of the monolithic reconfigurable fork hanger body 2212. The adjustable pivot pin 2204 is then inserted into the resilient cup 2202. The kingpin-threaded end 2232 of the kingpin 2230 is inserted into the kingpin through-hole 2210 of the monolithic reconfigurable fork hanger body 2212 and through the bottom-bushing 2242, bottom bushing washer 2244, and are secured to the kingpin threaded end 2232 with the locking nut 2246.

By inserting bolt 2225*a* through the fork arm through-hole 2221*b* and into the threaded-hole 2226, a rotation point is established. The angle of the fork arm 2216 is determined by choosing a through-hole 2228*a*, through-hole 2228*b*, or through-hole 2228*c* through which bolt 2223*a* will be secured with washer 2219 and locking nut 2220. In FIG. 22D the angle of the fork arm 2116 is fixed by choosing through-hole 2228*a*. The opposite fork arm 2216 will be installed in the same manner. With the axel through-holes 2218 aligned, the wheel axel assembly 1700 is installed with the wheel 1701. The view shown is the angled riding configuration 2203.

FIG. 22E is an assembled isometric view of the reconfigurable skateboard fork truck assembly 2200, in the angled riding configuration 2203, with the wheel axel assembly 1700 and the wheel 1701.

FIG. 22F is an assembled isometric view of the reconfigurable skateboard fork truck assembly 2200, in the normal riding configuration 2201, with the wheel axel assembly 1700 and the wheel 1701.

FIG. 23A is an isometric view of a formed fork hanger 2380 with integrated leaf spring shock absorbing action. The U-channel cutout 2383 on the back face of the formed fork hanger 2380 forms the U-channel leaf spring 2385. There are two parallel sets of spring dampening through-holes 2384*a*, 2384*b*, 2384*c*, 2384*d*, on the left side and the right side of the U-channel cutout 2383. The hanger yoke 2370 has an integrated pivot pin 2304 that is welded, machined or formed. A slot 2378 allows the hanger yoke 2370 to slide over the formed fork hanger 2380. The hanger yoke 2370 is positioned to have the yoke kingpin through-hole 2308 concentric with the formed fork hanger kingpin through-hole 2310. The hanger yoke 2370 is secured to the formed fork hanger 2380 with bolts 2374 that pass through through-holes 2376 and through through-holes 2386 that are tightened with locking nuts 2372. The second leaf spring is the formed curved leaf spring surface 2315. The third leaf spring consists of two leaf spring fork arms 2316.

FIG. 23B is an isometric view of the assembled formed fork hanger 2380 and hanger yoke 2370. An area 2309 defined by the two respective kingpin through-holes, the yoke kingpin through-hole 2308 and the formed fork hanger kingpin through-hole 2310. The area 2309 is an annular surface, and the rim of the hanger yoke kingpin through-hole 2308 will constrain the movement of the top-bushing 2340 (not shown), bottom bushing 2342 {not shown}, and the annular surface 2309 will allow the compressive forces to determine how flexible the hanger can move about the kingpin 2330 (not shown).

The slot 2312 allows leaf spring action to propagate along the leaf spring fork arm 2316. The leaf spring fork arms 2316 has five through-holes 2319 along most of its length and four spring dampening through-holes 2314*a*, 2314*b*, 2314*c* and 2314*d* on the left side and the right side along the slot 2312 of each leaf spring fork arm 2316.

FIG. 23C is a top view of the formed fork hanger 2380. This overview shows the U-channel leaf spring 2385 formed by the U-channel cutout 2383. The parallel rows of spring dampening through-holes 2384*a*, 2384*b*, 2384*c*, 2384*d* and 2384*e* are control points that constrain the movement of the U-channel leaf spring 2385. The U-channel leaf spring 2385 has adjustable or controllable flexing points as determined by the placement of spring dampening bolts 2387 and a corresponding spring dampening locking nuts 2388. The spring dampening bolts 2387 are inserted into the spring dampening through-holes 2384*e* on both sides of the U-channel 2383 and tightened with the spring dampening locking nuts 2388 from the other side. If the spring dampening bolts 2387 and the spring dampening locking nuts 2388 are fastened tightly, there is no movement as in the case of FIG. 23C. However, if spring dampening bolts 2387 and spring dampening locking nuts 2388 are fastened together loosely, the space that separates them will determine the U-channel leaf spring 2385 maximum excursions. Consequently, by selecting the higher spring dampening through-hole positions such as 2384*d*, 2384*c*, 2384*b*, or 2384*a*, this will provide controlled U-channel leaf spring 2385 excursions. If there are no spring dampening bolts 2387 and no spring dampening locking nuts 2388 implemented, then the pivot axis of the U-channel leaf spring 2385 would be at the top spring dampening through-hole pair 2384*a*. For certain riding conditions, specific reproducibility can be achieved by selecting certain spring dampening through-hole pairs. For example, selecting spring dampening through-hole 2384*c*, and using the spring dampening bolts 2387 and spring dampening locking nuts 2388 that are firmly tightened, the pivot axis of the U-channel leaf spring 2385 would be at spring dampening through-hole pairs 2384*c*.

A second leaf spring pivot axis 2327 is formed by the slot 2312 cut along the leaf spring fork arm 2316. The leaf spring fork arm 2316 will be called the leaf spring fork arm mount 2316. The spring dampening bolts 2321 are inserted into the spring dampening through-holes 2314*d* on both sides of the leaf spring fork arm mount 2316. The spring dampening bolts 2321 are then fastened to spring dampening locking nuts 2388 on the opposite side. The spring dampening bolts 2321 are then fastened to a spring dampening locking nut 2323 on the opposite side. If spring dampening bolts 2321 and the spring dampening locking nuts 2323 on the opposite side are fastened tightly, there is no movement. However, if spring dampening bolts 2321 and the spring dampening locking nuts 2323 are fastened together loosely, the space that separates them will determine the leaf spring fork arm mount 2316 maximum excursions. As shown in FIG. 23C there is no spring action because the spring dampening bolts 2321 and the spring dampening locking nuts 2323 are in the spring dampening through-holes 2314*d* and any motion is dampened or stopped. Consequently, by selecting the lower spring dampening through-hole pair positions 2384*c*, 2384*b* or 2384*a*, will provide maximum controlled leaf spring fork arm mount 2316 excursions. The most spring action that can be achieved by leaf spring fork arm mount 2316 is to use no spring dampening bolts 2321 and no spring dampening locking nuts 2323. The leaf spring fork arm mount 2316 will pivot about the dashed line pivot axis 2327.

FIG. 23D is a forward off-axis view of the formed fork hanger 2380 and hanger yoke 2370, which make up the formed fork hanger assembly 2390. Three leaf spring pivot points are shown that represent the motion of the three leaf springs: U-channel leaf spring 2385 with pivot axis 2325, formed curved leaf spring 2315 with pivot axis 2326, and the leaf spring fork arm mount 2316 with pivot axis 2327. This dampening motion produces a smooth ride. The U-channel leaf spring 2385 pivots about the pivot axis 2325. The leaf spring fork arm mount 2316 pivots about the pivot axis 2327. By referencing both FIG. 23B and FIG. 23D, all fastening components are shown: bolts 2387, spring dampening locking nuts 2388, spring dampening bolts 2321 and spring dampening locking nuts 2323. The U-channel leaf spring 2385 and the leaf spring fork arm mount 2316 are shown in the lock down position, with the bolts 2387, spring dampening locking nuts 2388, spring dampening bolts 2321 and spring dampening locking nuts 2323 are all tight. The leaf spring 2315 about pivot axis 2326 is not controlled and will act as a shock absorber based on the thickness and type of material used to make the formed fork hanger 2380.

FIG. 23E is a fork arm 2360 with an axel through-hole 2371. The fork arm 2360 has a fork arm slot 2366 that will slide onto the leaf spring fork arm mount 2316, as shown in FIG. 23D. The countersunk through-holes 2365 are of uniform separation and will align with the fork arm through-holes 2319 in the leaf spring fork arm mount 2316. These countersunk through-holes 2365 are on the top surface 2364 and are the same countersunk through-holes 2365 on the bottom surface 2369. They share the same through-hole axis.

FIG. 23F shows a rear off-axis expanded view of all components used to make up the shock-absorbing reconfigurable fork-truck assembly 2300. A simpler formed fork truck 2311 is used in this drawing. The formed fork truck 2311 is simpler as it has only one active shock absorbing leaf spring 2315, which pivots about the dashed line pivot axis 2326 (not shown, see FIG. 23D). The U-channel leaf spring 2385 is not used. The baseplate 2350 has a countersunk kingpin through-hole 2334 through which the kingpin 2330 passes and exits the kingpin bulkhead 2354 through the through-hole 2336 (not shown). The slot 2378 allows the hanger yoke 2370 with integrated pivot pin 2304 to slide over the formed fork hanger 2311. The hanger yoke 2370 is positioned to have the yoke kingpin through-hole 2308 concentric with the formed fork hanger kingpin through-hole 2310. The hanger yoke 2370 is secured to the formed fork hanger 2311 with bolts 2374 that pass through through-holes 2376 and through through-holes 2386 and are tightened with locking nuts 2372. The pivot pin resilient cup 2302 is inserted into the resilient cup recess hole 2358 located in the pivot pin bulkhead 2352. The kingpin threaded end 2332 passes through the top-bushing washer 2338, top-bushing 2340, hanger yoke through-hole 2308, formed fork hanger through-hole 2310, bottom-bushing 2342, bottom-bushing 'Washer 2344, and locked and tightened into place using the locking nut 2346 that is threaded onto the kingpin threaded end 2332. The fork arms 2360 slide onto the leaf spring fork arm mount 2316 and are bolted in place using short bolts 2362 that pass through countersunk through-holes 2365, through-holes 2319 and secured in place with locking nuts 2363. There is a thicker part of the fork arm 2360 that requires a long bolt 2361. Once both fork arms 2360 are secure, the wheel axel assembly 1700 with wheel 1701 is mounted through fork arm axel through-hole 2371 and tightened in place with washer 2219 and locking nut 2220.

FIG. 23G is an isometric view of a fork arm 2360 configuration that has the leaf spring fork arm mount 2316 slid into the fork arm slot 2366. The fasteners 2362 pass through the bottom surface 2369 countersunk through-holes 2365, through the through-holes 2319 of the leaf spring fork arm mount 2316, as seen in FIG. 23F. The next set of countersunk through holes 2365 of the top 2364 of the fork arm 2360 are securely fastened with the locking nuts 2363. The orientation of the fork arm 2360 in this configuration is flipped from its normal position as defined in FIG. 23E, which is a slightly lower wheel position.

FIG. 23H is a view of a specific fork arm 2360 configuration to illustrate the use of the spacer 2367. The fork arm 2360 is mounted underneath the leaf spring fork arm mount 2316. The bottom surface 2369 is mounted to the underside of the leaf spring fork arm mount 2316 to achieve an elevated riding position. To prevent an unstable ride a spacer 2367 is inserted into the fork arm slot 2366. Normally the leaf spring fork arm mount 2316 slides into the fork arm slot 2366. The spacer 2367 has through-holes 2368 that are properly spaced to accommodate securing the components with the longer bolts 2361 and the locking nuts 2363 (not shown) for similar fastening procedure. This configuration gives the rider the highest distance above the riding surface.

FIG. 23I is a side view of another configuration that raises the wheel closer to the skateboard 1798 (not shown) and creates a more stable ride. The fork arm 2360 slides onto the leaf spring fork arm mount 2316 using the fork arm slot 2366. The fork arm 2360 is oriented with the top surface 2364 facing in the upward direction and considered the normal orientation as defined in FIG. 23E.

FIG. 23J is the side view of a configuration showing the fork arm 2360 mounted on top of the leaf spring fork arm mount 2316 with the spacer 2367 inserted into the fork arm slot 2366 as explained in FIG. 23H. The bottom surface 2369 of the fork arm 2360 is in contact with the top of the leaf spring fork arm mount 2316. This configuration gives the rider the closest ride with respect to the ground and the most stable of riding configurations.

FIG. 23K is a side view of the assembled shock absorbing reconfigurable formed fork truck assembly 2300 with the wheel axel assembly 1700 and the wheel 1701.

FIG. 24A is an elevated off-axis view of a formed fork hanger 2480 with multiple integrated leaf springs and an integrated axel through-hole 2418. In FIG. 23F the formed hanger fork 2311 and the formed hanger fork 2380 in FIG. 23G, required a fork-arm 2360 in FIG. 23E to mount the wheel assembly 1700 and wheel 1701. The axel through-hole 2418 is incorporated into the vertical flat 2460 of the leaf spring fork arm mount 2416. The vertical flat 2460 and the axel through-hole 2418 are formed by the fork arm bend transition 2466, which is a 90° transition from the leaf spring fork arm mount 2416. The U-channel leaf spring 2385 pivots about pivot axis 2325, the formed curved leaf spring 2315 pivots about pivot axis 2326, and leaf spring fork arm mount 2416, formerly 2316, pivots about pivot axis 2327. The formed fork hanger 2480 is identical to the formed fork hanger 2380 in function including the use of the parallel rows of spring dampening through-holes 2384*a*, 2384*b*, 2384*c*, 2384*d* and 2384*e*, which are control points that constrain the movement of the U-channel leaf spring 2385, the parallel rows of spring dampening through-holes 2314*a*, 2314*b*, 2314*c*, and 2314*d* are control points that constrain the movement of the leaf spring fork arm mount 2416.

FIG. 24B is a top view of the formed fork hanger 2480 with multiple integrated leaf springs and an axel through-hole 2418. The axel through-hole 2418 is incorporated into the leaf spring fork arm mount 2416 at the vertical flat 2460 that is made by bending the leaf spring fork arm mount 2416 at fork arm bend transition 2466 with a 90° twist. The U-channel leaf spring 2385 pivots about pivot axis 2325, the formed curved leaf spring 2315 pivots about pivot axis 2326, and the leaf spring fork arm mount 2416 pivots about pivot axis 2327. The formed fork hanger 2480 is identical to the formed fork hanger 2380 in function including the use of the parallel rows of spring dampening through-holes 2384*a*, 2384*b*, 2384*c*, 2384*d*, and 2384*e*, which are control points that constrain the movement of the U channel leaf spring 2385 and the parallel rows of spring dampening through-holes 2314*a*, 2314*b*, 2314*c*, and 2314*d*, which are control points that constrain the movement of the leaf spring fork arm mount 2416.

FIG. 24C is an isometric view of an assembled shock absorbing formed truck assembly 2400 with a partially assembled wheel axel assembly 1700 and a wheel 1701. The shock absorbing formed truck assembly 2400 uses the formed fork hanger 2480 with axel through-hole 2418 and the hanger yoke 2370 with the same mounting hardware used on the shock-absorbing reconfigurable fork-truck assembly 2300 used in FIG. 23F. Wider washers 2461 are used to properly space the wheel axel assembly 1700 and wheel 1701. Also a wide washer 2461 is used to adequately hold the thinner vertical flat 2460 where the axel through-hole 2418 holds the axel 1714 with the locking nut 2220 securely tightened on the threaded end 1710 of axel 1714.

FIG. 24D is a side view of the completed shock absorbing formed truck assembly 2400 with the formed fork hanger 2480 with axel through-hole 2418 and the hanger yoke 2370 with the same mounting hardware used on the shock-absorbing reconfigurable fork-truck assembly 2300 used in FIG. 23F. The side view shows the attached wheel axel assembly 1700 and wheel 1701.

I claim:

1. A mobilized platform comprising:

a platform, said platform comprising a first platform end and a second platform end opposite said first platform end, the distance between said first platform end and said second platform end defining a length of said platform, said platform further comprising a third platform end opposite a fourth platform end, the distance between said third platform end and said fourth platform end defining a width of said platform;

a first fork hanger, said first fork hanger attached to said platform, said first fork hanger attached to a first cog-hub assembly, said first cog-hub assembly comprising a first cog-hub assembly end and a second cog-hub assembly end opposite said first cog-hub assembly end, wherein a portion of said first fork hanger is attached to said first cog-hub assembly at said first cog-hub assembly end and a portion of said first fork hanger is attached to said first cog-hub assembly at said second cog-hub assembly end;

wherein said first cog-hub assembly comprises a first cog-hub subassembly and a second cog-hub subassembly coaxial with said first cog-hub assembly, said mobilized platform further comprising a cog-tread connected to each of said first cog-hub subassembly and said second cog-hub assembly.

2. The mobilized platform of claim 1, wherein said first fork hanger comprises a first portion integral with said third platform end, and a second portion integral with said fourth platform end.

3. The mobilized platform of claim 1, wherein said first portion of said first fork hanger is separated from said second portion of said first fork hanger by said platform.

4. The mobilized platform of claim 1, wherein said first cog-hub assembly is a first wheel assembly.

5. The mobilized platform of claim 1, wherein said cog-tread spans more than half of the width of said platform.

6. The mobilized platform of claim 1, wherein said cog-tread spans substantially all of the width of said platform.

7. A mobilized platform, comprising:

a platform, said platform comprising a first platform end and a second platform end opposite said first platform end, the distance between said first platform end and said second platform end defining a length of said platform, said platform further comprising a third platform end opposite a fourth platform end, the distance between said third platform end and said fourth platform end defining a width of said platform;

a first fork hanger, said first fork hanger attached to said first platform, said first fork hanger attached to a first cog-hub assembly, said first cog-hub assembly comprising a first cog-hub assembly end and a second cog-hub assembly end opposite said first cog-hub assembly end, wherein a portion of said first fork hanger is attached to said first cog-hub assembly at said first cog-hub assembly end and a portion of said first fork hanger is attached to said first cog-hub assembly at said second cog-hub assembly end; and a cog-tread attached to said first cog-hub assembly and spanning more than half of the width of said platform;

wherein said portion of said first fork hanger attached to said first cog-hub assembly at said first cog-hub assembly end is adjacent to said third platform end and said portion of said first fork hanger attached to said first cog-hub assembly at said second cog-hub assembly end is adjacent to said fourth platform end.

8. The mobilized platform of claim 7, further comprising a cooler body connected to a top of said platform.

9. The mobilized platform of claim 7, further comprising a seat connected to a top of said platform.

10. The mobilized platform of claim 7, further comprising a pulling handle assembly attached to said platform.

11. The mobilized platform of claim 7, wherein said removably connected structure comprises peg-legs and said platform comprises peg leg access holes configured to receive said peg legs.

12. The mobilized platform of claim 7, wherein said first cog-hub assembly comprises a v-groove.

13. The mobilized platform of claim 7, wherein said first cog-hub assembly comprises a u-groove.

14. The mobilized platform of claim 7, wherein said first cog-hub assembly comprises two coaxial cog-hub subassemblies, said first cog-hub assembly being part of a cog-tread drive assembly that further comprises said cog-tread, wherein each of said two coaxial cog-hub subassemblies is connected to said cog-tread.

15. A mobilized platform, comprising:

a platform, said platform comprising a first platform end and a second platform end opposite said first platform end, the distance between said first platform end and said second platform end defining a length of said platform, said platform further comprising a third platform end opposite a fourth platform end, the distance between said third platform end and said fourth platform end defining a width of said platform;

a first fork hanger, said first fork hanger attached to said platform, said first fork hanger attached to a first cog-hub assembly, said first cog-hub assembly comprising a first cog-hub assembly end and a second cog-hub assembly end opposite said first cog-hub assembly end, wherein a portion of said first fork hanger is attached to said first cog-hub assembly at said first cog-hub assembly end and a portion of said first fork hanger is attached to said first cog-hub assembly at said second cog-hub assembly end; and a second fork hanger, said second fork hanger attached to said platform, said second fork hanger attached to a second cog-hub assembly, said second cog-hub assembly comprising a principal cog-hub assembly end and a secondary cog-hub assembly end opposite said principal cog-hub assembly end, wherein a portion of said second fork hanger is attached to said second cog-hub assembly at said principal cog-hub assembly end and a portion of said second fork hanger is attached to said second cog-hub assembly at said secondary cog-hub assembly end; and a cog-tread spanning more than half of the width of said platform;

wherein said portion of said first fork hanger attached to said first cog-hub assembly at said first cog-hub assembly end is adjacent to said third platform end and said portion of said first fork hanger attached to said first cog-hub assembly at said second cog-hub assembly end is adjacent to said fourth platform end; and wherein said portion of said second fork hanger attached to said second cog-hub assembly at said principal cog-hub assembly end is adjacent to said third platform end and said portion of said second fork hanger attached to said second cog-hub assembly at said secondary cog-hub assembly end is adjacent to said fourth platform end;

wherein said cog-tread is connected to said first cog-hub assembly and said second cog-hub assembly, and said cog-tread is positioned between said portion of said first fork hanger attached to said first cog-hub assembly at said first cog-hub assembly end and said portion of said first fork hanger attached to said first cog-hub assembly at said second cog-hub assembly end, and said cog-tread is further positioned between said second fork hanger portion attached to said second cog-hub assembly at said principal cog-hub assembly end and said second fork hanger portion attached to said second cog-hub assembly at said secondary cog-hub assembly end.

16. The mobilized platform of claim 15, wherein the distance between said principal cog-hub assembly end and said secondary cog-hub assembly end is greater than half the distance of said platform width.

17. The mobilized platform of claim 15, wherein said cog-tread spans substantially all of the width of said platform.

* * * * *